US007886831B2

(12) United States Patent
Butterfield, Jr. et al.

(10) Patent No.: US 7,886,831 B2
(45) Date of Patent: Feb. 15, 2011

(54) APPARATUS FOR RADIALLY EXPANDING AND PLASTICALLY DEFORMING A TUBULAR MEMBER

(75) Inventors: Charles Anthony Butterfield, Jr., Cypress, TX (US); David Paul Brisco, Duncan, OK (US)

(73) Assignee: Enventure Global Technology, L.L.C., Houston, TX (US)

( * ) Notice: Subject to any disclaimer, the term of this patent is extended or adjusted under 35 U.S.C. 154(b) by 577 days.

(21) Appl. No.: 11/834,401

(22) Filed: Aug. 6, 2007

(65) Prior Publication Data

US 2008/0083541 A1 Apr. 10, 2008

Related U.S. Application Data

(63) Continuation-in-part of application No. 10/546,548, filed as application No. PCT/US2004/006246 on Feb. 26, 2004, now Pat. No. 7,438,133, and a continuation-in-part of application No. 10/351,160, filed on Jan. 22, 2003, now Pat. No. 6,976,541.

(60) Provisional application No. 60/450,504, filed on Feb. 26, 2003.

(51) Int. Cl.
*E21B 43/00* (2006.01)

(52) U.S. Cl. ..... 166/380; 166/177.4; 166/207

(58) Field of Classification Search ..... 166/380, 166/386, 177.4, 207
See application file for complete search history.

(56) References Cited

U.S. PATENT DOCUMENTS 46,818 A 3/1865 Patterson (Continued)

FOREIGN PATENT DOCUMENTS

AU 01/269810 B2 6/2000

(Continued)

OTHER PUBLICATIONS

Neal J. Adams, Drilling Engineering, A Complete Well Planning Approach, 1985, pp. 618-627, PennWell Publishing Company, Tulsa, Oklahoma.

(Continued)

*Primary Examiner*—David J Bagnell
*Assistant Examiner*—David Andrews
(74) *Attorney, Agent, or Firm*—Conley Rose, P.C.; Derek V. Forinash

(57) ABSTRACT

An apparatus for radially expanding and plastically deforming a tubular member. In some embodiments, the apparatus includes a tubular support, sliding sleeve, rupture disc, and expansion cone. The tubular support has a first internal passage, wherein the sliding sleeve is disposed, and a flow passage, wherein the rupture disc is seated. The sliding sleeve has a second internal passage and is moveable by fluid pressure between first and second positions. In the first position, the second internal passage is fluidicly coupled with a first annulus surrounding the tubular support. In the second position, the second internal passage is fluidicly isolated from the first annulus. The rupture disc fluidicly isolates the first internal passage from a second annulus surrounding the tubular support and is adapted to rupture, whereby the first internal passage and the second annulus are fluidicly coupled. The expansion cone is disposed in the second annulus and moveable under pressure from fluid in the second annulus.

21 Claims, 77 Drawing Sheets

U.S. PATENT DOCUMENTS

| | | | |
|---|---|---|---|
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,225,005 | A | 5/1917 | Boyd et al. |
| 1,233,888 | A | 7/1917 | Leonard |
| 1,358,818 | A | 11/1920 | Bering |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,739,932 | A | 12/1929 | Ventresca |
| 1,756,531 | A | 4/1930 | Aldeen et al. |
| 1,880,218 | A | 10/1932 | Simmons |
| 1,952,652 | A | 3/1934 | Brannon |
| 1,981,525 | A | 11/1934 | Price |
| 2,046,870 | A | 7/1936 | Clasen et al. |
| 2,087,185 | A | 7/1937 | Dillon |
| 2,110,913 | A | 3/1938 | Lowrey |
| 2,122,757 | A | 7/1938 | Scott |
| 2,134,311 | A | 10/1938 | Minor et al. |
| 2,145,168 | A | 1/1939 | Flagg |
| 2,160,263 | A | 5/1939 | Fletcher |
| 2,293,938 | A | 6/1939 | Dunn et al. |
| 2,187,275 | A | 1/1940 | McLennan |
| 2,204,586 | A | 6/1940 | Grau |
| 2,211,173 | A | 8/1940 | Shaffer |
| 2,214,226 | A | 9/1940 | English |
| 2,226,804 | A | 12/1940 | Carroll |
| 2,273,017 | A | 2/1942 | Boynton |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,407,552 | A | 9/1946 | Hoesel |
| 2,447,629 | A | 8/1948 | Beissinger et al. |
| 2,481,637 | A | 9/1949 | Yancey |
| 2,500,276 | A | 3/1950 | Church |
| 2,546,295 | A | 3/1951 | Boice |
| 2,583,316 | A | 1/1952 | Bannister |
| 2,609,258 | A | 9/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,695,449 | A | 11/1954 | Chauvin |
| 2,723,721 | A | 11/1955 | Corsette |
| 2,734,580 | A | 2/1956 | Layne |
| 2,735,485 | A | 2/1956 | Metcalf, Jr. |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 3/1960 | Steinberg |
| 3,010,547 | A | 1/1962 | Marskell |
| 3,015,362 | A | 1/1962 | Moosman |
| 3,015,500 | A | 1/1962 | Barnett |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,162,245 | A | 12/1964 | Howard et al. |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,331,439 | A | 7/1967 | Sanford |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,397,745 | A | 8/1968 | Owens et al. |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,463,228 | A | 8/1969 | Hearn |
| 3,477,506 | A | 11/1969 | Malone |
| 3,489,220 | A | 1/1970 | Kinley |
| 3,489,437 | A | 1/1970 | Duret |
| 3,498,376 | A | 3/1970 | Sizer et al. |
| 3,504,515 | A | 4/1970 | Reardon |
| 3,508,771 | A | 4/1970 | Duret |
| 3,520,049 | A | 7/1970 | Lysenko et al. |
| 3,528,498 | A | 9/1970 | Carothers |
| 3,532,174 | A | 10/1970 | Diamantides |
| 3,568,773 | A | 3/1971 | Chancellor |
| 3,572,777 | A | 3/1971 | Blose et al. |
| 3,574,357 | A | 4/1971 | Alexandru |
| 3,578,081 | A | 5/1971 | Bodine |
| 3,579,805 | A | 5/1971 | Kast |
| 3,581,817 | A | 6/1971 | Kammerer |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,678,727 | A | 7/1972 | Jackson |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curlington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinley |
| 3,789,648 | A | 2/1974 | Ames |
| 3,797,259 | A | 3/1974 | Kammerer, Jr. |
| 3,805,567 | A | 4/1974 | Agius Sinerco |
| 3,812,912 | A | 5/1974 | Wuenschel |
| 3,818,734 | A | 6/1974 | Bateman |

3,826,124 A 7/1974 Baksay
3,830,294 A 8/1974 Swanson, Jr.
3,830,295 A 8/1974 Crowe
3,834,742 A 9/1974 McPhillips
3,848,668 A 11/1974 Sizer
3,866,954 A 2/1975 Slator et al.
3,874,446 A 4/1975 Crowe
3,885,298 A 5/1975 Pogonowski
3,887,006 A 6/1975 Pitts
3,893,718 A 7/1975 Powell
3,898,163 A 8/1975 Mott
3,915,478 A 10/1975 Al et al.
3,915,763 A 10/1975 Jennings
3,935,910 A 2/1976 Gaudy et al.
3,942,824 A 3/1976 Sable
3,945,444 A 3/1976 Knudson
3,948,321 A 4/1976 Owen et al.
3,963,076 A 6/1976 Winslow
3,970,336 A 7/1976 O'Sickey
3,977,076 A 8/1976 Vieira et al.
3,977,473 A 8/1976 Page, Jr.
3,989,280 A 11/1976 Schwarz
3,997,193 A 12/1976 Tsuda et al.
3,999,605 A 12/1976 Braddick
4,003,433 A 1/1977 Goins
4,011,652 A 3/1977 Black
4,018,634 A 4/1977 Fencl
4,019,579 A 4/1977 Thuse
4,026,583 A 5/1977 Gottlieb
4,047,568 A 9/1977 Aulenbacher
4,053,247 A 10/1977 Marsh, Jr.
4,064,941 A * 12/1977 Smith ..... 166/300
4,068,711 A 1/1978 Aulenbacher
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchison
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr. et al.
4,304,428 A 12/1981 Grigorian et al.
4,328,983 A 5/1982 Gibson
4,355,664 A 10/1982 Cook
4,358,511 A 11/1982 Smith, Jr. et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahm et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida et al.
4,495,073 A 1/1985 Beimgraben
4,501,327 A 2/1985 Retz
4,505,017 A 3/1985 Schukei
4,505,987 A 3/1985 Yamada
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,521,258 A 6/1985 Tamehiro et al.
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres
4,595,063 A 6/1986 Jennings et al.
4,596,913 A 6/1986 Takechi et al.
4,598,938 A 7/1986 Boss et al.
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,629,224 A 12/1986 Landriault
4,630,849 A 12/1986 Fukui
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh
4,651,836 A 3/1987 Richards
4,656,779 A 4/1987 Fedeli et al.

4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett
4,682,797 A 7/1987 Hildner
4,685,191 A 8/1987 Mueller et al.
4,685,834 A 8/1987 Jordan
4,693,498 A 9/1987 Baugh et al.
4,703,802 A 11/1987 Bryan et al.
4,711,474 A 12/1987 Patrick
4,714,117 A 12/1987 Dech
4,730,851 A 3/1988 Watts
4,732,416 A 3/1988 Deaden et al.
4,735,444 A 4/1988 Skipper
4,739,654 A 4/1988 Pilkington et al.
4,739,916 A 4/1988 Ayres et al.
4,751,836 A 6/1988 Breese
4,754,781 A 7/1988 Jan de Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,799,544 A 1/1989 Curlett
4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.
4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward
4,892,337 A 1/1990 Gunderson et al.
4,893,658 A 1/1990 Kimura et al.
4,904,136 A 2/1990 Matsumoto
4,907,828 A 3/1990 Chang
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundell
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet et al.
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,249,628 A 10/1993 Surjaatmadia
5,253,713 A 10/1993 Gregg et al.
5,265,675 A 11/1993 Hearn et al.
RE34,467 E 12/1993 Reeves
5,273,075 A 12/1993 Skaer
5,275,242 A 1/1994 Payne
5,282,508 A 2/1994 Ellingsen et al.
5,282,652 A 2/1994 Werner
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich 5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Baro et al.
5,370,425 A 12/1994 Dougherty et al.
5,375,661 A 12/1994 Daneshy et al.
5,377,753 A 1/1995 Haberman et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,419,595 A 5/1995 Yamamoto et al.
5,425,559 A 6/1995 Nobileau
5,426,130 A 6/1995 Thurber et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,794,840 A 8/1998 Hohl et al.
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris et al.
5,862,866 A 1/1999 Springer
5,875,851 A 3/1999 Vick, Jr. et al.
5,885,941 A 3/1999 Sateva et al.
5,887,476 A 3/1999 Damsohn et al.
5,895,079 A 4/1999 Carstensen et al.
5,899,268 A 5/1999 Lynde et al.
5,901,594 A 5/1999 Wasson
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck et al.
5,985,053 A 11/1999 Hara et al.
6,009,611 A 1/2000 Adams et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,013,724 A 1/2000 Mizutani
6,015,012 A 1/2000 Reddick
6,017,168 A 1/2000 Fraser, Jr. et al.
6,021,850 A 2/2000 Wood et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.

6,138,761 A 10/2000 Freeman et al.
6,142,230 A 11/2000 Smalley et al.
6,148,915 A 11/2000 Mullen
6,155,613 A 12/2000 Quadflieg et al.
6,158,785 A 12/2000 Beaulier et al.
6,158,963 A 12/2000 Hollis et al.
6,167,970 B1 1/2001 Stout
6,182,775 B1 2/2001 Hipp
6,183,013 B1 2/2001 Mackenzie et al.
6,183,573 B1 2/2001 Fujiwara et al.
6,189,616 B1 2/2001 Gano et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.
6,263,966 B1 7/2001 Haut et al.
6,263,968 B1 7/2001 Freeman et al.
6,263,972 B1 7/2001 Richardson et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,286,614 B1 9/2001 Gano et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,349,521 B1 2/2002 McKeon et al.
6,352,112 B1 3/2002 Mills
6,354,373 B1 3/2002 Vercaemer et al.
6,357,485 B2 3/2002 Quigley
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,446,323 B1 9/2002 Metcalfe et al.
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup
6,497,289 B1 12/2002 Cook et al.
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,575,250 B1 6/2003 Wijsman
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson et al.
6,604,763 B1 8/2003 Cook et al.
6,607,220 B2 8/2003 Sivley, IV
6,609,735 B1 8/2003 DeLange
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka 6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,826,937 B2 12/2004 Su
6,832,649 B2 12/2004 Bode et al.
6,834,725 B2 12/2004 Whanger et al.
6,843,319 B2 1/2005 Tran et al.
6,843,322 B2 1/2005 Burtner
6,857,473 B2 2/2005 Cook et al.
6,880,632 B2 4/2005 Tom et al.
6,892,819 B2 5/2005 Cook et al.
6,902,000 B2 6/2005 Simpson
6,907,652 B1 6/2005 Heijnen
6,923,261 B2 8/2005 Metcalfe et al.
6,935,429 B2 8/2005 Badrak
6,935,430 B2 8/2005 Harrall et al.
6,966,370 B2 11/2005 Cook et al.
6,968,618 B2 11/2005 Cook et al.
6,976,539 B2 12/2005 Metcalfe et al.
6,976,541 B2 12/2005 Brisco et al.
6,977,096 B2 12/2005 LeClaire
7,000,953 B2 2/2006 Berghaus
7,007,760 B2 3/2006 Lohbeck
7,011,161 B2 3/2006 Ring et al.
7,021,390 B2 4/2006 Cook et al.
7,036,582 B2 5/2006 Cook et al.
7,040,396 B2 5/2006 Cook et al.
7,044,218 B2 5/2006 Cook et al.
7,044,221 B2 5/2006 Cook et al.
7,048,062 B2 5/2006 Ring et al.
7,048,067 B1 5/2006 Cook et al.
7,055,608 B2 6/2006 Cook et al.
7,063,142 B2 6/2006 Cook et al.
7,063,149 B2 6/2006 Simpson et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,684 B2 9/2006 Cook et al.
7,100,685 B2 9/2006 Cook et al.
7,108,061 B2 9/2006 Cook et al.
7,108,072 B2 9/2006 Cook et al.
7,114,559 B2 10/2006 Sonnier et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,146,702 B2 12/2006 Cook et al.
7,147,053 B2 12/2006 Cook et al.
7,159,665 B2 1/2007 Cook et al.
7,159,667 B2 1/2007 Cook et al.
7,164,964 B2 1/2007 Stacklies
7,168,496 B2 1/2007 Cook et al.
7,168,499 B2 1/2007 Cook et al.
7,172,019 B2 2/2007 Cook et al.
7,172,021 B2 2/2007 Brisco et al.
7,172,024 B2 2/2007 Cook et al.
7,174,964 B2 2/2007 Cook et al.
7,185,710 B2 3/2007 Cook et al.
7,191,841 B2 3/2007 Sivley, IV
7,225,879 B2 6/2007 Wylie et al.
7,231,985 B2 6/2007 Cook et al.
7,234,531 B2 6/2007 Kendziora
7,234,968 B2 6/2007 Lottmann et al.
7,240,728 B2 7/2007 Cook et al.
7,240,729 B2 7/2007 Cook et al.
2001/0002626 A1 6/2001 Frank et al.
2001/0018354 A1 8/2001 Pigni
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Sivley, IV
2003/0075337 A1 4/2003 Maguire
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0055758 A1* 3/2004 Brezinski et al. ..... 166/384
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0112610 A1 6/2004 Tran et al.
2004/0118574 A1 6/2004 Cook et al.
2004/0123983 A1 7/2004 Cook et al.
2004/0123988 A1 7/2004 Cook et al.
2004/0129431 A1 7/2004 Jackson

| | | | |
|---|---|---|---|
| 2004/0159446 | A1 | 8/2004 | Haugen et al. |
| 2004/0174017 | A1 | 9/2004 | Brill et al. |
| 2004/0188099 | A1 | 9/2004 | Cook et al. |
| 2004/0194278 | A1 | 10/2004 | Brill et al. |
| 2004/0194966 | A1 | 10/2004 | Zimmerman |
| 2004/0195826 | A1 | 10/2004 | Goto |
| 2004/0216506 | A1 | 11/2004 | Simpson et al. |
| 2004/0216873 | A1 | 11/2004 | Frost, Jr. et al. |
| 2004/0221996 | A1 | 11/2004 | Burge |
| 2004/0228679 | A1 | 11/2004 | Reavis et al. |
| 2004/0231839 | A1 | 11/2004 | Ellington et al. |
| 2004/0231843 | A1 | 11/2004 | Simpson et al. |
| 2004/0231855 | A1 | 11/2004 | Cook et al. |
| 2004/0238181 | A1 | 12/2004 | Cook et al. |
| 2004/0244968 | A1 | 12/2004 | Cook et al. |
| 2004/0251034 | A1 | 12/2004 | Kendziora et al. |
| 2004/0262014 | A1 | 12/2004 | Cook et al. |
| 2005/0011641 | A1 | 1/2005 | Cook et al. |
| 2005/0015963 | A1 | 1/2005 | Costa et al. |
| 2005/0028988 | A1 | 2/2005 | Cook et al. |
| 2005/0039910 | A1 | 2/2005 | Lohbeck |
| 2005/0039928 | A1 | 2/2005 | Cook et al. |
| 2005/0045324 | A1 | 3/2005 | Cook et al. |
| 2005/0045341 | A1 | 3/2005 | Cook et al. |
| 2005/0045342 | A1 | 3/2005 | Luke et al. |
| 2005/0056433 | A1 | 3/2005 | Ring et al. |
| 2005/0056434 | A1 | 3/2005 | Watson et al. |
| 2005/0077051 | A1 | 4/2005 | Cook et al. |
| 2005/0081358 | A1 | 4/2005 | Cook et al. |
| 2005/0087337 | A1 | 4/2005 | Brisco et al. |
| 2005/0098323 | A1 | 5/2005 | Cook et al. |
| 2005/0103502 | A1 | 5/2005 | Watson et al. |
| 2005/0123639 | A1 | 6/2005 | Ring et al. |
| 2005/0133225 | A1 | 6/2005 | Oosterling |
| 2005/0138790 | A1 | 6/2005 | Cook et al. |
| 2005/0144771 | A1 | 7/2005 | Cook et al. |
| 2005/0144772 | A1 | 7/2005 | Cook et al. |
| 2005/0144777 | A1 | 7/2005 | Cook et al. |
| 2005/0150098 | A1 | 7/2005 | Cook et al. |
| 2005/0150660 | A1 | 7/2005 | Cook et al. |
| 2005/0161228 | A1 | 7/2005 | Cook et al. |
| 2005/0166387 | A1 | 8/2005 | Cook et al. |
| 2005/0166388 | A1 | 8/2005 | Cook et al. |
| 2005/0172473 | A1 | 8/2005 | Cook et al. |
| 2005/0173108 | A1 | 8/2005 | Cook |
| 2005/0183863 | A1 | 8/2005 | Cook et al. |
| 2005/0205253 | A1 | 9/2005 | Cook et al. |
| 2005/0217768 | A1 | 10/2005 | Asahi et al. |
| 2005/0217865 | A1 | 10/2005 | Ring |
| 2005/0217866 | A1 | 10/2005 | Watson et al. |
| 2005/0223535 | A1 | 10/2005 | Cook et al. |
| 2005/0224225 | A1 | 10/2005 | Cook et al. |
| 2005/0230102 | A1 | 10/2005 | Cook et al. |
| 2005/0230103 | A1 | 10/2005 | Cook et al. |
| 2005/0230104 | A1 | 10/2005 | Cook et al. |
| 2005/0230123 | A1 | 10/2005 | Waddell et al. |
| 2005/0236159 | A1 | 10/2005 | Costa et al. |
| 2005/0236163 | A1 | 10/2005 | Cook et al. |
| 2005/0244578 | A1 | 11/2005 | Van Egmond et al. |
| 2005/0246883 | A1 | 11/2005 | Alliot et al. |
| 2005/0247453 | A1 | 11/2005 | Shuster et al. |
| 2005/0265788 | A1 | 12/2005 | Renkema |
| 2005/0269107 | A1 | 12/2005 | Cook et al. |
| 2006/0027371 | A1 | 2/2006 | Gorrara |
| 2006/0032640 | A1 | 2/2006 | Costa et al. |
| 2006/0048948 | A1 | 3/2006 | Noel |
| 2006/0054330 | A1 | 3/2006 | Ring et al. |
| 2006/0065403 | A1 | 3/2006 | Watson et al. |
| 2006/0065406 | A1 | 3/2006 | Shuster et al. |
| 2006/0096762 | A1 | 5/2006 | Brisco |
| 2006/0102360 | A1 | 5/2006 | Brisco |
| 2006/0112768 | A1 | 6/2006 | Shuster et al. |
| 2006/0113086 | A1 | 6/2006 | Costa et al. |
| 2006/0162937 | A1 | 7/2006 | Costa et al. |
| 2006/0163460 | A1 | 7/2006 | Kerstan et al. |
| 2006/0196679 | A1 | 9/2006 | Brisco et al. |
| 2006/0207760 | A1 | 9/2006 | Watson et al. |
| 2006/0208488 | A1 | 9/2006 | Costa |
| 2006/0213668 | A1 | 9/2006 | Cook et al. |
| 2006/0219414 | A1 | 10/2006 | Shuster |
| 2006/0225892 | A1 | 10/2006 | Watson et al. |
| 2006/0243444 | A1 | 11/2006 | Brisco et al. |
| 2006/0266527 | A1 | 11/2006 | Brisco et al. |
| 2006/0272826 | A1 | 12/2006 | Shuster et al. |
| 2007/0012456 | A1 | 1/2007 | Cook et al. |
| 2007/0017572 | A1 | 1/2007 | Cook et al. |
| 2007/0034383 | A1 | 2/2007 | Shuster et al. |
| 2007/0039742 | A1 | 2/2007 | Costa |
| 2007/0131431 | A1 | 6/2007 | Shuster et al. |
| 2007/0154270 | A1 | 7/2007 | Waddell et al. |

FOREIGN PATENT DOCUMENTS

| | | | |
|---|---|---|---|
| AU | 767364 | | 6/2000 |
| AU | 770008 | | 8/2000 |
| AU | 770359 | | 8/2000 |
| AU | 771884 | | 8/2000 |
| AU | 776580 | | 1/2001 |
| AU | 782901 | | 4/2001 |
| AU | 783245 | | 5/2001 |
| AU | 773168 | | 7/2001 |
| AU | 780123 | | 8/2001 |
| AU | 01/283026 | | 2/2002 |
| AU | 01/292695 | B2 | 3/2002 |
| AU | 01/294802 | B2 | 4/2002 |
| AU | 02/239857 | B2 | 9/2002 |
| CA | 736288 | | 6/1966 |
| CA | 771462 | | 11/1967 |
| CA | 1171310 | | 7/1984 |
| CA | 2289811 | | 11/1999 |
| CA | 2292171 | | 6/2000 |
| CA | 2497854 | | 6/2000 |
| CA | 2298139 | | 8/2000 |
| CA | 2414449 | | 2/2002 |
| CA | 2419806 | | 4/2002 |
| CA | 2453034 | | 1/2003 |
| CA | 2234386 | | 3/2003 |
| CA | 2398001 | | 4/2003 |
| CA | 2466685 | | 3/2004 |
| CA | 2249139 | | 1/2007 |
| DE | 174521 | | 9/1952 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | A | 6/1988 |
| EP | 0294264 | A1 | 12/1988 |
| EP | 0553566 | A1 | 8/1993 |
| EP | 620289 | A1 | 10/1994 |
| EP | 0633391 | A2 | 1/1995 |
| EP | 0713953 | B1 | 11/1995 |
| EP | 0823534 | A1 | 2/1998 |
| EP | 0881354 | A2 | 12/1998 |
| EP | 0881359 | A1 | 12/1998 |
| EP | 0899420 | A1 | 3/1999 |
| EP | 0937861 | A2 | 6/1999 |
| EP | 0952305 | A1 | 10/1999 |
| EP | 0952306 | A1 | 10/1999 |
| EP | 1141515 | | 6/2000 |
| EP | 1235972 | | 5/2001 |
| EP | 1106778 | A1 | 6/2001 |
| EP | 1152119 | A2 | 11/2001 |
| EP | 1152120 | A2 | 11/2001 |
| EP | 1152120 | A3 | 6/2002 |
| EP | 1306519 | A2 | 5/2003 |

| | | | |
|---|---|---|---|
| EP | 1505251 | | 2/2005 |
| EP | 1505251 | A2 | 2/2005 |
| EP | 1555386 | A1 | 7/2005 |
| EP | 1505251 | A3 | 2/2007 |
| FR | 1325596 | | 3/1963 |
| FR | 2583398 | A1 | 12/1986 |
| FR | 2771133 | A | 5/1990 |
| FR | 2717855 | A1 | 9/1995 |
| FR | 2741907 | A1 | 6/1997 |
| FR | 2780751 | | 1/2000 |
| FR | 2841626 | A1 | 1/2004 |
| GB | 2275705 | | 3/1942 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1008383 | | 10/1965 |
| GB | 1062610 | | 3/1967 |
| GB | 1111536 | | 5/1968 |
| GB | 1520552 | | 8/1976 |
| GB | 1448304 | | 9/1976 |
| GB | 1460864 | | 1/1977 |
| GB | 1542847 | | 3/1979 |
| GB | 1563740 | | 3/1980 |
| GB | 1582767 | | 1/1981 |
| GB | 2058877 | | 4/1981 |
| GB | 2108228 | | 5/1983 |
| GB | 2115860 | | 9/1983 |
| GB | 2124275 | A | 2/1984 |
| GB | 2125876 | | 3/1984 |
| GB | 2194978 | A | 3/1988 |
| GB | 2211446 | A | 7/1989 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 1/1993 |
| GB | 2275705 | A | 9/1994 |
| GB | 2279383 | | 1/1995 |
| GB | 2305682 | A | 4/1997 |
| GB | 2322655 | A | 9/1998 |
| GB | 2325949 | A | 12/1998 |
| GB | 2326896 | A | 1/1999 |
| GB | 2329916 | A | 4/1999 |
| GB | 2331103 | A | 5/1999 |
| GB | 2329918 | A | 7/1999 |
| GB | 2336383 | A | 10/1999 |
| GB | 2343691 | A | 5/2000 |
| GB | 2344606 | A | 6/2000 |
| GB | 2345308 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2348661 | A | 10/2000 |
| GB | 2350137 | B | 11/2000 |
| GB | 2355738 | A | 12/2000 |
| GB | 2356651 | A | 5/2001 |
| GB | 2357099 | A | 6/2001 |
| GB | 2359837 | B | 9/2001 |
| GB | 2361724 | A | 10/2001 |
| GB | 2365898 | A | 2/2002 |
| GB | 2367842 | A | 4/2002 |
| GB | 2368865 | A | 5/2002 |
| GB | 2370301 | A | 6/2002 |
| GB | 2371064 | A | 7/2002 |
| GB | 2371574 | A | 7/2002 |
| GB | 2373524 | A | 9/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382607 | A | 6/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2384807 | C | 8/2003 |
| GB | 2348223 | B | 9/2003 |
| GB | 2347952 | B | 10/2003 |
| GB | 2348657 | B | 10/2003 |
| GB | 2358358 | B | 10/2003 |
| GB | 2358359 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2391028 | A | 1/2004 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |

| | | | |
|---|---|---|---|
| GB | 2392932 | B | 6/2004 |
| GB | 2395734 | A | 6/2004 |
| GB | 2396634 | A | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396689 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 4401633 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2040402 | A | 2/2005 |
| GB | 2400624 | B | 2/2005 |
| GB | 2404676 | A | 2/2005 |
| GB | 2404677 | A | 2/2005 |
| GB | 2404680 | A | 2/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408277 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2410280 | | 7/2005 |
| GB | 2390622 | B | 8/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2410518 | A | 8/2005 |
| GB | 2380503 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2400393 | B | 10/2005 |
| GB | 2412681 | A | 10/2005 |
| GB | 2412682 | A | 10/2005 |
| GB | 2394979 | B | 11/2005 |
| GB | 2414493 | A | 11/2005 |
| GB | 2409217 | B | 12/2005 |
| GB | 2410518 | B | 12/2005 |
| GB | 2414749 | A | 12/2005 |
| GB | 2414750 | A | 12/2005 |
| GB | 2414751 | A | 12/2005 |
| GB | 2415003 | A | 12/2005 |
| GB | 2415215 | | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415982 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2408278 | B | 2/2006 |
| GB | 2416556 | A | 2/2006 |
| GB | 2416794 | A | 2/2006 |

| | | | |
|---|---|---|---|
| GB | 2416795 | A | 2/2006 |
| GB | 2417273 | A | 2/2006 |
| GB | 2417275 | A | 2/2006 |
| GB | 2406126 | A | 3/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2414493 | B | 8/2006 |
| GB | 2418690 | B | 8/2006 |
| GB | 2418944 | B | 8/2006 |
| GB | 2421257 | B | 8/2006 |
| GB | 2421258 | B | 8/2006 |
| GB | 2421259 | B | 8/2006 |
| GB | 2422859 | A | 8/2006 |
| GB | 2422860 | A | 8/2006 |
| GB | 2423317 | A | 8/2006 |
| GB | 2404676 | B | 9/2006 |
| GB | 2418941 | B | 9/2006 |
| GB | 2418942 | B | 9/2006 |
| GB | 2418943 | B | 9/2006 |
| GB | 2424077 | A | 9/2006 |
| GB | 2405893 | B | 10/2006 |
| GB | 2413136 | A | 10/2006 |
| GB | 2417273 | B | 10/2006 |
| GB | 2418216 | B | 10/2006 |
| GB | 2418217 | B | 10/2006 |
| GB | 2419907 | B | 10/2006 |
| GB | 2422860 | B | 10/2006 |
| GB | 2406125 | B | 11/2006 |
| GB | 2415004 | B | 12/2006 |
| GB | 2422859 | B | 12/2006 |
| GB | 2423317 | B | 12/2006 |
| GB | 2426993 | A | 12/2006 |
| GB | 2427636 | A | 1/2007 |
| GB | 2427885 | A | 1/2007 |
| GB | 2427886 | A | 1/2007 |
| GB | 2429482 | A | 2/2007 |
| GB | 2410280 | B | 4/2007 |
| GB | 2412178 | B | 5/2007 |
| GB | 2415215 | B | 5/2007 |
| ID | H3-HC.02.P01.012.197 | | 8/2004 |
| ID | 044392 | A | 9/2005 |
| ID | 046.2804 | A | 8/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 1295799 | A1 | 2/1995 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 6/1978 |
| SU | 620582 | | 8/1978 |
| SU | 641070 | | 1/1979 |
| SU | 909114 | | 5/1979 |
| SU | 874952 | | 6/1979 |
| SU | 832049 | | 5/1981 |
| SU | 976019 | | 5/1981 |
| SU | 976020 | | 5/1981 |
| SU | 853089 | | 8/1981 |
| SU | 894169 | | 12/1981 |
| SU | 899850 | | 1/1982 |
| SU | 907220 | | 2/1982 |
| SU | 953172 | | 8/1982 |
| SU | 959878 | | 9/1982 |
| SU | 989038 | | 1/1983 |
| SU | 1002514 | | 3/1983 |
| SU | 1041671 | | 9/1983 |
| SU | 1051222 | A | 10/1983 |
| SU | 1077803 | A | 3/1984 |
| SU | 1086118 | A | 4/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | A1 | 7/1988 |
| SU | 1430498 | A1 | 10/1988 |
| SU | 1432190 | A1 | 10/1988 |
| SU | 1601330 | A1 | 10/1990 |
| SU | 1627663 | A | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A1 | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| WO | WO 81/00132 | A1 | 1/1981 |
| WO | WO 90/05598 | A | 5/1990 |
| WO | WO 92/01859 | A1 | 2/1992 |
| WO | WO 92/08875 | A2 | 5/1992 |
| WO | WO 93/25799 | A1 | 12/1993 |
| WO | WO 93/25800 | | 12/1993 |
| WO | WO 93/25800 | A1 | 12/1993 |
| WO | WO 94/21887 | A1 | 9/1994 |
| WO | WO 94/25655 | A1 | 11/1994 |
| WO | WO 95/03476 | A1 | 2/1995 |
| WO | WO 96/01937 | A1 | 1/1996 |
| WO | WO 96/10710 | | 4/1996 |
| WO | WO 96/21083 | A1 | 7/1996 |

| | | | |
|---|---|---|---|
| WO | WO 96/26350 | A1 | 8/1996 |
| WO | WO 96/10710 | | 11/1996 |
| WO | WO 96/37681 | A1 | 11/1996 |
| WO | WO 97/06346 | A1 | 2/1997 |
| WO | WO 97/11306 | A1 | 3/1997 |
| WO | WO 97/17524 | A2 | 5/1997 |
| WO | WO 97/17526 | A2 | 5/1997 |
| WO | WO 97/17527 | A2 | 5/1997 |
| WO | WO 97/20130 | A2 | 6/1997 |
| WO | WO 97/21901 | A2 | 6/1997 |
| WO | WO 97/35084 | A1 | 9/1997 |
| WO | WO 98/00626 | A1 | 1/1998 |
| WO | WO 98/07957 | A1 | 2/1998 |
| WO | WO 98/09053 | A2 | 3/1998 |
| WO | WO 98/22690 | | 5/1998 |
| WO | WO 98/22690 | A1 | 5/1998 |
| WO | WO 98/26152 | A1 | 6/1998 |
| WO | WO 98/42947 | | 10/1998 |
| WO | WO 98/42947 | A1 | 10/1998 |
| WO | WO 98/49423 | A1 | 11/1998 |
| WO | WO 99/02818 | A1 | 1/1999 |
| WO | WO 99/04135 | A1 | 1/1999 |
| WO | WO 99/06670 | A1 | 2/1999 |
| WO | WO 99/08827 | A1 | 2/1999 |
| WO | WO 99/08828 | A1 | 2/1999 |
| WO | WO 99/18328 | A1 | 4/1999 |
| WO | WO 99/23354 | A1 | 5/1999 |
| WO | WO 99/25524 | A1 | 5/1999 |
| WO | WO 99/25951 | A1 | 5/1999 |
| WO | WO 99/35368 | A1 | 7/1999 |
| WO | WO 99/43923 | A1 | 9/1999 |
| WO | WO 00/01926 | A1 | 1/2000 |
| WO | WO 00/04271 | A1 | 1/2000 |
| WO | WO 03/000690 | | 1/2000 |
| WO | WO 00/08301 | | 2/2000 |
| WO | WO 00/08301 | A2 | 2/2000 |
| WO | WO 00/18635 | | 4/2000 |
| WO | WO 00/26500 | A1 | 5/2000 |
| WO | WO 00/26501 | A1 | 5/2000 |
| WO | WO 00/26502 | A1 | 5/2000 |
| WO | WO 00/31375 | A1 | 6/2000 |
| WO | WO 00/37766 | A2 | 6/2000 |
| WO | WO 00/37767 | A2 | 6/2000 |
| WO | WO 00/37768 | A1 | 6/2000 |
| WO | WO 00/37771 | A1 | 6/2000 |
| WO | WO 00/37772 | A1 | 6/2000 |
| WO | WO 00/39432 | A1 | 7/2000 |
| WO | WO 00/46484 | A1 | 8/2000 |
| WO | WO 00/50727 | A1 | 8/2000 |
| WO | WO 00/50732 | A1 | 8/2000 |
| WO | WO 00/50733 | A1 | 8/2000 |
| WO | WO 00/66877 | | 11/2000 |
| WO | WO 00/77431 | A2 | 12/2000 |
| WO | WO 01/04520 | A1 | 1/2001 |
| WO | WO 01/04535 | A1 | 1/2001 |
| WO | WO 01/047161 | | 2/2001 |
| WO | WO 01/18353 | | 3/2001 |
| WO | WO 01/18354 | A1 | 3/2001 |
| WO | WO 01/21929 | A1 | 3/2001 |
| WO | WO 01/26860 | A1 | 4/2001 |
| WO | WO 01/33037 | A1 | 5/2001 |
| WO | WO 01/38693 | A1 | 5/2001 |
| WO | WO 01/60545 | A1 | 8/2001 |
| WO | WO 01/83943 | A1 | 11/2001 |
| WO | WO 01/98623 | A1 | 12/2001 |
| WO | WO 02/01102 | A1 | 1/2002 |
| WO | WO 02/10550 | A1 | 2/2002 |
| WO | WO 02/10551 | A1 | 2/2002 |
| WO | WO 02/20941 | A1 | 3/2002 |
| WO | WO 02/23007 | A1 | 3/2002 |
| WO | WO 02/25059 | A1 | 3/2002 |
| WO | WO 02/28560 | | 4/2002 |
| WO | WO 02/29199 | A1 | 4/2002 |
| WO | WO 02/38343 | A2 | 5/2002 |
| WO | WO 02/38343 | A3 | 5/2002 |
| WO | WO 02/40825 | A1 | 5/2002 |
| WO | WO 02/053867 | A2 | 7/2002 |
| WO | WO 02/053867 | A3 | 7/2002 |
| WO | WO 02/059456 | A1 | 8/2002 |
| WO | WO 02/066783 | A1 | 8/2002 |
| WO | WO 02/068792 | A1 | 9/2002 |
| WO | WO 02/073000 | A1 | 9/2002 |
| WO | WO 02/075107 | A1 | 9/2002 |
| WO | WO 02/077411 | A1 | 10/2002 |
| WO | WO 02/081863 | A1 | 10/2002 |
| WO | WO 02/081864 | A2 | 10/2002 |
| WO | WO 02/086285 | A1 | 10/2002 |
| WO | WO 02/086286 | A2 | 10/2002 |
| WO | WO 02/090713 | A1 | 11/2002 |
| WO | WO 02/095181 | A1 | 11/2002 |
| WO | WO 02/163192 | | 11/2002 |
| WO | WO 02/103150 | A2 | 12/2002 |
| WO | WO 03/004819 | A2 | 1/2003 |
| WO | WO 03/004819 | A3 | 1/2003 |
| WO | WO 03/004820 | A2 | 1/2003 |
| WO | WO 03/004820 | A3 | 1/2003 |
| WO | WO 03/004837 | | 1/2003 |
| WO | WO 03/008756 | A1 | 1/2003 |
| WO | WO 03/012255 | A1 | 2/2003 |
| WO | WO 03/014153 | | 2/2003 |
| WO | WO 03/016669 | A2 | 2/2003 |
| WO | WO 03/016669 | A3 | 2/2003 |
| WO | WO 03/023178 | A2 | 3/2003 |
| WO | WO 03/023178 | A3 | 3/2003 |
| WO | WO 03/023179 | A2 | 3/2003 |
| WO | WO 03/023179 | A3 | 3/2003 |
| WO | WO 03/029607 | A1 | 4/2003 |
| WO | WO 03/029608 | A1 | 4/2003 |
| WO | WO 03/036018 | A2 | 5/2003 |
| WO | WO 03/042486 | A2 | 5/2003 |
| WO | WO 03/042486 | A3 | 5/2003 |
| WO | WO 03/042487 | A2 | 5/2003 |
| WO | WO 03/042487 | A3 | 5/2003 |
| WO | WO 03/042489 | A2 | 5/2003 |
| WO | WO 03/048520 | A1 | 6/2003 |
| WO | WO 03/048521 | A2 | 6/2003 |
| WO | WO 03/055616 | A2 | 7/2003 |
| WO | WO 03/058022 | A2 | 7/2003 |
| WO | WO 03/058022 | A3 | 7/2003 |
| WO | WO 03/059549 | A1 | 7/2003 |
| WO | WO 03/064813 | A1 | 8/2003 |
| WO | WO 03/069115 | A3 | 8/2003 |
| WO | WO 03/071086 | A2 | 8/2003 |
| WO | WO 03/071086 | A3 | 8/2003 |
| WO | WO 03/078785 | A2 | 9/2003 |
| WO | WO 03/078785 | A3 | 9/2003 |
| WO | WO 03/086675 | A2 | 10/2003 |
| WO | WO 03/086675 | A3 | 10/2003 |
| WO | WO 03/089161 | A2 | 10/2003 |
| WO | WO 03/089161 | A3 | 10/2003 |
| WO | WO 03/093623 | A2 | 11/2003 |
| WO | WO 03/093623 | A3 | 11/2003 |
| WO | WO 03/093624 | | 11/2003 |
| WO | WO 03/102365 | A1 | 12/2003 |
| WO | WO 03/104601 | A2 | 12/2003 |
| WO | WO 03/104601 | A3 | 12/2003 |
| WO | WO 03/106130 | A2 | 12/2003 |
| WO | WO 03/106130 | A3 | 12/2003 |
| WO | WO 2004/000337 | A1 | 1/2004 |
| WO | WO 2004/007711 | | 1/2004 |
| WO | WO 2004/008073 | | 1/2004 |
| WO | WO 2004/009950 | A1 | 1/2004 |
| WO | WO 2004/010039 | A2 | 1/2004 |
| WO | WO 2004/010039 | A3 | 1/2004 |
| WO | WO 2004/010317 | | 1/2004 |
| WO | WO 2004/010712 | | 1/2004 |

| | | | |
|---|---|---|---|
| WO | WO 2004/010762 | | 2/2004 |
| WO | WO 2004/011776 | A2 | 2/2004 |
| WO | WO 2004/011776 | A3 | 2/2004 |
| WO | WO 2004/011973 | | 2/2004 |
| WO | WO 2004/013462 | | 2/2004 |
| WO | WO 2004/015241 | | 2/2004 |
| WO | WO 2004/018823 | A2 | 3/2004 |
| WO | WO 2004/018823 | A3 | 3/2004 |
| WO | WO 2004/018824 | A2 | 3/2004 |
| WO | WO 2004/018824 | A3 | 3/2004 |
| WO | WO 2004/020895 | A2 | 3/2004 |
| WO | WO 2004/020895 | A3 | 3/2004 |
| WO | WO 2004/023014 | A2 | 3/2004 |
| WO | WO 2004/023014 | A3 | 3/2004 |
| WO | WO 2004/026017 | A2 | 4/2004 |
| WO | WO 2004/026017 | A3 | 4/2004 |
| WO | WO 2004/026073 | A2 | 4/2004 |
| WO | WO 2004/026073 | A3 | 4/2004 |
| WO | WO 2004/026500 | A2 | 4/2004 |
| WO | WO 2004/026500 | A3 | 4/2004 |
| WO | WO 2004/027200 | A2 | 4/2004 |
| WO | WO 2004/027200 | A3 | 4/2004 |
| WO | WO 2004/027201 | | 4/2004 |
| WO | WO 2004/027201 | A2 | 4/2004 |
| WO | WO 2004/027204 | A2 | 4/2004 |
| WO | WO 2004/027204 | A3 | 4/2004 |
| WO | WO 2004/027205 | A2 | 4/2004 |
| WO | WO 2004/027205 | A3 | 4/2004 |
| WO | WO 2004/027318 | | 4/2004 |
| WO | WO 2004/027392 | A1 | 4/2004 |
| WO | WO 2004/027786 | A2 | 4/2004 |
| WO | WO 2004/027786 | A3 | 4/2004 |
| WO | WO 2004/028936 | | 4/2004 |
| WO | WO 2004/053434 | A2 | 6/2004 |
| WO | WO 2004/053434 | A3 | 6/2004 |
| WO | WO 2004/057715 | A1 | 7/2004 |
| WO | WO 2004/057715 | A2 | 7/2004 |
| WO | WO 2004/067961 | A2 | 8/2004 |
| WO | WO 2004/067961 | A3 | 8/2004 |
| WO | WO 2004/072436 | A1 | 8/2004 |
| WO | WO 2004/074622 | A2 | 9/2004 |
| WO | WO 2004/074622 | A3 | 9/2004 |
| WO | WO 2004/076798 | A2 | 9/2004 |
| WO | WO 2004/076798 | A3 | 9/2004 |
| WO | WO 2004/081346 | A2 | 9/2004 |
| WO | WO 2004/083591 | A2 | 9/2004 |
| WO | WO 2004/083591 | A3 | 9/2004 |
| WO | WO 2004/083592 | A2 | 9/2004 |
| WO | WO 2004/083592 | A3 | 9/2004 |
| WO | WO 2004/083593 | A2 | 9/2004 |
| WO | WO 2004/083594 | A2 | 9/2004 |
| WO | WO 2004/083594 | A3 | 9/2004 |
| WO | WO 2004/085790 | A2 | 10/2004 |
| WO | WO 2004/089608 | A2 | 10/2004 |
| WO | WO 2004/089608 | A3 | 10/2004 |
| WO | WO 2004/092527 | A2 | 10/2004 |
| WO | WO 2004/092528 | A2 | 10/2004 |
| WO | WO 2004/092528 | A3 | 10/2004 |
| WO | WO 2004/092530 | A2 | 10/2004 |
| WO | WO 2004/092530 | A3 | 10/2004 |
| WO | WO 2004/094766 | A2 | 11/2004 |
| WO | WO 2004/094766 | A3 | 11/2004 |
| WO | WO 02005/017303 | A2 | 2/2005 |
| WO | WO 2005/021921 | A2 | 3/2005 |
| WO | WO 2005/021921 | A3 | 3/2005 |
| WO | WO 2005/021922 | A2 | 3/2005 |
| WO | WO 2005/021922 | A3 | 3/2005 |
| WO | WO 2005/023391 | | 3/2005 |
| WO | WO 2005/024170 | A2 | 3/2005 |
| WO | WO 2005/024170 | A3 | 3/2005 |
| WO | WO 2005/024171 | A3 | 3/2005 |
| WO | WO 2005/027318 | | 3/2005 |
| WO | WO 2005/028446 | | 3/2005 |
| WO | WO 2005/028451 | | 3/2005 |
| WO | WO 2005/028453 | | 3/2005 |
| WO | WO 2005/028473 | | 3/2005 |
| WO | WO 2005/028641 | | 3/2005 |
| WO | WO 2005/028642 | | 3/2005 |
| WO | WO 2005/028669 | | 3/2005 |
| WO | WO 2005/028803 | A2 | 3/2005 |
| WO | WO 2005/028819 | | 3/2005 |
| WO | WO 2005/028936 | | 3/2005 |
| WO | WO 2005/043122 | | 5/2005 |
| WO | WO 2005/061852 | | 7/2005 |
| WO | WO 2005/071212 | A1 | 8/2005 |
| WO | WO 2005/079186 | A2 | 9/2005 |
| WO | WO 2005/079186 | A3 | 9/2005 |
| WO | WO 2005/081803 | A2 | 9/2005 |
| WO | WO 2005/086614 | A2 | 9/2005 |
| WO | WO 2006/002449 | | 1/2006 |
| WO | WO 2006/010674 | | 2/2006 |
| WO | WO 2006/014333 | A2 | 2/2006 |
| WO | WO 2006/017459 | A2 | 2/2006 |
| WO | WO 2006/020723 | A2 | 2/2006 |
| WO | WO 2006/020726 | A2 | 2/2006 |
| WO | WO 2006/020734 | A2 | 2/2006 |
| WO | WO 2006/020734 | A3 | 2/2006 |
| WO | WO 2006/020809 | A2 | 2/2006 |
| WO | WO 2006/020810 | A2 | 2/2006 |
| WO | WO 2006/020810 | A3 | 2/2006 |
| WO | WO 2006/020827 | A2 | 2/2006 |
| WO | WO 2006/020827 | A3 | 2/2006 |
| WO | WO 2006/020913 | A2 | 2/2006 |
| WO | WO 2006/020913 | A3 | 2/2006 |
| WO | WO 2006/020960 | A2 | 2/2006 |
| WO | WO 2006/033720 | A2 | 3/2006 |
| WO | WO 2006/060387 | A2 | 6/2006 |
| WO | WO 2006/060387 | A3 | 6/2006 |
| WO | WO 2006/079072 | A2 | 7/2006 |
| WO | WO 2006/079072 | A3 | 7/2006 |
| WO | WO 2006/088743 | A2 | 8/2006 |
| WO | WO 2006/088743 | A3 | 8/2006 |
| WO | WO 2006/096762 | A1 | 9/2006 |
| WO | WO 2006/102171 | A2 | 9/2006 |
| WO | WO 2006/102556 | A2 | 9/2006 |
| WO | WO 2007/014339 | A2 | 2/2007 |

OTHER PUBLICATIONS

Harvey J. Arbuckle, Advanced Laser Texturing Tames Tough Tasks.

Baker Hughes, EXPatch Expandable Cladding System, Copyright 2002, Baker Hughes Inc.

Baker Hughes, EXPress Expandable Screen System, Baker Hughes Inc.

Baker Hughes, FORMlock Expandable Liner Hanger, Baker Hughes Inc.

Dorel Banabic, Analysis of Metal Sheet. Formability and its Factors of Influence, Deep-Drawing Optimization by Controlling the Blank-Holding Force, Mathematical Modelling of Some Special Sheet Metal Forming Procedures, Finite Element Simulation of Deep-Drawing, Theoretical and Experimental Research on Anisotropic Behavior of Sheet Metal.

Kate Blasingame, Gerry Gales, Solid Expandable Tubular Technology in Mature Basins, Copyright 2003, pp. 1-10, AAPG/SPE.

J.C.M. Braas, C.O. Aihevba, M. Shandoodi, R.H. Van Noort, M.N. Baaijens, Water Production Management—PDO's Successful Application of Expandable Technology, Copyright 2002, pp. 1-8, Society of Petroleum Engineers.

V. Brizmer, Y. Kugerman, I. Etson, A Laser Surface Textured Parallel Thrust Bearing, 2003; pp. 397-403, vol. 46, Issue 3.

Jim Brock, Scott Costa, Lev Ring, Andrei Fiuppov, An Expanded Horizon, Feb. 2000, pp. 115-117.

Bill Buckler, Nick Steinsberger, Kevin Waddell, Rune Gusevik, Edwin Zwald, Expandable Cased-hole Liner Remediates Prolific Gas Well and Minimizes Loss of Production, Copyright 2002, pp. 1-6.

Michael D. Bullock, Tubulars Technology—Expandable Tubular Technology Continues to Broaden Range of Applications, Advances Grow Expandable Applications, Sep. 2004, The American Oil & Gas Reporter.
G.L. Cales, The Development and Applications of Solid Expandable Tubular Technology, Jun. 10, 2003, pp. 1-11.
Gerry Cales, Tom Grant, Larry Book; Reducing Non-Productive Time Through the Use of Solid Expandable Tubulars: How to Beat the Curve Through Pre-Planning, Copyright 2004, Offshore Technology Conference.
Gerry Cales, David Shepherd, Brad Wiest, Pat York, Chan Daigle, Larry Rose, Mike Patterson, Subsidence Remediation—Extending Well Life Through the Use of Solid Expandable Casing Systems, Mar. 27, 2001, pp. 1-16, American Association of Drilling Engineers.
Don Campo, Gerald Cales, Colley Andrews, Mike Bullock, Mark Rivenbark, Patrick York, Case Histories—Drilling and Recompletion Applications Using Solid Expandable Tubular Technology, Copyright 2002, pp. 1-13; Society of Petroleum Engineers.
Chris Carstens, Mike Breaux, Kate Blasingame, Solid Expandable Tublar Technology: The Value of Planned Installation vs. Contingency, pp. 1-10.
Case History—Eemskanaal—2, Groningen, Feb. 2002, Enventure Global Technology.
Case History—Graham Ranch No. 1, Newark East Barnett Field, Feb. 2002, Enventure Global Technology.
Case History—K.K. Camel No. 1, Ridge Field, Lafayette Parish, Louisiana, Feb. 2002, Enventure Global Technology.
Case History—Mississippi Canyon 809, URSA TLP, OCS-G 5868, No. A-12, Mar. 2004, Enventure Global Technology.
Case History—Unocal Sequoia, Mississippi Canyon 941 Well No. 2, 2005, Enventure Global Technology.
Case History—Yibal 381, Oman, Feb. 2002, Enventure Global Technology.
Lance Cook, Same Internal Casing Diameter From Surface to TD—Drilling Deeper than Ever Before, pp. 1-2, Jul. 2002, Offshore Magazine.
Adrian Cottrill, Core Ideas Expanding Into the Mainstream, Jul. 26, 2002, pp. 26-27, Upstream Magazine.
Chan L Daigle, Donald B. Campo, Carey J. Naquin, Rudy Cardenas, Lev M. Ring, Patrick L. York, Expandable Tubulars: Field Examples of Application in Well Construction and Remediation, Copyright 2000, pp. 1-14, Society of Petroleum Engineers.
Ali Daneshy, Management Report , Technology Strategy Breeds Value, May 2004.
Data Sheet—Enventure Cased-Hole Liner (CHL) System, Dec. 2002, pp. 1-2, Enventure Global Technology.
Data Sheet—Enventure Openhold Liner (OHL) System, Dec. 2002, pp. 1-2, Enventure Global Technology.
Data Sheet—Window Exit Applications OHL Window Exit Expansion, Jun. 2003, pp. 1-2, Enventure Global Technology.
Bill Dean, Lance Cook, David Brisco, Monodiameter Drilling Liner—From Concept to Reality, Copyright 2003, pp. 1-15, Society of Petroleum Engineers.
Karl Demong, Breakthroughs using Solid Expandable Tubulars to Construct Extended Reach Wells, Copyright, 2004, pp. 1-13, Society of Petroleum Engineers.
Karl Demong, Mark Swift, Mark Rivenbark, Carl Dismuke, Saudi Aramco, Casing Design in Complex Wells: The Use of Expendables and Multilateral Technology to Attack the Size Reduction Issue, pp. 1-11.
Karl Demong, Mark Rivenbark,.Carl Dismuke, Expandable Tubulars Enable Multilaterals without Compromise on Hole Size, Casing Design in Complex Wells, Jun. 2003, PennWell Corporation.
Karl Demong, Mark Rivenbark, Khalid Syed Hussain, Planning the Well Construction Process for the use of Solid Expandable Casing, Copyright 2003, pp. 1-10, Society of Petroleum Engineers.
Laurence Demoulin, Tendance Technologie, Les tubes expansibles changent la face du forage petrolier, Jul. 3, 2003, pp. 50-52, Issue No. 2878.
Kenneth Dupal, Donald B. Campo, Colley J. Andrews, R. Lance Cook, Lev M. Ring, Patrick L. York, Realization of the MonoDiameter Well Evolution of a Game-Changing Technology, Copyright 2002, pp. 1-10, Issue No. 14312, Offshore Technology Conference.
Kenneth K. Dupal, Donald B. Campo, John E. Lofton, Don Weisinger, R. Lance Cook, Michael D. Bullock, Thomas P. Grant, Patrick L. York, Solid Expandable Tubular Technology—A Year of Case Histories in the Drilling Environment Copyright 27, 2001, pp. 1-16, Issue No. 67770, Society of Petroleum Engineers.
Ken Dupal, Carey J. Naquin, Chan Daigle, Lance Cook, Pat York, Deep Offshore Technology,. Well Design With Expandable Tubulars Reduces Costs and Increases Success in Deepwater Applications, 2000, pp. 2-16.
Gier Owe Egge, Production Enhancement Technology, Mar. 10, 2003, pp. 1-18.
EIS Expandable Isolation Sleeve, Feb. 2003.
Letter from Darin H. Duphorne of Baker Hughes to William Norvell of Beirne, Maynard & Parsons, L.L.P. dated Apr. 1, 2005.
SET Technology: The Facts, Copyright 2004, pp. 1-25.
Solid expandable tubulars are enabling technology, Drilling Contractor, Mar./Apr. 2001.
Enventure ready to rejuvenate the North Sea, Pipe & Tubular Services, Sep. 2004.
Carlos Escobar, Bill Dean, Brian, Race, Kevin Waddell, Increasing Solid Expandable Tubular Technology Reliability in a Myriad of Downhole Environinents, Copyright 2003, Society of Petroleum Engineers.
Izhak Etsion, Improving Tribological Performance of Mechanical Seals by Laser Surface Texturing, Surface Technologies LTD.
Izhak Etsion, Gregory Halperin, A laser surface textured hydrostatic methanical seal, Sealing Technology, Mar. 2003.
Expandable Casing Accesses Remote Reservoirs, Petroleum Engineer International, Apr. 1999.
Expandable Sand Screens, Weatherford Completion Systems, Copyright 2002, pp. 1-40.
Andrei Filippov, Robert Mack, Lance Cook, Patrick York, Lev Ring; Terry McCoy, Expandable Tubular Solutions, Copyright 1999, pp. 1-16, Issue 56500, Society of Petroleum Engineers.
First ever SET workshop held in Aberdeen, Roustabout, Oct. 2004.
Perry A. Fischer, Expendables and the dream of the monodiameter well: a status report, Jul. 2004, World Oil.
Rick Von Flatern, Oilfield Service trio target Jules Verne Territory, Aug. 17, 2001, OilOnline—The Original Online Source for the Oil Industry.
Rick Fontova, Solid Expandable Tubulars (SET) Provide Value to Operators Worldwide in a Variety of Applications, Apr. 2005, EP Journal of Technology, pp. 1-17.
Fraunhofer IWU—Research Area: Sheet Metal Forming—Superpositions of Vibrations, Copyright 2001.
William Furlow, Casing expansion, test process fine tuned on ultra-deepwater well, Offshore, Dec. 2000, PennWell Corporation.
William Furlow, Expandable solid casing reduces telescope effect, Offshore, pp. 102, 140, Issue: Aug. 1998, PennWell Corporation.
William Furlow, Agbada well solid tubulars expanded bottom up, screens expanded top down, Offshore, Issue: Jan. 2002, PennWell Corporation.
Mike Gilmer, Brent Emerson, World's First Completion Set Inside Expandable Screen, High Tech Wells, Copyright 2003, pp. 1-7.
Thomas P. Grant, Michael D. Bullock, Deepwater Expandable Openhole Liner Case Histories: Learnings Through Field Applications,Offshore Technology Conference, Copyright 2002, pp. 1-6, Issue 14218.
Phiup Guichelaar, Karalyn Folkert, Izhak Etsion, Steven Pride, Effect of Micro-Surface Texturing on Breakaway Torque and Blister Formation on Carbon-Graphite Faces in a Mechanical Seal, Journal of the Society of Tribologists and Lubrication Engineers, Aug. 2002, pp. 18-21.
Rune Gusevik, Randy Merritt, Reaching Deep Reservoir Targets Using Solid Expandable Tubulars, Society of Petroleum Engineers, Copyright 2002, pp. 1-8, Issue 77612.
Henry Haefke, Yvonne Gerbig, Gabriel Dumitru, Valerio Romano, Microtexturing of Functional Surfaces for Improving Their Tribological Performance, Proceedings of the International Tribology Conference, 2000, pp. 217-221, Nagasaki.

Completion Products, Halliburton, Copyright 1996.
Ian D. Harris, Tube Welding, www.tubenet.org, accessed Oct. 25, 2006.
Richard C. Haut, Qamar Sharif, Meeting Economic Challenges of Deepwater Drilling With Expandable—Tubular Technology, Deep Offshore Technology Conference, 1999.
Jennifer Pallanich Hull, MonoDiameter technology keeps hole diameter to TD, Offshore, Copyright 2002, pp. 1-2, Issue—Oct. 2002, PennWell Corporation.
Innovators Chart the Course, pp. 1-21, PennWell Custom Publishing, Tulsa/U.S.A.
Diane Langley, Case Study: Value in Drilling Derived From Application-Specific Technology.
G.R. Linsell, Trib-Gel A Chemical Cold Welding Agent, Trib Tech, Jan. 5, 2004, pp. 1-5.
Todd E. Lizotte, Scratching the surfate, PT Design, pp. 41-44, Issue—Jun. 1999.
C. Lee Lohoefer, Ben Mathis, David Brisco, Kevin Waddell, Lev Ring, Patrick York, Expandable Liner Hanger Provides Cost-Effective Alternative Solution, Society of Petroleum Engineers, Copyright 2000, pp. 1-12, Issue 59151.
R.D. Mack, Terry McCoy, Lev Ring, How in situ expahsion affects casing and tubing properties, World Oil magazine; pp. 69-71, Issue Jul. 1999, Gulf Publishing Company.
Robert Mack, Andrei Filippov Larry Kendziora, Lev Ring, In-Situ Expansion of Casing and Tubing—Effect on Mechanical Properties and Resistance to Sulfide Stress Cracking, Corrosion 2000, Copyright 2000, pp. 143, Issue 00164.
Randy M. Merritt, Casing Remediation—Extending Well Life Through the Use of Solid Expandable Casing Systems, pp. 1-15.
Randy M. Merritt, William Buckler, Nick Steinsberger, Rune Gusevik, Well Remediation Using Expandable Cased-Hole Liners—Summary of Case Histories.
Randy M. Merritt, Rune Gusevik, William Buckler, Nick Steinsberger, Well remediation using expandable cased-hole liners, World Oil, Copyright 2004 pp. 56-65, Issue Jul. 2002, Gulf Publishing Company, U.S.A.
Expandable Tubular Energy, Mohawk Energy, Houston, TX / U.S.A.
Melvin J. Moore, Donald B. Campo, Joel Hockaday, Lev Ring, Expandable Liner Hangers: Case Histories, Copyright 2002, pp. 1-11, Issue 14313, Offshore Technology Conference.
Melvin J. Moore, Warren J. Winters, Edwin Zwald, David Brisco, Field Trial Proves Upgrades to Solid Expandable Tubulars, Offshore Technology Conference, Copyright 2002, pp. 1-11, Issue 14217.
Shell and Halliburton Agree to Form Company to Develop and Market Expandable Casing Technology, News Release—Joint Venture, Jun. 3, 1998, pp. 1-2.
Norlizah Mohd Nor, Edmund Huang, Chin Hon Voon, James Lau, Michael Ruggier, Transforming Conventional Wells to Bigbore Completions Using Solid Expandable Tubular Technology, Offshore Technology Conference, Copyright 2002, pp. 1-8, Issue 14315.
Michael Patin, Doug Keel, Craig Johnson, Virgil Newton, Overcoming Well Control Challenges with Solid Expandable Tubular Technology, Offshore Technology Conference, Copyright 2003, pp. 1-5, issue 15152.
Pipeline Rehabilitation by Sliplining with Polyethylene Pipe, pp. 389-412.
Design and optimization of an ultrasonic die system for forming metal cans, Power Ultrasonics, Jul. 1, 2000.
Matt Ratliff, Changing Safety Paradigms in the Oil and Gas Industry, Society of Petroleum Engineers, Copyright 2004, pp. 1-6, Issue 90828.
Conoco and Tesco Unveil Revolutionary Drilling Rig, Rigzone News, Feb. 11, 2002.
Tesco Provides Casing Drilling Operations Update, Rigzone News, Oct. 16, 2001.
Mark Rivenbark, Expandable Tubular Technology—Drill Deeper, Farther, More Economically, Enventure Global Technology.
Mark Rivenbark, Karl Demong, Sami S. Mulhem, Glen Olivera, Solid Expandable Tubular Technology: The Value of Planned Installation vs. Contingency, Society for Petroleum Engineers, Copyright 2004, pp. 1-8, Issue 90821.
Mark Rivenbark, Karl Demons, Omar Al Farad, Window Exit Sidetrack Enhancements Through the Use of Solid Expandable Casing, Society of Petroleum Engineers / International Association of Drilling Contractors, Copyright 2004, pp. 1-7, Issue 88030.
Eduardo Perez-Roca, Stacey Andrews, Doug Keel, AddreSsing Common Drilling Challenges Using Solid Expandable Tubular Technology, Society of Petroleum Engineers, Copyright 2003, pp. 1-9, Issue 80446.
Aviram Ronen, Izhak Etsion, Yuri Kligerman, Friction-Reducing Surface-Texturing in Reciprocating Automotive Components, Tribology Transactions, 2001, pp. 359-366, vol. 44.
G. Ryk, Y. Kligerman, I. Etsion, Experimental Investigation of Laser Surface Texturing for Reciprocating Automotive Components, Tribology Transactions, 2002, pp. 444-449, vol. 45.
Tom Sanders, Rune Gusevik, Ron Nida, James Griffith, Practices for Providing Zonal Isolation in Conjunction with Expandable Casing Jobs—Case Histories, pp. 1-5.
Tom Sanders, Tim Baseflug, Neal Keith, Three Diverse Applications on Three Continents for a Single Major Operator, Offshore Technology Conference, Copyright 2004, pp. 1-8, Issue 16667.
SET Technology: The Facts, Enventure Global Technology, Copyright 2004, pp. 1-25.
Gertjan Siemers, Thompson Ukomah, Robert Mack, Greg Noel, John Donald, Development and Field Testing of Solid Expandable Corrosion Resistant-Cased-hole Liners to Boost Gas Production in Corrosive Environments, Offshore Technology Conference; Copyright 2003, pp. 1-6, Issue 15149.
Slim Well: Stepping Stone to MonoDiameter, Enventure Global Technology, pp. 1-16, Issue Jun. 2003.
Maurice Smith, Pipe Dream Reality, New Technology Magazine, pp. 1-3, Issue Dec. 2003.
Solid Expandable Tubulars, Enventure Global Technology, pp. 1-16, Issue Mar. 2002.
Steven W. Sparling, Greg Noel, Expanding Oil Field Tubulars Through a Window Demonstrates Value and Provides New Well Construction Option, Offshore Technology Conference, Copyright 2004, pp. 1-9, Issue 16664.
Mike Sumrow, Shell drills world's first MonoDiameter well in South Texas, Oil & Gas Journal, Copyright 2002, Issue Oct. 21, 2002, PennWell Corporation.
Nicolas Touboul, Lee Womble, John Kotrla, Neal Keith, New Technologies Combine to Reduce Drilling Costs in Ultradeepwater Applications, Society of Petroleum Engineers, Copyright 2004, pp. 1-10, Issue 90830.
Letter from Tod T. Tumey of Tumey L.L.P. To Andrei Filippov of Mohawk Energy regarding analyzation of patents 6892819, 6695012, 6640903, 6631769, 6631759, 5348095, May 6, 2006.
Donald L. Turcotte, Gerald Schubert, Geodynamics Applications of Continuum Physics, to Geological Problems, Copyright 1982, John Wiley & Sons, Inc., Canada.
Roger Van Noort, Mark Rivenbark, Mike Jones, Using Solid Expandable Tubulars for Openhole Water Shutoff, Society of Petroleum Engineers, Copyright 2002, pp. 1-6, Issue 78495.
Roger Van Noort, Majid Shandoodi, Mike Jones, Water Production Reduced Using Solid Expandable Tubular Technology to "Clad" In Fractured Carbonite Formation, Offshore Technology Conference, Copyright 2003, pp. 1-9, Issue 15153.
Rick Von Flatern, From exotic to routine—the offshore quick-step, Offshore Engineer, pp. 77-83, Issue Apr. 2004.
Rick Von Flatern, Oilfield service trio target Jules Verne territory, Offshore Engineer, pp. 1-4, Issue Aug. 2001.
Kevin Waddell, Advances in Single-diameter Well Technology: The Next Step to Cost-Effective Optimization, Society of Petroleum Engineers, Copyright 2004, pp. 1-10, Issue 90818.
Kevin Waddell, Rutmer Schuurmans, Installation of Solid Expandable Tubular Systems Through Milled Casing Windows, Society of Petroleum Engineers, Copyright 2004, pp. 1-10, Issue 87208.
Peggy Williams, Straightening the Drilling Curve, Drilling Technology, Issue Jan. 2003.
Threadlockers, Oilfield Catalog Jet-Lok Product Application Descriptions, www.jetlube.com, accessed Aug. 8, 2003.

Low Temperature Bonding of Dissimilar and Hard-to-Bond Materials and Metals-Including, Materials Resources International, www.materialsresources.com, Accessed Jan. 5, 2004.
3d Surface Texture Parameters, www.michmet.com, accessed Jan. 22, 2004.
Glavanic Protection, Metallurgical Bonds, Custom Fabrication—Spur Industries, www.spurind.com, accessed Jan. 5, 2004.
Examination Report dated Sep. 4, 2006 on Australian patent application No. 2001/278196.
Examination Report dated Oct. 4, 2006 on Australian patent application No. 2002/237757.
Examination Report dated Apr. 21, 2005 on Australian patent application No. 2001/278196.
Examination Report dated Apr. 28, 2005 on Australian patent application No. 2002/237757.
Examination Report dated Apr. 13, 2005 on Australian patent application No. 2002/240366.
Examination Report dated Jan. 19, 2006 on Australian patent application No. 20031257878.
Examination Report dated Jan. 30, 2006 on Australian patent application No. 2003/257878.
Examination Report dated Jan. 19, 2006 on Australian patent application No. 20031257881.
Examination Report dated Jan. 30, 2006 on Australian patent application No. 2003/257881.
Examination Report dated Jun. 14, 2006 on Australian patent application No. 2004/202805.
Examination Report dated Jun. 14, 2006 on Australian patent application No. 2004/202809.
Examination Report dated Jun. 14, 2006 on Australian patent application No. 2004/202812.
Examination Report dated Jun. 14, 2006 on Australian patent application No. 2004/202813.
Examination Report dated Jun. 14, 2006 on Australian patent application No. 2004/202815.
Examination Report dated Nov. 15, 2006 on Canadian patent application No. 2298139.
Examination Report dated Feb. 7, 2007 on Canadian patent application No. 2383231.
Examination Report dated Jan. 24, 2007 on Canadian patent application No. 2419806.
Examination Report dated Jan. 30, 2007 on Canadian patent application No. 2432030.
Examination Report dated Jan. 24, 2007 on Canadian patent application No. 2438807.
Examination Report dated Jan. 30, 2007 on Canadian patent application No. 2517524.
Examination Report dated Mar. 1, 2007 on Chinese PCT national patent application No. 02827985.9.
Examination Report dated Apr. 24, 2006 on European patent application No. 03728326.4.
Examination Report dated Jun. 28, 2006 on European patent application No. 03752486.5.
Search Report dated Nov. 14, 2005 on European application No. 03071281.2.
Search Report dated Nov. 7, 2005 on European application No. 03701281.
Search Report dated May 3, 2006 on European application No. 03723674.2.
Search Report dated Mar. 7, 2006 on European application No. 03728326.
Search Report dated Apr. 24, 2006 on European application No. 03728326.4.
Search Report dated Feb. 8, 2006 on European application No. 03752486.5.
Search Report dated Feb. 24, 2006 on European application No. 03759400.
Search Report dated Mar. 24, 2006 on European application No. 03759400.9.
Search Report dated Mar. 14, 2006 on European application No. 03793078.
Search Report dated Jun. 16, 2006 on European application No. 03793078.1.
Search Report dated Feb. 9, 2005 on European application No. 02806451.7.
Search Report dated Nov. 22, 2005 on European application No. 03723674.2.
Examination Report dated Oct. 31, 2003 on British patent application No. 0219757.2.
Examination Report dated Nov. 25, 2003 on British patent application No. 0013661.4.
Examination Report dated Apr. 4, 2003 on British patent application No. 0208367.3.
Examination Report dated Nov. 4, 2003 on British patent application No. 0208367.3.
Examination Report dated Nov. 17, 2003 on British patent application No. 0208367.3.
Examination Report dated Jan. 30, 2004 on British patent application No. 0208367.3.
Examination Report dated Apr. 10, 2003 on British patent application No. 0212443.6.
Examination Report dated Feb. 9, 2004 on British patent application No. 0216409.3.
Examination Report dated Nov. 28, 2003 on British patent application No. 0300085.8.
Examination Report dated Dec. 1, 2003 on British patent application No. 030086.6.
Examination Report dated Sep. 10, 2004 on British patent application No. 0306046.4.
Examination Report dated Jul. 15, 2004 on British patent application No. 0314846.7.
Examination Report dated May 25, 2004 on British patent application No. 0320747.9.
Examination Report dated Jan. 31, 2006 on British patent application No. 03701281.2.
Examination Report dated Feb. 6, 2006 on British patent application No. 03723674.2.
Examination Report dated Oct. 29,2004 on British patent application No. 0400018.8.
Examination Report dated Nov. 4, 2005 on British patent application No. 0400019.6.
Examination Report dated Oct. 29, 2004 on British patent application No. 0400019.6.
Examination Report dated Sep. 2, 2005 on British patent application No. 0400019.6.
Examination Report dated May 20, 2004 on British patent application No. 0404796.5.
Examination Report dated Jun. 28, 2004 on British patent application No. 0406257.6.
Examination Report dated Sep. 2, 2005 on British patent application No. 0406257.6.
Examination Report dated Feb. 21, 2006 on British patent application No. 0406257.6.
Examination Report dated Mar. 3, 2006 on British patent application No. 0406257.6.
Examination Report dated May 20, 2004 on British patent application No. 0406258.4.
Examination Report dated Jul. 12, 2004 on British patent application No. 0408672.4.
Examination Report dated Feb. 13, 2006 on British patent application No. 0412876.5.
Examination Report dated Dec. 8, 2004 on British patent application No. 0422419.2.
Examination Report dated Nov. 8, 2005 on British patent application No. 0422419.2.
Examination Report dated Dec. 15, 2005 on British patent application No. 0422893.8.
Examination Report dated Aug. 8, 2005 on British patent application No. 04228918.
Examination Report dated Nov. 24, 2005 on British patent application No. 0425948.7.
Examination Report dated Nov. 24, 2005 on British patent application No. 0425956.0.

Examination Report dated Feb. 9, 2005 on British patent application No. 0428141.5.
Examination Report dated Feb. 21, 2006 on British patent application No. 0428141.6.
Examination Report dated Apr. 5, 2006 on British patent application No. 0500275.3.
Examination Report dated Sep. 12, 2005 on British patent application No. 0500184.7.
Examination Report dated Sep. 6, 2005 on British patent application No. 0500600.2.
Examination Report dated Jan. 27, 2006 on British patent application No. 0501667.0.
Examination Report dated Nov. 15, 2005 on British patent application No. 0503250.3.
Examination Report dated Mar. 2, 2006 on British patent application No. 0503250.3.
Examination Report dated Sep. 22, 2005 on British patent application No. 0503470.7.
Examination Report dated Sep. 21, 2005 on British patent application No. 0506699.8.
Examination Report dated May 11, 2006 on British patent application No. 0506699.8.
Examination Report dated Jan. 17, 2006 on British patent application No. 0507979.3.
Examination Report dated Jun. 16, 2005 on British patent application No. 0507979.3.
Examination Report dated Sep. 29, 2005 on British patent application No. 0507980.1.
Examination Report dated Feb. 3, 2006 on British patent application No. 0509618.5.
Examination Report dated Feb. 14, 2006 on British patent application No. 0509620.1.
Examination Report dated Feb. 3, 2006 on British patent application No. 0509627.6.
Examination Report dated Feb. 3, 2006 on British patent application No. 0509629.2.
Examination Report dated Sep. 27, 2005 on British patent application No. 0509629.2.
Examination Report dated Feb. 3, 2006 on British patent application No. 0509630.0.
Examination Report dated Feb. 14, 2006 on British patent application No. 0509631.8.
Examination Report dated Nov. 9, 2005 on British patent application No. 0517448.7.
Examination Report dated Oct. 27, 2005 on British patent application No. 0518025.2.
Examination Report dated Nov. 29, 2005 on British patent application No. 0518039.3.
Examination Report dated Oct. 28, 2005 on British patent application No. 0518252.2.
Examination Report dated Nov. 9, 2005 on British patent application No. 0518799.2.
Examination Report dated Dec. 16, 2005 on British patent application No. 0518893.3.
Examination Report dated Mar. 8, 2006 on British patent application No. 0519989.8.
Examination Report dated Dec. 22, 2005 on British patent application No. 0521024.0.
Examination Report dated Dec. 13, 2005 on British patent application No. 0522050.4.
Examination Report dated Mar. 20, 2006 on British patent application No. 0602877.3.
Examination Report dated Aug. 28, 2002 on British patent application No. 0004285.3.
Examination Report dated Mar. 28, 2003 on British patent application No. 0004285.3.
Search and Examination Report dated Mar. 7, 2006 on British patent application No. 0522155.1.
Search and Examination Report dated Feb. 3, 2006 on British patent application No. 0525768.8.
Search and Examination Report dated Feb. 3, 2006 on British patent application No. 0525770.4.
Search and Examination Report dated Feb. 2, 2006 on British patent application No. 0525772.0.
Search and Examination Report dated Feb. 2, 2006 on British patent application No. 0525774.6.
Search and Examination Report dated Jun. 3, 2003 on British patent application No. 0004282.0.
Search and Examination Report dated Jul. 1, 2003 on British patent application No. 0225505.7.
Search and Examination Report dated Jun. 2, 2003 on British patent application No. 0308290.6.
Search and Examination Report dated Jun. 2, 2003 on British patent application No. 0308293.0.
Search and Examination Report dated Jul. 14, 2003 on British patent application No. 0308293.0.
Search and Examination Report dated Jun. 2, 2003 on British patent application No. 0308294.8.
Search and Examination Report dated Jul. 14, 2003 on British patent application No. 0308294.8.
Search and Examination Report dated Jun. 2, 2003 on British patent application No. 0308295.5.
Search and Examination Report dated Jul. 14, 2003 on British patent application No. 03082953.5
Search and Examination Report dated Jun. 2, 2003 on British patent application No. 0308296.3.
Search and Examination Report dated Jul. 14, 2003 on British patent application No. 0308296.3.
Search and Examination Report dated Jun. 2, 2003 on British patent application No. 0308297.1.
Search and Examination Report dated Jul. 1, 2003 on British patent application No. 0308297.1.
Search and Examination Report dated Jun. 2, 2003 on British patent application No. 03082997.
Search and Examination Report dated Jun. 2, 2003 on British patent application No. 0308302.9.
Search and Examination Report dated Jun. 2, 2003 on British patent application No. 0308303.7.
Search and Examination Report dated Jul. 14, 2003 on British patent application No. 0308303.7.
Search and Examination Report dated Jun. 24, 2003 on British patent application No. 0310090.6.
Search and Examination Report dated Jun. 24, 2003 on British patent application No. 0310099.7.
Search and Examination Report dated Jun. 24, 2003 on British patent application No. 0310101.1.
Search and Examination Report dated Jun. 24, 2003 on British patent-application No. 0310104.5.
Search and Examination Report dated Jun. 24, 2003 on British patent application No. 0310118.5.
Search and Examination Report dated Jun. 12, 2003 on British patent application No. 0310757.0.
Search and Examination Report dated Jun. 12, 2003 on British patent application No. 0310759.6.
Search and Eicaininination Report dated Jun. 12, 2003 on British patent application No. 0310770.3.
Search and Examination Report dated Jun. 12, 2003 on British patent application No. 0310772.9.
Search and Examination Report dated Jun. 21, 2003 on British patent application No. 0310785.1.
Search and Examination Report dated Jun. 12, 2003 on British patent application No. 0310795.0.
Search and Examination Report dated Jun. 12, 2003 on British patent application No. 0310797.6.
Search and Examination Report dated Jun. 12, 2003 on British patent application No. 0310799.2.
Search and Examination Report dated Jun. 12, 2003 on British patent application No. 0310801.6.
Search and Examination Report dated Jun. 12, 2003 on British patent application No. 0310833.9.
Search and Examination Report dated Jun. 12, 2003 on British patent application No. 0310836.2.
Examination Report dated Aug. 7, 2003 on British patent application No. 0310836.2.

Search and Examination Report dated Sep. 3, 2003 on British patent application No. 0313406.1.
Search and Examination Report dated Aug. 14, 2003 on British patent application No. 0316883.8.
Search and Examination Report dated Nov. 25, 2003 on British patent application No. 0316883.8.
Search and Examination Report dated Aug. 14, 2003 on British patent application No. 0316886.1.
Search and Examination Report dated Nov. 25, 2003 on British patent application No. 0316886.1.
Search and Examination Report dated Aug. 14, 2003 on British patent application No. 0316887.9.
Search and Examination Report dated Nov. 15, 2003 on British patent application No. 0316887.9.
Search and Examination Report dated Sep. 3, 2003 on British patent application No. 0318545.1.
Search and Examination Report dated Sep. 3, 2003 on British patent application No. 0318547.4.
Search and Examination Report dated Sep. 3, 2003 on British patent application No. 0318547.7.
Search and Examination Report dated Sep. 3, 2003 on British patent application No. 0318549.3.
Search and Examination Report dated Sep. 3, 2003 on British patent application No. 0318550.1.
Search and Examination Report dated Dec. 16, 2003 on British patent application No. 0320579.6.
Search and Examination Report dated Dec. 17, 2003 on British patent application No. 0320580.4.
Search and Examination Report dated Dec. 19, 2003 on British patent application No. 0323891.2.
Search and Examination Report dated Nov. 4, 2003 on British patent application No. 0324172.6.
Search and Examination Report dated Nov. 4, 2003 on British patent application No. 0324172.6.
Search and Examination Report dated Nov. 4, 2003 on British patent application No. 0324174.2.
Search and Examination Report dated Nov. 18, 2003 on British patent application No. 0325071.9.
Examination Report dated Feb. 2, 2004 on British patent application No. 0325071.9.
Search and Examination Report dated Dec. 3, 2003 on British patent application No. 0325072.7.
Examination Report dated Feb. 5, 2004 on British patent application No. 0325072.7.
Examination Report dated Apr. 13, 2004 on British patent application No. 0325072.7.
Search and Examination Report dated Jun. 9, 2004 on British patent application No. 0403891.5.
Search and Examination Report dated Jun. 9, 2004 on British patent application No. 0403893.1.
Search and Examination Report dated Jun. 9, 2004 on British patent application No. 0403894.9.
Search and Examination Report dated Jun. 9, 2004 on British patent application No. 0403894.9.
Search and Examination Report dated Jun. 9, 2004 on British patent application No. 0403897.2.
Search and Examination Report dated Jun. 10, 2004 on British patent application No. 0403920.2.
Search and Examination Report dated Jun. 10, 2004 on British patent application No. 0403921.0.
Search and Examination Report dated Jun. 10, 2004 on British patent application No. 0403926.9.
Search and Examination Report dated Apr. 21, 2004 on British patent application No. 0404826.0.
Search and Examination Report dated Apr. 21, 2004 on British patent application No. 0404828.6.
Search and Examination Report dated Apr. 21, 2004 on British patent application No. 0404830.2.
Examination Report dated Aug. 17, 2004 on British patent application No. 0404830.2.
Search and Examination Report dated Apr. 21, 2004 on British patent application No. 0404832.8.
Search and Examination Report dated Apr. 21, 2004 on British patent application No. 0404833.6.
Search and Examination Report dated Aug. 19, 2004 on British patent application No. 0404833.6.
Search and Examination Report dated May 17, 2004 on British patent application No. 0404837.7.
Examination Report dated Jul. 12, 2004 on British patent application No. 0404837.7.
Search and Examination Report dated May 14, 2004 on British patent application No. 0404839.3.
Search and Examination Report dated May 14, 2004 on British patent application No. 0404842.7.
Search and Examination Report dated May 14, 2004 on British patent application No. 0404845.0.
Search and Examination Report dated May 17, 2004 on British patent application No. 04048492.
Search and Examination Report dated Jun. 30, 2004 on British patent application No. 0411698.4.
Search and Examination Report dated Jul. 14, 2004 on British patent application No. 0411892.3.
Search and Examination Report dated Jul. 15, 2004 on British patent application No. 0411893.1.
Search and Examination Report dated Jul. 14, 2004 on British patent application No. 0411893.3.
Search and Examination Report dated Jun. 30, 2004 on British patent application No. 0411894.9.
Search and Examination Report dated Jul. 22, 2004 on British patent application No. 0412190.1.
Search and Examination Report dated Jul. 22, 2004 on British patent application No. 0412191.9.
Search and Examination Report dated Jul. 22, 2004 on British patent application No. 0412192.7.
Search and Examination Report dated Sep. 27, 2005 on British patent application No. 0412876.5.
Search and Examination Report dated Aug. 11, 2004 on British patent application No. 0416834.0.
Search and Examination Report dated Nov. 16, 2004 on British patent application No. 0416834.0.
Search and Examination Report dated Aug. 25, 2004 on British patent application No. 0417810.9.
Search and Examination Report dated Aug. 25, 2004 on British patent application No. 0417811.7.
Search and Examination Report dated Aug. 25, 2004 on British patent application No. 0418005.5.
Search and Examination Report dated Sep. 10, 2004 on British patent application No. 0418425.5.
Search and Examination Report dated Sep. 10, 2004 on British patent application No. 0418426.3.
Search and Examination Report dated Sep. 10, 2004 on British patent application No. 0418427.1.
Search and Examination Report dated Sep. 10, 2004 on British patent application No. 0418429.7.
Search and Examination Report dated Sep. 10, 2004 on British patent application No. 0418429.7.
Search and Examination Report dated Sep. 10, 2004 on British patent application No. 0418430.5.
Search and Examination Report dated Sep. 10, 2004 on British patent application No. 0418431.3.
Search and Examination Report dated Sep. 10, 2004 on British patent application No. 0418432.1.
Search and Examination Report dated Sep. 10, 2004 on British patent application No. 0418433.9.
Search and Examination Report dated Sep. 10, 2004 on British patent application No. 0418439.6.
Search and Examination Report dated Sep. 10, 2004 on British patent application No. 0418442.0.
Search and Examination Report dated Nov. 24, 2004 on British patent application No. 0422893.8.
Search and Examination Report dated Nov. 12, 2004 on British patent application No. 0423416.7.
Search and Examination Report dated Nov. 12, 2004 on British patent application No. 0423417.5.

Search and Examination Report dated Nov. 12, 2004 on British patent application No. 0423418.3.
Search and Examination Report dated Apr. 14, 2005 on British patent application No. 0425948.7.
Search and Examination Report dated Apr. 14, 2005 on British patent application No. 0425951.1.
Search and Examination Report dated Apr. 14, 2005 on British patent application No. 0425956.0.
Search and Examination Report dated Jan. 12, 2005 on British patent application No. 0426155.8.
Search and Examination Report dated Jan. 12, 2005 on British patent application No. 0426156.6.
Search and Examination Report dated Jan. 12, 2005 on British patent application No. 0426157.4.
Search and Examination Report dated Feb. 15, 2005 on British patent application No. 0500600.2.
Search and Examination Report dated Mar. 21, 2005 on British patent application No. 0503470.7.
Search and Examination Report dated Jul. 22, 2005 on British patent application No. 0505039.8.
Search and Examination Report dated May 20, 2005 on British patent application No. 0506697.2.
Search and Examination Report dated Jun. 26, 2006 on British patent application No. 0506699.8.
Search and Examination Report dated Sep. 20, 2005 on British patent application No. 0506700.4.
Search and Examination Report dated Jun. 26, 2006 on British patent application No. 0506702.0.
Search and Examination Report dated Jun. 19, 2006 on British patent application No. 0507980.1.
Search and Examination Report dated Sep. 27, 2005 on British patent application No. 0509618.5.
Search and Examination Report dated Sep. 27, 2005 on British patent application No. 0509620.1.
Search and Examination Report dated Sep. 27, 2005 on British patent application No. 0509626.8.
Search and Examination Report dated Sep. 27, 2005 on British patent application No. 0509627.6.
Search and Examination Report dated Sep. 27, 2005 on British patent application No. 0509529.2.
Search and Examination Report dated Sep. 27, 2005 on British patent application No. 0509630.0.
Search and Examination Report dated Sep. 27, 2005 on British patent application No. 0509631.8.
Search and Examination Report dated Jul. 26, 2005 on British patent application No. 0512396.3.
Search and Examination Report dated Jul. 27, 2005 on British patent application No. 0512398.9.
Search and Examination Report dated Nov. 7, 2005 on British patent application No. 0516429.8.
Search and Examination Report dated Nov. 8, 2005 on British patent application No. 0516430.6.
Search and Examination Report dated Nov. 8, 2005 on British patent application No. 0516431.4.
Search and Examination Report dated Apr. 3, 2006 on British patent application No. 0521931.6.
Search and,Examination Report dated Aug. 8, 2006 on British patent application No. 0522052.0.
Search and Examination Report dated Jan. 5, 2006 on British patent application No. 0522892.9.
Search and Examination Report dated Jan. 12, 2006 on British patent application No. 0523075.0.
Search and Examination Report dated Dec. 14, 2005 on British patent application No. 0523076.8.
Search and Examination Report dated Dec. 13, 2005 on British patent application No. 0523078.4.
Search and Examination Report dated Jan. 12, 2006 on British patent application No. 0523132.9.
Search and Examination Report dated Dec. 19, 2005 on British patent application No. 0524692.1.
Search and Examination Report dated Jan. 26, 2006 on British patent application No. 0525663.1.
Search and Examination Report dated Sep. 25, 2006 on British patent application No. 0602877.3.
Search and Examination Report dated Jul. 19, 2006 on British patent application No. 0609173.0.
Search and Examination Report dated Nov. 2, 2006 on British patent application No. 0613405.0.
Search and Examination Report dated Nov. 2, 2006 on British patent application No. 0613406.8.
Search Report dated Mar. 9, 2005 on British patent application No. 0415835.8.
Search Report dated Mar. 10, 2005 on British patent application No. 0415835.8.
Search Report dated Dec. 2, 2004 on British patent application No. 0415835.8.
Search Report dated Mar. 7, 2006 on British patent application No. 0519989.8.
Search Report dated Jul. 13, 2000 on British patent application No. 0003251.6.
Search Report dated Jan. 15, 2001 on British patent application No. 0004282.0.
Search Report dated Jul. 31, 2001 on British patent application No. 0004282.0.
Search Report dated Jul. 14, 2000 on British patent application No. 0004285.3.
Search Report dated Jan. 17, 2001 on British patent application No. 0004285.3.
Search Report dated Aug. 28, 2002 on British patent application No. 0004285.3.
Search Report dated Jul. 24, 2000 on British patent application No. 0005399.1.
Search Report dated Feb. 15, 2001 on British patent application No. 0005399.1.
Search Report dated Oct. 23, 2000 on British patent application No. 0013661.4.
Search Report dated Apr. 18, 2001 on British patent application No. 0013661.4.
Search Report dated Feb. 20, 2003 on British patent application No. 0013661.4.
Search Report dated Nov. 26, 2002 on British patent application No. 0219757.2.
Search Report dated Jan. 21, 2003 on British patent application No. 02197572.2
Search Report dated Dec. 6, 2002 on British patent application No. 0220872.6.
Search Report dated Mar. 13, 2003 on British patent application No. 0220872.6.
Examination Report dated Oct. 29, 2004 on British patent application No. 0220872.6.
Search Report dated Mar. 6, 2003 on British patent application No. 0225505.7.
Examination Report dated Oct. 27, 2004 on British patent application No. 0225505.7.
Search Report dated Apr. 24, 2006 on British patent application No. 0507980.1.
Search Report dated Mar. 27, 2000 on British patent application No. 9926449.1.
Search Report dated Mar. 30, 2000 on British patent application No. 9926449.1.
Search Report dated Jul. 4, 2001 on British patent application No. 9926449.1.
Search Report dated Sep. 5, 2001 on British patent application No. 9926449.1.
Search Report dated Feb. 28, 2000 on British patent application No. 9926450.9.
Search Report dated May 15, 2000 on British patent application No. 9926450.9.
Search Report dated Nov. 22, 2002 on British patent application No. 9926450.9.
Search Report dated Jun. 27, 2000 on British patent application No. 9930398.4.
Examination Report dated Feb. 15, 2007 on Norwegian patent application No. 1999 5991.

Examination Report dated Sep. 20, 2006 on Norwegian patent application No. 2000 2876.
Examination Report dated Jan. 24, 2007 on Norwegian patent application No. 2002 0070.
Search Report dated Aug. 20, 2002 on Norwegian patent application 1999 5593.
Search Report dated May 13, 2006 on Norwegian patent application No. 2002 1613.
Search Report dated May 29, 2006 on Norwegian patent application No. 2002 3885.
Combined Search Report and Written Opinion dated Apr. 17, 2006 on PCT/US05/28869.
International Preliminary Examination Report dated Sep. 4, 2003 on PCT/US01/28960.
International Preliminary Examination Report dated Aug. 6, 2004 on PCT/US02/24399.
International Preliminary Examination Report dated Jun. 1, 2005 on PCT/US02/25608.
International Preliminary Examination Report dated Jul. 7, 2004 on PCT/US02/25727.
International Preliminary Examination Report dated Apr. 14, 2004 on PCT/US02/36157.
International Preliminary Examination Report dated Jan. 4, 2005 on PCT/US02/36267.
International Preliminary Examination Report dated Feb. 18, 2005 on PCT/US02/39418.
International Preliminary Examination Report dated Nov. 8, 2005 on PCT/US02/39425.
International Preliminary Examination Report dated Dec. 9, 2004 on PCT/US03/04837.
International Preliminary Examination Report dated May 10, 2005 on PCT/US03/06544.
International Preliminary Examination Report dated Jul. 7, 2004 on PCT/US03/10144.
International Preliminary Examination Report dated Aug. 15, 2005 on PCT/US03/11765.
International Preliminary Examination Report dated Sep. 16, 2004 on PCT/US03/11765.
International Preliminary Examination Report dated Dec. 10, 2004 on PCT/US03/11765.
International Preliminary Examination Report dated Jul. 18, 2005 on PCT/US03/11765.
International Preliminary Examination Report dated Mar. 2, 2005 on PCT/US03/13787.
International Preliminary Examination Report dated Apr. 7, 2005 on PCT/US03/13787.
International Preliminary Examination Report dated May 12, 2005 on PCT/US03/14153.
International Preliminary Examination Report dated Nov. 14, 2005 on PCT/US03/15020.
International Preliminary Examination Report dated May 9, 2005 on PCT/US03/15020.
International Preliminary Examination Report dated Sep. 30, 2004 on PCT/US03/20870.
International Preliminary Examination Report dated May 25, 2005 on PCT/US03/25667.
International Preliminary Examination Report dated Aug. 30, 2005 on PCT/US03/25675.
International Preliminary Examination Report dated Aug. 17, 2004 on PCT/US03/25676.
International Preliminary Examination Report dated Aug. 17, 2004 on PCT/US03/25677.
International Preliminary Examination Report dated Dec. 20, 2004 on PCT/US03/25742.
International Preliminary Examination Report dated Dec. 8. 2004 on PCT/US03/29460.
International Preliminary Examination Report dated May 23, 2005 on PCT/US03/29858.
International Preliminary Examination Report dated Aug. 16, 2004 on PCT/US03/29859.
International Preliminary Examination Report dated May 23, 2005 on PCT/US03/38550.
International Preliminary Report on Patentability, Application PCT/US04/00631, Mar. 2, 2006.
International Preliminary Report on Patentability, Application PCT/US04/11973, Dec. 27, 2006.
International preliminary Report on Patentability, Application PCT/US04/02122, May 13, 2005.
International Preliminary Report on Patentability, Application PCT/US04/04740, Jun. 27, 2006.
International Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Mar. 17, 2003.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/08170, Jan. 13, 2005.
International Preliminary Report on Patentability, Application PCT/US04/08170, Sep. 29, 2005.
International Preliminary Report on Patentability, Application PCT/US04/08171, Sep. 13, 2005.
International Preliminary Report on Patentability, Application PCT/US04/10317, Jun. 23, 2006.
International Preliminary Report on Patentability, Application PCT/US04/11177, Jun. 9, 2005.
International Preliminary Report on Patentability, Application PCT/US04/28423, Jul. 13, 2005.
International Preliminary Report on Patentability, Application PCT/US04/28423, Jun. 19, 2006.
International Preliminary Report on Patentability, Application PCT/US04/28438, Sep. 20, 2005.
International Preliminary Report on Patentability, Application PCT/US04/28438, Sep. 20, 2005.
International Preliminary Report on Patentability, Application PCT/US04/28887, Sep. 27, 2006.
International Preliminary Report on Patentability, Application PCT/US04/28889, Aug. 1, 2006.
International Preliminary Report on Patentability, Application PCT/US05/28642, Jul. 2006, .
International Preliminary Report on Patentability, Application PCT/US05/28819, Feb. 12, 2007.
International Search Report, Application PCT/IL00/00245, Sep. 18, 2000.
International Search Report, Application PCT/US00/18635, Nov. 24, 2000.
International Search Report, Application PCT/US00/27645, Dec. 19, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application. PCT/US01/30256, Jan. 3, 2002.
International Search Report, Application PCT/US01/41446, Oct. 30, 2001.
International Search Report, Application PCT/US02/00093, May 30, 2002.
International Search Report.Application PCT/US02/00093, Aug. 6, 2002.
International Search Report, Application PCT/US02/00677, Jul. 17, 2002.

International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477, Oct. 31, 2003.
International Search Report, Application PCT/US02/20477, Apr. 6, 2004.
International Search Report, Application PCT/US02/24399, Feb. 20, 2004.
International Search Report, Application PCT/US02/24399, Feb. 27, 2004.
International Search Report, Application PCT/US02/24399, Aug. 6, 2004.
International Search Report, Application PCT/US02/25608, May 24, 2004.
International Search Report, Application PCT/US02/25727, Feb. 19, 2004.
Examination Report, Application PCT/US02/25727, Jul. 7, 2004.
International Search Report, Application PCT/US02/29856, Dec. 16, 2002.
International Search Report, Application PCT/US02/36157, Sep. 29, 2003.
International Search Report, Application PCT/US02/36267, May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144, Oct. 31, 2003.
International Search Report, Application PCT/US03/11765, Nov. 13, 2003.
International Search Report, Application PCT/US03/13787, May 28, 2004.
International Search Report, Application PCT/US03/14153, May 28, 2004.
International Search Report, Application PCT/US03/15020, Nov. 14, 2005.
International Search Report, Application PCT/US03/15020, Jul. 30, 2003.
International Search Report, Application PCT/US03/18530, Jun. 24, 2004.
International Search Report, Application PCT/US03/19993, May 24, 2004.
International Search Report, Application PCT/US03/20694, Nov. 12, 2003.
International Search Report, Application PCT/US03/20870, May 24, 2004.
International Search Report, Application PCT/US03/20870, Sep. 30, 2004.
International Search Report, Application PCT/US03/24779, Mar. 3, 2004.
International Search Report, Application PCT/US03/25667, Feb. 26, 2004.
International Search Report, Application PCT/US03/25675, May 25, 2004.
International Search Report, Application PCT/US03/25676, May 17, 2004.
International Search Report, Application PCT/US03/25677, May 21, 2004.
International Search Report, Application PCT/US03/25707, Jun. 23, 2004.
International Search Report, Application PCT/US03/25715, Apr. 9, 2004.
International Search Report, Application PCT/US03/25716, Jan. 16, 2005.
International Search Report, Application PCT/US03/25742, May 27, 2004.
International Search Report, Application PCT/US03/29460, May 25, 2004.
International Search Report, Application PCT/US03/29858, Jun. 30, 2004.
International Search Report, Application PCT/US03/29859, May 21, 2004.
International Search Report, Application PCT/US03/38550, Jun. 15, 2004.
International Search Report, Application PCT/US04/00631, Mar. 28, 2005.
International Search Report, Application PCT/US04/10317, May 25, 2006.
International Search Report, Application PCT/US04/28831, Dec. 19, 2005.
International Search Report, Application PCT/US04/28889, Nov. 14, 2005.
International Search Report, Application PCT/US05/28669, Apr. 17, 2006.
International Search Report and Written Opinion, Application PCT/US04/26345, Oct. 5, 2006.
International Search Report and Written Opinion, Application PCT/US05/28446, Oct. 27, 2006.
International Search Report and Written Opinion, Application PCT/US06/02449, Oct. 24, 2006.
International Search Report and Written Opinion, Application PCT/US04/10762, Sep. 1, 2005.
International Search Report and Written Opinion, Application PCT/US04/00631, Mar. 28, 2005.
International Search Report and Written Opinion, Application PCT/US04/02122, Feb. 24, 2005.
International Search Report and Written Opinion, Application PCT/US04/04740, Jan. 19, 2005.
International Search Report and Written Opinion, Application PCT/US04/06246, Jan. 26, 2005.
International Search Report and Written Opinion, Application PCT/US04/07711, Nov. 28, 2006.
International Search Report and Written Opinion, Application PCT/US04/08030, Jan. 6, 2005.
International Search Report and Written Opinion, Application PCT/US04/08073, Mar. 4, 2005.
International Search Report and Written Opinion, Application PCT/US04/08170, Jan. 13, 2005.
International Search Report and Written Opinion, Application PCT/US04/08171, Feb. 16, 2005.
International Search Report and Written Opinion, Application PCT/US04/11177, Feb. 14, 2005.
International Search Report and Written Opinion, Application PCT/US04/11973, Sep. 27, 2005.
International Search Report and Written Opinion, Application PCT/US04/28423, Jul. 13, 2005.
International Search Report and Written Opinion, Application PCT/US04/28438, Mar. 14, 2005.
International Search Report and Written Opinion, Application PCT/US05/28473, Sep. 1, 2006.
International Search Report and Written Opinion, Application PCT/US05/28642, Jul. 14, 2006.
International Search Report and Written Opinion, Application PCT/US05/28819, Aug. 3, 2006.
International Search Report and Written Opinion, Application PCT/US06/04809, Aug. 29, 2006.
International Search Report and Written Opinion, Application PCT/US06/09886, Dec. 4, 2006.
Written Opinion, Application PCT/US01/19014, Dec. 10, 2002.
Written Opinion, Application PCT/US01/23815, Jul. 25, 2002.
Written Opinion, Application PCT/US01/28960, Dec. 2, 2002.
Written Opinion, Application PCT/US01/30256, Nov. 11, 2002.
Written Opinion, Application PCT/US01/30256, Nov. 27, 2002.
Written Opinion, Application PCT/US02/00093, Apr. 21, 2003.
Written Opinion, Application PCT/US02/00677, Apr. 17, 2003.

Written Opinion, Application PCT/US02/04353, Apr. 11, 2003.
Written Opinion, Application PCT/US02/20256, May 9, 2003.
Written Opinion, Application PCT/US02/24399, Apr. 28, 2004.
Written Opinion, Application PCT/US02/25608, Sep. 13, 2004.
Written Opinion, Application PCT/US02/25608, Feb. 2, 2005.
Written Opinion, Application PCT/US02/25727, May 17, 2004.
Written Opinion, Application PCT/US02/39418, Jun. 9, 2004.
Written Opinion, Application PCT/US02/39425, Nov. 22, 2004.
Written Opinion, Application PCT/US02/39425, Apr. 11, 2005.
Written Opinion, Application PCT/US03/06544, Feb. 18, 2005.
Written Opinion, Application PCT/US03/11765, May 11, 2004.
Written Opinion, Application PCT/US03/13787, Nov. 9, 2004.
Written Opinion, Application PCT/US03/14153, Sep. 9, 2004.
Written Opinion, Application PCT/US03/14153, Nov. 9, 2004.
Written Opinion, Application PCT/US03/18530, Sep. 13, 2004.
Written Opinion, Application PCT/US03/19993, Oct. 15, 2004.
Written Opinion, Application PCT/US03/25675, May 9, 2005.
Written Opinion, Application PCT/US03/29858, Jan. 21, 2005.
Written Opinion, Application PCT/US03/38550, Dec. 10, 2004.
Written Opinion, Application PCT/US04/08171, May 5, 2005.
Written Opinion, Application PCT/US04/29025, Jan. 4, 2007.
Examination Report dated Oct. 13, 2006 on Australian Patent Application No. 200400246.
Examination Report dated Sep. 22, 2006 on Australian Patent Application No. 2004200248.
Examination Report dated Mar. 7, 2007 on Australian Patent Application No. 2002367017.
Examination Report dated Jun. 5, 2007 on Brazilian patent application No. PI 9906143-0.
Examination Report dated Oct. 16, 2007 on Brazilian patent application No. PI 0003319-7.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.
Examination Report dated Feb. 26, 2007 on Canadian Patent Application No. 2389094.
Examination Report dated Oct. 11, 2007 on European Patent Application No. 2806451.7.
Examination Report dated Jul. 4, 2007 on European Patent Application No. 3728326.4.
Examination Report dated Apr. 2, 2007 on European Patent Application No. 37012812.
Examination Report dated Jan. 10, 2007 on European Patent Application No. 3723674.2.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.0.
Examination Report dated Sep. 13, 2007 on British Patent application No. 604360.8.
Examination Report dated Aug. 7, 2007 on British Patent application No. 613924.0.
Examination Report dated May 23, 2007 on British patent application No. 621060.3.
Examination Report dated Jul. 23, 2007 on British patent application No. 621060.3.
Examination Report dated Jun. 21, 2007 on British:patent application No. 621059.5.
Examination Report dated Aug. 8, 2007 on British patent application No. 621059.5.
Examination Report dated Jun. 21, 2007 on British patent application No. 621053.8.
Examination Report dated Aug. 13, 2007 on British patent application No. 621053.8.
Examination Report dated Aug. 17, 2007 on British patent application No. 603576.
Examination Report dated Aug. 7, 2007 on British patent application No. 613924.
Examination Report dated May 23, 2007 on British patent application No. 621062.9.
Examination Report dated Jul. 23, 2007 on British patent application No. 621062.9.
Examination Report dated Apr. 5, 2007 on British patent applidetion No. 613406.8.
Examination Report dated Jun. 22, 2007 on British patent application No. 609173.
Examination Report dated Sep. 14, 2007 on British patent application No. 623634.3.
Examination Report dated Jul. 5, 2007 on British patent application No. 624328.1.
Examination Report dated Sep. 4, 2007 on British patent application No. 624328.1.
Examination Report dated Oct. 26, 2007 on British patent application No. 624328.1.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5.
Examination Report dated Aug. 15, 2007 on British patent application No. 625615.
Examination Report dated Jul. 26, 2007 on British patent application No. 522049.6.
Examination Report dated Mar. 5, 2007 on British patent application No. 522049.6.
Examination Report dated Sep. 7, 2007 on British patent application No. 522049.6.
Examination Report dated Aug. 16, 2007 on British patent application No. 625636.6.
Examination Report dated Jul. 16, 2007 on British patent application No. 522155.1.
Examination Report dated Sep. 26, 2007 on British patent application No. 624781.1.
Search and Examination Report dated Aug. 16, 2007 on British patent application No. 621054.6.
Search and Examination Report dated Oct. 5, 2007 on British patent application No. 623631.9.
Search and Examination Report dated Mar. 30, 2007 on British patent application No. 702797.2.
iSearch and Examination Report dated Aug. 2, 2007 on British Patent application No. 702797.2.
Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.

Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Oct. 10, 2007 on British patent application No. 603995.2.
Search and Examination Report dated Mar. 15, 2007 on British patent application No. 6043593.
Seardh and Examination Report dated Mar. 15, 2007 on British patent application No. 604360.8.
Search Report dated Jun. 6, 2007 on British patent application No. 613406.8.
Substantive Examination dated Jul. 25, 2007 on Mexican patent application No. PA/A/2004/006681.
Examination Report dated Oct. 5, 2007 on Mexican patent application No. PA/A/2005/003117.
Examination Report dated Oct. 16, 2007 on Mexican patent application No. PA/A/2005/003116
Examination Report dated Oct. 5, 2007 on Mexican patent application No. PA/A/2004/007922.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent application No. 20000924.
International Preliminary Exam Report dated May 23, 2007 on International patent application No. PCT/US06/009886.
Written Opinion of ISA dated Aug. 2, 2007 on International patent application No. PCT/US05/028451.
Search Report of ISA dated Aug. 2, 2007 on International patent application No. PCT/US05/028451.

* cited by examiner

APPARATUS FOR RADIALLY EXPANDING AND PLASTICALLY DEFORMING A TUBULAR MEMBER

CROSS REFERENCE TO RELATED APPLICATIONS

The present application is a continuation-in-part of U.S. patent application Ser. No. 10/546,548, filed on Aug. 23, 2005, now U.S. Pat. No. 7,438,133, which is (1) a continuation-in-part of U.S. patent application Ser. No. 10/351,160, filed on Jan. 22, 2003, which issued as U.S. Pat. No. 6,976,541 on Dec. 20, 2005; and (2) the U.S. National Stage patent application for International patent application number PCT/US2004/006246, filed on Feb. 26, 2004, which claimed the benefit of the filing date of U.S. provisional patent application No. 60/450,504, filed on Feb. 26, 2003, the entire disclosures of which are incorporate herein by reference.

BACKGROUND

The present disclosure relates generally to oil and gas exploration, and in particular to forming and repairing wellbore casings to facilitate oil and gas exploration.

DETAILED DESCRIPTION

Figure 1:
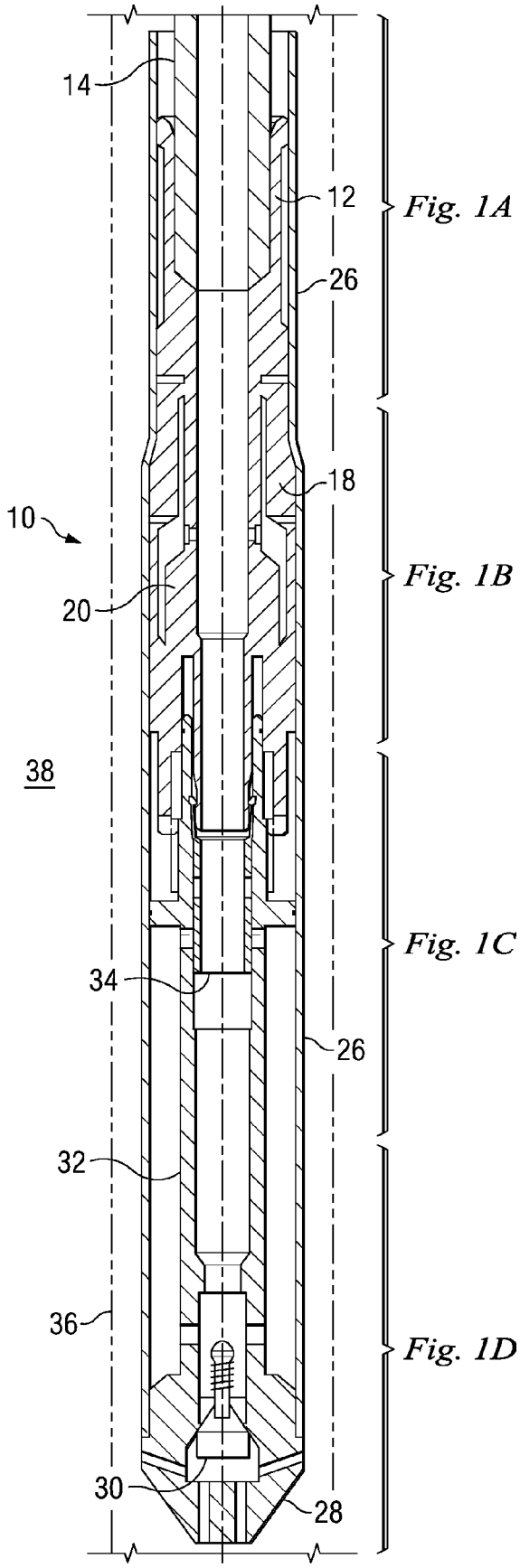
FIGS. 1, 1*a*, 1*b*, 1*c*, and 1*d* are fragmentary cross-sectional illustrations of an exemplary embodiment of an apparatus for radially expanding and plastically deforming a tubular member during the placement of the apparatus within a wellbore.
Figure 1A:
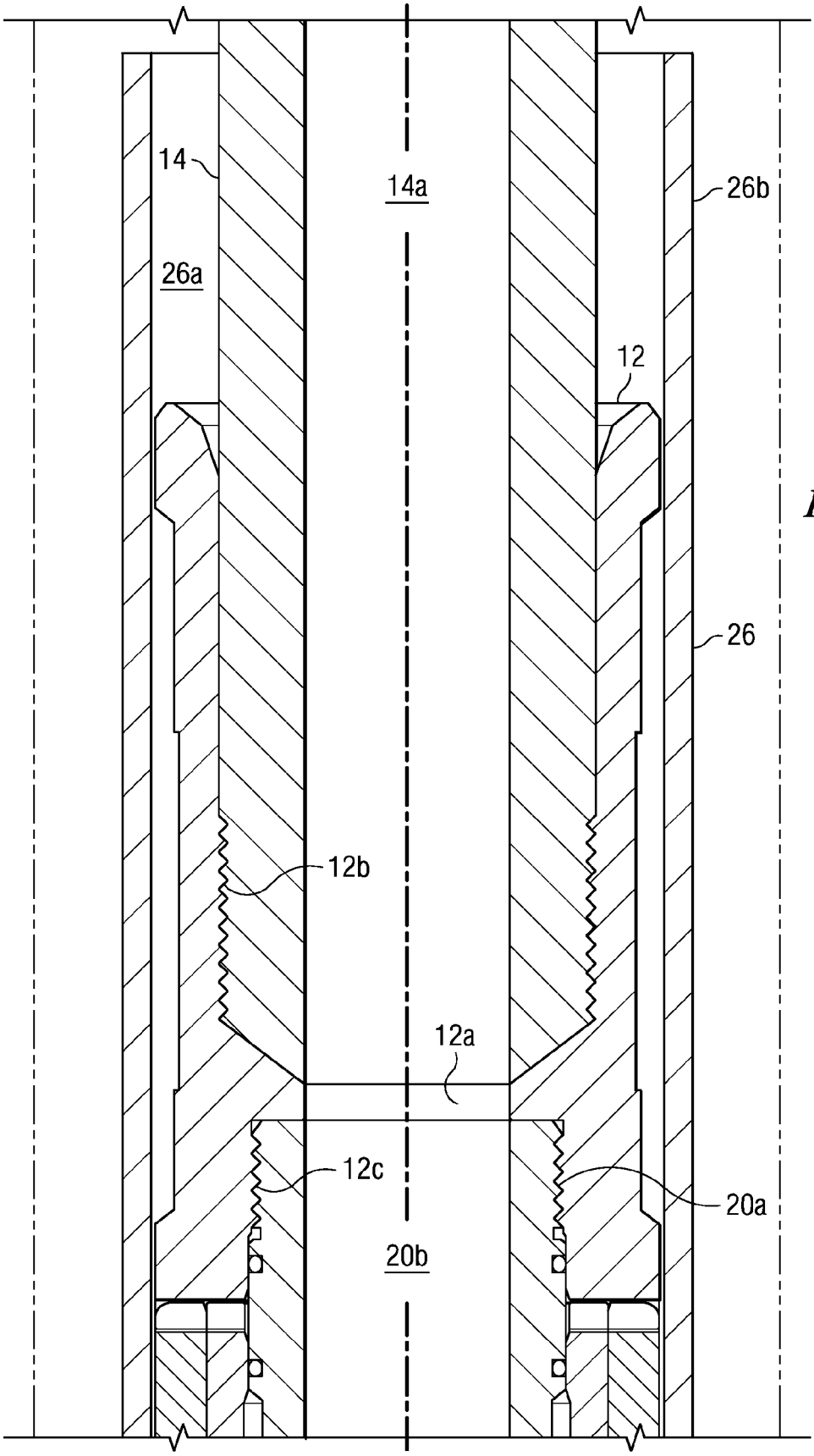
Figure 1B:
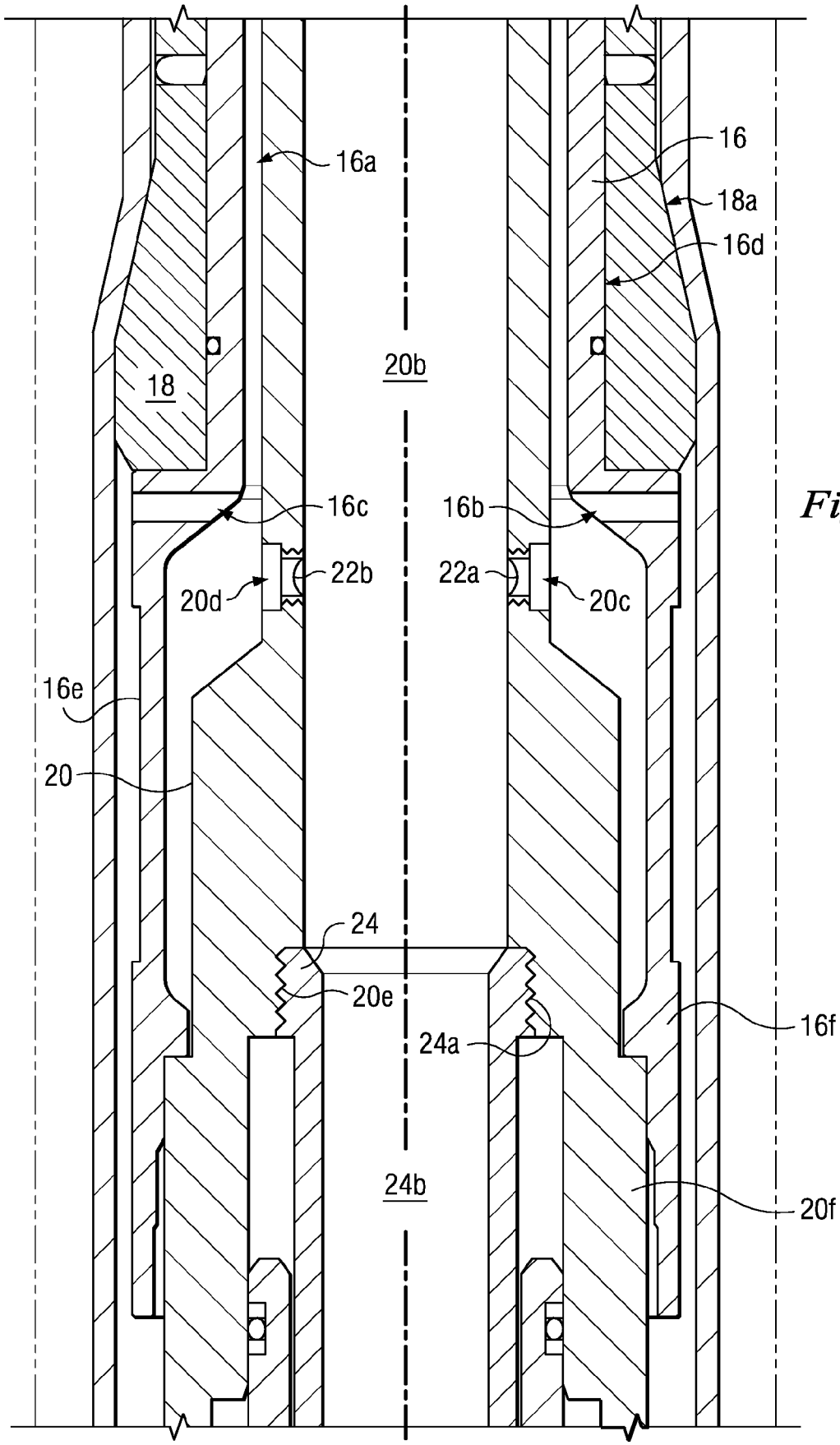
Figure 1C:
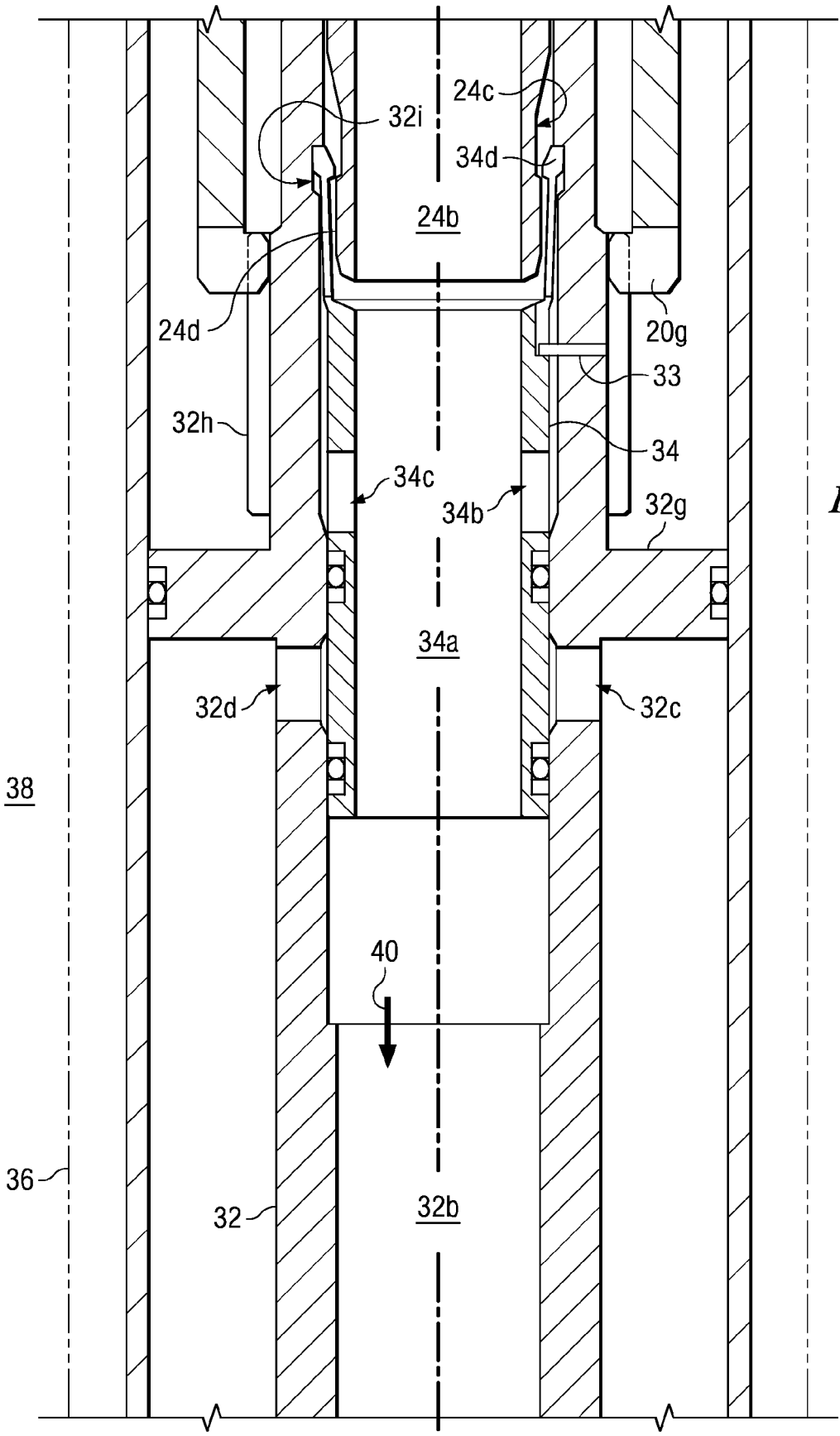
Figure 1D:
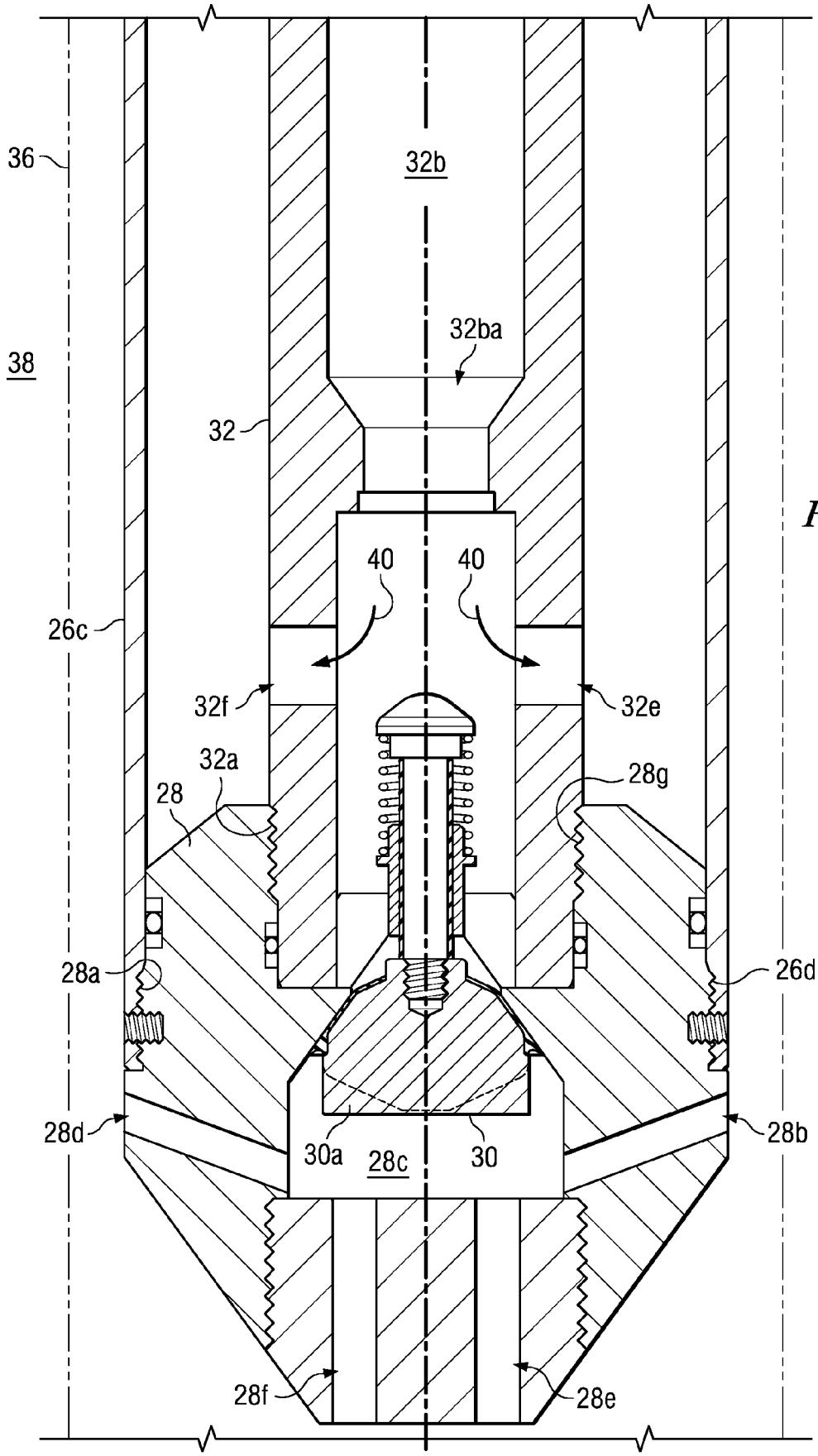
Figure 2:
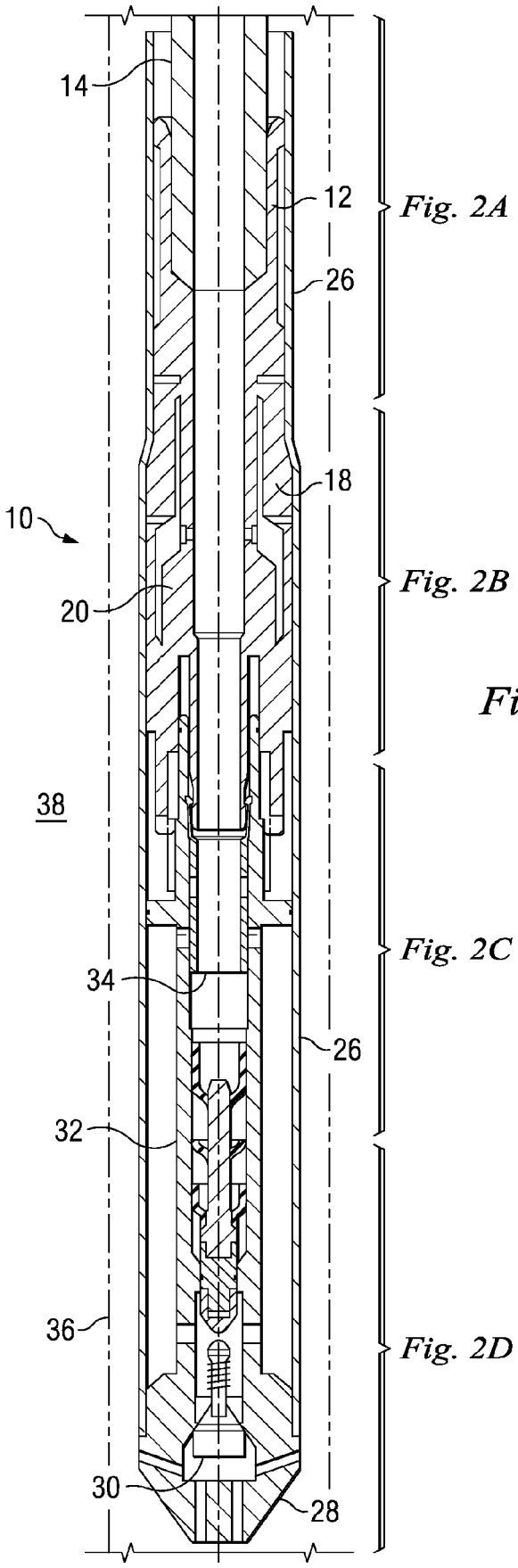
FIGS. 2, 2*a*, 2*b*, 2*c*, and 2*d* are fragmentary cross-sectional illustrations of the apparatus of FIGS. 1, 1*a*, 1*b*, 1*c*, and 1*d* during the radial expansion and plastic deformation of the tubular member.
Figure 2A:
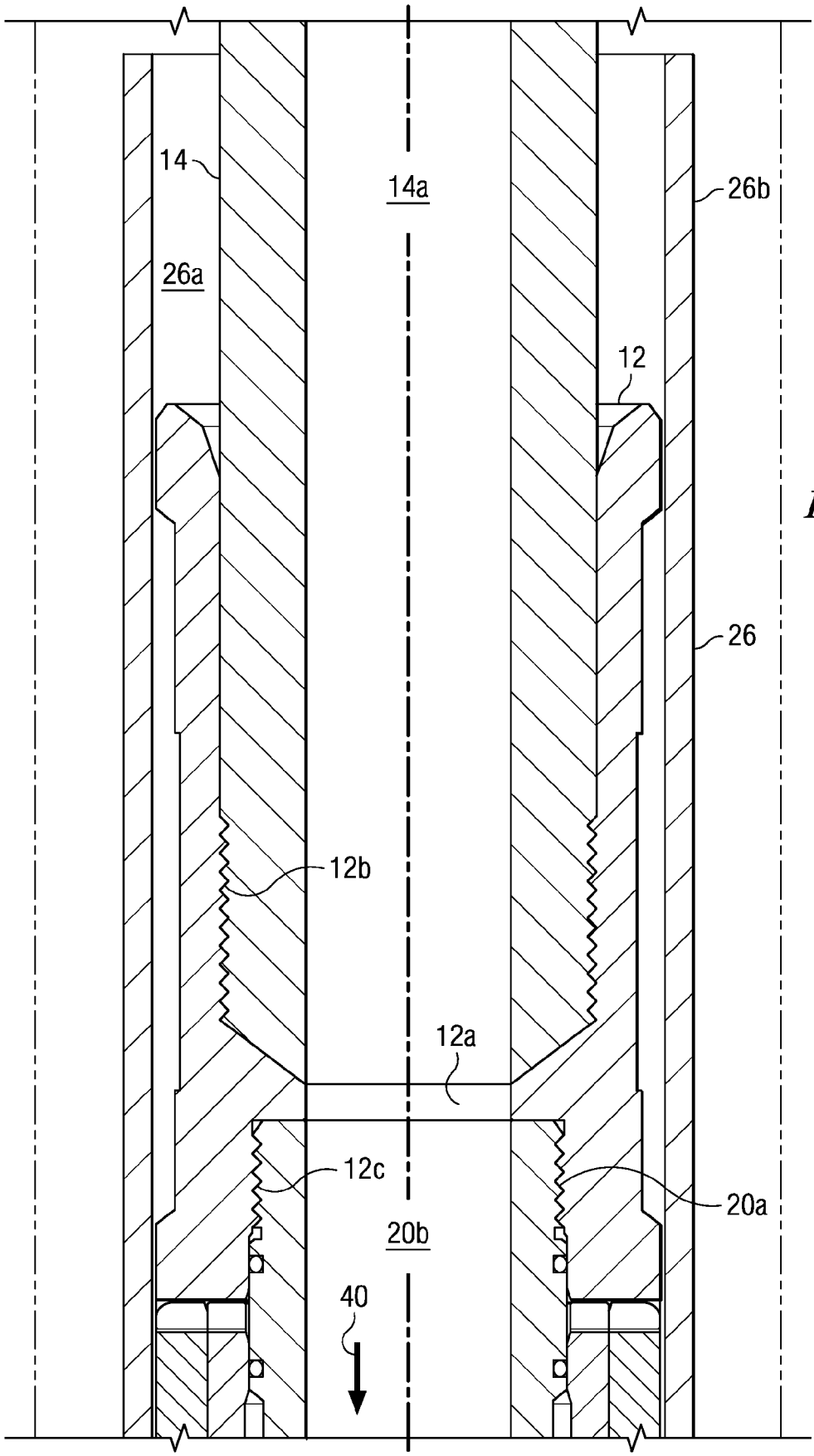
Figure 2B:
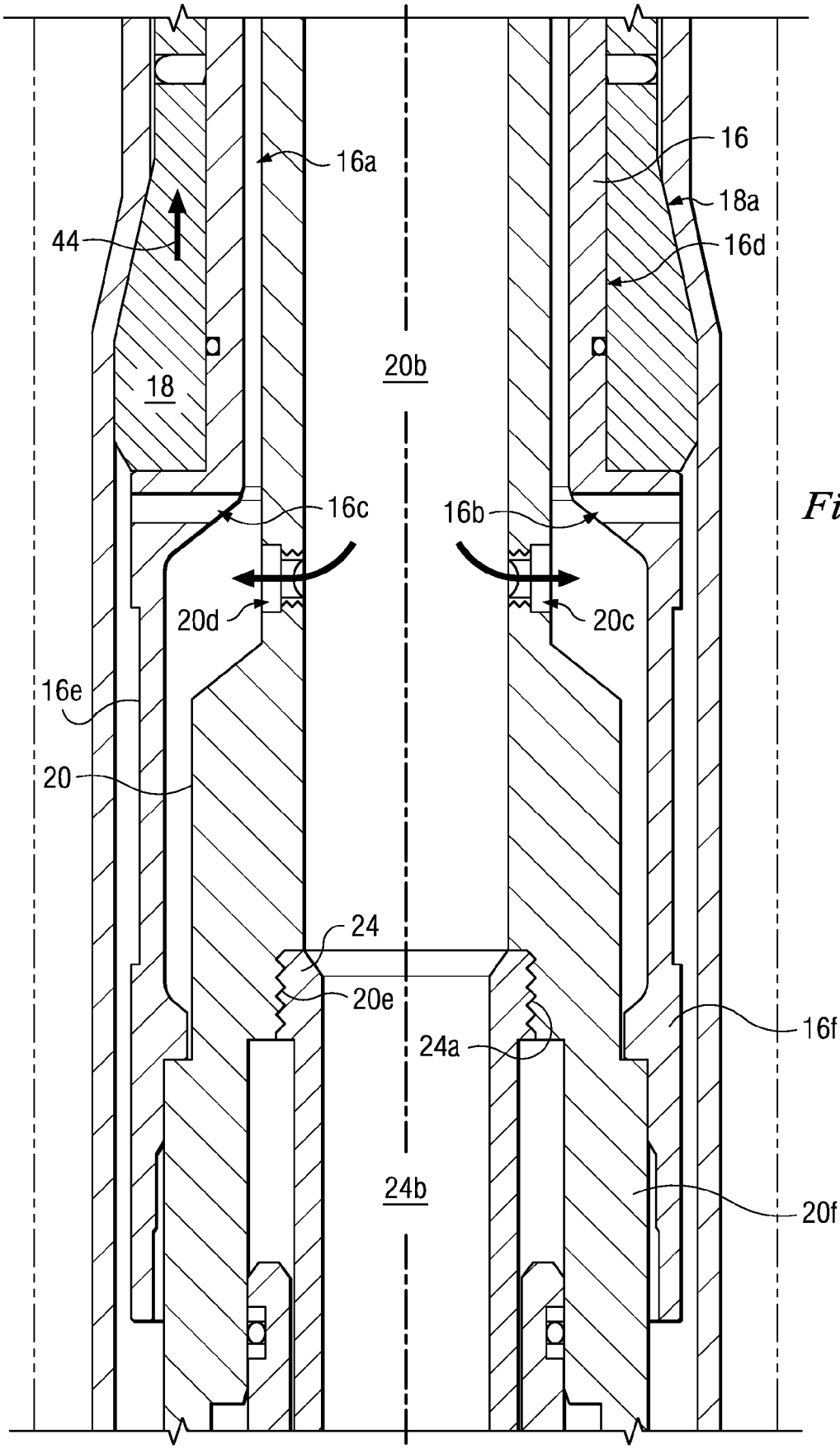
Figure 2C:
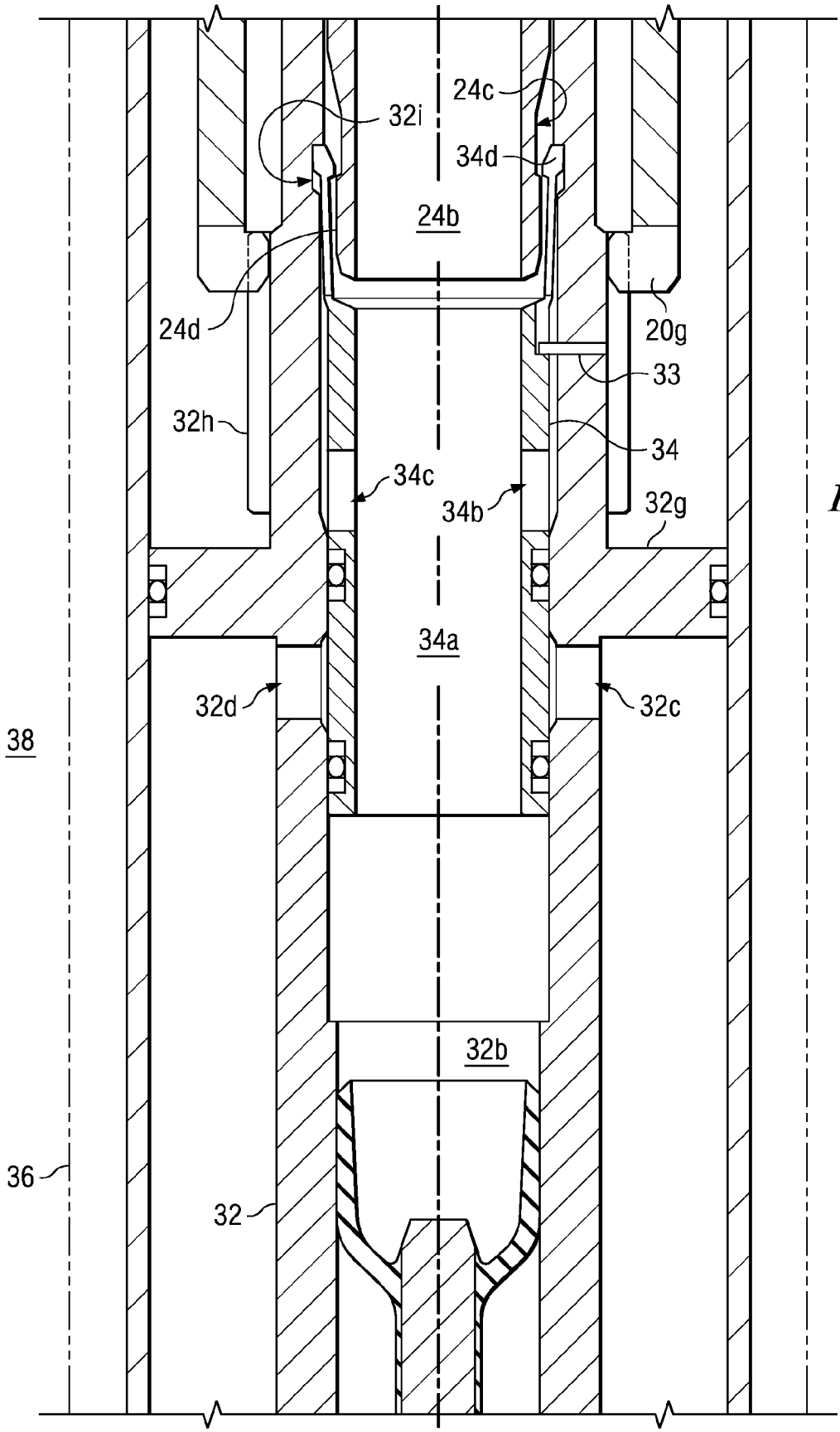
Figure 2D:
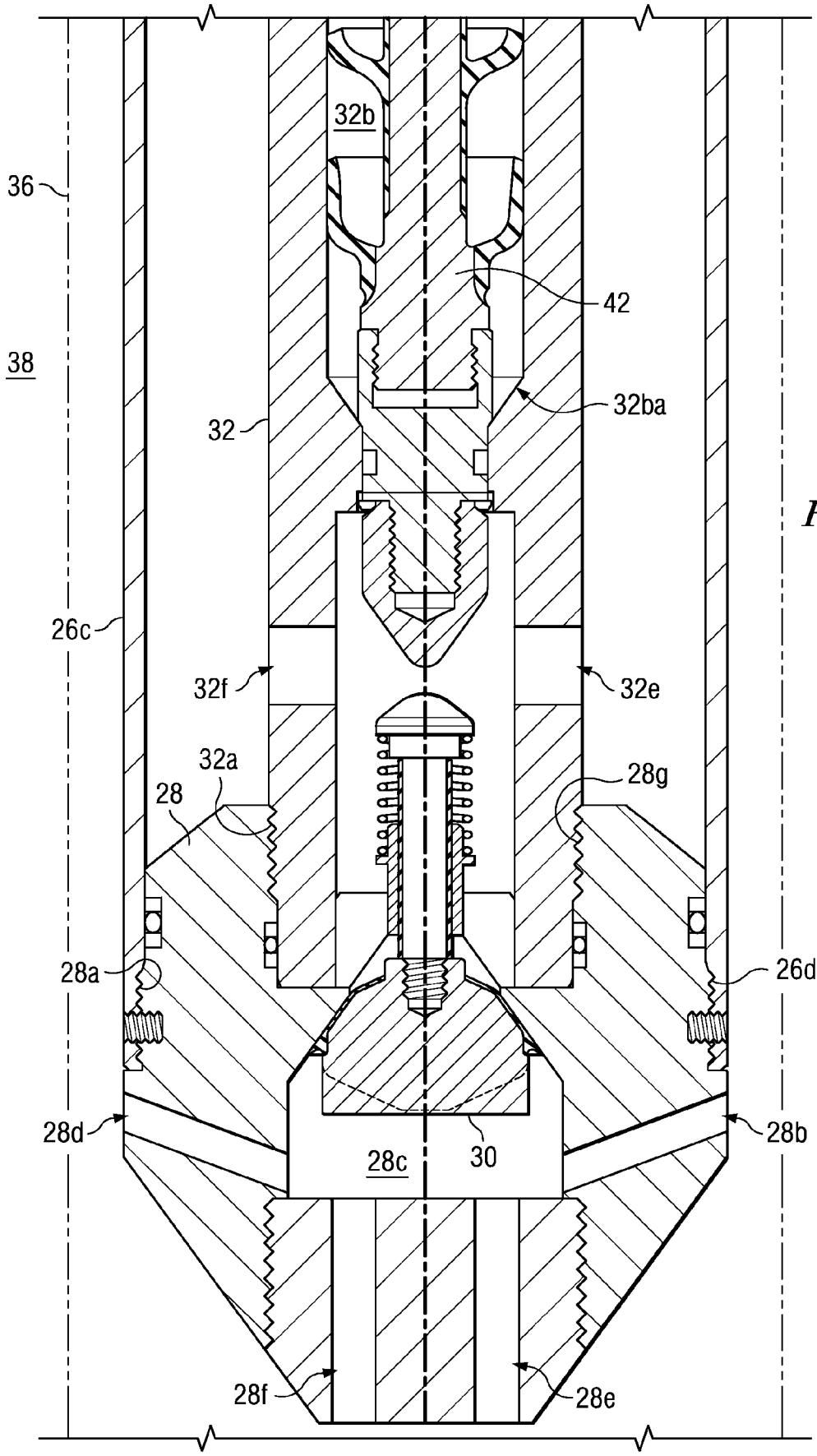
Figure 3:
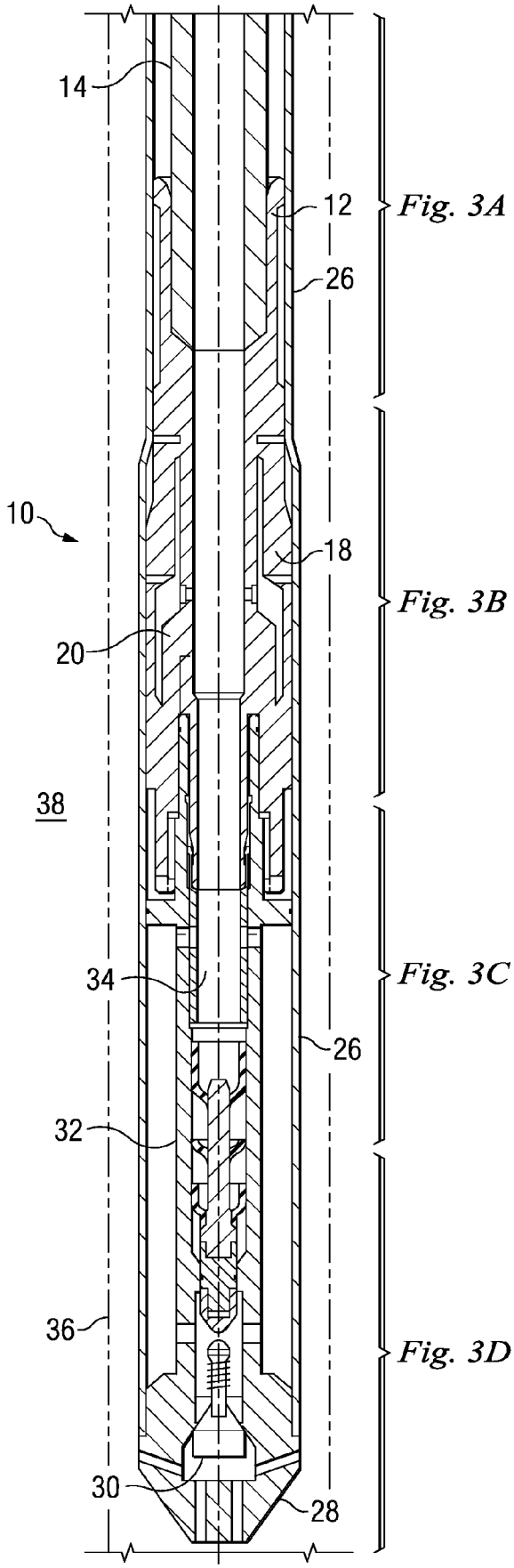
FIGS. 3, 3*a*, 3*b*, 3*c*, and 3*d* are fragmentary cross-sectional illustrations of the apparatus of FIGS. 1, 1*a*, 1*b*, 1*c*, and 1*d* during the injection of a hardenable fluidic sealing material into an annulus between the exterior of the apparatus and the wellbore.
Figure 3A:
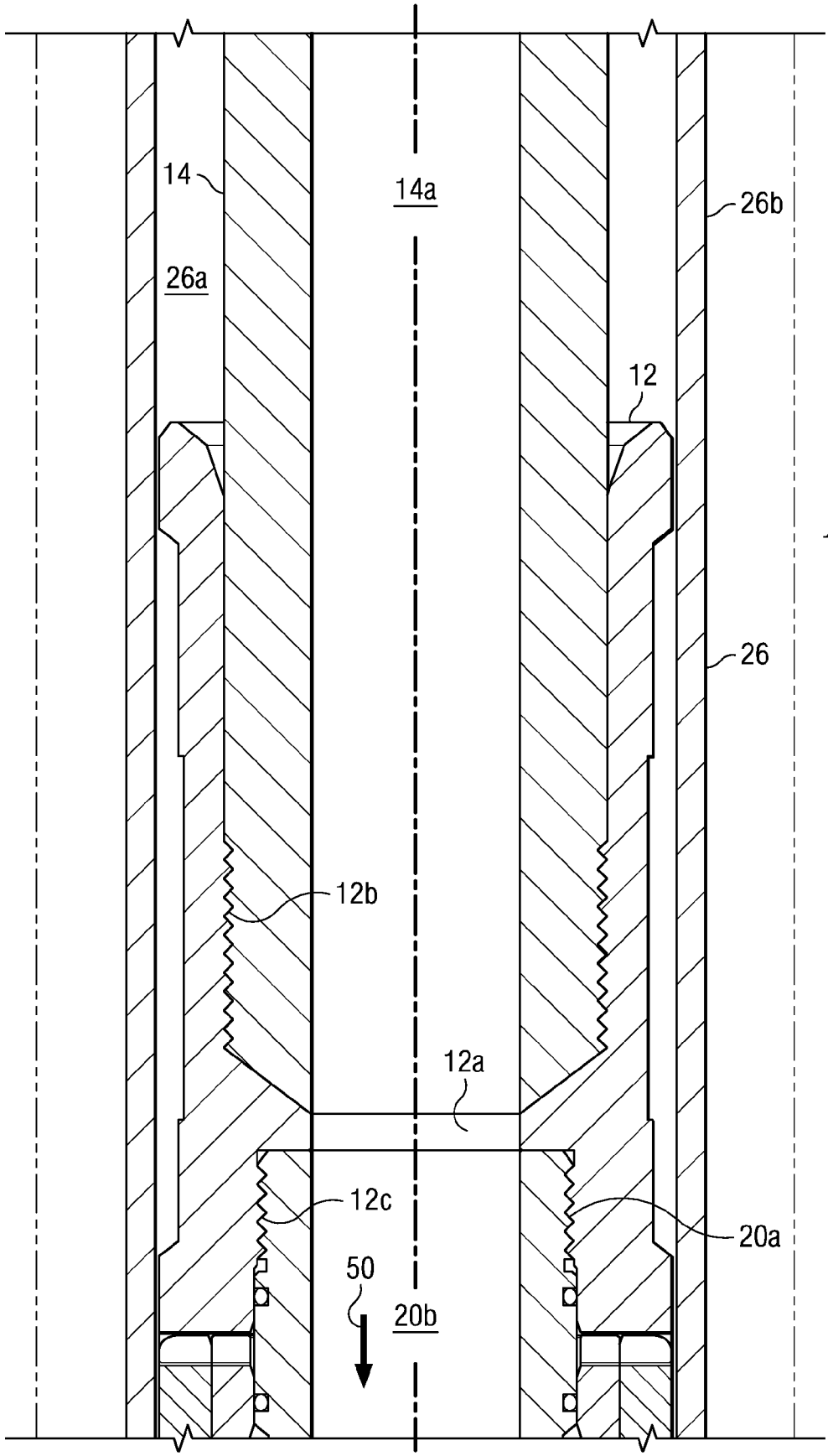
Figure 3B:
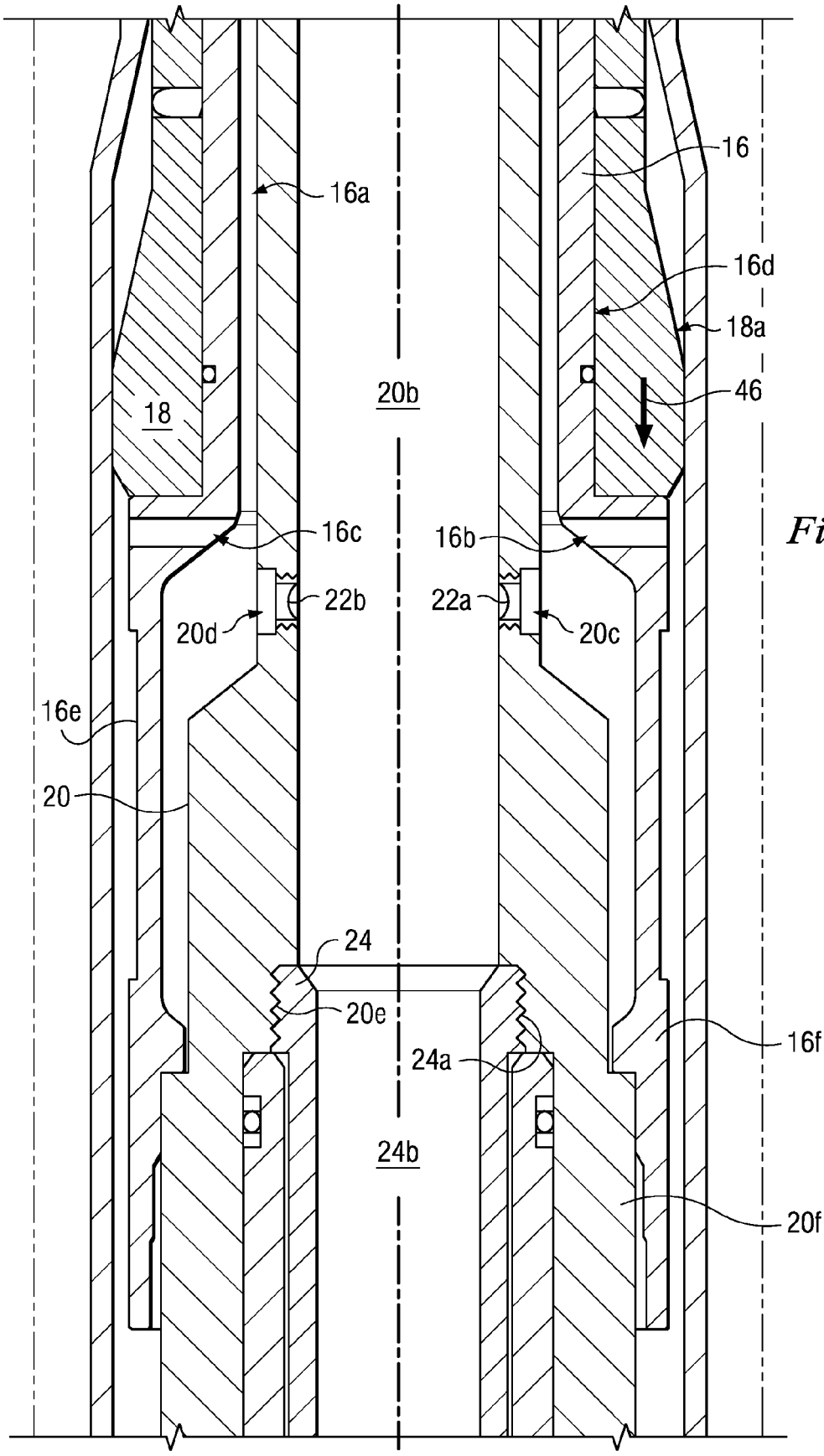
Figure 3C:
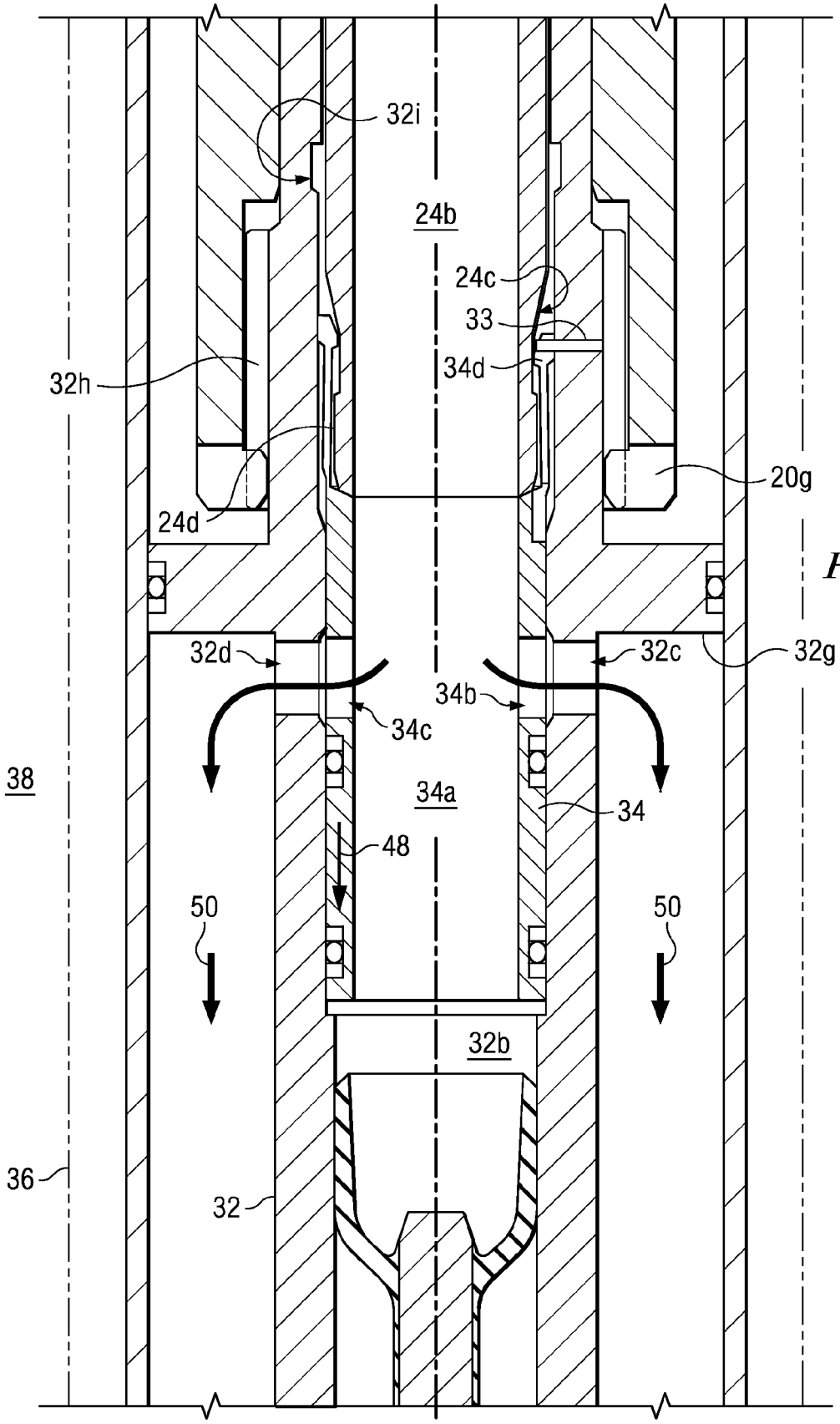
Figure 3D:
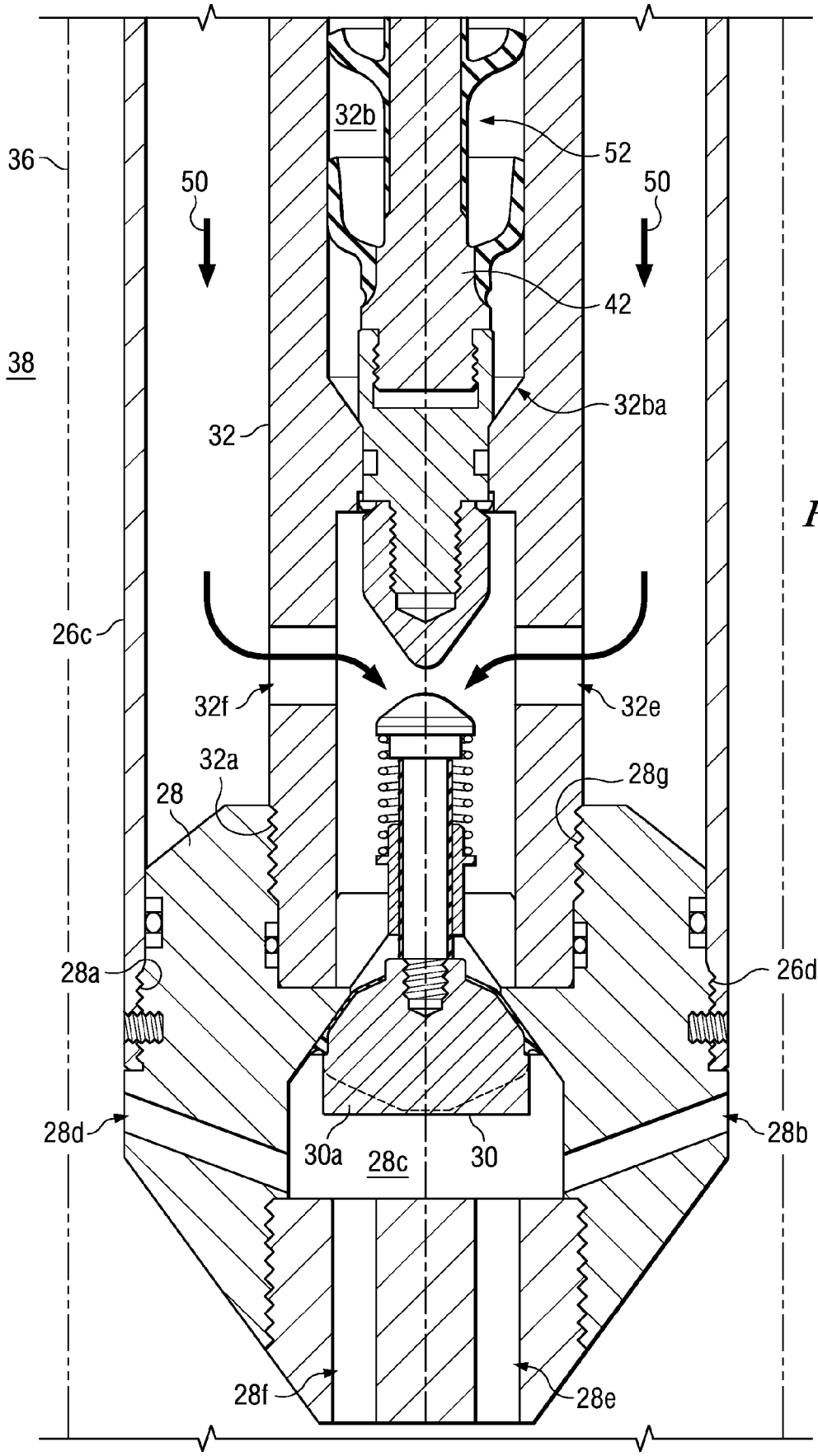
Figure 4:
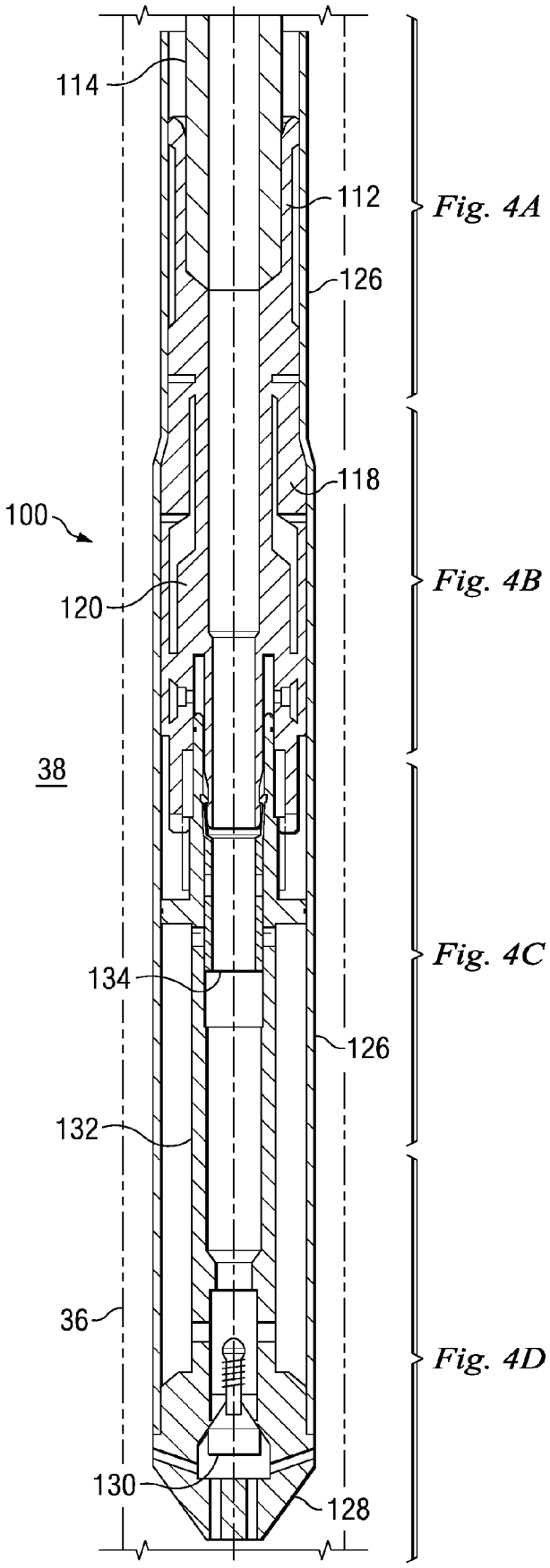
FIGS. 4, 4*a*, 4*b*, 4*c*, and 4*d* are fragmentary cross-sectional illustrations of an exemplary embodiment of an apparatus for radially expanding and plastically deforming a tubular member during the placement of the apparatus within a wellbore.
Figure 4A:
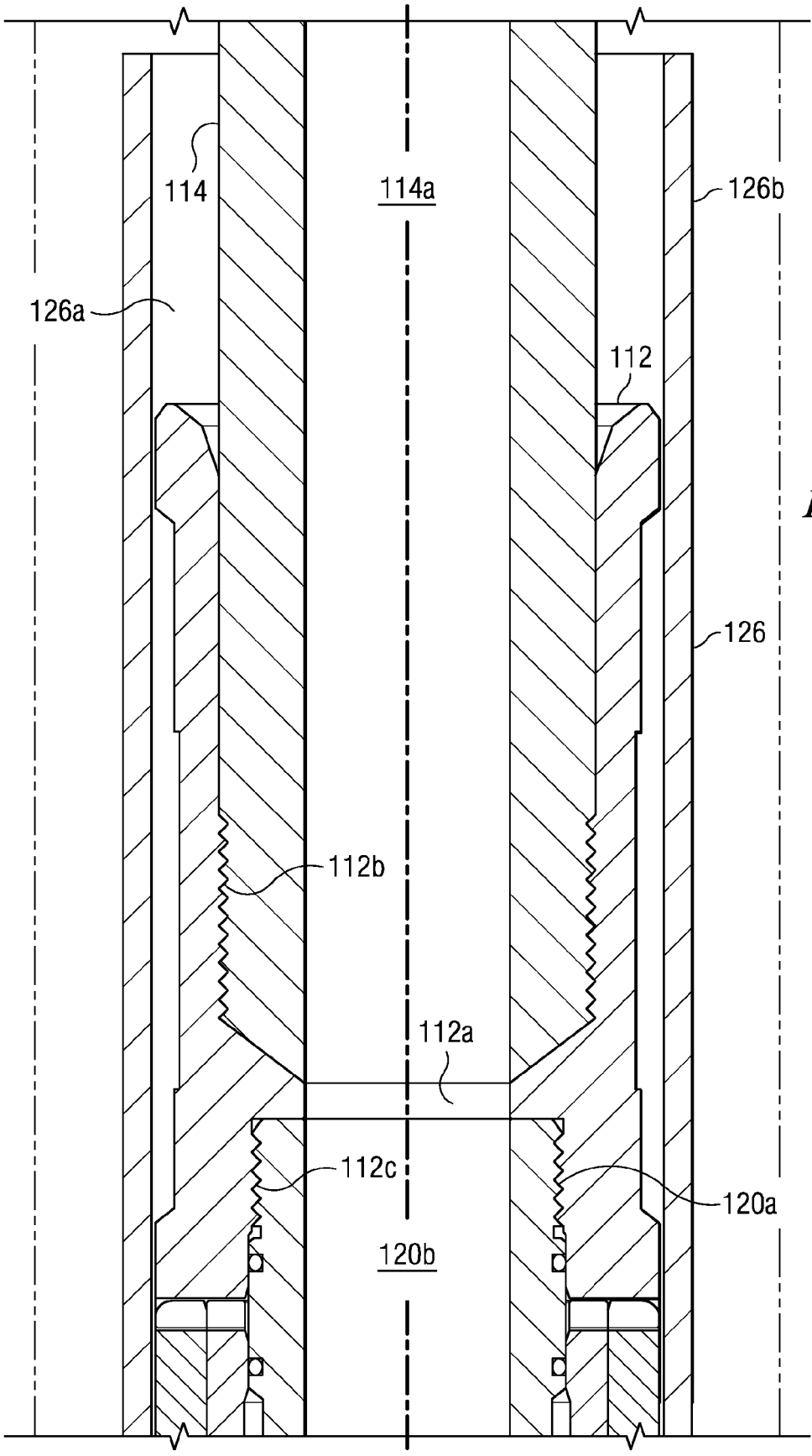
Figure 4B:
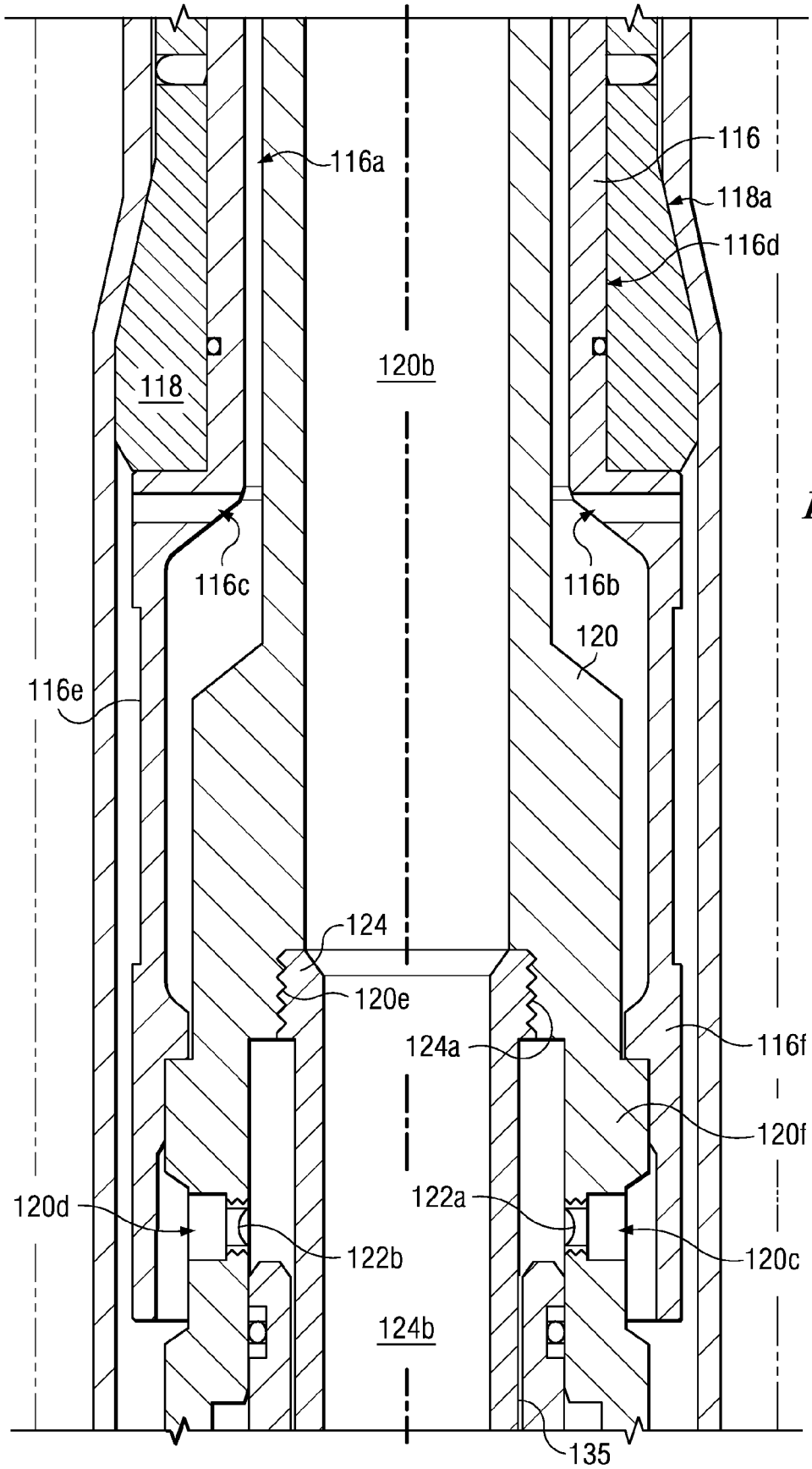
Figure 4C:
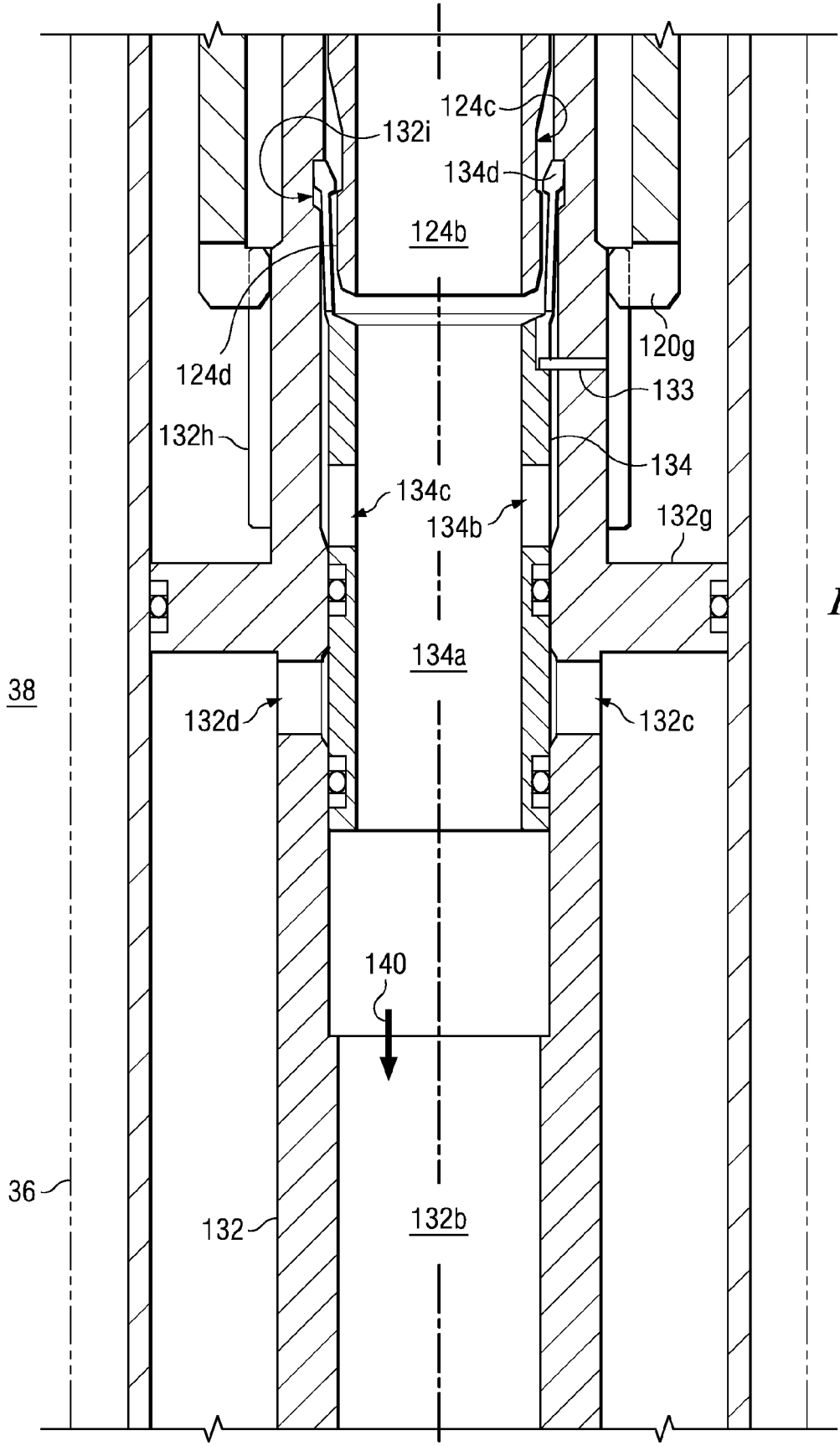
Figure 4D:
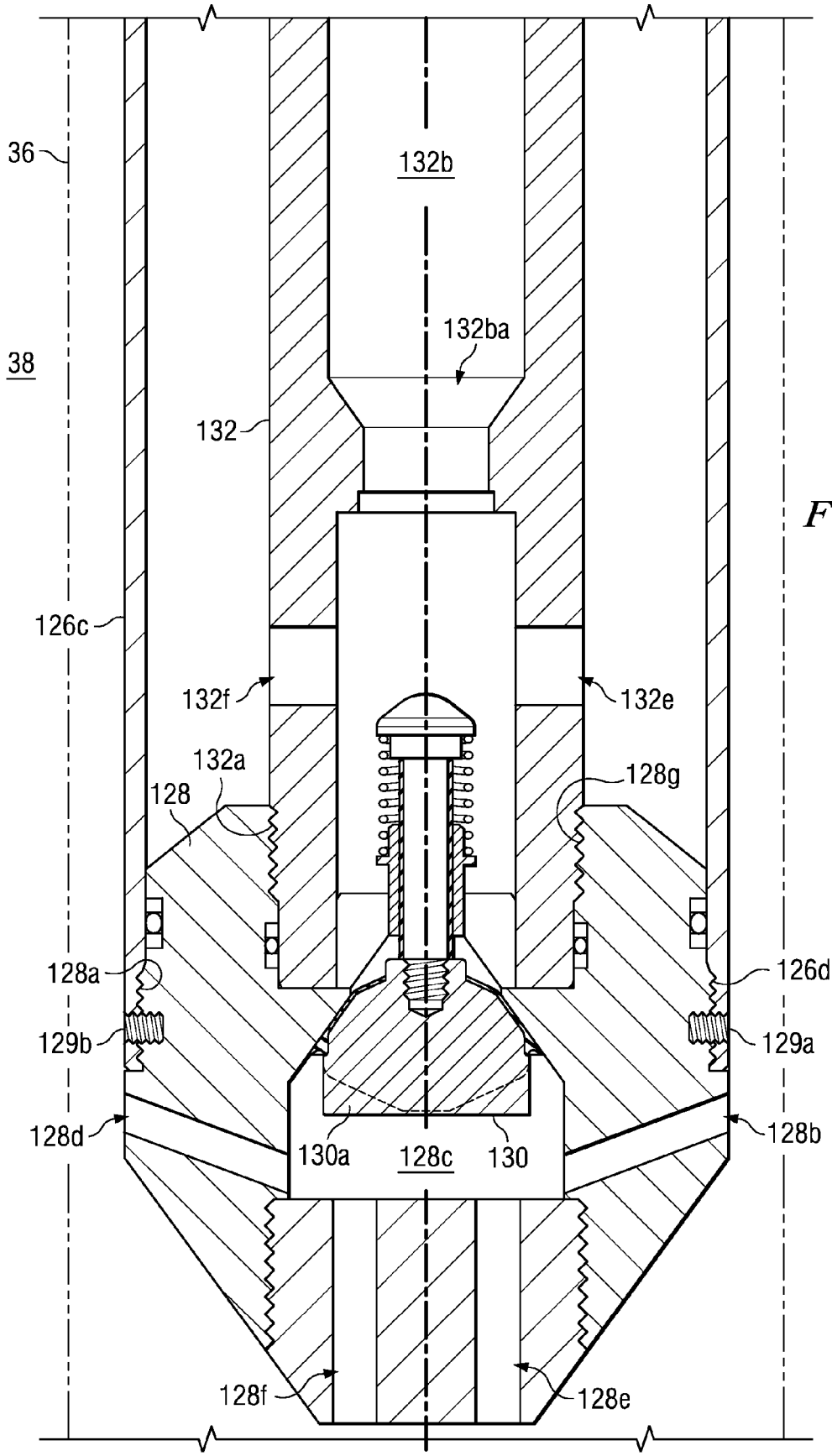
Figure 5:
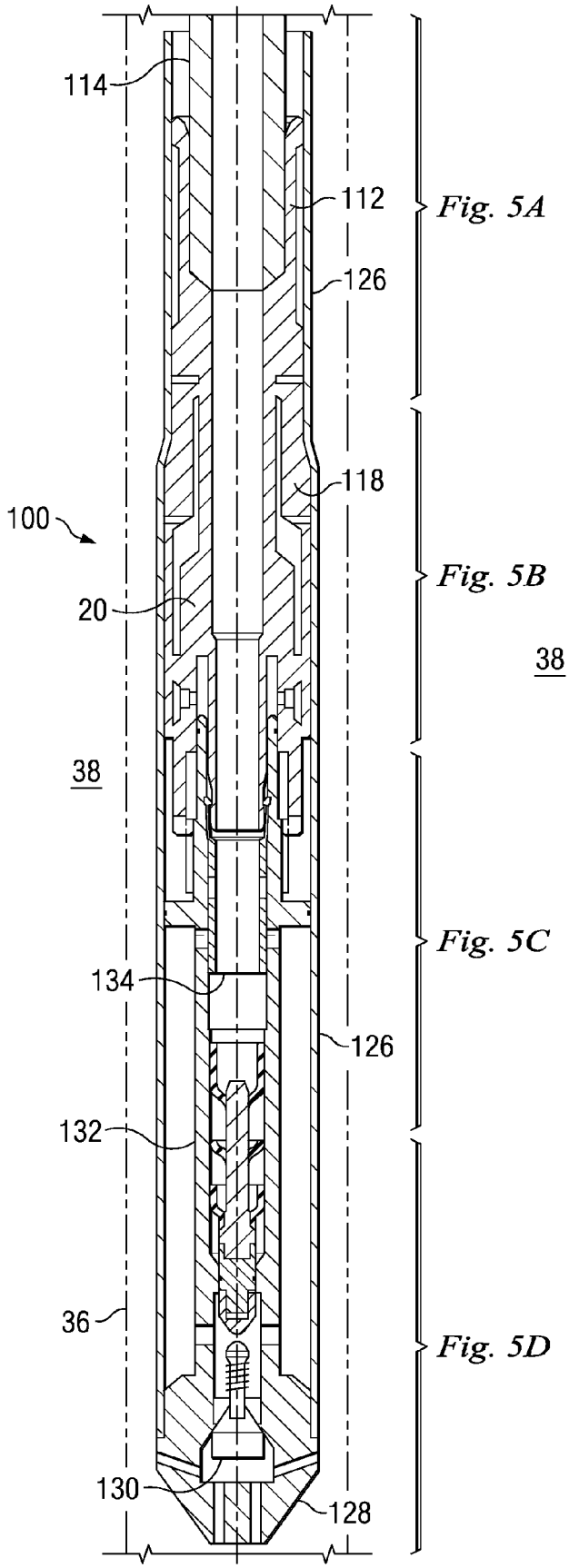
FIGS. 5, 5*a*, 5*b*, 5*c*, and 5*d* are fragmentary cross-sectional illustrations of the apparatus of FIGS. 4, 4*a*, 4*b*, 4*c*, and 4*d* during the radial expansion and plastic deformation of the tubular member.
Figure 5A:
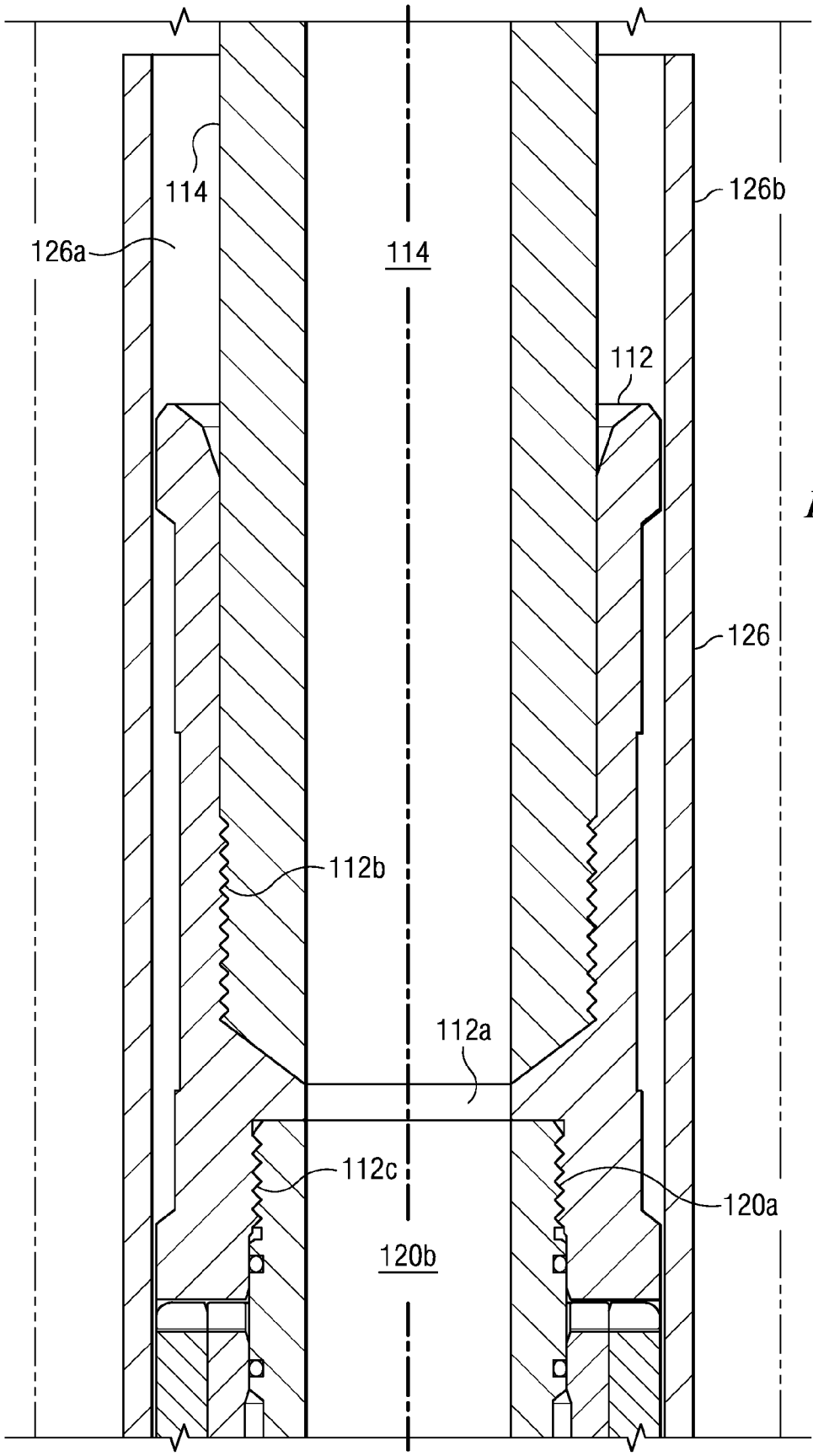
Figure 5B:
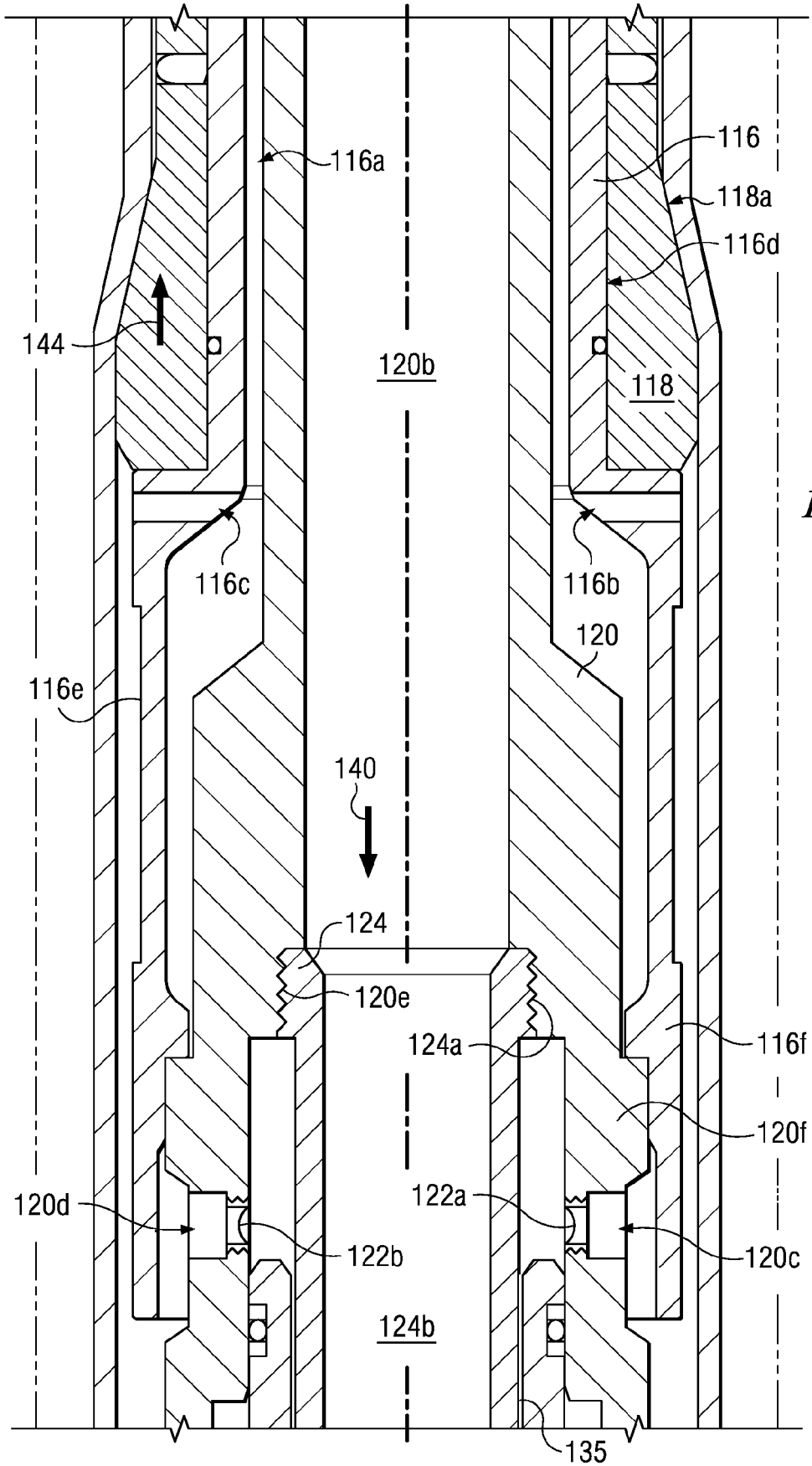
Figure 5C:
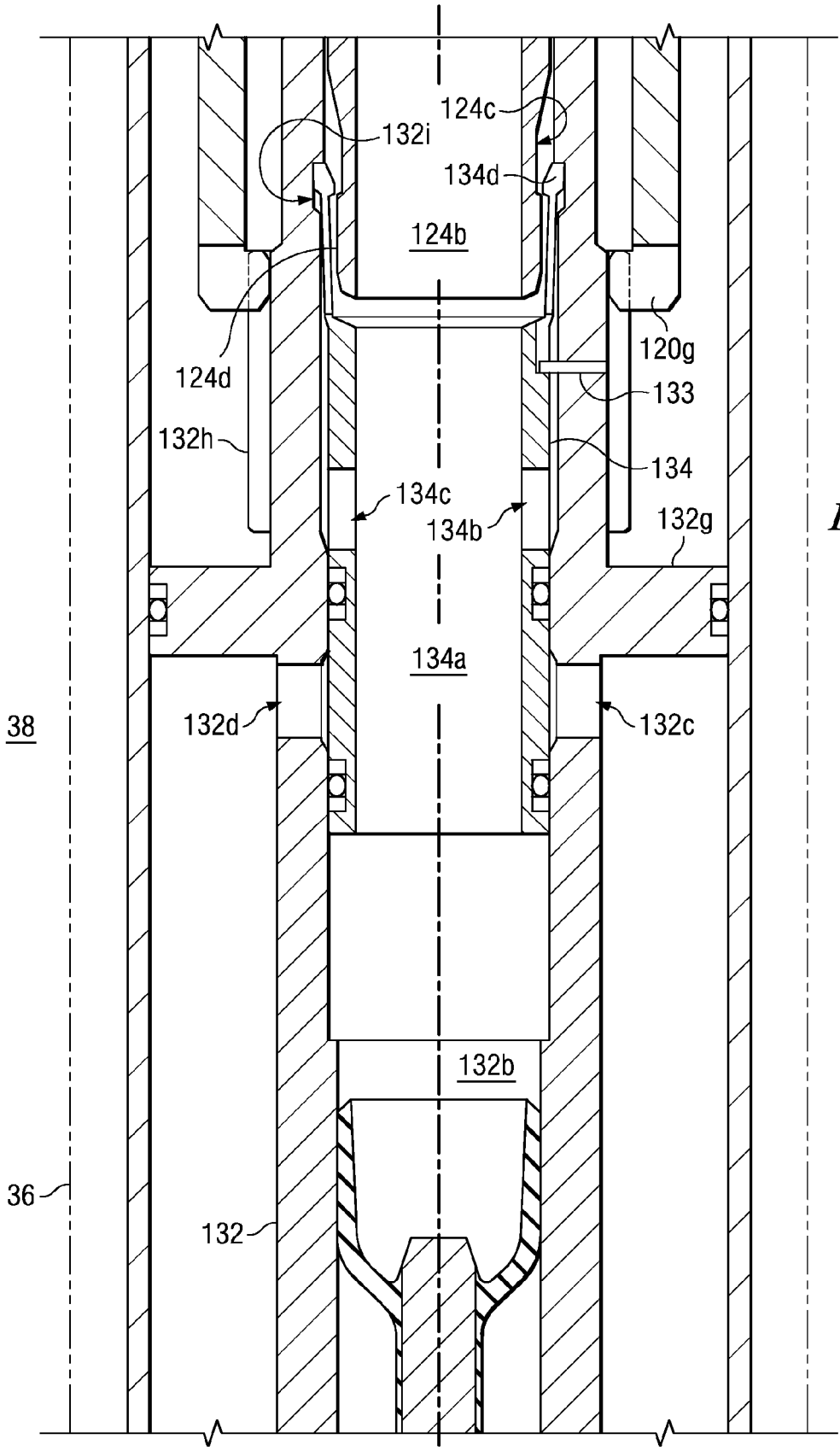
Figure 5D:
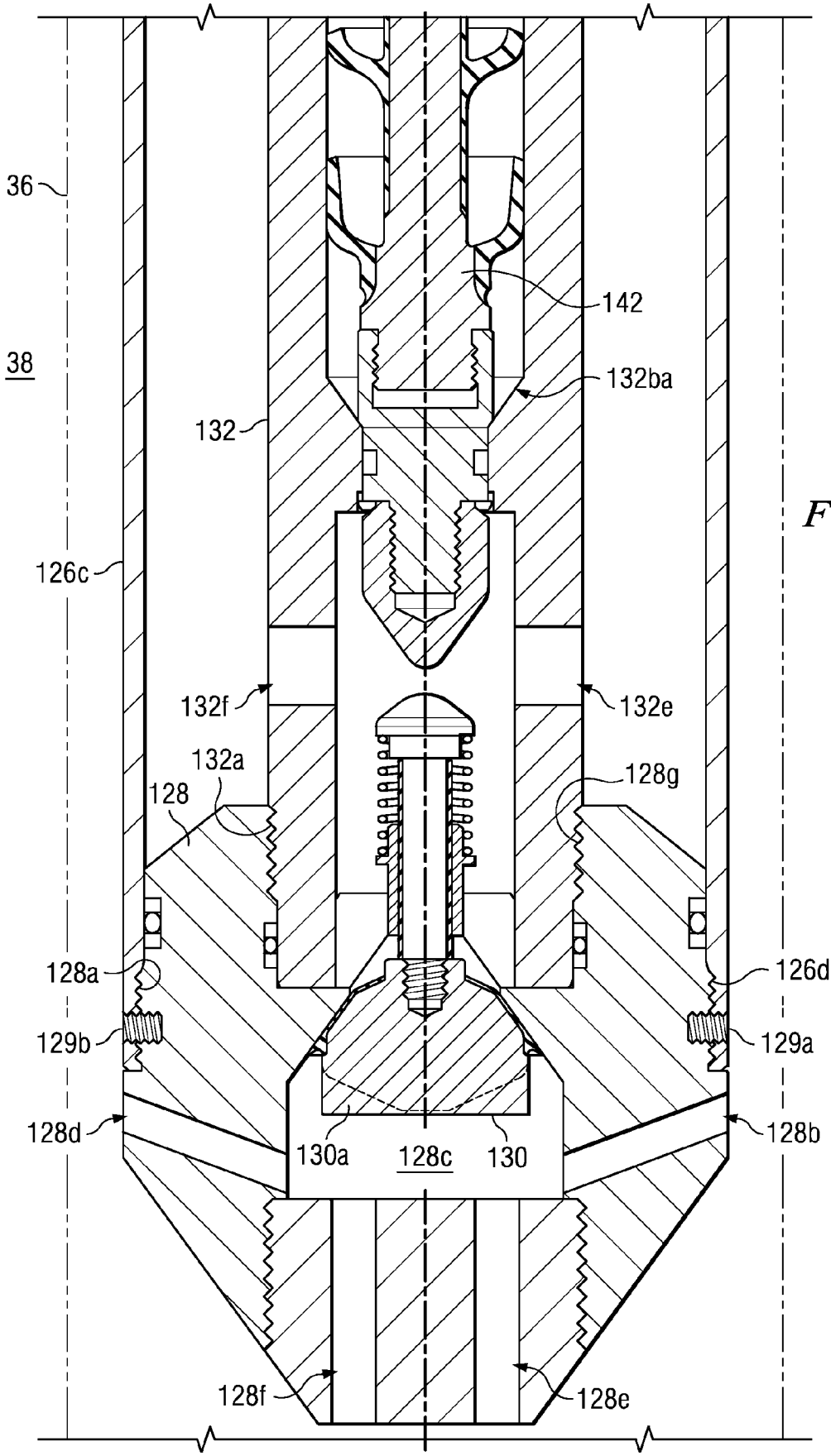
Figure 6:
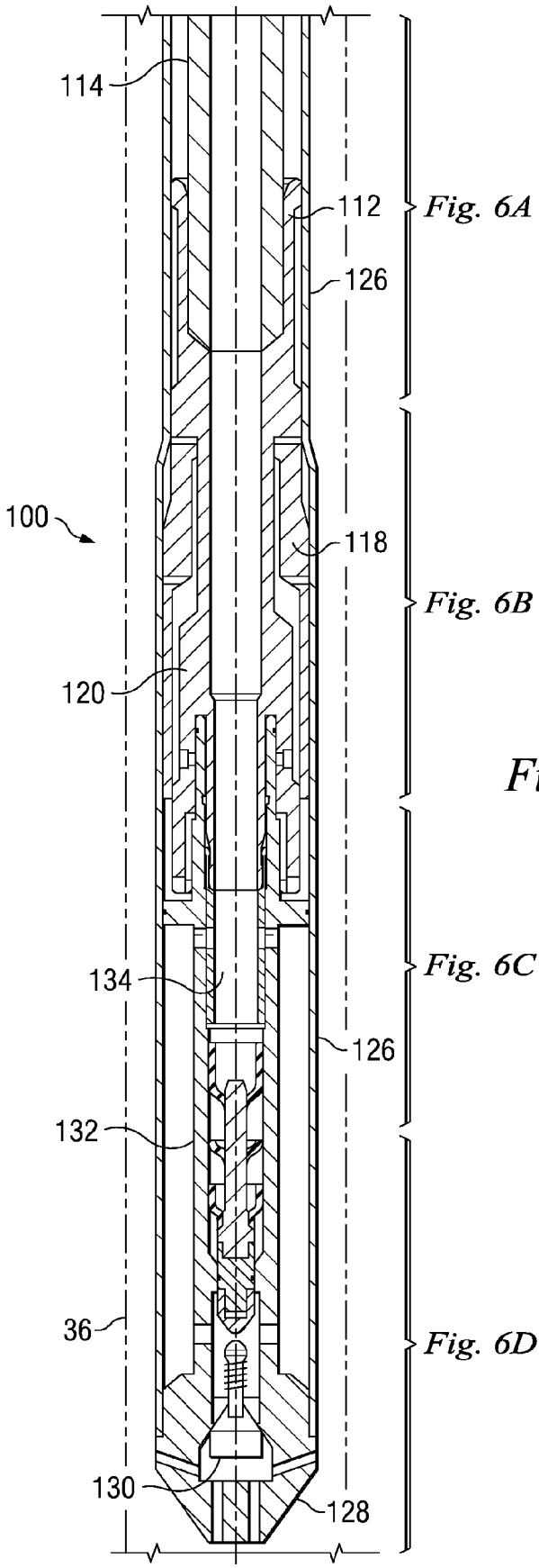
FIGS. 6, 6*a*, 6*b*, 6*c*, and 6*d* are fragmentary cross-sectional illustrations of the apparatus of FIGS. 4, 4*a*, 4*b*, 4*c*, and 4*d* during the injection of a hardenable fluidic sealing material into an annulus between the exterior of the apparatus and the wellbore.
Figure 6A:
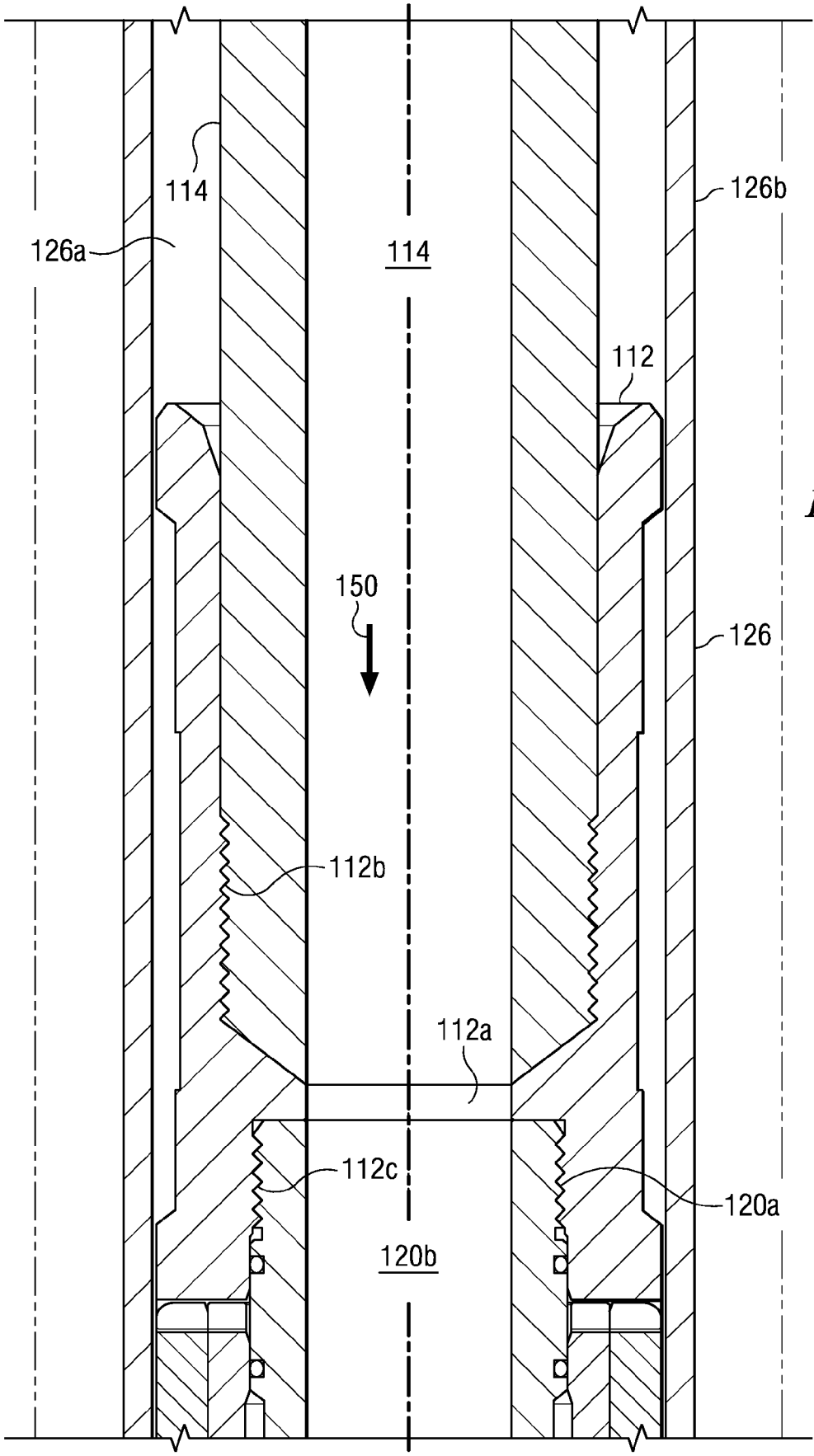
Figure 6B:
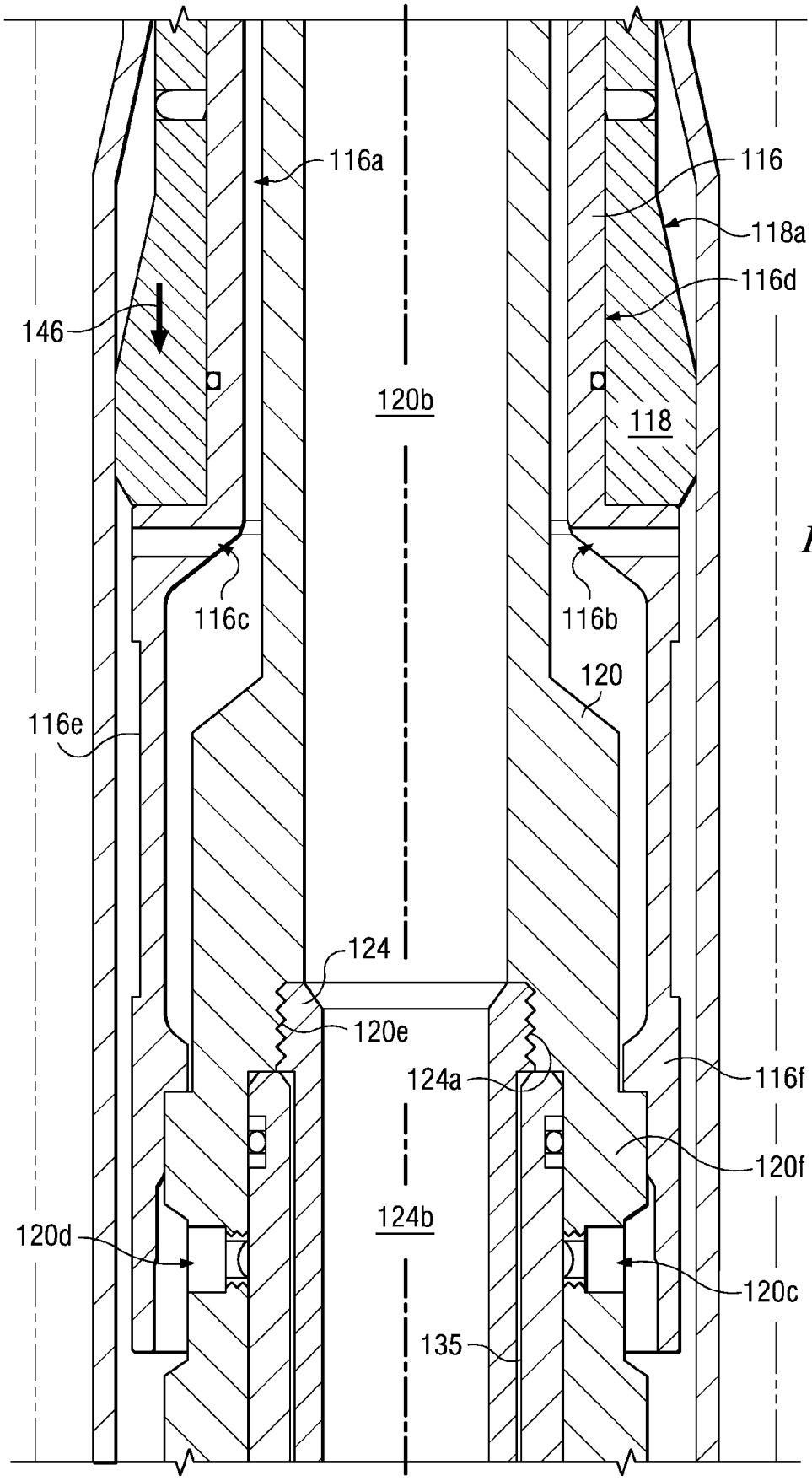
Figure 6C:
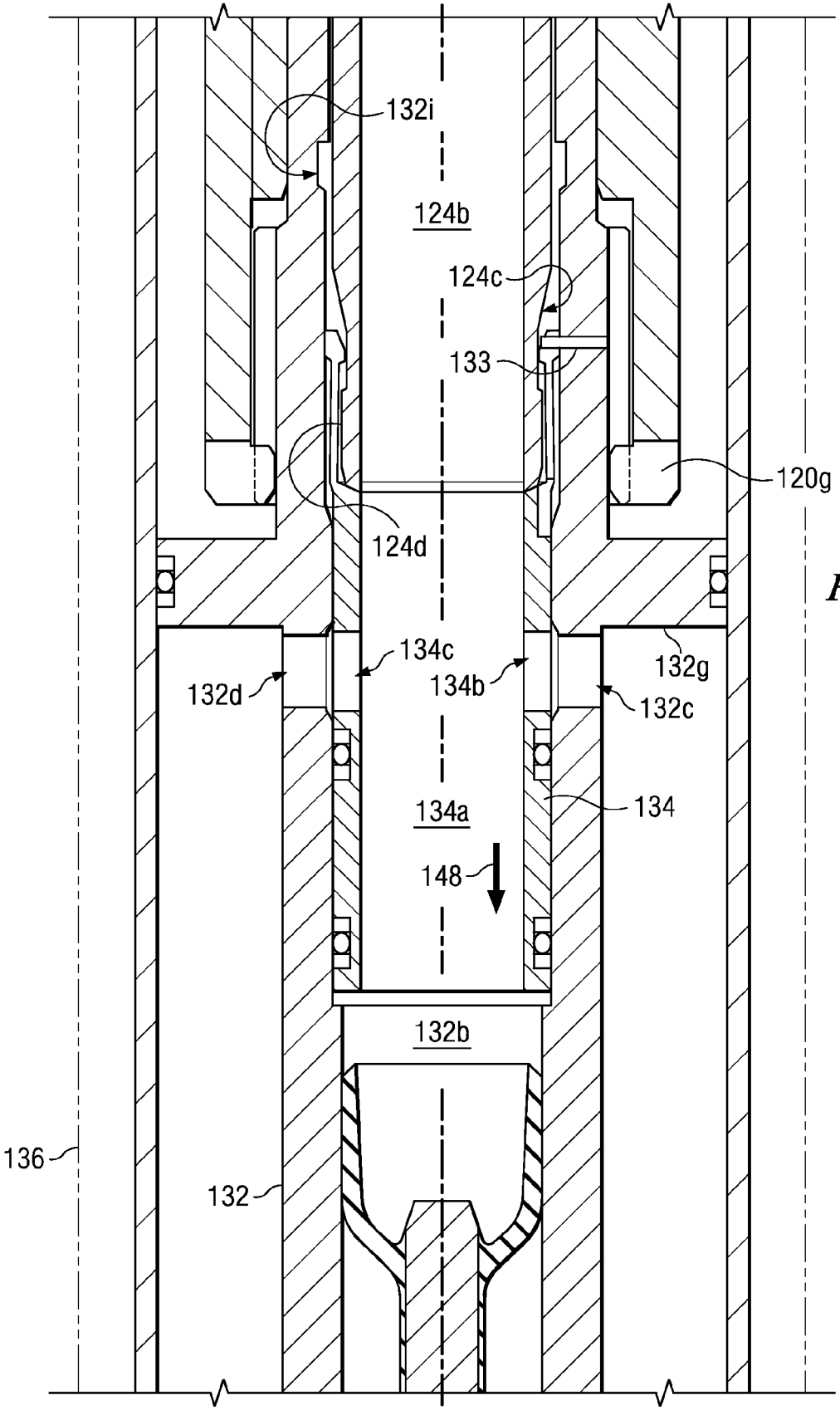
Figure 6D:
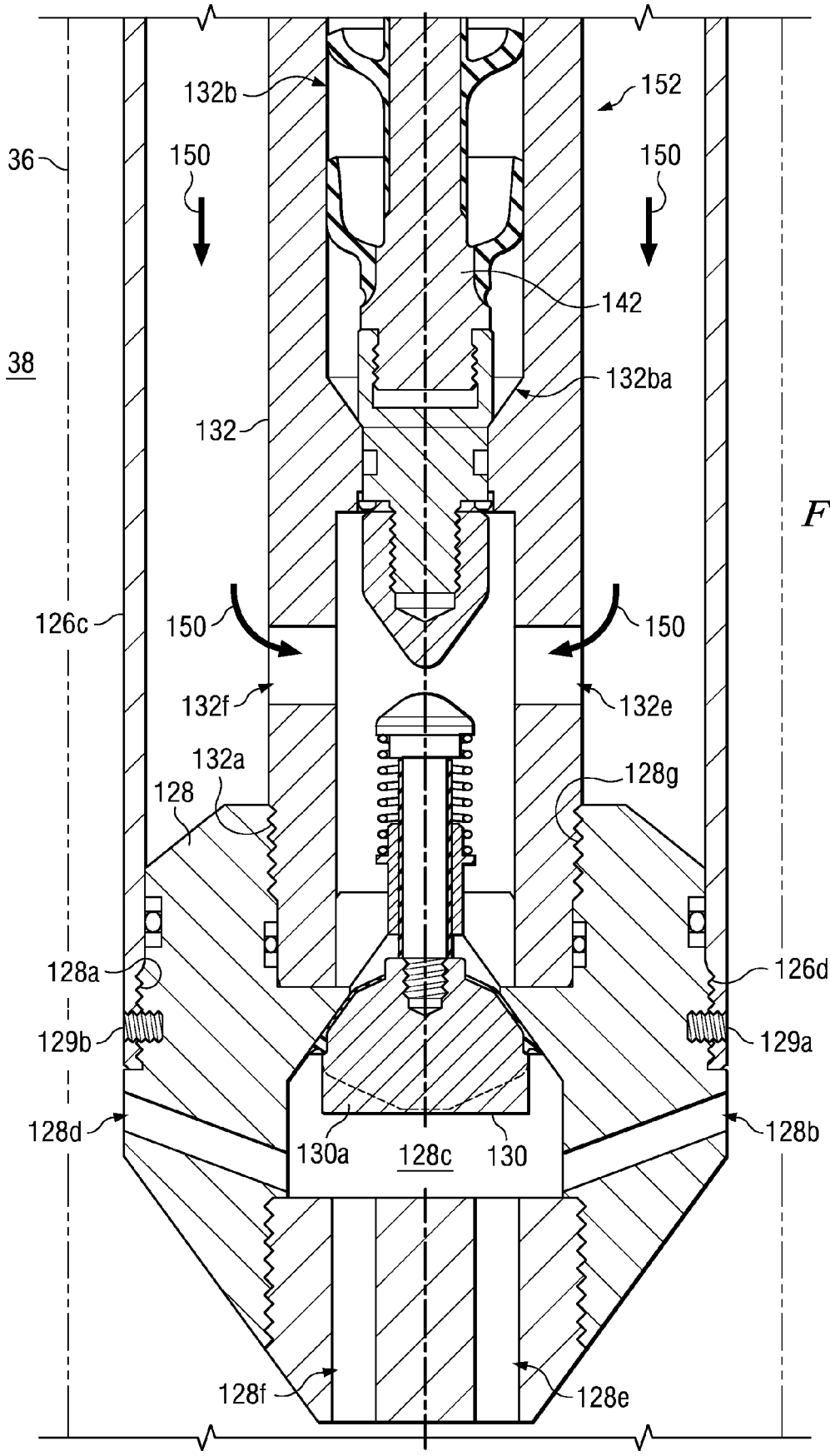

Referring to FIGS. 1, 1*a*, 1*b*, 1*c*, and 1*d*, an exemplary embodiment of an apparatus 10 for radially expanding and plastically deforming a tubular member includes a tubular support 12 that defines an internal passage 12*a* and includes a threaded connection 12*b* at one end and a threaded connection 12*c* at another end. In an exemplary embodiment, during operation of the apparatus 10, a threaded end of a conventional tubular support member 14 that defines a passage 14*a* may be coupled to the threaded connection 12*b* of the tubular support member 12.

An end of a tubular support 16 that defines an internal passage 16*a* and radial passages, 16*b* and 16*c*, and includes an external annular recess 16*d*, an external flange 16*e*, and an internal flange 16*f* is coupled to the other end of the tubular support 12. A tubular expansion cone 18 that includes a tapered external expansion surface 18*a* is received within and is coupled to the external annular recess 16*d* of the tubular support 16 and an end of the tubular expansion cone abuts an end face of the external sleeve 16*e* of the tubular support.

A threaded connection 20*a* of an end of a tubular support 20 that defines an internal passage 20*b* and radial passages, 20*c* and 20*d*, and includes a threaded connection 20*e*, an external flange 20*f*, and internal splines 20*g* at another end is coupled to the threaded connection 12*c* of the other end of the tubular support 12. In an exemplary embodiment, the external flange 20*f* of the tubular support 20 abuts the internal flange 16*f* of the tubular support 16. Rupture discs, 22*a* and 22*b*, are received and mounted within the radial passages, 20*c* and 20*d*, respectively, of the tubular support 20.

A threaded connection 24*a* of an end of a tubular stinger 24 that defines an internal passage 24*b* and includes an external annular recess 24*c* and an external flange 24*d* at another end is coupled to the threaded connection 20*e* of the tubular support 20. An expandable tubular member 26 that defines an internal passage 26*a* for receiving the tubular supports 12, 14, 16, and 20 mates with and is supported by the external expansion surface 18*a* of the tubular expansion cone 18 that includes an upper portion 26*b* having a smaller inside diameter and a lower portion 26*c* having a larger inside diameter and a threaded connection 26*d*.

A threaded connection 28*a* of a shoe 28 that defines internal passages, 28*b*, 28*c*, 28*d*, 28*e*, and 28*f*, and includes another threaded connection 28*g* is coupled to the threaded connection 26*d* of the lower portion 26*c* of the expandable tubular member 26. A conventional one-way poppet valve 30 is movably coupled to the shoe 28 and includes a valve element 30*a* for controllably sealing an opening of the internal passage 28*c* of the shoe. In an exemplary embodiment, the one-way poppet valve 30 only permits fluidic materials to be exhausted from the apparatus 10.

A threaded connection 32*a* at an end of a tubular body 32 that defines an internal passage 32*b*, having a plug valve seat 32*ba*, upper flow ports, 32*c* and 32*d*, and lower flow ports, 32*e* and 32*f*, and includes an external flange 32*g* for sealingly engaging the interior surface of the expandable tubular member 26, external splines 32*h* for mating with and engaging the internal splines 20*g* of the tubular support 20, and an internal annular recess 32*i* is coupled to the threaded connection 28*g* of the shoe 28. Another end of the tubular body 32 is received within an annulus defined between the interior surface of the other end of the tubular support 20 and the exterior surface of the tubular stinger 24, and sealingly engages the interior surface of the tubular support 20.

A sliding sleeve valve 34 is movably received and supported within the internal passage 32*b* of the tubular body 32 that defines an internal passage 34*a* and radial passages, 34*b* and 34*c*, and includes collet fingers 34*d* at one end positioned within the annular recess 32*i* of the tubular body for releasably engaging the external flange 24*d* of the tubular stinger 24. The sliding sleeve valve 34 sealingly engages the internal surface of the internal passage 32*b* of the tubular body 32, and blocks the upper flow ports, 32*c* and 32*d*, of the tubular body. A valve guide pin 33 is coupled to the tubular body 32 for engaging the collet fingers 34*d* of the sliding sleeve valve 34 and thereby guiding and limiting the movement of the sliding sleeve valve.

During operation, as illustrated in FIGS. 1, 1*a*, 1*b*, 1*c*, and 1*d*, the apparatus 10 is positioned within a preexisting structure such as, for example, a wellbore 36 that traverses a subterranean formation 38. In an exemplary embodiment, during or after the positioning of the apparatus 10 within the wellbore 36, fluidic materials 40 may be circulated through and out of the apparatus into the wellbore 36 though the internal passages 14*a*, 12*a*, 20*b*, 24*b*, 34*a*, 32*b*, 28*b*, 28*c*, 28*d*, 28*e*, and 28*f*.

In an exemplary embodiment, as illustrated in FIGS. 2, 2*a*, 2*b*, 2*c*, and 2*d*, during operation of the apparatus 10, a conventional plug valve element 42 may then be injected into the apparatus through the passages 14*a*, 12*a*, 20*b*, 24*b*, 34*a*, and 32*b* until the plug valve element is seated in the plug seat 32*ba* of the internal passage of the tubular body 32. As a result, the flow of fluidic materials through the lower portion of the internal passage 32*b* of the tubular body 32 is blocked. Continued injection of fluidic materials 40 into the apparatus 10, following the seating of the plug valve element 42 in the plug seat 32*ba* of the internal passage of the tubular body 32, pressurizes the internal passage 20*b* of the tubular support and thereby causes the rupture discs, 22*a* and 22*b*, to be ruptured thereby opening the internal passages, 20*c* and 20*d*, of the tubular support 20. As a result, fluidic materials 40 are then conveyed through the internal passages, 20*c* and 20*d*, and radial passages, 16*c* and 16*d*, thereby pressurizing a region within the apparatus 10 below the tubular expansion cone 18. As a result, the tubular support 12, tubular support 14, tubular support 16, tubular expansion cone 18, tubular support 20, and tubular stinger 24 are displaced upwardly in the direction 44 relative to the expandable tubular member 26, shoe 28, tubular body 32, and sliding sleeve valve 34 thereby radially expanding and plastically deforming the expandable tubular member.

During the continued upward displacement of the tubular support 12, tubular support 14, tubular support 16, tubular expansion cone 18, tubular support 20, and tubular stinger 24 in the direction 44 relative to the expandable tubular member 26, shoe 28, tubular body 32, and sliding sleeve valve 34, the upward movement of the sliding sleeve valve is prevented by the operation of the valve guide pin 33. Consequently, at some point, the collet fingers 34*d* of the sliding sleeve valve 34 disengage from the external flange 24*d* of the tubular stinger 24.

In an exemplary embodiment, as illustrated in FIGS. 3, 3*a*, 3*b*, 3*c*, and 3*d*, during operation of the apparatus 10, before radially expanding and plastically deforming the expandable tubular member 26, the tubular support 12, tubular support 14, tubular support 16, tubular expansion cone 18, tubular support 20, and tubular stinger 24 are displaced downwardly in the direction 46 relative to the expandable tubular member 26, shoe 28, tubular body 32, and sliding sleeve valve 34 by, for example, setting the apparatus down onto the bottom of the wellbore 36. As a result, the other end of the tubular stinger 24 impacts and displaces the sliding sleeve valve 34 downwardly in the direction 48 thereby aligning the internal passages, 32*c* and 32*d*, of the tubular body 32, with the internal passages, 34*b* and 34*c*, of the sliding sleeve valve. A hardenable fluidic sealing material 50 may then be injected into the apparatus 10 through the internal passages 14*a*, 12*a*, 20*b*, 24*b*, and 34*a*, into and through the internal passages 32*c* and 32*d* and 34*b* and 34*c*, into and through an annulus 52 defined between the interior of the expandable tubular member 26 and the exterior of the tubular body 32, and then out of the apparatus through the internal passages 32*e* and 32*f* of the tubular body and the internal passages 28*b*, 28*c*, 28*d*, 28*e*, and 28*f* of the shoe 28 into the annulus between the exterior surface of the expandable tubular member and the interior surface of the wellbore 36. As a result, an annular body of a hardenable fluidic sealing material such as, for example, cement is formed within the annulus between the exterior surface of the expandable tubular member 26 and the interior surface of the wellbore 36. Before, during, or after the curing of the annular body of the hardenable fluidic sealing material, the apparatus may then be operated as described above with reference to FIG. 2 to radially expand and plastically deform the expandable tubular member 26.

Referring to FIGS. 4, 4*a*, 4*b*, 4*c*, and 4*d*, an exemplary embodiment of an apparatus 100 for radially expanding and plastically deforming a tubular member includes a tubular support 112 that defines a internal passage 112*a* and includes a threaded connection 112*b* at one end and a threaded connection 112*c* at another end. In an exemplary embodiment, during operation of the apparatus 100, a threaded end of a conventional tubular support member 114 that defines a passage 114*a* may be coupled to the threaded connection 112*b* of the tubular support member 112.

An end of a tubular support 116 that defines an internal passage 116*a* and radial passages, 116*b* and 116*c*, and includes an external annular recess 116*d*, an external flange 116*e*, and an internal flange 116*f* is coupled to the other end of the tubular support 112. A tubular expansion cone 118 that includes a tapered external expansion surface 118*a* is received within and is coupled to the external annular recess 116*d* of the tubular support 116 and an end of the tubular expansion cone abuts an end face of the external sleeve 116*e* of the tubular support.

A threaded connection 120*a* of an end of a tubular support 120 that defines an internal passage 120*b* and radial passages, 120*c* and 120*d*, and includes a threaded connection 120*e*, an external flange 120*f*, and internal splines 120*g* at another end is coupled to the threaded connection 112*c* of the other end of the tubular support 112. In an exemplary embodiment, the external flange 120*f* of the tubular support 120 abuts the internal flange 116*f* of the tubular support 116. Rupture discs, 122*a* and 122*b*, are received and mounted within the radial passages, 120*c* and 120*d*, respectively, of the tubular support 120.

A threaded connection 124*a* of an end of a tubular stinger 124 that defines an internal passage 124*b* and includes an external annular recess 124*c* and an external flange 124*d* at another end is coupled to the threaded connection 120*e* of the tubular support 120. An expandable tubular member 126 that defines an internal passage 126*a* for receiving the tubular supports 112, 114, 116, and 120 mates with and is supported by the external expansion surface 118*a* of the tubular expansion cone 118 that includes an upper portion 126*b* having a smaller inside diameter and a lower portion 126*c* having a larger inside diameter and a threaded connection 126*d*.

A threaded connection 128*a* of a shoe 128 that defines internal passages, 128*b*, 128*c*, 128*d*, 128*e*, and 128*f*, and includes another threaded connection 128*g* is coupled to the threaded connection 126*d* of the lower portion 126*c* of the expandable tubular member 126. Pins, 129*a* and 129*b*, coupled to the shoe 128 and the lower portion 126*c* of the expandable tubular member 126 prevent disengagement of the threaded connections, 126*d* and 128*a*, of the expandable tubular member and shoe. A conventional one-way poppet valve 130 is movably coupled to the shoe 128 and includes a valve element 130*a* for controllably sealing an opening of the internal passage 128*c* of the shoe. In an exemplary embodiment, the one-way poppet valve 130 only permits fluidic materials to be exhausted from the apparatus 100.

A threaded connection 132*a* at an end of a tubular body 132 that defines an internal passage 132*b*, having a plug valve seat 132*ba*, upper flow ports, 132*c* and 132*d*, and lower flow ports, 132*e* and 132*f*, and includes an external flange 132*g* for sealingly engaging the interior surface of the expandable tubular member 126, external splines 132*h* for mating with and engaging the internal splines 120*g* of the tubular support 120, and an internal annular recess 132*i* is coupled to the threaded connection 128*g* of the shoe 128. Another end of the tubular body 132 is received within an annulus defined between the interior surface of the other end of the tubular support 120 and the exterior surface of the tubular stinger 124, and sealingly engages the interior surface of the tubular support 120. An annular passage 133 is further defined between the interior surface of the other end of the tubular body 132 and the exterior surface of the tubular stinger 124.

A sliding sleeve valve 134 is movably received and supported within the internal passage 132*b* of the tubular body 132 that defines an internal passage 134*a* and radial passages, 134*b* and 134*c*, and includes collet fingers 134*d* at one end positioned within the annular recess 132*i* of the tubular body for releasably engaging the external flange 124*d* of the tubular stinger 124. The sliding sleeve valve 134 sealingly engages the internal surface of the internal passage 132*b* of the tubular body 132, and blocks the upper flow ports, 132*c* and 132*d*, of the tubular body. A valve guide pin 135 is coupled to the tubular body 132 for engaging the collet fingers 134*d* of the sliding sleeve valve 134 and thereby guiding and limiting the movement of the sliding sleeve valve.

During operation, as illustrated in FIGS. 4, 4*a*, 4*b*, 4*c*, and 4*d*, the apparatus 100 is positioned within a preexisting structure such as, for example, the wellbore 36 that traverses the subterranean formation 38. In an exemplary embodiment, during or after the positioning of the apparatus 100 within the wellbore 36, fluidic materials 140 may be circulated through and out of the apparatus into the wellbore 36 though the internal passages 114*a*, 112*a*, 120*b*, 124*b*, 134*a*, 132*b*, 128*b*, 128*c*, 128*d*, 128*e*, and 128*f*.

In an exemplary embodiment, as illustrated in FIGS. 5, 5*a*, 5*b*, 5*c*, and 5*d*, during operation of the apparatus 100, a conventional plug valve element 142 may then be injected into the apparatus through the passages 114*a*, 112*a*, 120*b*, 124*b*, 134*a*, and 132*b* until the plug valve element is seated in the plug seat 132*ba* of the internal passage of the tubular body 132. As a result, the flow of fluidic materials through the lower portion of the internal passage 132*b* of the tubular body 132 is blocked. Continued injection of fluidic materials 140 into the apparatus 100, following the seating of the plug valve element 142 in the plug seat 132*ba* of the internal passage of the tubular body 132, pressurizes the internal annular passage 135 and thereby causes the rupture discs, 122*a* and 122*b*, to be ruptured thereby opening the internal passages, 120*c* and 120*d*, of the tubular support 120. As a result, fluidic materials 140 are then conveyed through the internal passages, 120*c* and 120*d*, thereby pressurizing a region within the apparatus 100 below the tubular expansion cone 118. As a result, the tubular support 112, tubular support 114, tubular support 116, tubular expansion cone 118, tubular support 120, and tubular stinger 124 are displaced upwardly in the direction 144 relative to the expandable tubular member 126, shoe 128, tubular body 132, and sliding sleeve valve 134 thereby radially expanding and plastically deforming the expandable tubular member.

During the continued upward displacement of the tubular support 112, tubular support 114, tubular support 116, tubular expansion cone 118, tubular support 120, and tubular stinger 124 in the direction 144 relative to the expandable tubular member 126, shoe 128, tubular body 132, and sliding sleeve valve 134, the upward movement of the sliding sleeve valve is prevented by the operation of the valve guide pin 135. Consequently, at some point, the collet fingers 134*d* of the sliding sleeve valve 134 disengage from the external flange 124*d* of the tubular stinger 124.

In an exemplary embodiment, as illustrated in FIGS. 6, 6*a*, 6*b*, 6*c*, and 6*d*, during operation of the apparatus 100, before or after radially expanding and plastically deforming the expandable tubular member 126, the tubular support 112, tubular support 114, tubular support 116, tubular expansion cone 118, tubular support 120, and tubular stinger 124 are displaced downwardly in the direction 146 relative to the expandable tubular member 126, shoe 128, tubular body 132, and sliding sleeve valve 134 by, for example, setting the apparatus down onto the bottom of the wellbore 36. As a result, the end of the tubular body 132 that is received within the annulus defined between the interior surface of the other end of the tubular support 120 and the exterior surface of the tubular stinger 124 and that sealingly engages the interior surface of the tubular support 120 is displaced upwardly relative to the tubular support and tubular stinger thereby preventing fluidic materials from passing through the annular passage 133 into the radial passages, 120*c* and 120*d*, of the tubular support. Furthermore, as a result, the other end of the tubular stinger 124 impacts and displaces the sliding sleeve valve 134 downwardly in the direction 148 thereby aligning the internal passages, 132*c* and 132*d*, of the tubular body 132, with the internal passages, 134*b* and 134*c*, respectively, of the sliding sleeve valve. A hardenable fluidic sealing material 150 may then be injected into the apparatus 100 through the internal passages 114*a*, 112*a*, 120*b*, 124*b*, and 134*a*, into and through the internal passages 132*c* and 132*d* and 134*b* and 134*c*, into and through an annulus 152 defined between the interior of the expandable tubular member 126 and the exterior of the tubular body 132, and then out of the apparatus through the internal passages 132*e* and 132*f* of the tubular body and the internal passages 128*b*, 128*c*, 128*d*, 128*e*, and 128*f* of the shoe 128 into the annulus between the exterior surface of the expandable tubular member and the interior surface of the wellbore 36. As a result, an annular body of a hardenable fluidic sealing material such as, for example, cement is formed within the annulus between the exterior surface of the expandable tubular member 126 and the interior surface of the wellbore 36. Before, during, or after the curing of the annular body of the hardenable fluidic sealing material, the apparatus may then be operated as described above with reference to FIG. 5 to radially expand and plastically deform the expandable tubular member 126.

Referring to FIGS. 7, 7*a*, 7*b*, 7*c*, 7*d* and 7*e*, an exemplary embodiment of an apparatus 200 for radially expanding and plastically deforming a tubular member includes a tubular support 212 that defines a internal passage 212*a* and includes a threaded connection 212*b* at one end and a threaded connection 212*c* at another end. In an exemplary embodiment, during operation of the apparatus 200, a threaded end of a conventional tubular support member 214 that defines a passage 214*a* may be coupled to the threaded connection 212*b* of the tubular support member 212.

An end of a tubular support 216 that defines an internal passage 216*a* and radial passages, 216*b* and 216*c*, and includes an external annular recess 216*d*, an external flange 216*e*, and an internal flange 216*f* is coupled to the other end of the tubular support 212. A tubular expansion cone 218 that includes a tapered external expansion surface 218*a* is received within and is coupled to the external annular recess 216*d* of the tubular support 216 and an end of the tubular expansion cone abuts an end face of the external sleeve 216*e* of the tubular support.

A threaded connection 220*a* of an end of a tubular support 220 that defines an internal passage 220*b* and radial passages, 220*c* and 220*d*, and includes a threaded connection 220*e*, an external flange 220*f*, and internal splines 220*g* at another end is coupled to the threaded connection 212*c* of the other end of the tubular support 212. In an exemplary embodiment, the external flange 220*f* of the tubular support 220 abuts the internal flange 216*f* of the tubular support 216. Rupture discs, 222*a* and 222*b*, are received and mounted within the radial passages, 220*c* and 220*d*, respectively, of the tubular support 220.

A threaded connection 224*a* of an end of a tubular stinger 224 that defines an internal passage 224*b* and includes an external annular recess 224*c* and an external flange 224*d* at another end is coupled to the threaded connection 220*e* of the tubular support 220. An expandable tubular member 226 that defines an internal passage 226*a* for receiving the tubular supports 212, 214, 216, and 220 mates with and is supported by the external expansion surface 218*a* of the tubular expansion cone 218 that includes an upper portion 226*b* having a smaller inside diameter and a lower portion 226*c* having a larger inside diameter and a threaded connection 226*d*.

A threaded connection 228*a* of a shoe 228 that defines internal passages, 228*b*, 228*c*, and 228*d*, and includes a threaded connection 228*e* at one end and a threaded connection 228*f* at another end is coupled to the threaded connection 226*d* of the lower portion 226*c* of the expandable tubular member 226. Pins, 230*a* and 230*b*, coupled to the shoe 228 and the lower portion 226*c* of the expandable tubular member 226 prevent disengagement of the threaded connections, 226*d* and 228*a*, of the expandable tubular member and shoe. A threaded connection 232*a* of a shoe insert 232 that defines internal passages 232*b* and 232*c* is coupled to the threaded connection 228*f* of the shoe 228. In an exemplary embodiment, the shoe 228 and/or the shoe insert 232 are fabricated from composite materials in order to reduce the weight and cost of the components.

A conventional one-way poppet valve 234 is movably coupled to the shoe 228 and includes a valve element 234*a* for controllably sealing an opening of the internal passage 228*c* of the shoe. In an exemplary embodiment, the one-way poppet valve 234 only permits fluidic materials to be exhausted from the apparatus 200.

A threaded end 236*a* of a tubular plug seat 236 that defines an internal passage 236*b* having a plug seat 236*ba* and lower flow ports, 236*c* and 236*d*, is coupled to the threaded connection 228*e* of the shoe 228. In an exemplary embodiment, the tubular plug seat 236 is fabricated from aluminum in order to reduce weight and cost of the component. A tubular body 238 defines an internal passage 238*a*, lower flow ports, 238*b* and 238*c*, and upper flow ports, 238*d* and 238*e*, and includes an internal annular recess 238*f* at one end that mates with and receives the other end of the tubular plug seat 236, and an internal annular recess 238*g* and an external flange 238*h* for sealingly engaging the interior surface of the expandable tubular member 226 at another end. In an exemplary embodiment, the tubular body 238 is fabricated from a composite material in order to reduce weight and cost of the component.

Figure 7:
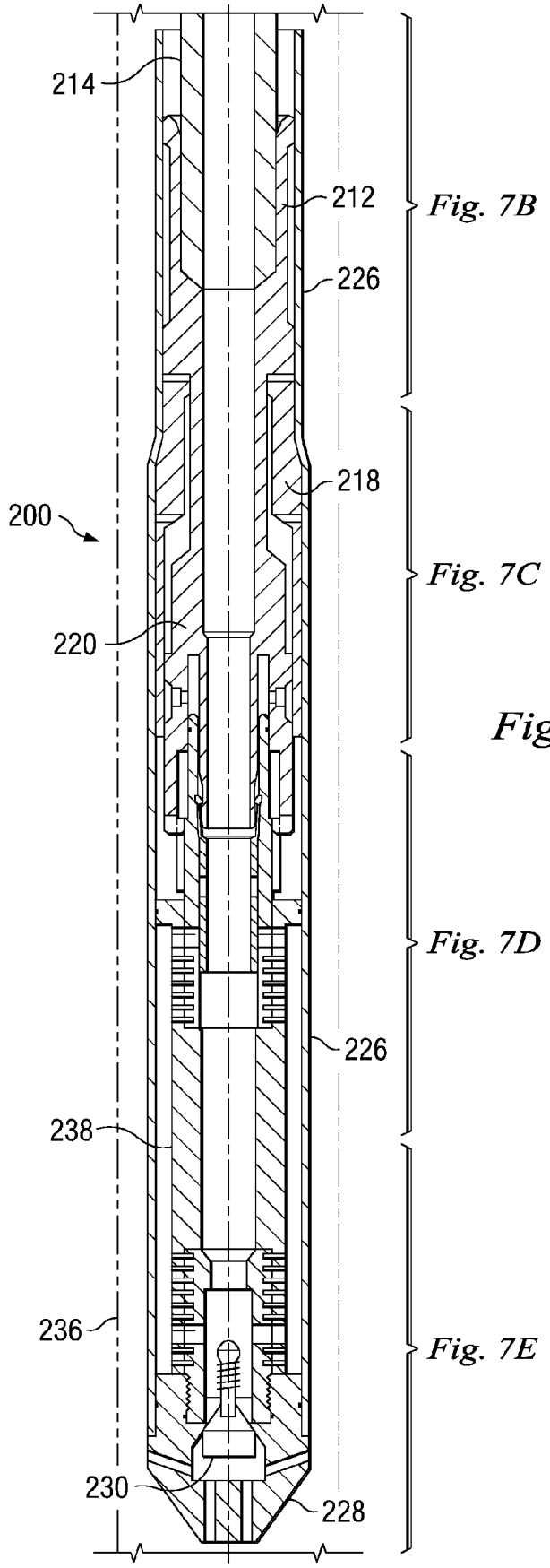
FIGS. 7, 7*a*, 7*b*, 7*c*, 7*d*, and 7*e* are fragmentary cross-sectional illustrations of an exemplary embodiment of an apparatus for radially expanding and plastically deforming a tubular member during the placement of the apparatus within a wellbore.
Figure 7A:
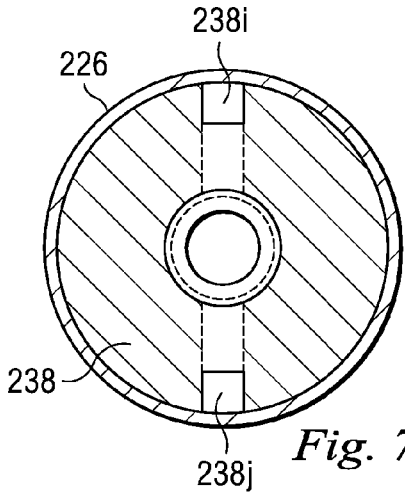
Figure 7B:
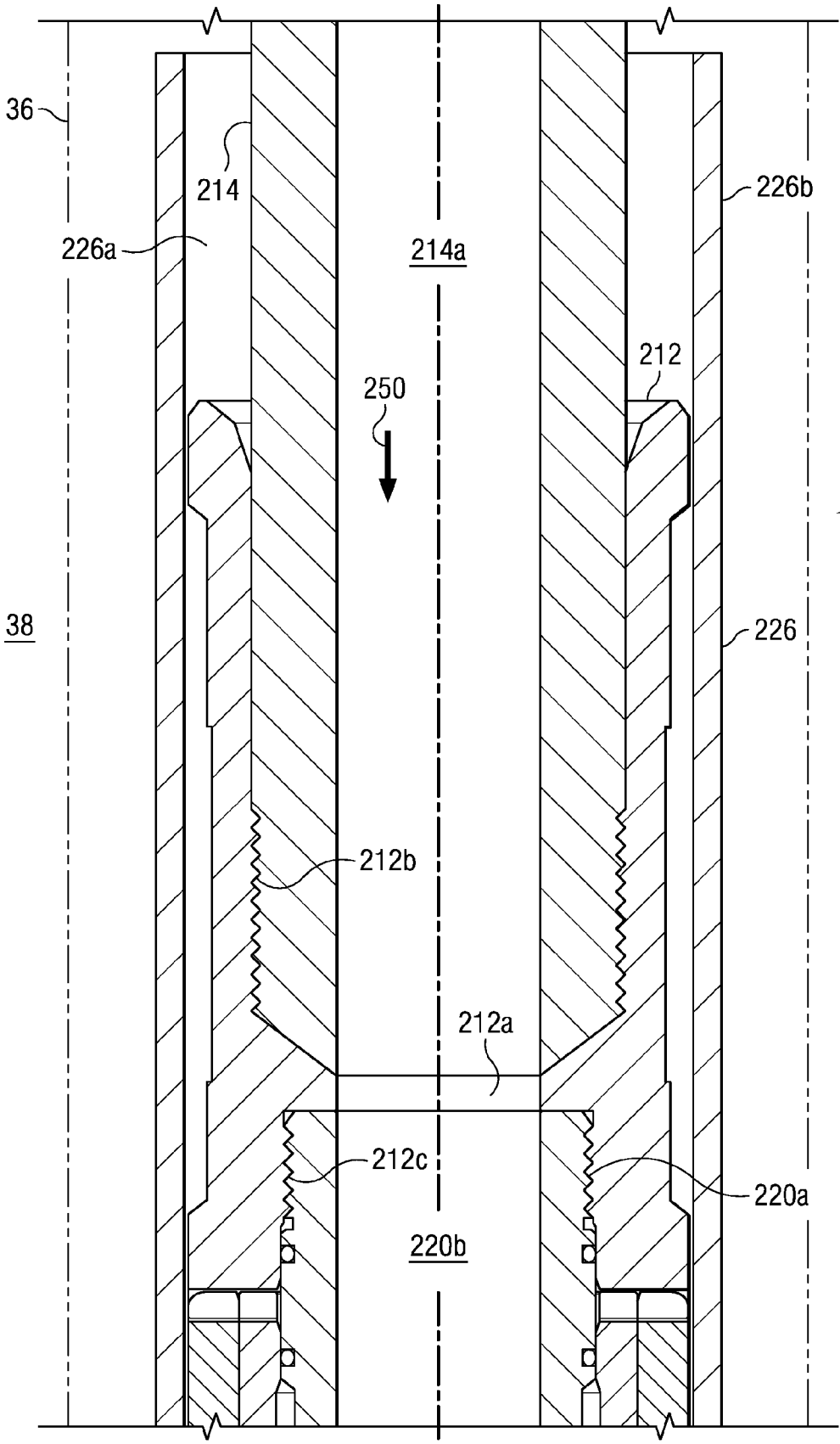
Figure 7C:
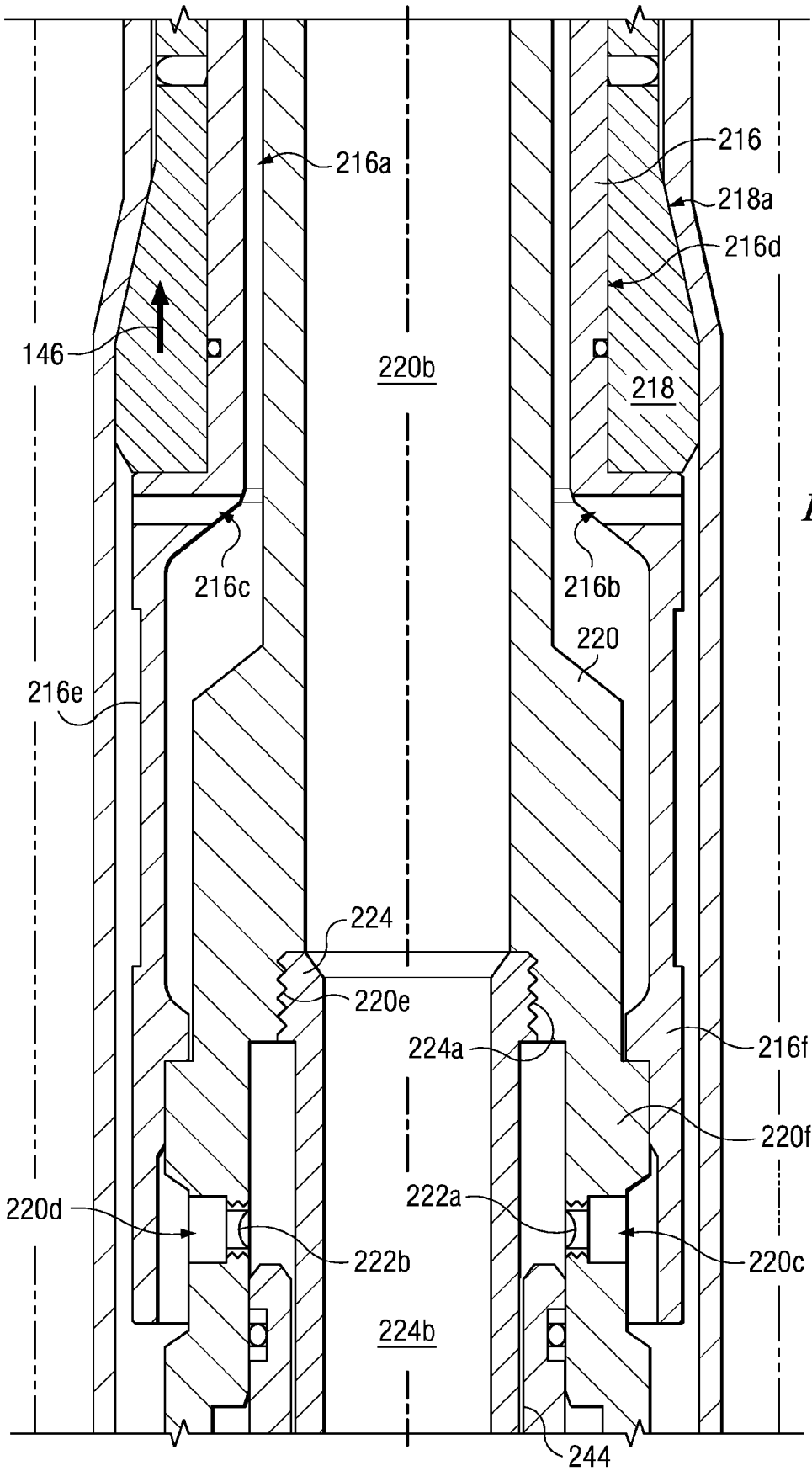
Figure 7D:
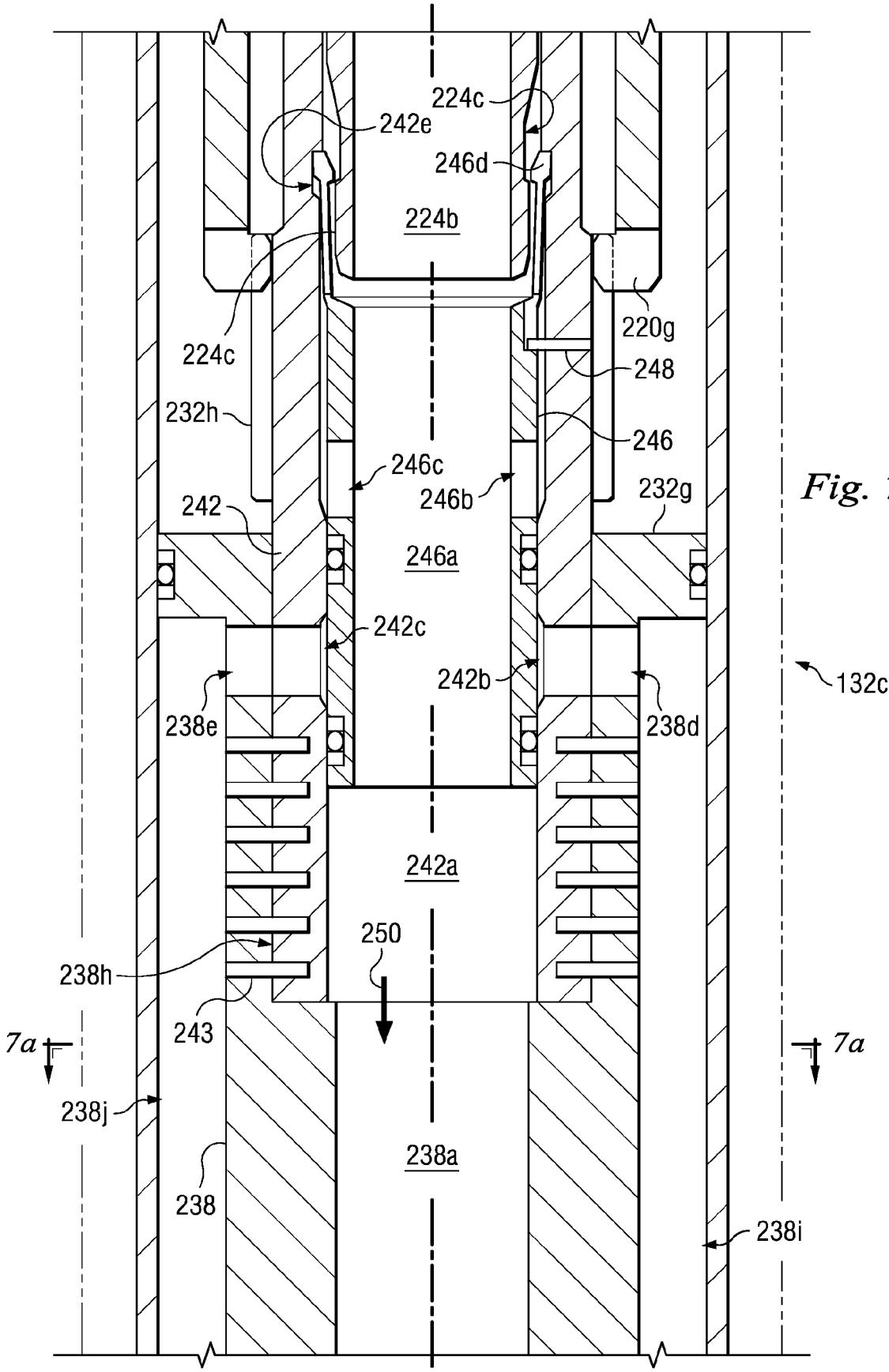
Figure 7E:
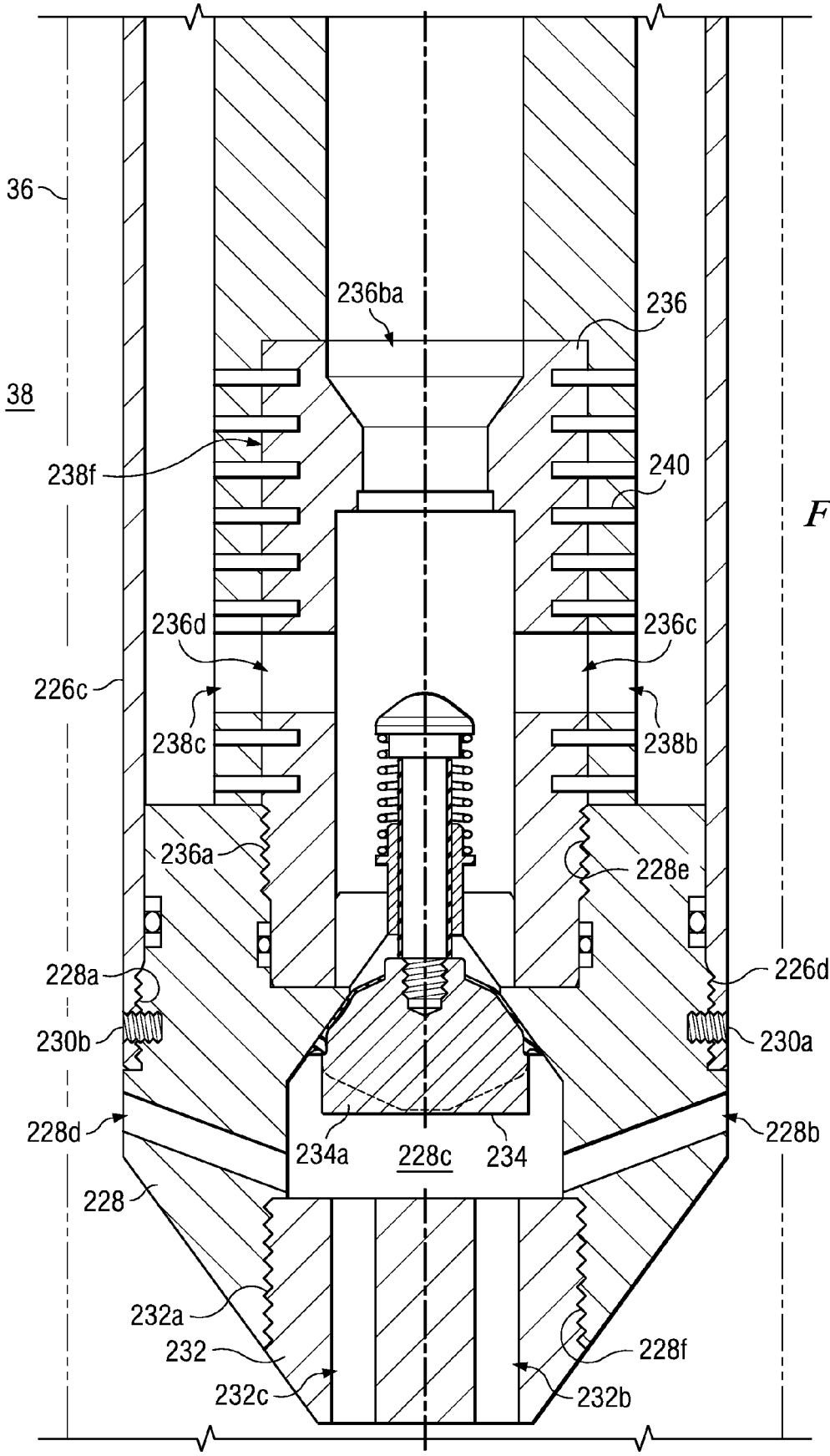
Figure 8:
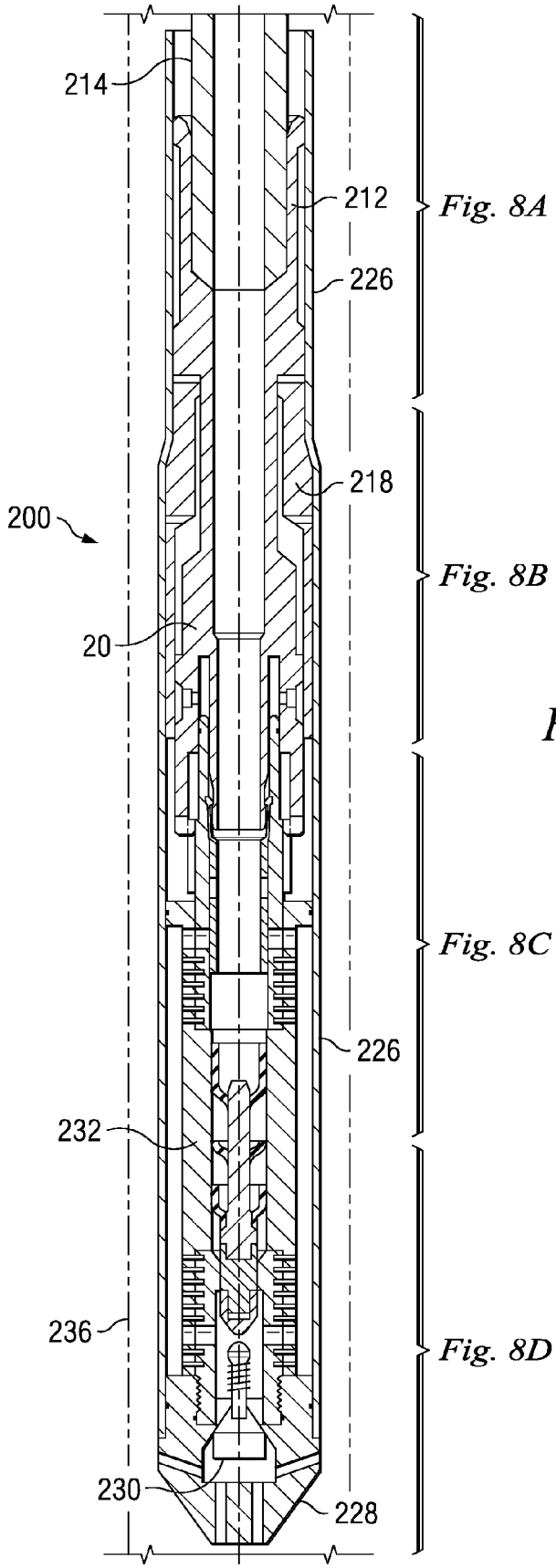
FIGS. 8, 8*a*, 8*b*, 8*c*, and 8*d* are fragmentary cross-sectional illustrations of the apparatus of FIGS. 7, 7*a*, 7*b*, 7*c*, 7*d*, and 7*e* during the radial expansion and plastic deformation of the tubular member.
Figure 8A:
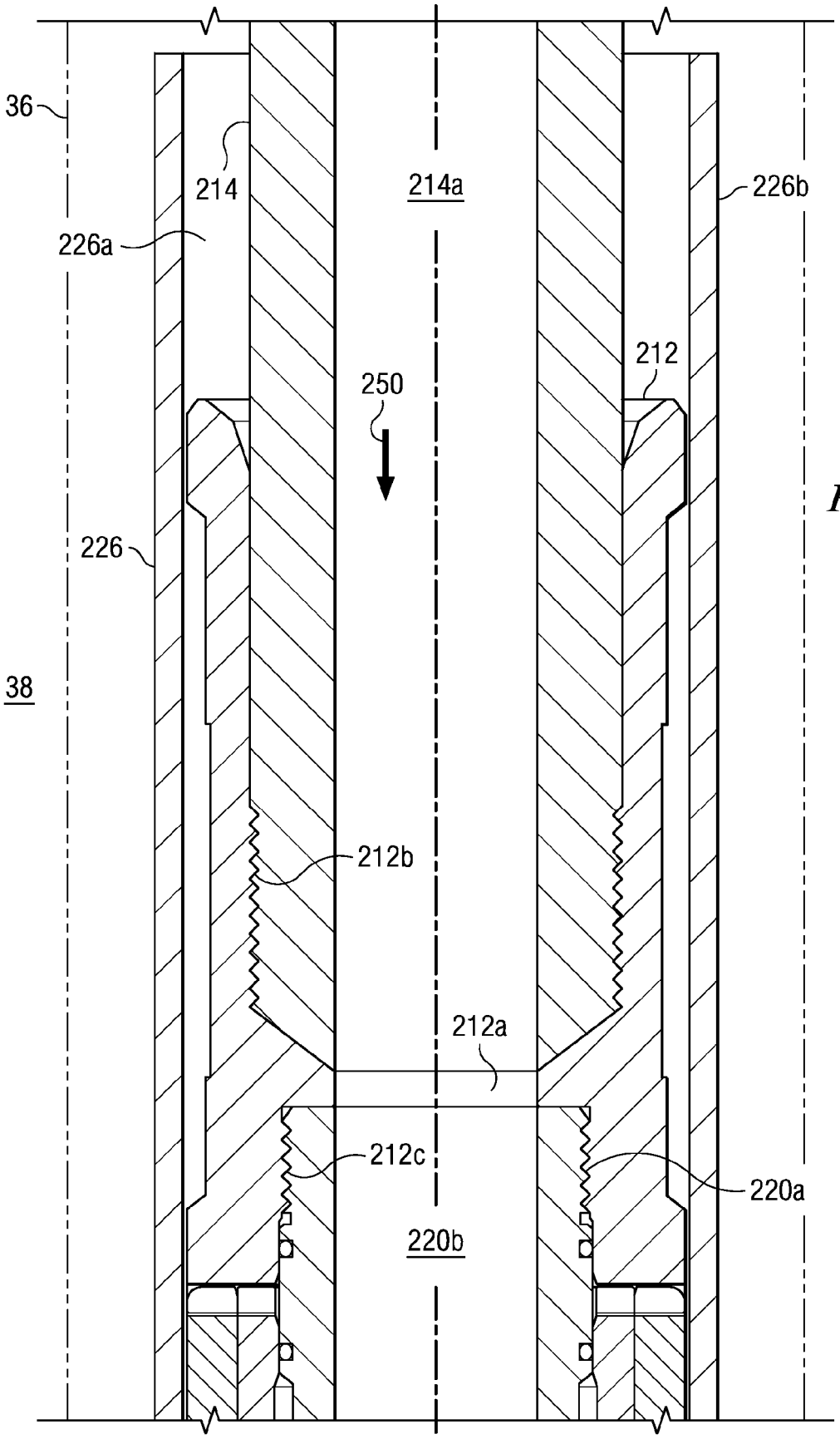
Figure 8B:
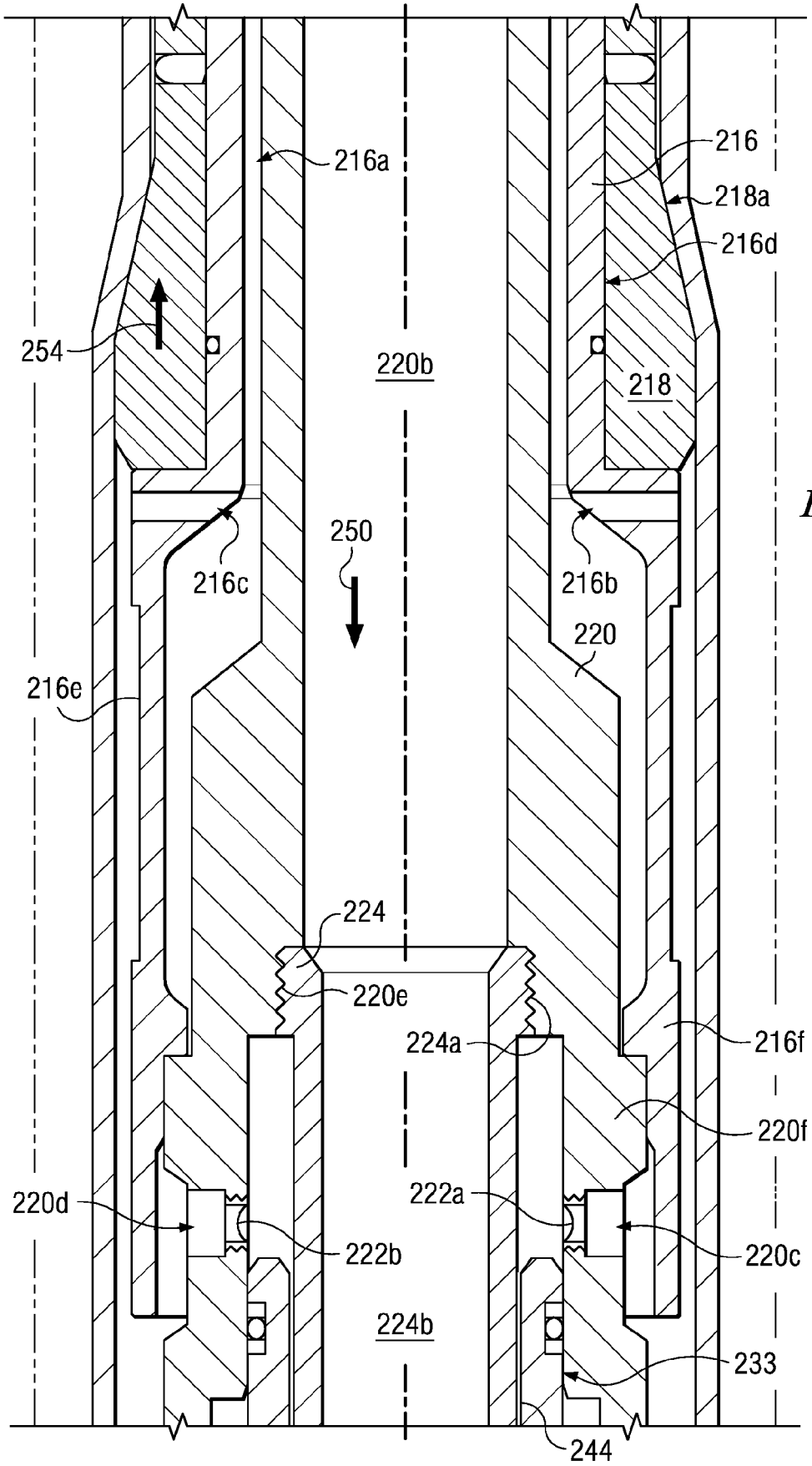
Figure 8C:
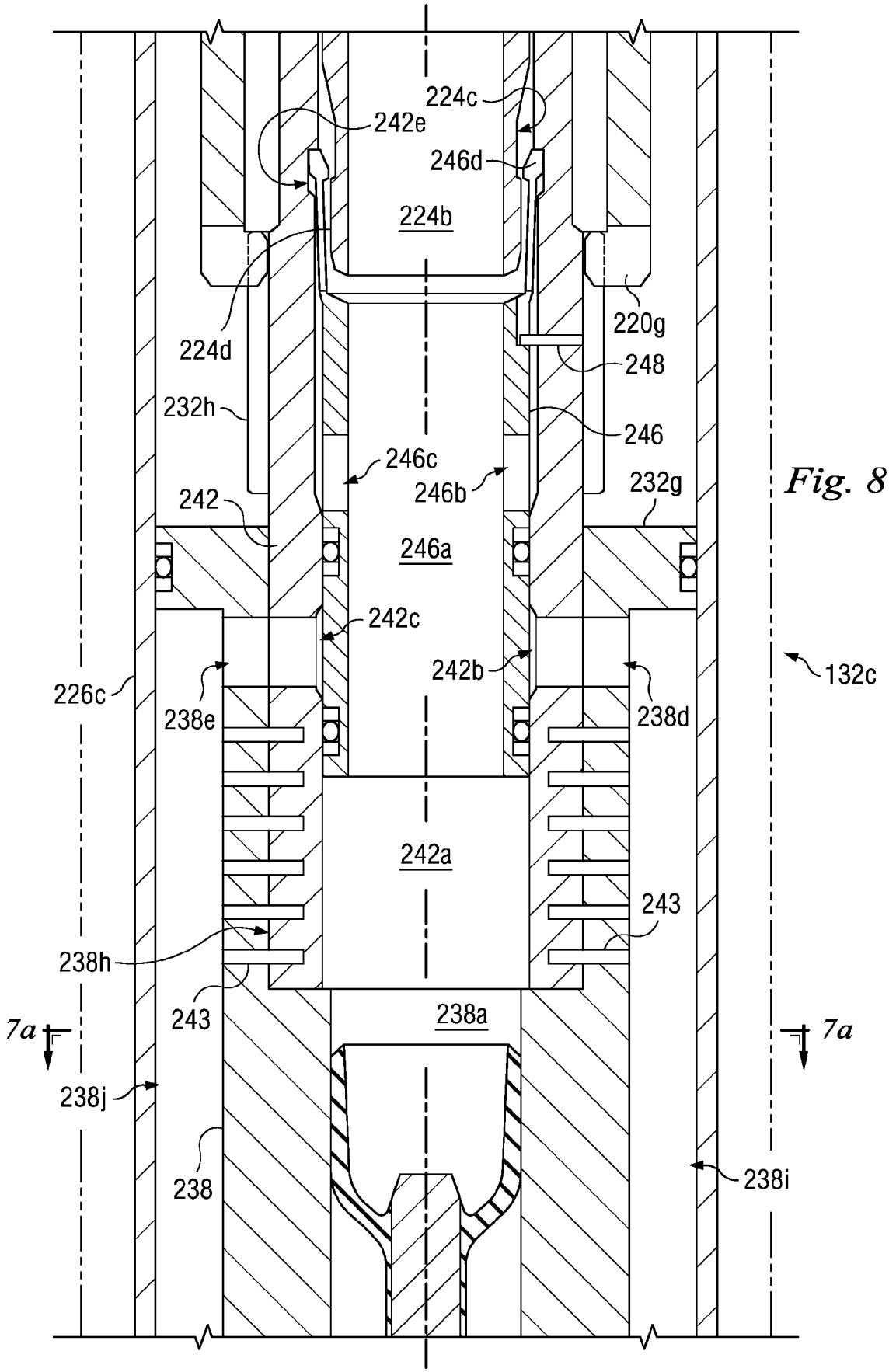
Figure 8D:
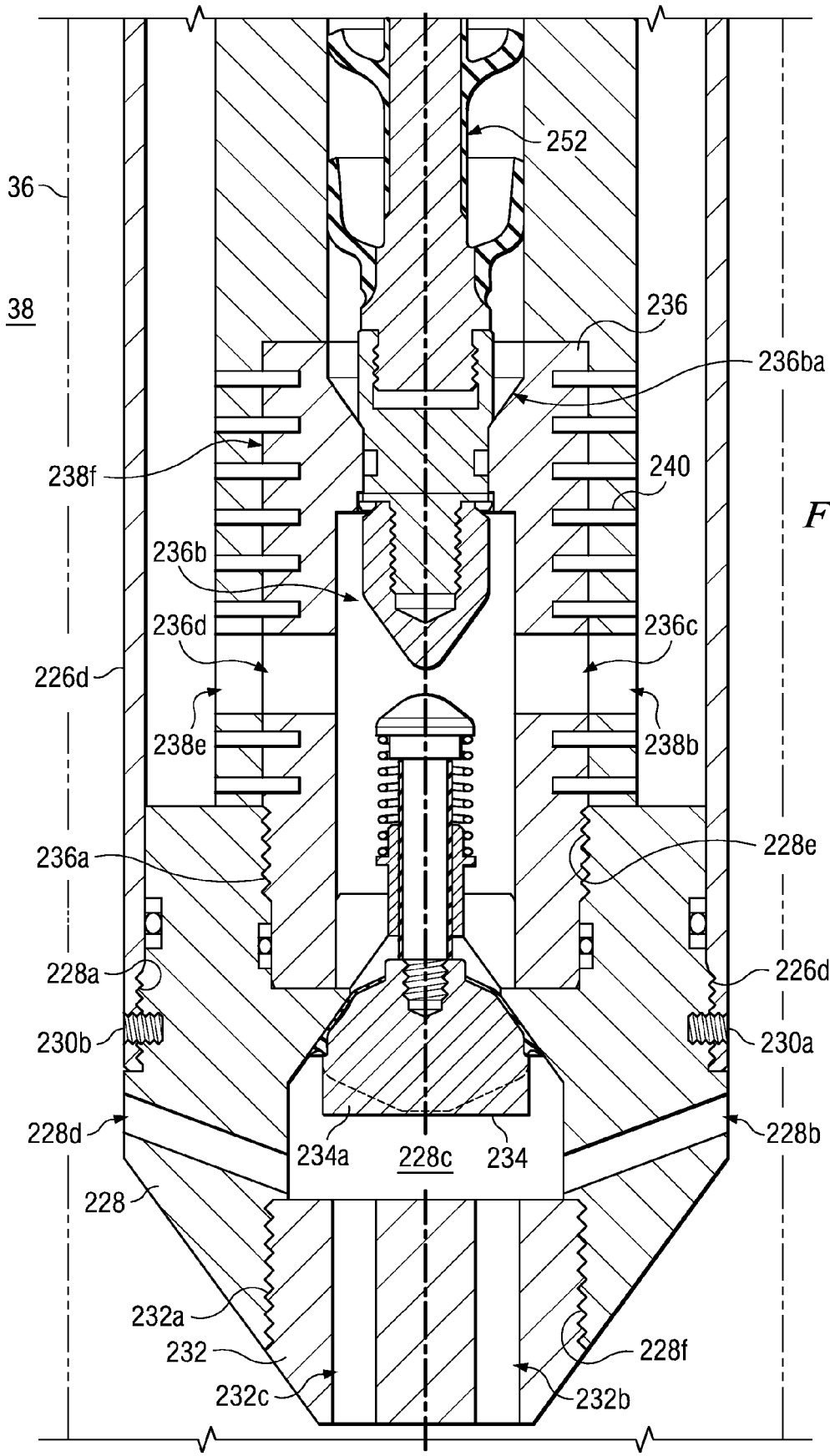
Figure 9:
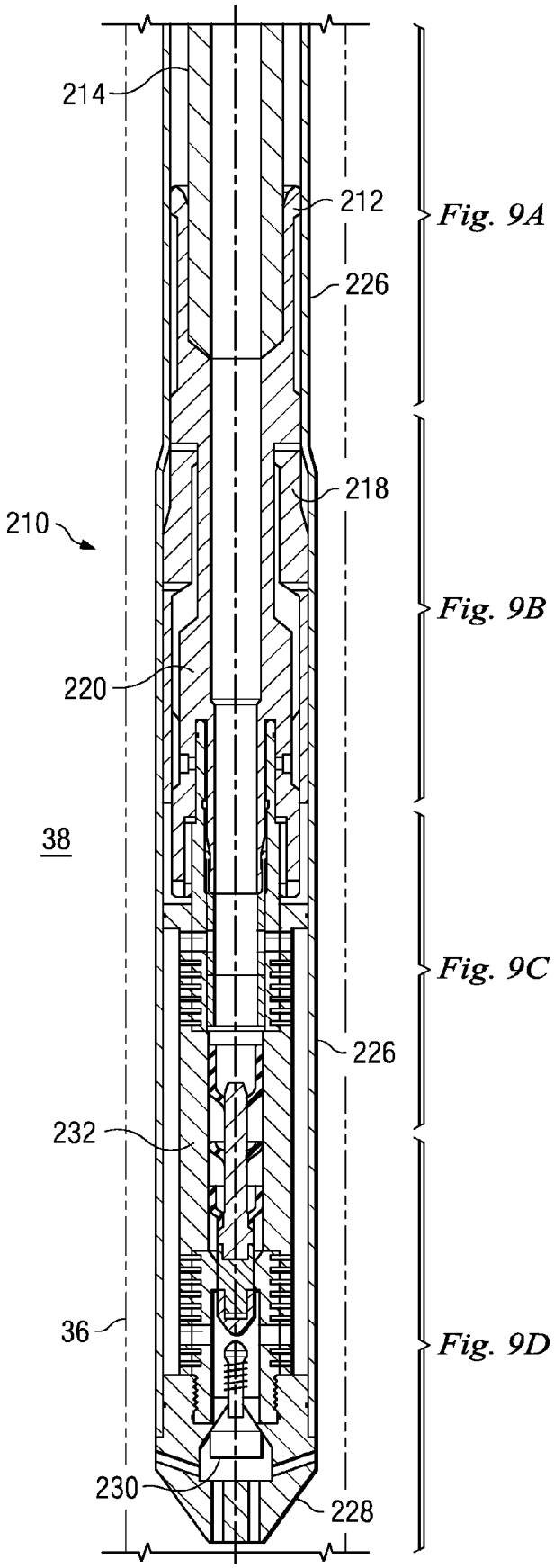
FIGS. 9, 9*a*, 9*b*, 9*c*, and 9*d* are fragmentary cross-sectional illustrations of the apparatus of FIGS. 7, 7*a*, 7*b*, 7*c*, 7*d*, and 7*e* during the injection of a hardenable fluidic sealing material into an annulus between the exterior of the apparatus and the wellbore.
Figure 9A:
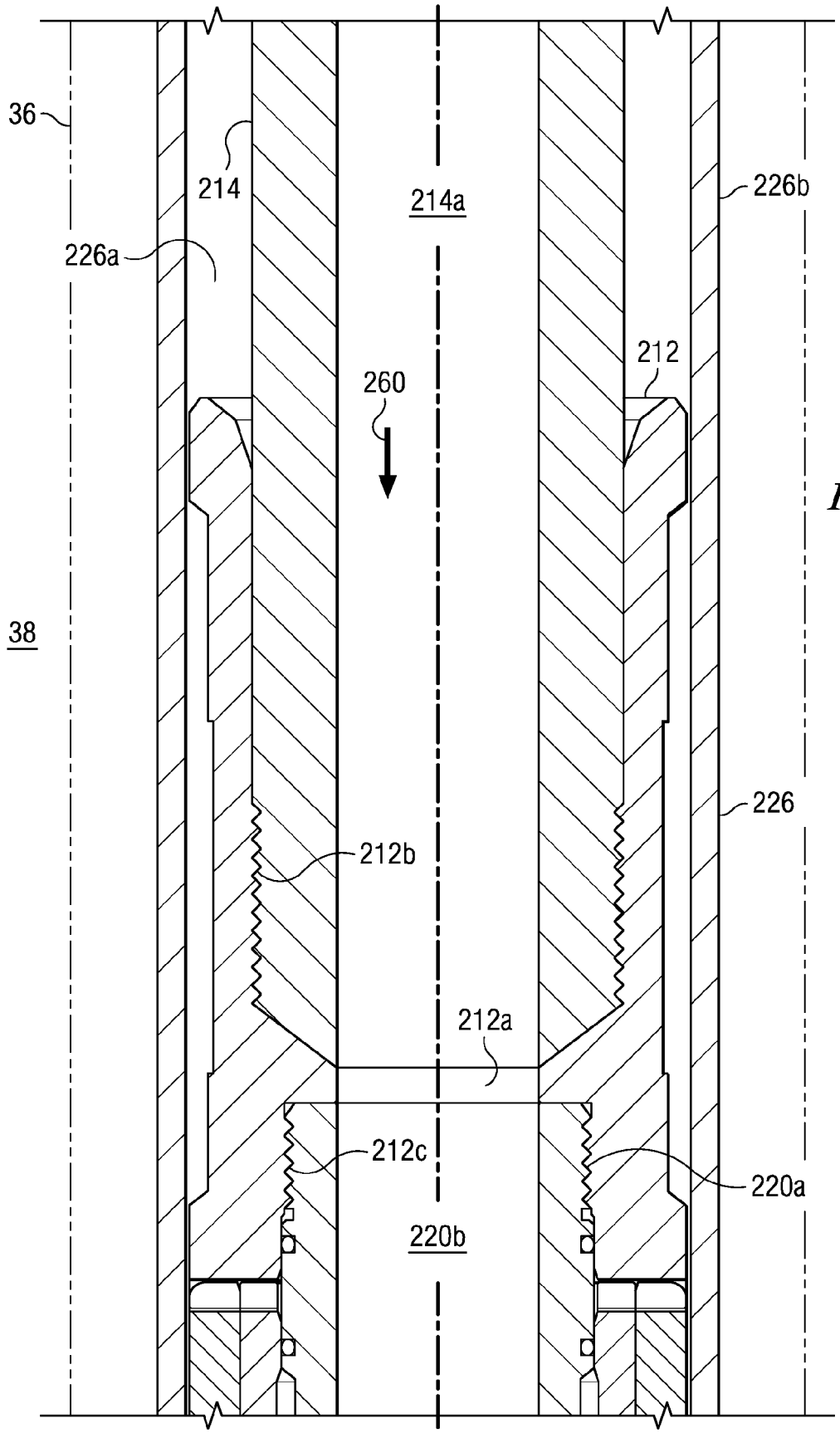
Figure 9B:
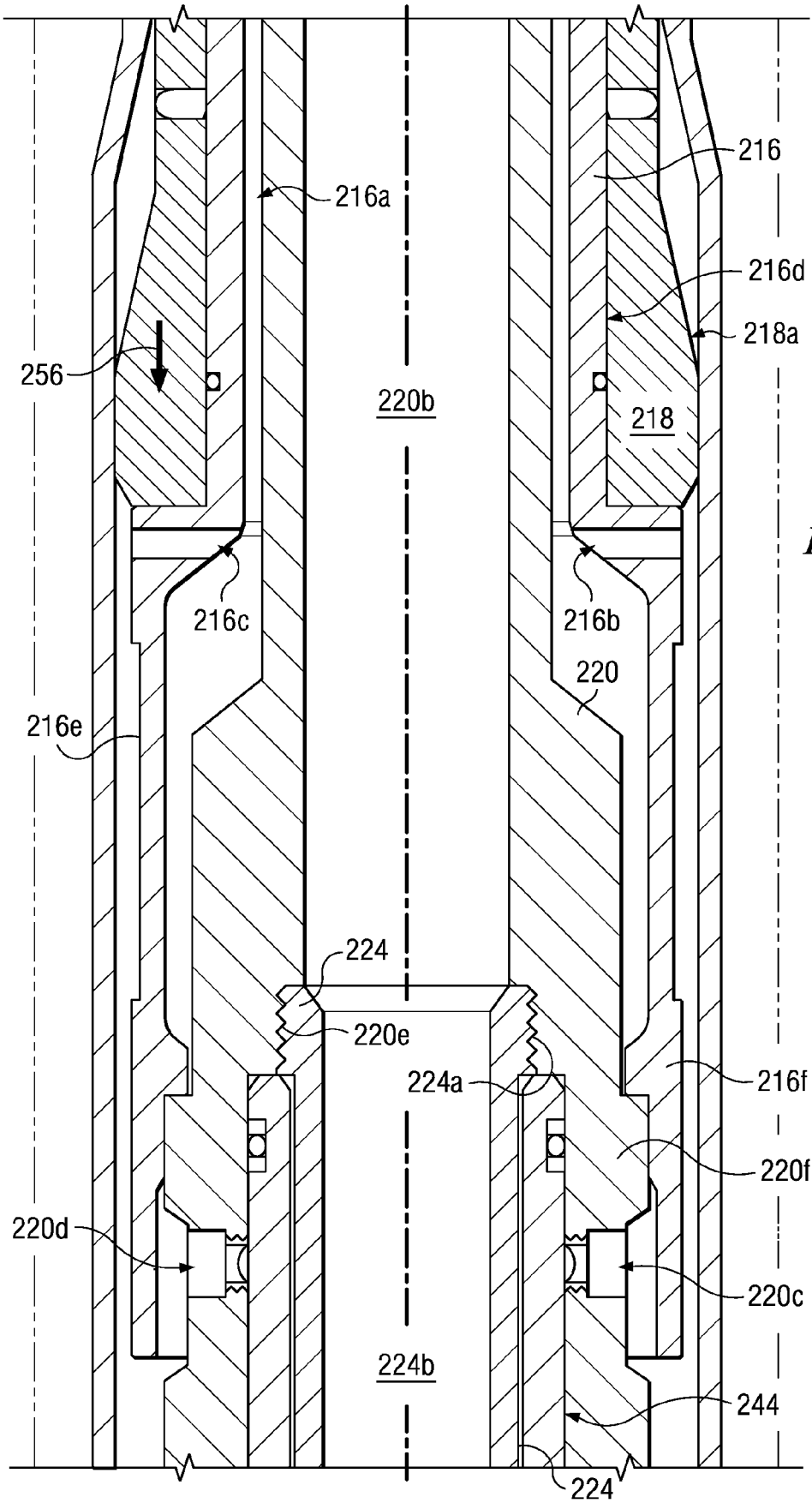
Figure 9C:
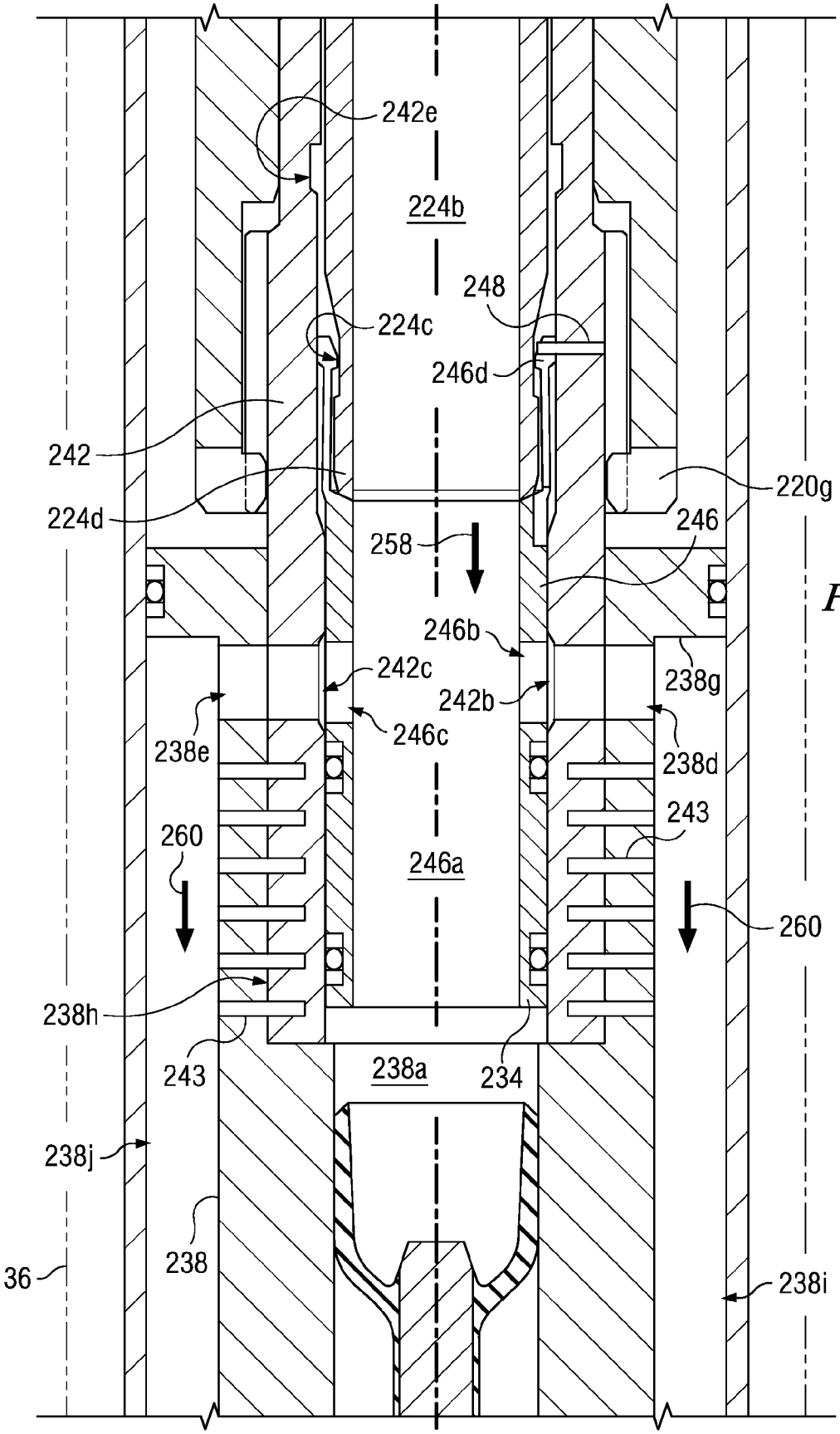
Figure 9D:
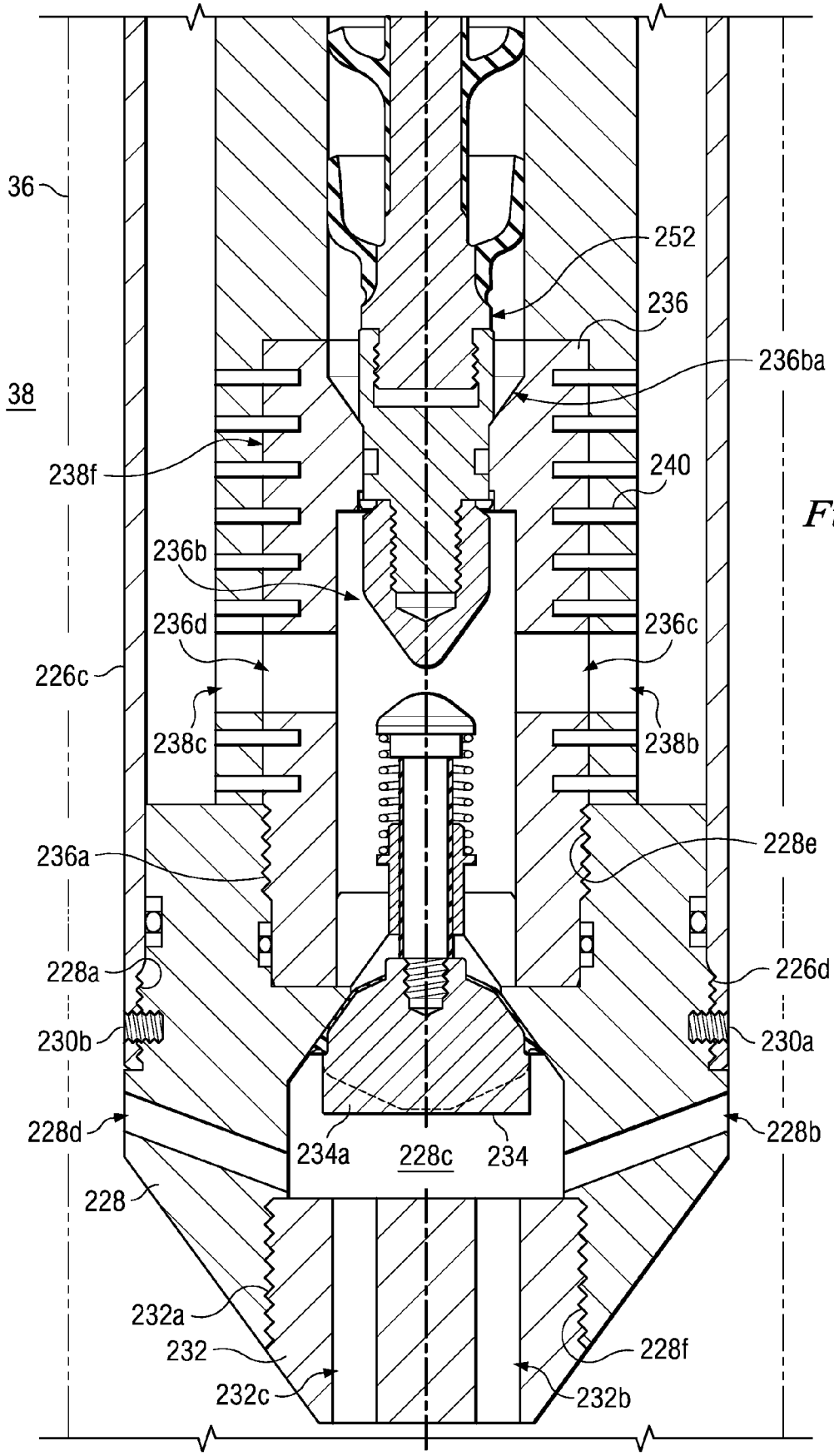

In an exemplary embodiment, as illustrated in FIG. 7*a*, the tubular body 238 further defines longitudinal passages, 238*i* and 238*j*, for fluidicly coupling the upper and lower flow ports, 238*d* and 238*e* and 238*b* and 238*c*, respectively.

One or more retaining pins 240 couple the other end of the tubular plug seat 236 to the internal annular recess 238*f* of the tubular body.

An end of a sealing sleeve 242 that defines an internal passage 242*a* and upper flow ports, 242*b* and 242*c*, and includes external splines 242*d* that mate with and receive the internal splines 220*g* of the tubular support 220 and an internal annular recess 242*e* is received within and mates with the internal annular recess 238*g* at the other end of the tubular body. The other end of the sealing sleeve 242 is received within an annulus defined between the interior surface of the other end of the tubular support 220 and the exterior surface of the tubular stinger 224, and sealingly engages the interior surface of the other end of the tubular support 220. In an exemplary embodiment, the sealing sleeve 242 is fabricated from aluminum in order to reduce weight and cost of the component. One or more retaining pins 243 coupled the end of the sealing sleeve 242 to the internal annular recess 238*g* at the other end of the tubular body 238. An annular passage 244 is further defined between the interior surface of the other end of the tubular body sealing sleeve 242 and the exterior surface of the tubular stinger 224.

A sliding sleeve valve 246 is movably received and supported within the internal passage 242*a* of the sealing sleeve 242 that defines an internal passage 246*a* and radial passages, 246*b* and 246*c*, and includes collet fingers 246*d* at one end positioned within the annular recess 242*e* of the sealing sleeve for releasably engaging the external flange 224*d* of the tubular stinger 224. The sliding sleeve valve 246 sealingly engages the internal surface of the internal passage 242*a* of the sealing sleeve 242, and blocks the upper flow ports, 242*b* and 242*c* and 238*d* and 238*e*, of the sealing sleeve and the tubular body, respectively. A valve guide pin 248 is coupled to the sealing sleeve 242 for engaging the collet fingers 246*d* of the sliding sleeve valve 246 and thereby guiding and limiting the movement of the sliding sleeve valve.

During operation, as illustrated in FIGS. 7, 7*a*, 7*b*, 7*c*, 7*d* and 7*e*, the apparatus 200 is positioned within a preexisting structure such as, for example, the wellbore 36 that traverses the subterranean formation 38. In an exemplary embodiment, during or after the positioning of the apparatus 200 within the wellbore 36, fluidic materials 250 may be circulated through and out of the apparatus into the wellbore 36 though the internal passages 214*a*, 212*a*, 220*b*, 224*b*, 246*a*, 242*a*, 238*a*, 236*b*, 228*b*, 228*c*, 228*d*, 232*b*, and 232*c*.

In an exemplary embodiment, as illustrated in FIGS. 8, 8*a*, 8*b*, 8*c*, and 8*d*, during operation of the apparatus 200, a conventional plug valve element 252 may then be injected into the apparatus through the passages 214*a*, 212*a*, 220*b*, 224*b*, 246*a*, 242*a*, 238*a*, and 236*b* until the plug valve element is seated in the plug seat 236*ba* of the internal passage 236*b* of the tubular plug seat 236. As a result, the flow of fluidic materials through the lower portion of the internal passage 236*b* of the tubular plug seat 236 is blocked. Continued injection of fluidic materials 250 into the apparatus 200, following the seating of the plug valve element 252 in the plug seat 236*ba* of the internal passage 236*b* of the tubular plug seat 236, pressurizes the internal annular passage 244 and thereby causes the rupture discs, 222*a* and 222*b*, to be ruptured thereby opening the internal passages, 220*c* and 220*d*, of the tubular support 220. As a result, fluidic materials 250 are then conveyed through the internal passages, 220*c* and 220*d*, thereby pressurizing a region within the apparatus 200 below the tubular expansion cone 218. As a result, the tubular support 212, tubular support 214, tubular support 216, tubular expansion cone 218, tubular support 220, and tubular stinger 224 are displaced upwardly in the direction 254 relative to the expandable tubular member 226, shoe 228, shoe insert 232, tubular plug seat 236, tubular body 238, sealing sleeve 242, and sliding sleeve valve 236 thereby radially expanding and plastically deforming the expandable tubular member.

During the continued upward displacement of the tubular support 212, tubular support 214, tubular support 216, tubular expansion cone 218, tubular support 220, and tubular stinger 224 in the direction 254 relative to the expandable tubular member 226, shoe 228, shoe insert 232, tubular plug seat 236, tubular body 238, sealing sleeve 242, and sliding sleeve valve 236, the upward movement of the sliding sleeve valve is prevented by the operation of the valve guide pin 248. Consequently, at some point, the collet fingers 246*d* of the sliding sleeve valve 246 disengage from the external flange 224*d* of the tubular stinger 224.

In an exemplary embodiment, as illustrated in FIGS. 9, 9*a*, 9*b*, 9*c*, and 9*d*, during operation of the apparatus 200, before or after radially expanding and plastically deforming the expandable tubular member 226, the tubular support 212, tubular support 214, tubular support 216, tubular expansion cone 218, tubular support 220, and tubular stinger 224 are displaced downwardly in the direction 256 relative to the expandable tubular member 226, shoe 228, shoe insert 232, tubular plug seat 236, tubular body 238, sealing sleeve 242, and sliding sleeve valve 236 by, for example, setting the apparatus down onto the bottom of the wellbore 36. As a result, the end of the sealing sleeve 242 that is received within the annulus defined between the interior surface of the other end of the tubular support 220 and the exterior surface of the tubular stinger 224 and that sealingly engages the interior surface of the tubular support 220 is displaced upwardly relative to the tubular support and tubular stinger thereby preventing fluidic materials from passing through the annular passage 244 into the radial passages, 220*c* and 220*d*, of the tubular support. Furthermore, as a result, the other end of the tubular stinger 224 impacts and displaces the sliding sleeve valve 246 downwardly in the direction 258 thereby aligning the internal passages, 238*d* and 238*e* and 242*b* and 242*c*, of the tubular body 238 and sealing sleeve 242, respectively, with the internal passages, 246*b* and 246*c*, respectively, of the sliding sleeve valve. A hardenable fluidic sealing material 260 may then be injected into the apparatus 200 through the internal passages 214*a*, 212*a*, 220*b*, 224*b*, and 246*a*, into and through the internal passages 238*d*, 238*e*, 242*b*, 242*c*, 246*b* and 246*c*, into and through the longitudinal grooves, 238*i* and 238*j*, into and through the internal passages, 236*a*, 236*b*, 238*b* and 238*c*, and then out of the apparatus through the internal passages 228*b*, 228*c*, 228*d* of the shoe 228*f* and 232*b* and 232*c* of the shoe insert 232 into the annulus between the exterior surface of the expandable tubular member 226 and the interior surface of the wellbore 36. As a result, an annular body of a hardenable fluidic sealing material such as, for example, cement is formed within the annulus between the exterior surface of the expandable tubular member 226 and the interior surface of the wellbore 36. Before, during, or after the curing of the annular body of the hardenable fluidic sealing material, the apparatus may then be operated as described above with reference to FIG. 8 to radially expand and plastically deform the expandable tubular member 226.

Figure 10:
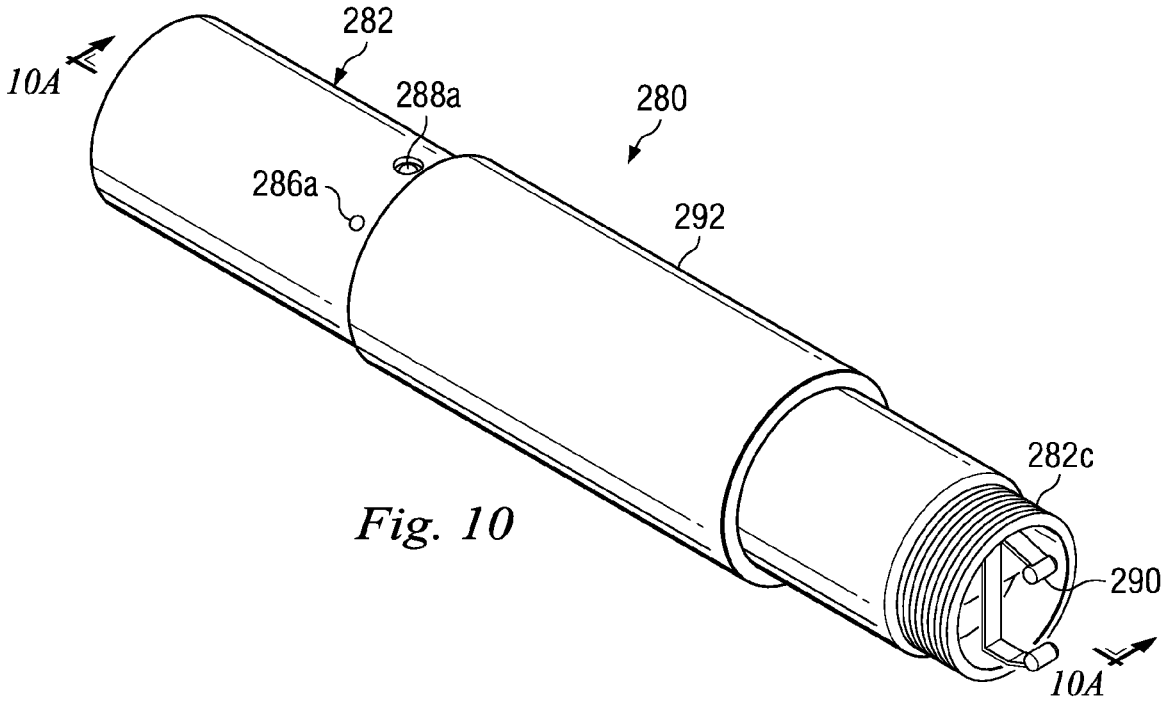
FIG. 10 is a perspective illustration of an exemplary embodiment of an assembly including an exemplary embodiment of a tubular support, an exemplary embodiment of a one-way poppet valve, an exemplary embodiment of a sliding sleeve, and an exemplary embodiment of a tubular body.
Figure 10B:
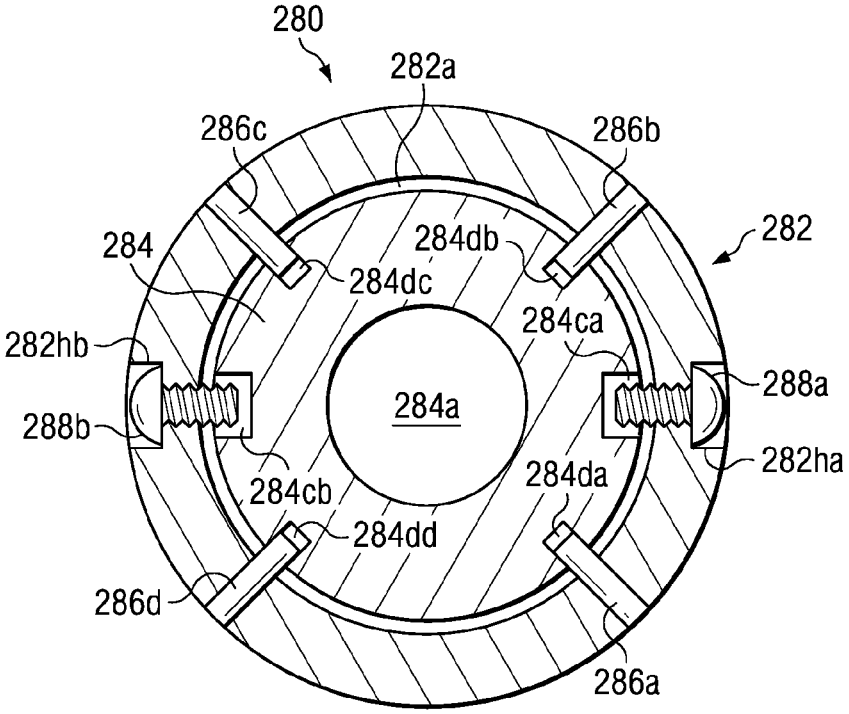
FIG. 10*b* is a cross-sectional illustration of the assembly of FIGS. 10 and 10*a* taken along line 10B-10B.
Figure 10A:
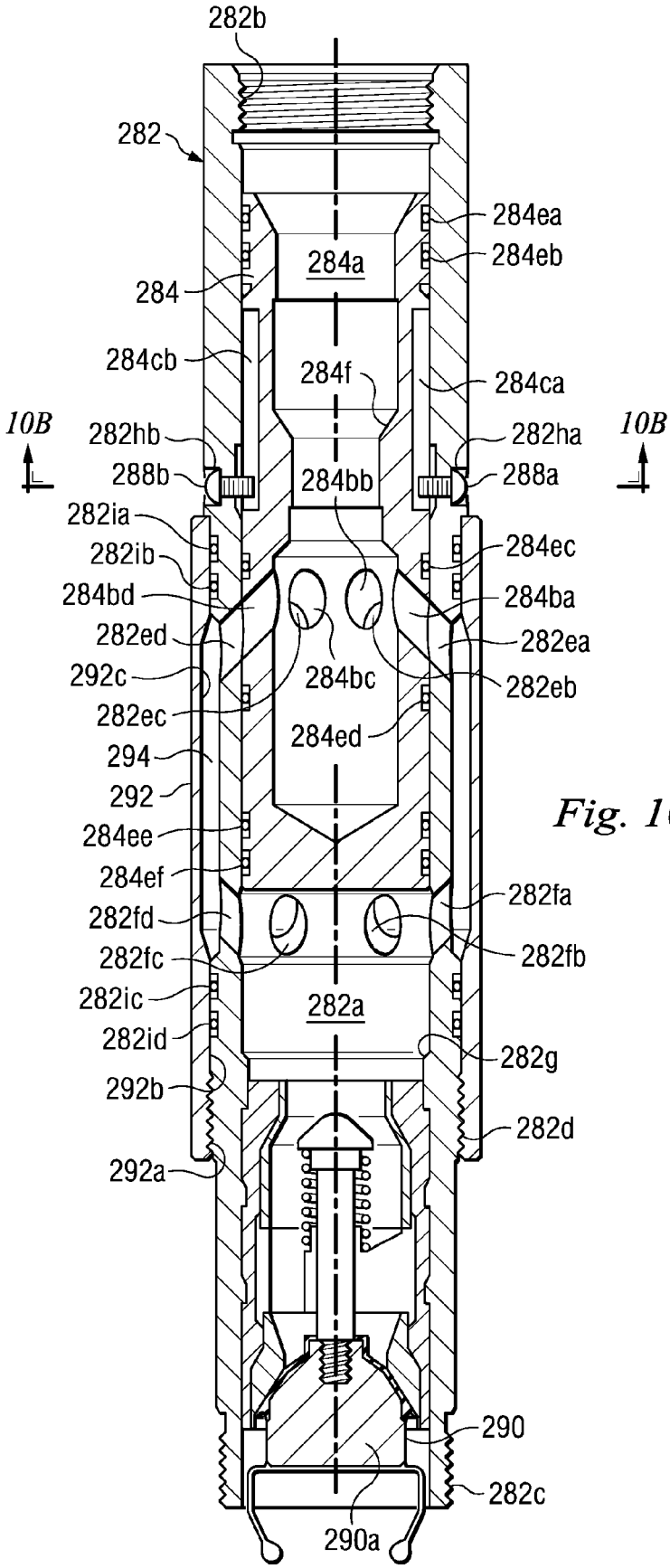
FIG. 10*a* is a cross-sectional illustration of the assembly of FIG. 10 taken along line 10A-10A.

In an exemplary embodiment, as illustrated in FIGS. 10, 10*a* and 10*b*, an exemplary embodiment of a flow control device 280 includes a tubular support 282 that defines an internal passage 282*a* and includes an internal threaded connection 282*b* at one end, an external threaded connection 282*c* at another end, and an external threaded connection 282*d* between the ends of the tubular support 282. The tubular support 282 defines a plurality of generally circumferentially-spaced flow ports 282*ea*, 282*eb*, 282*ec* and 282*ed* at one axial location along the support 282, and a plurality of generally circumferentially-spaced flow ports 282*fa*, 282*fb*, 282*fc* and 282*fd* at another axial location along the support 282. The tubular support 282 further includes an internal shoulder 282*g*, counterbores 282*ha* and 282*hb*, and axially-spaced sealing elements 282*ia*, 282*ib*, 282*ic* and 282*id*, each of which extends within a respective annular channel formed in the exterior surface of the tubular support 282. In an exemplary embodiment, each of the sealing elements 282*ia*, 282*ib*, 282*ic* and 282*id* is an o-ring.

A sliding sleeve 284 that defines a longitudinally-extending internal passage 284*a* and a plurality of generally circumferentially-spaced flow ports 284*ba*, 284*bb*, 284*bc* and 284*bd*, and includes longitudinally-extending channels 284*ca* and 284*cb*, generally circumferentially-spaced bores 284*da*, 284*db*, 284*dc* and 284*dd*, axially-spaced sealing elements 284*ea*, 284*eb*, 284*ec*, 284*ed*, 284*ee* and 284*ef*, and a plug seat 284*f*, is received within the passage 282*a*, sealingly engaging the interior surface of the tubular support 282. In an exemplary embodiment, each of the sealing elements 284*ea*, 284*eb*, 284*ec*, 284*ed*, 284*ee* and 284*ef* is an o-ring that extends in an annular channel formed in the exterior surface of the sliding sleeve 284. The sliding sleeve 284 is adapted to move relative to, and slide against the interior surface of, the tubular support 282 under conditions to be described.

Circumferentially-spaced pins 286*a*, 286*b*, 286*c* and 286*d* extend through the tubular support 282 and into the bores 284*da*, 284*db*, 284*dc* and 284*dd*, respectively, thereby locking the position of the sliding sleeve 284 relative to the tubular support 282. Protrusions such as, for example, fasteners 288*a* and 288*b*, extend through the counterbores 282*ha* and 282*hb*, respectively, of the tubular support 282 and into the channels 284*ca* and 284*cb*, respectively, to guide and limit the movement of the sliding sleeve 284 relative to the tubular support 282. Moreover, the pins 286*a*, 286*b*, 286*c* and 286*d*, and the fasteners 288*a* and 288*b*, are adapted to prevent the sliding sleeve 284 from rotating about its longitudinal axis, relative to the tubular support 282.

A one-way poppet valve 290 is coupled to the tubular support 282 and includes a movable valve element 290*a* for controllably sealing an opening of the internal passage 282*a* of the tubular support 282. In an exemplary embodiment, the one-way poppet valve 290 only permits fluidic materials to flow through the internal passage 282*a* of the tubular support 282 in one direction. In an exemplary embodiment, the one-way poppet valve 290 only permits fluidic materials to flow through the internal passage 282*a* of the tubular support 282 in the downward direction as viewed in FIG. 10*a*.

An internal threaded connection 292*a* of an outer sleeve 292 that defines an internal passage 292*b* through which the tubular support 282 extends and includes an internal annular recess 292*c*, is coupled to the external threaded connection 282*d* of the tubular support 282. As a result, the tubular support 282 is coupled to the outer sleeve 292, with the sealing elements 282*ia* and 282*ib* sealingly engaging the interior surface of the outer sleeve 292 above the internal annular recess 292*c*, and the sealing elements 282*ic* and 282*id* sealingly engaging the interior surface of the outer sleeve 292 below the internal annular recess 292*c*. An annular region 294 is defined between the exterior surface of the tubular support 282 and the interior surface of the outer sleeve 292 defined by the internal annular recess 292*c*.

Referring to FIGS. 11, 11*a*, 11*b*, 11*c*, and 11*d*, an exemplary embodiment of an apparatus 300 for radially expanding and plastically deforming a tubular member includes a tubular support 312 that defines a internal passage 312*a* and includes a threaded connection 312*b* at one end and a threaded connection 312*c* at another end. In an exemplary embodiment, during operation of the apparatus 300, a threaded end of a tubular support member 314 that defines a passage 314*a* may be coupled to the threaded connection 312*b* of the tubular support member 312.

An end of a tubular support 316 that defines an internal passage 316*a* and radial passages, 316*b* and 316*c*, and includes an external annular recess 316*d*, an external sleeve 316*e*, and an internal flange 316*f* is coupled to the other end of the tubular support 312. A tubular expansion cone 318 that includes a tapered external expansion surface 318*a* is received within and is coupled to the external annular recess 316*d* of the tubular support 316 and an end of the tubular expansion cone 318 abuts an end face of the external sleeve 316*e* of the tubular support 316.

A threaded connection 320*a* of an end of a tubular support 320 that defines an internal passage 320*b* having an enlarged-inside-diameter portion 320*ba*, defines radial passages, 320*c* and 320*d*, and includes an external flange 320*e*, and internal splines 320*f* at another end is coupled to the threaded connection 312*c* of the other end of the tubular support 312. In an exemplary embodiment, the external flange 320*e* of the tubular support 320 abuts the internal flange 316*f* of the tubular support 316. Rupture discs, 322*a* and 322*b*, are received and mounted within the radial passages, 320*c* and 320*d*, respectively, of the tubular support 320.

An end of a tubular support 324 defining an internal passage 324*a* and including an external flange 324*b*, an external threaded connection 324*c* at another end, and external splines 324*d* for mating with and engaging the internal splines 320*f* of the tubular support 320, extends within the enlarged-inside-diameter portion 320*ba* of the passage 320*b* of the tubular support 320, and sealingly engages an interior surface of the tubular support 320. The external threaded connection 324*c* of the tubular support 324 is coupled to the internal threaded connection 282*b* of the tubular support 282 of the flow control device 280 so that the other end of the tubular support 324 extends within the internal passage 282*a* of the tubular support 282. In an exemplary embodiment, the other end of the tubular support 324 is proximate an end of the sliding sleeve 284 of the flow control device 280. In an exemplary embodiment, the other end of the tubular support 324 abuts the end of the sliding sleeve 284 of the flow control device 280.

An expandable tubular member 326 that defines an internal passage 326*a* for receiving the tubular supports 312, 314, 316, and 320 mates with and is supported by the external expansion surface 318*a* of the tubular expansion cone 318 that includes an upper portion 326*b* having a smaller inside diameter and a lower portion 326*c* having a larger inside diameter and a threaded connection 326*d*.

A ring 327 through which the other end of the tubular support 324 extends abuts, and is disposed between, the external flange 324*b* of the tubular support 324 and the end of the tubular support 282 of the flow control device 280 proximate the internal threaded connection 282*b*. The ring 327 sealingly engages an exterior surface of the tubular support 324 and an interior surface of the expandable tubular member 326.

The external threaded connection 282*c* of the tubular support 282 of the flow control device 282 is coupled to an internal threaded connection 328*a* of a shoe 328 that defines internal passages, 328*b*, 328*c*, 328*d*, 328*e*, 328*f*, and 328*g*, and includes another threaded connection 328*h* that is coupled to the threaded connection 326*d* of the lower portion 326*c* of the expandable tubular member 326. As a result, the flow control device 282 is coupled to and extends between the tubular support 324 and the shoe 328. In an exemplary embodiment, the one-way poppet valve 290 of the flow control device 280 only permits fluidic materials to be exhausted from the apparatus 300.

Figure 11:
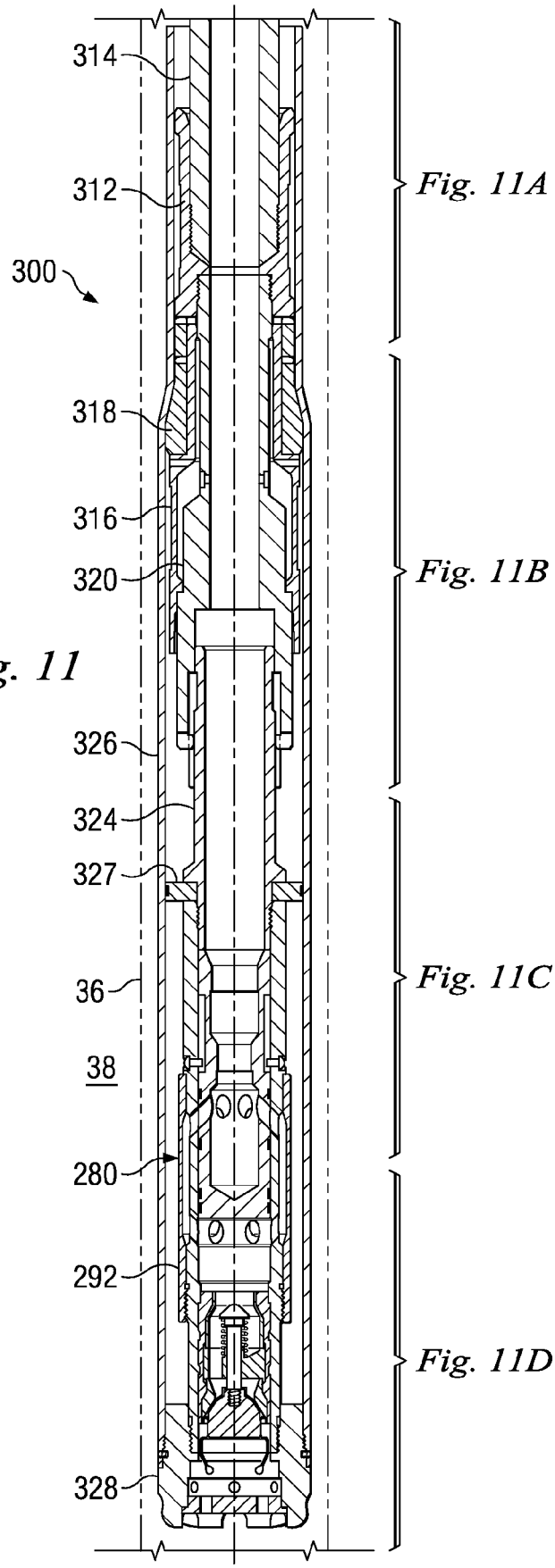
FIGS. 11, 11*a*, 11*b*, 11*c* and 11*d* are fragmentary cross-sectional illustrations of an exemplary embodiment of an apparatus for radially expanding and plastically deforming a tubular member during the placement of the apparatus within a wellbore, the apparatus including the assembly of FIGS. 10, 10*a* and 10*b*.
Figure 11A:
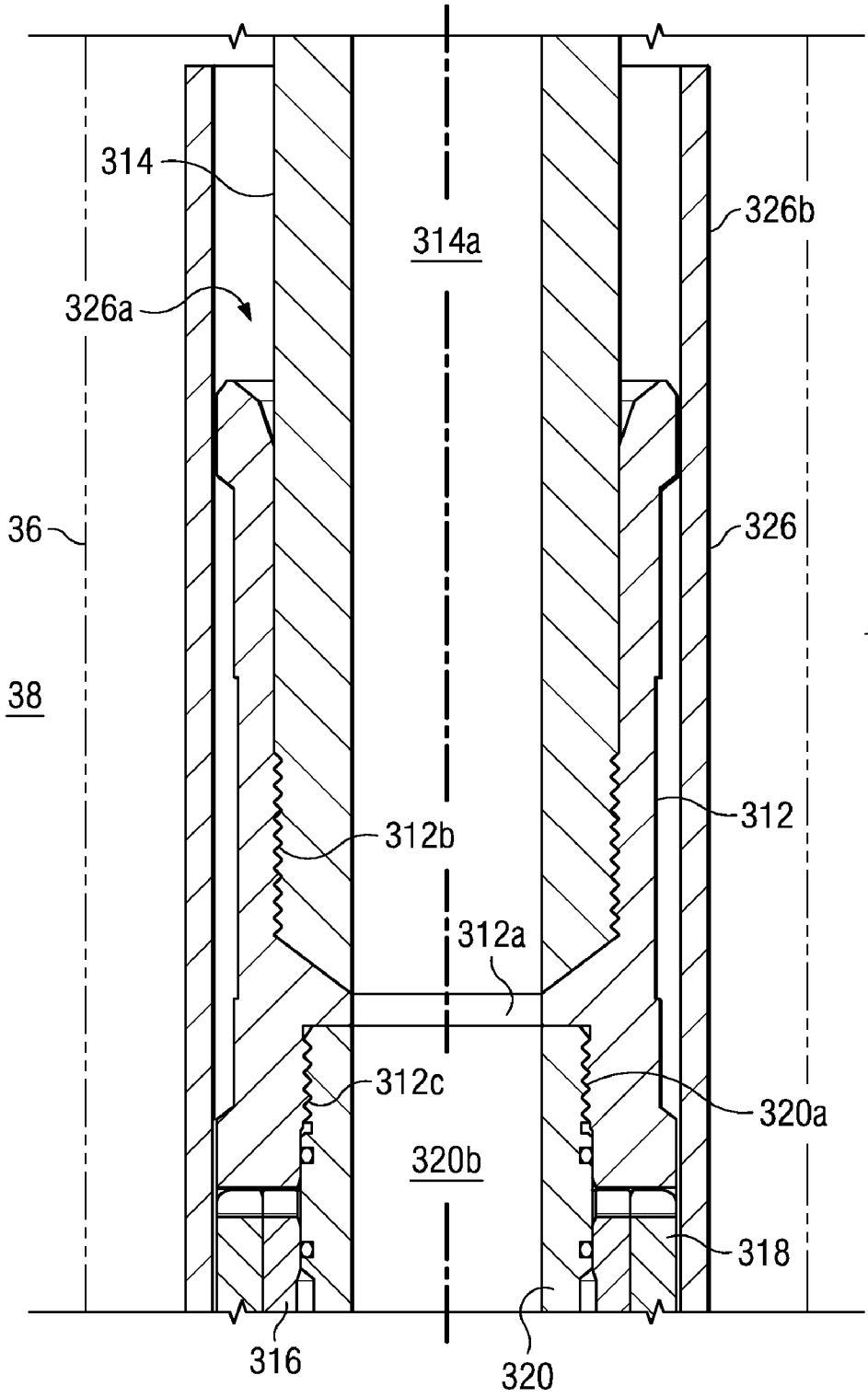
Figure 11B:
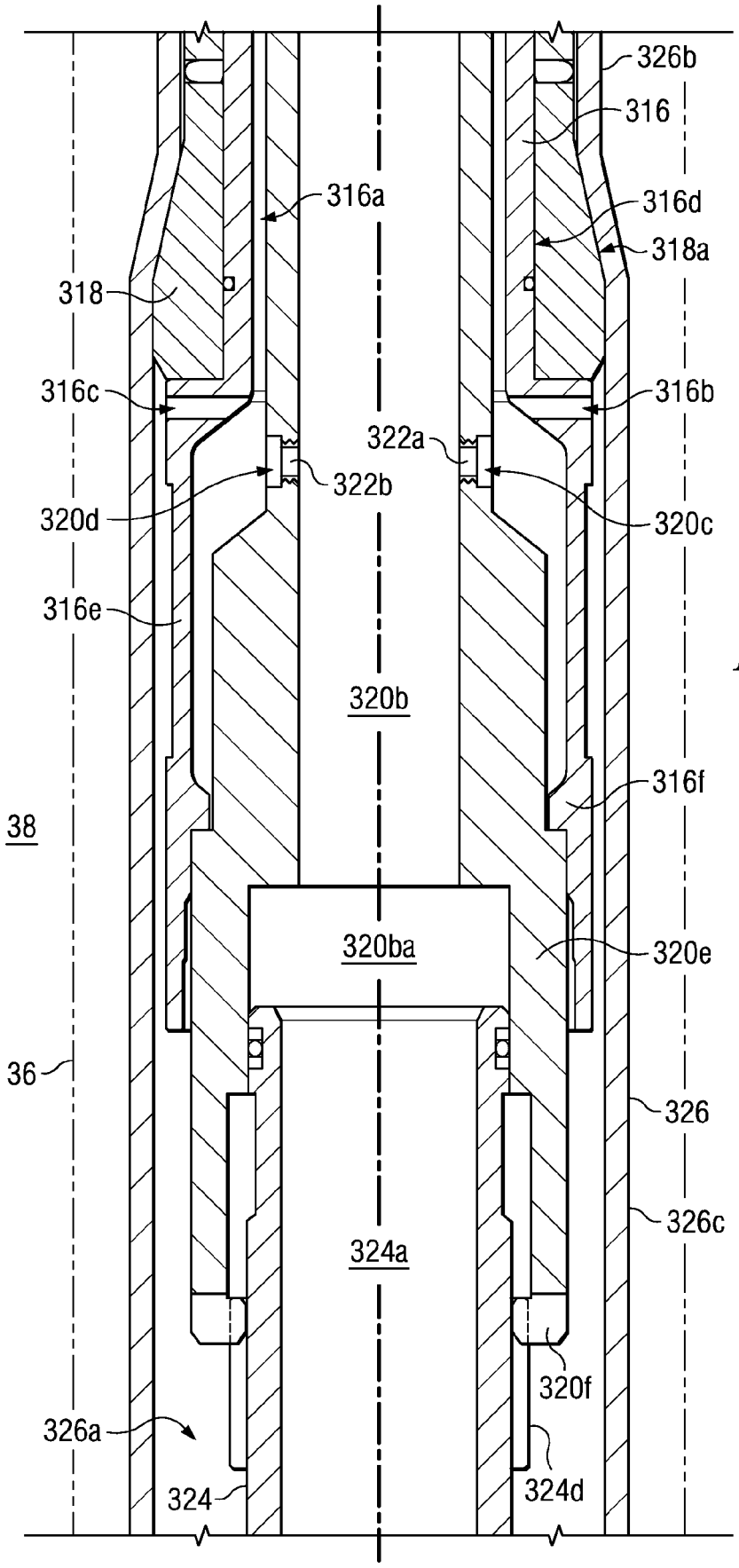
Figure 11C:
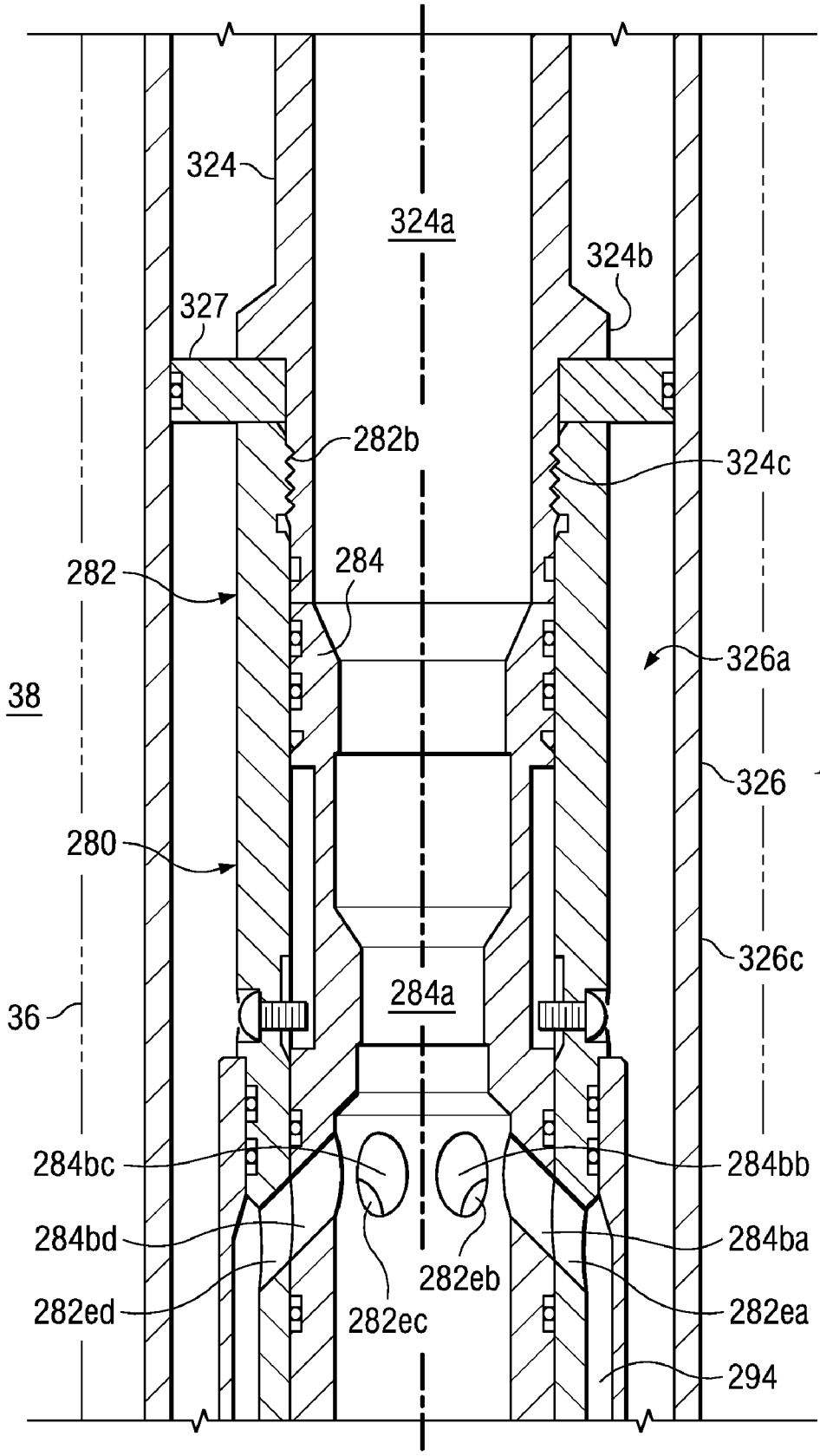
Figure 11D:
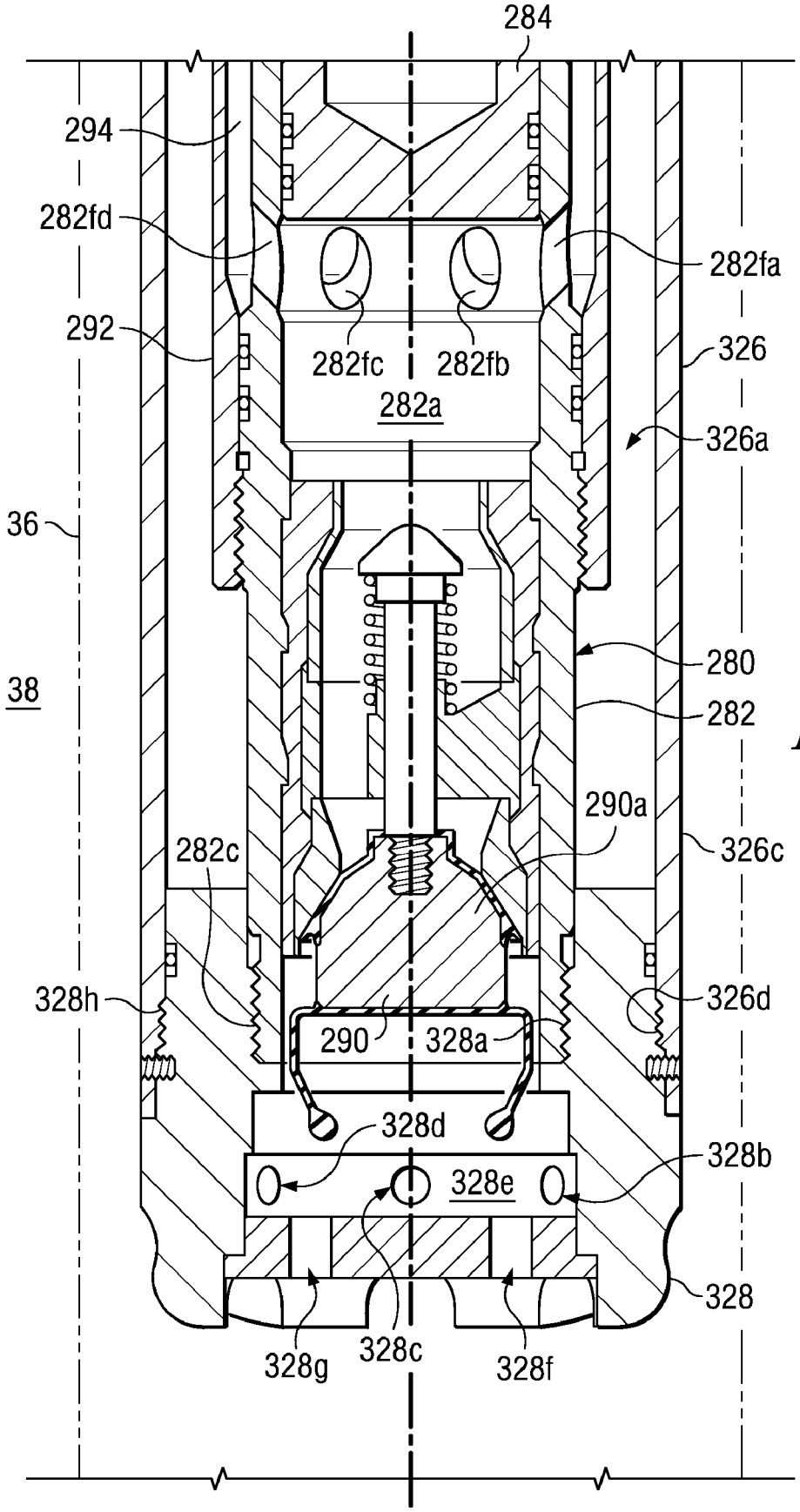
Figure 12:
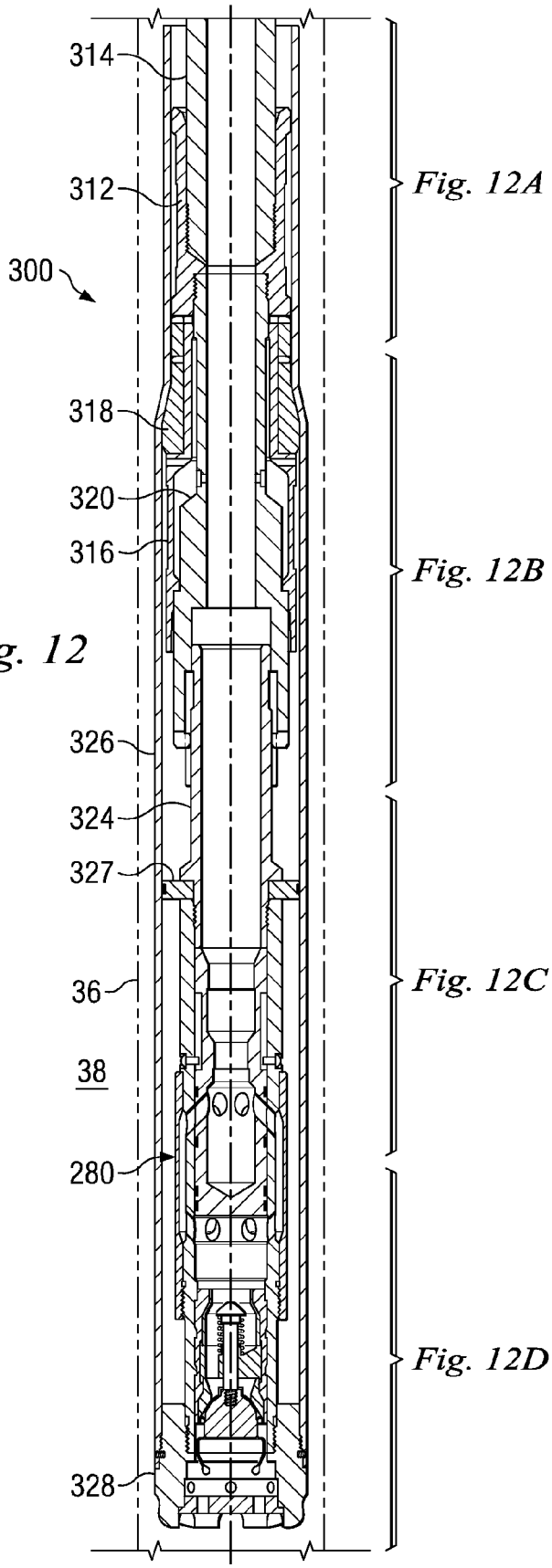
FIGS. 12, 12*a*, 12*b*, 12*c* and 12*d* are fragmentary cross-sectional illustrations of the apparatus of FIGS. 11, 11*a*, 11*b*, 11*c* and 11*d* during the injection of a fluidic material into an annulus between the exterior of the apparatus and the wellbore.
Figure 12A:
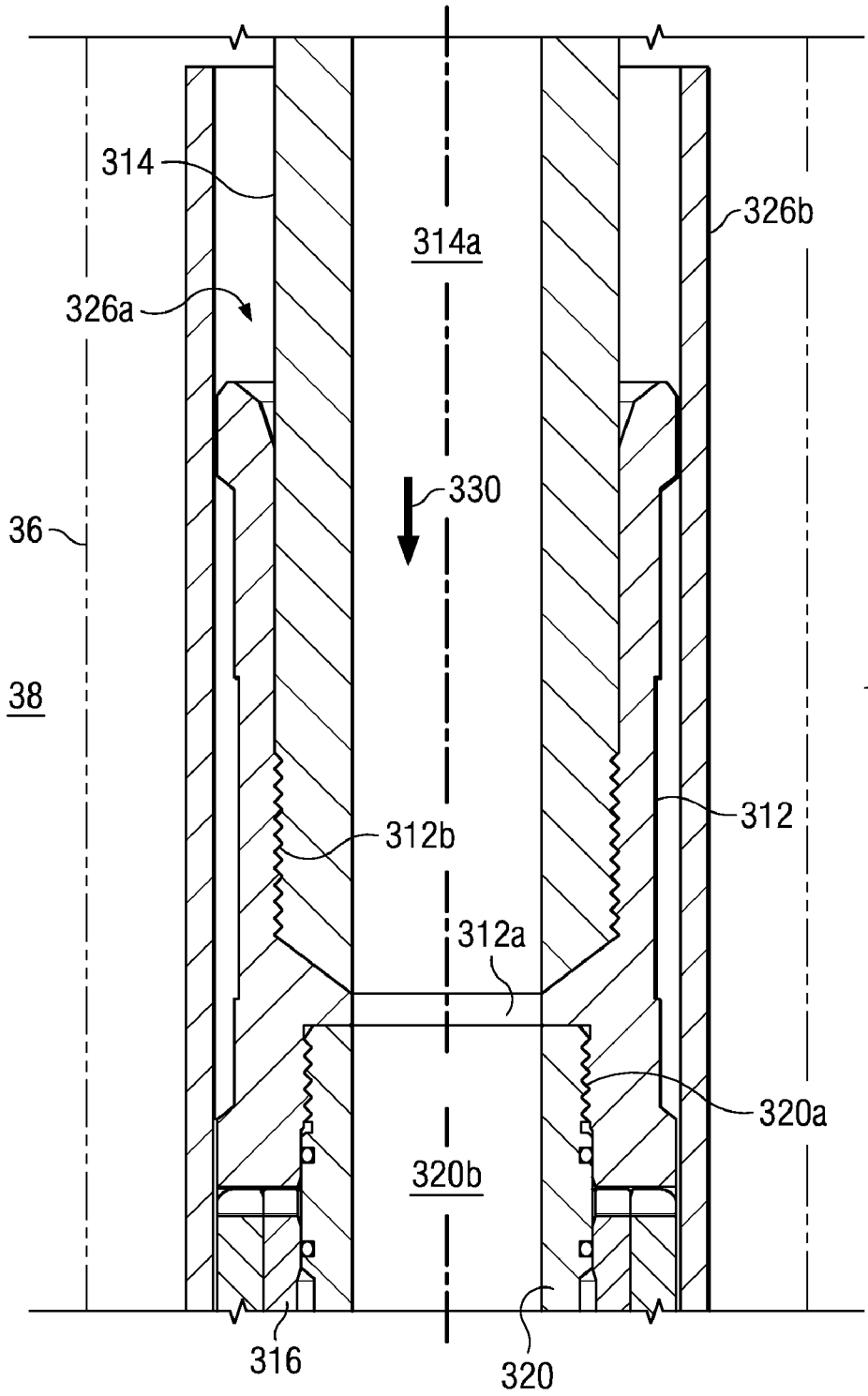
Figure 12B:
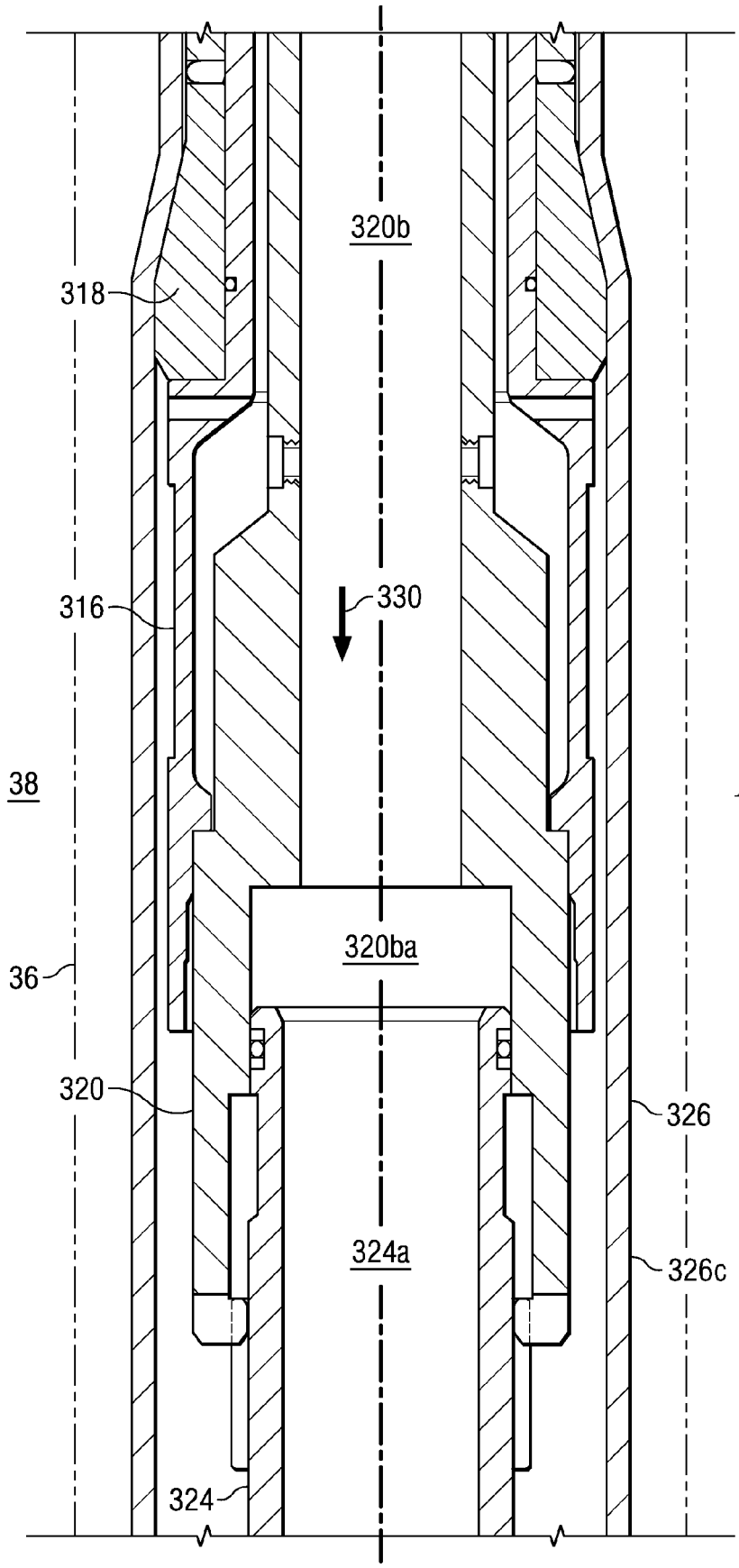
Figure 12C:
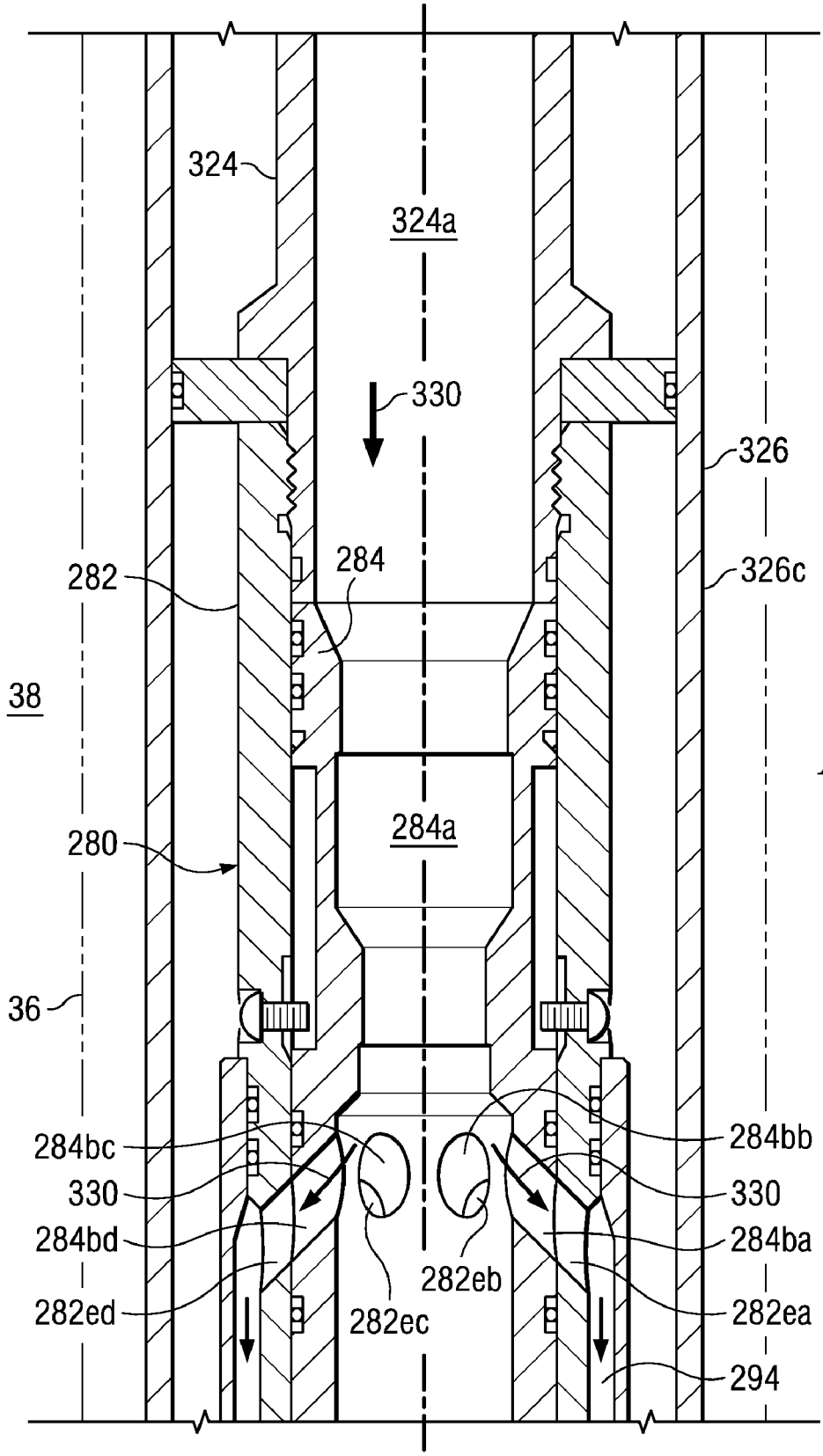
Figure 12D:
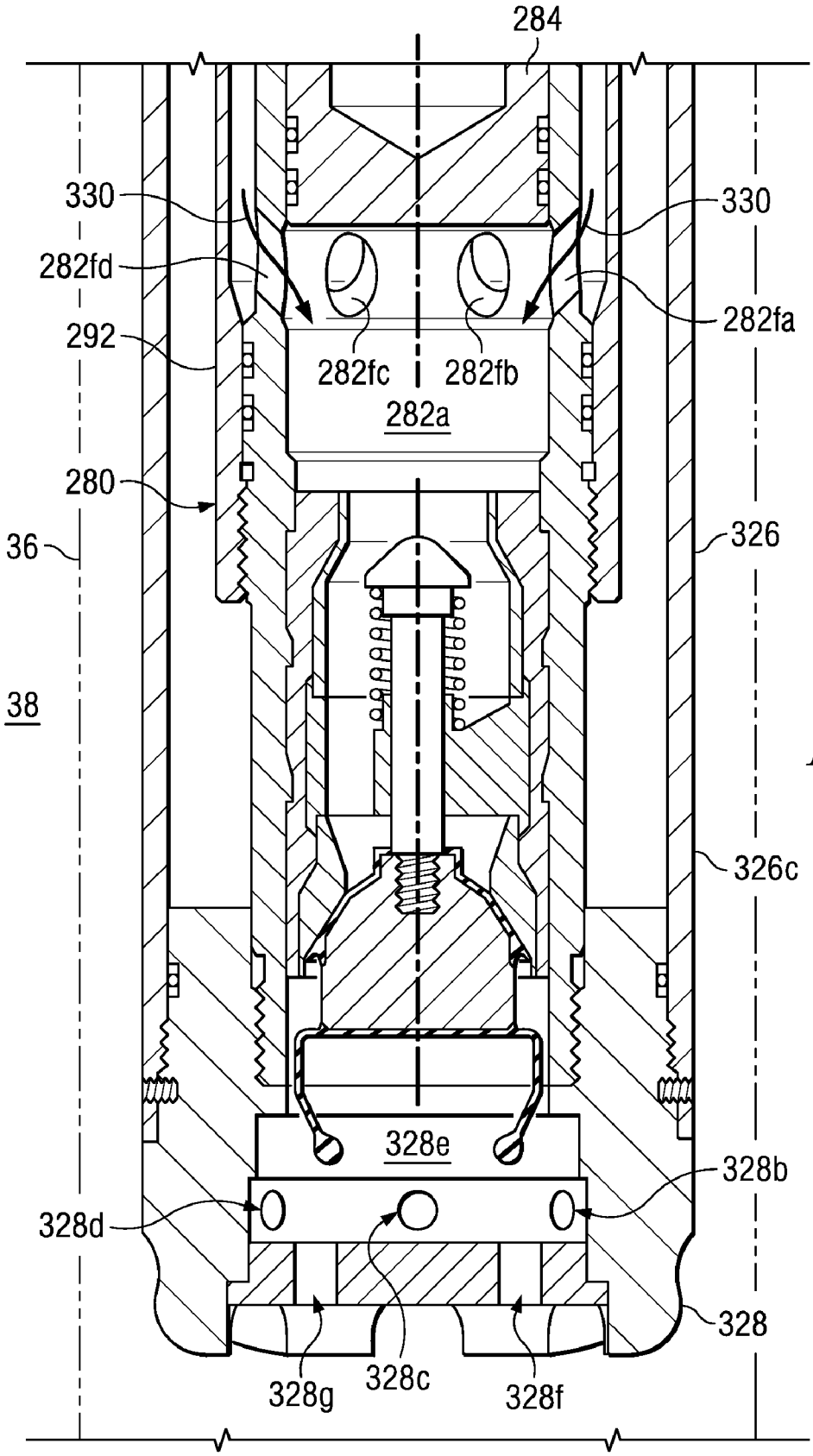
Figure 13:
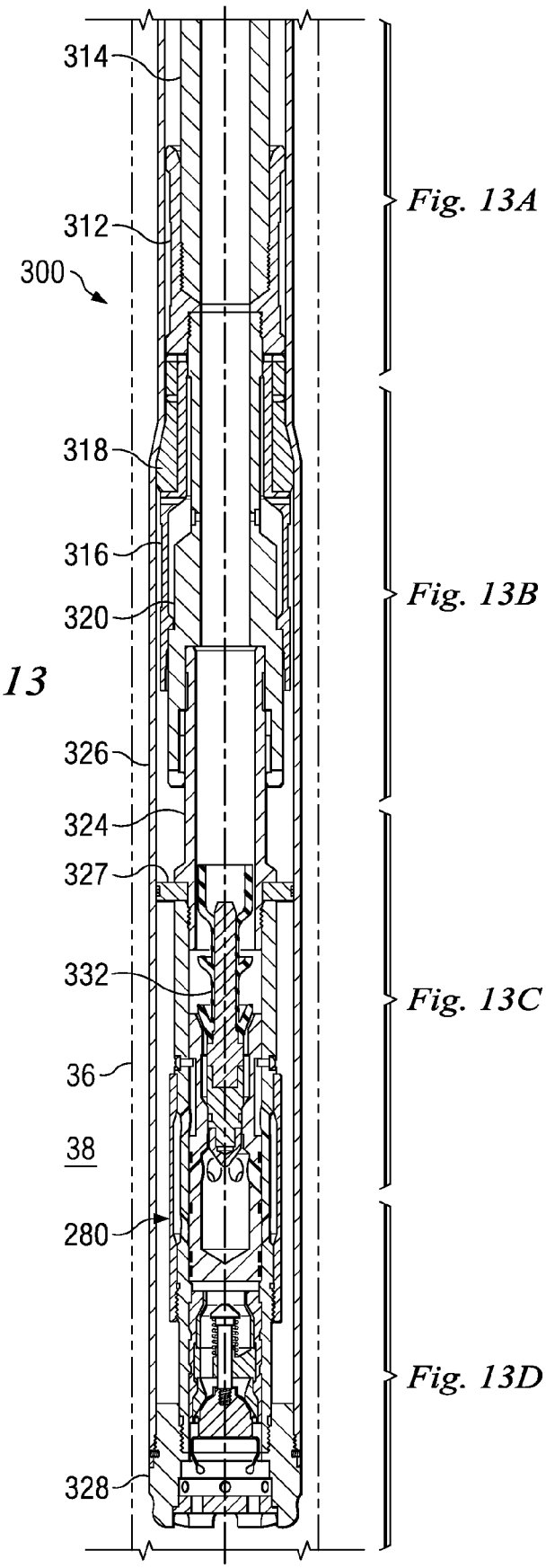
FIGS. 13, 13*a*, 13*b*, 13*c* and 13*d* are fragmentary cross-sectional illustrations of the apparatus of FIGS. 11, 11*a*, 11*b*, 11*c* and 11*d* during the radial expansion and plastic deformation of the tubular member.
Figure 13A:
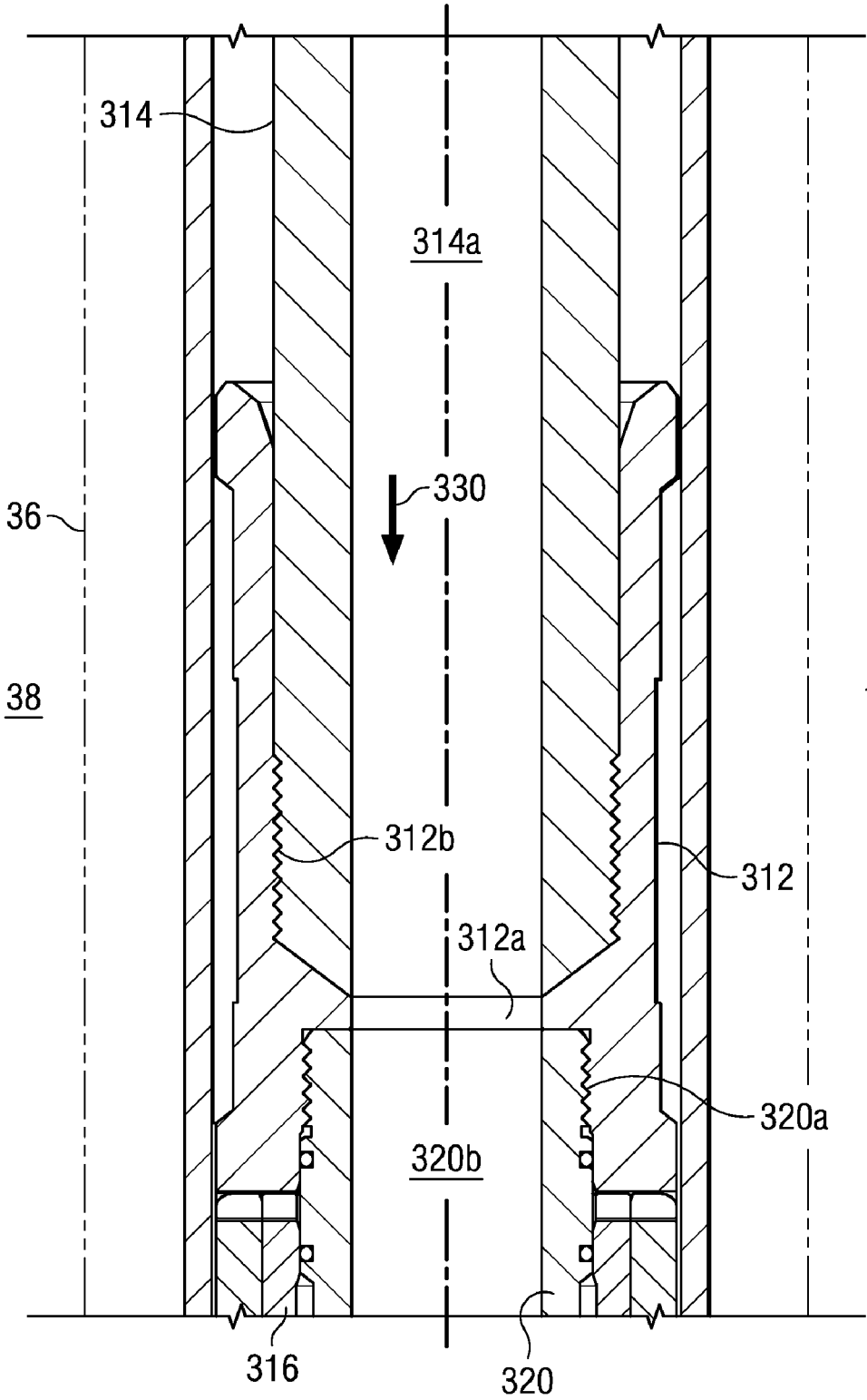
Figure 13B:
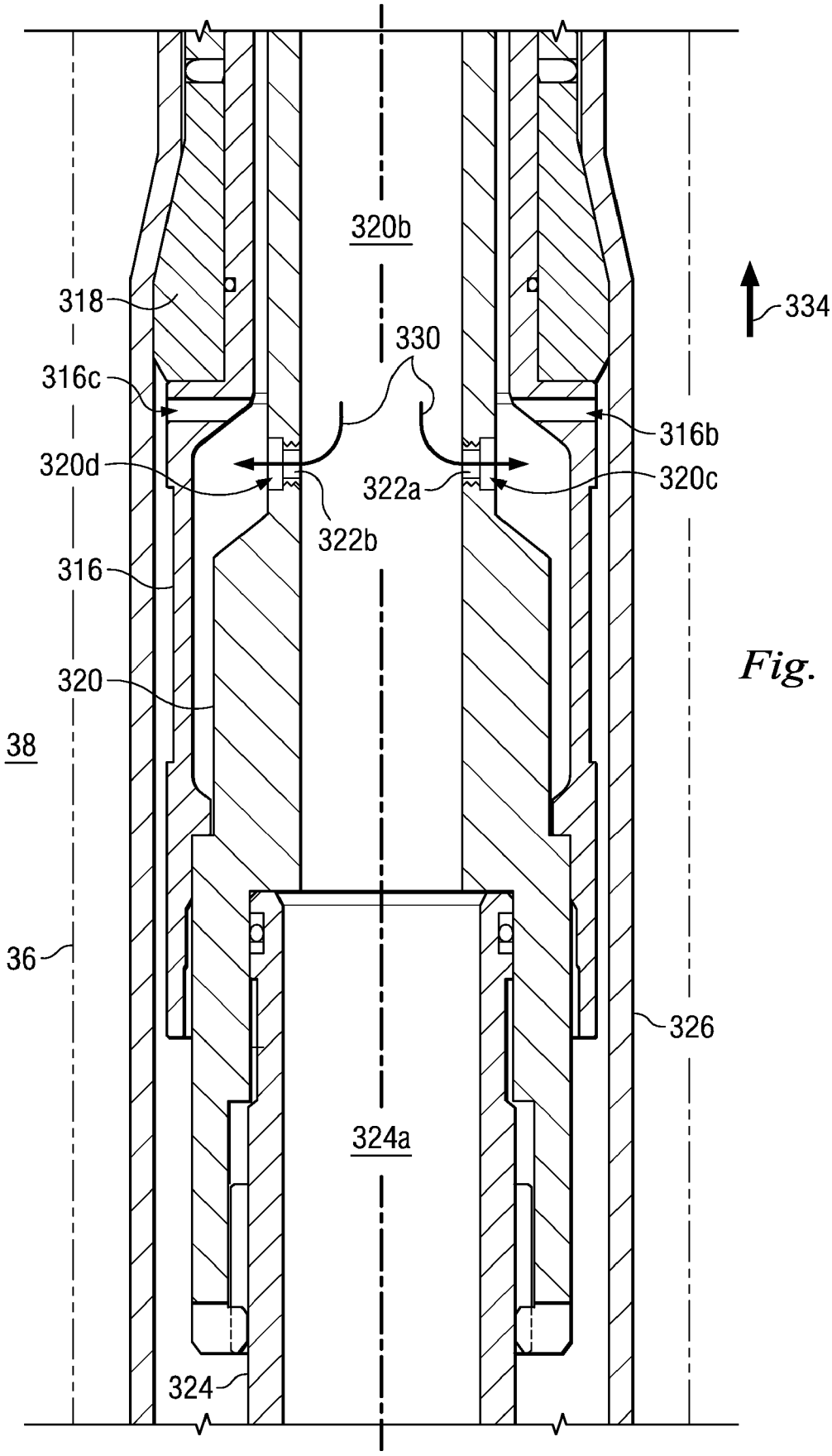
Figure 13C:
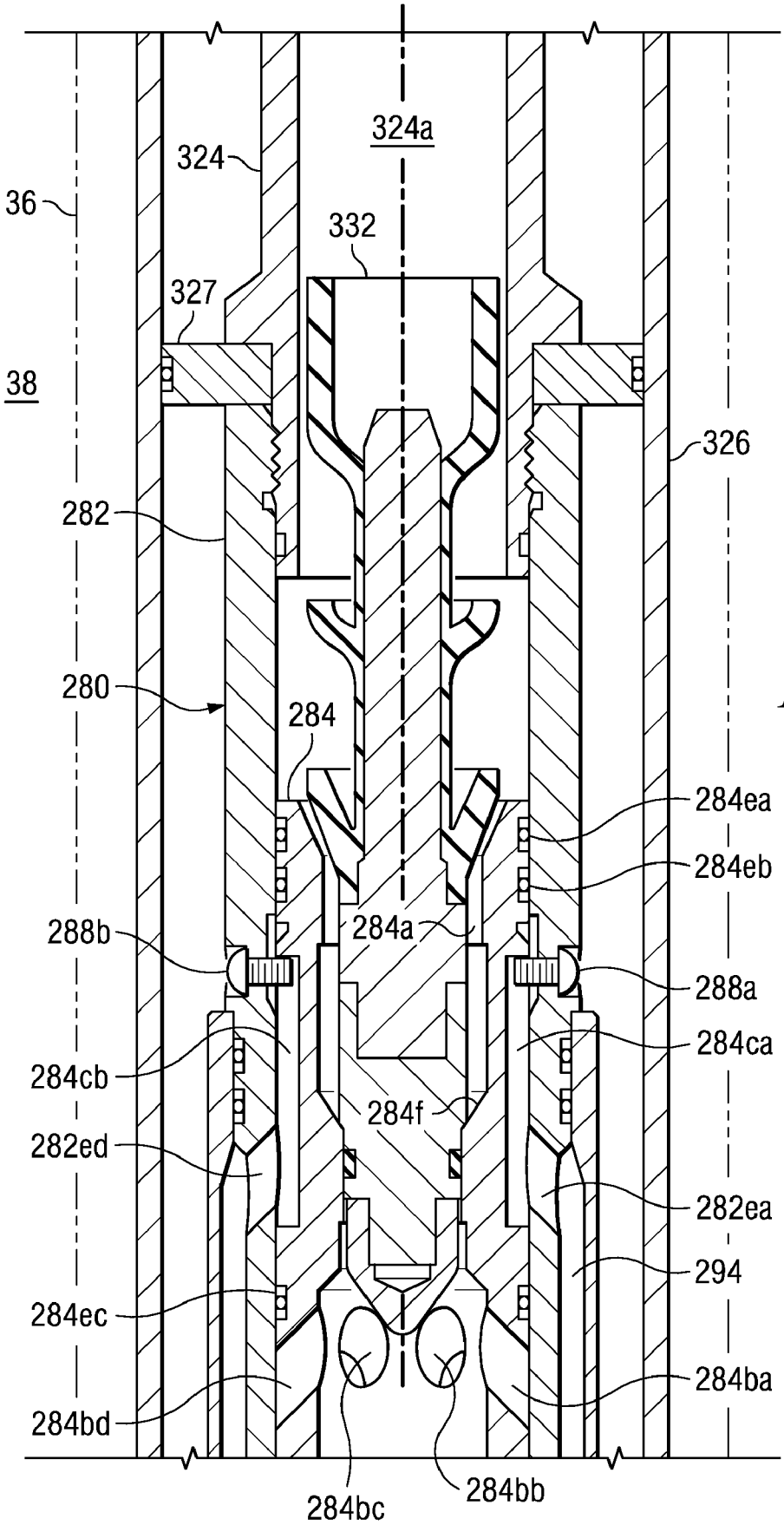
Figure 13D:
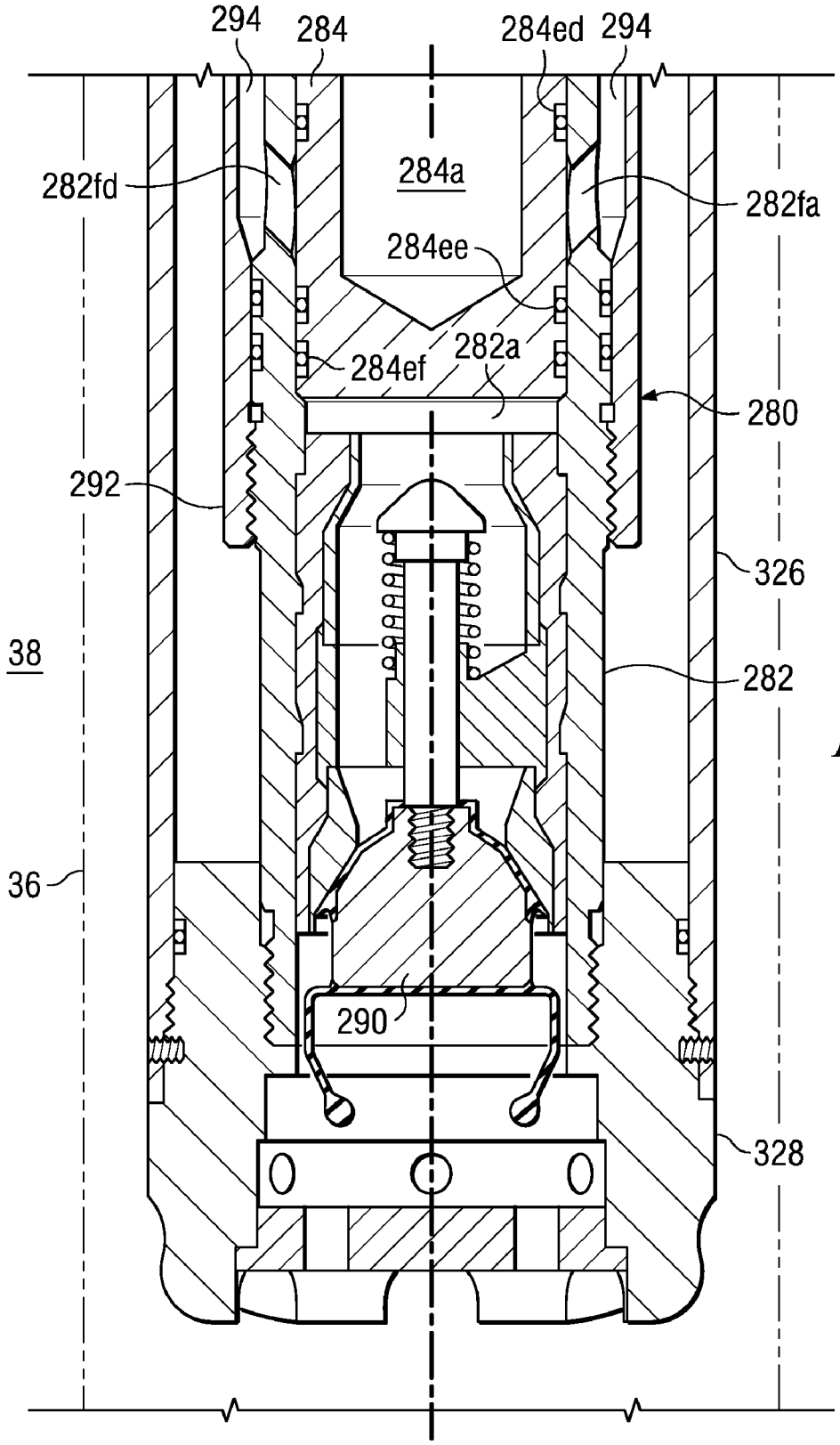

During operation, in an exemplary embodiment, as illustrated in FIGS. 11, 11*a*, 11*b*, 11*c* and 11*d*, the apparatus 300 is positioned within a preexisting structure such as, for example, the wellbore 36 that traverses the subterranean formation 38. The pins 286*a*, 286*b*, 286*c* and 286*d* of the flow control device 280 lock the position of the sliding sleeve 284, relative to the tubular support 282, as described above. As a result, the flow ports 284*ba*, 284*bb*, 284*bc* and 284*bd* of the sliding sleeve 284 are aligned with the flow ports 282*ea*, 282*eb*, 282*ec* and 282*ed*, respectively, of the tubular support 282 so that the passage 284*a* of the sliding sleeve 284 is fluidicly coupled to the annular region 294, which, as illustrated in FIG. 11*d*, is fluidicly coupled to the portion of the internal passage 282*a* of the tubular support 282 below the sliding sleeve 284 via the flow ports 282*fa*, 282*fb*, 282*fc* and 282*fd*.

In an exemplary embodiment, as illustrated in FIGS. 12, 12*a*, 12*b*, 12*c* and 12*d*, during or after the positioning of the apparatus 300 within the wellbore 36, fluidic materials 330 may be circulated through and out of the apparatus 300 into the wellbore 36 through at least the internal passages 314*a*, 312*a*, 320*b*, 324*a* and 284*a*, the flow ports 284*ba*, 284*bb*, 284*bc* and 284*bd*, the flow ports 282*ea*, 282*eb*, 282*ec* and 282*ed* aligned with the flow ports 284*ba*, 284*bb*, 284*bc* and 284*bd*, respectively, the annular region 294, the flow ports 282*fa*, 282*fb*, 282*fc* and 282*fd*, the portion of the internal passage 282*a* below the sliding sleeve 284, and the internal passages 328*b*, 328*c*, 328*d*, 328*e*, 328*f*, and 328*g*. In addition, in an exemplary embodiment, the fluidic materials 330 also flow through the portion of the internal passage 282*a* above the sliding sleeve 284. As a result of the circulation of the fluidic materials 330 through and out of the apparatus 300, the fluidic materials 330 are injected into the annulus between the exterior surface of the expandable tubular member 326 and the interior surface of the wellbore 36.

In an exemplary embodiment, as illustrated in FIGS. 13, 13*a*, 13*b*, 13*c*, and 13*d*, during the injection of the fluidic materials 330 into the annulus between the exterior surface of the expandable tubular member 326 and the interior surface of the wellbore 36, a plug valve element 332 may then be injected into the apparatus 300 through the passages 314*a*, 312*a*, 320*b*, 324*a* and 284*a* until the plug valve element 332 is seated in the plug seat 284*f* of the sliding sleeve 284. As a result, the flow of the fluidic materials 330 through the internal passage 284*a* and the flow ports 284*ba*, 284*bb*, 284*bc* and 284*bd* of the sliding sleeve 284 of the flow control device 280 is blocked. Continued injection of the fluidic materials 330 into the apparatus 300, following the seating of the plug valve element 332 in the plug seat 284*f* of the sliding sleeve 284, pressurizes the passages 314*a*, 320*b* and 324*a*, thereby causing locking pins 286*a*, 286*b*, 286*c* and 286*d* to shear and the plug valve element 332 and the sliding sleeve 284 to move downward, relative to the tubular support 282 of the flow control device 280. In an exemplary embodiment, the fasteners 288*a* and 288*b* guide the axial movement of the sliding sleeve 284, and continue to generally prevent any rotation of the sliding sleeve 284 about its longitudinal axis and relative to the tubular support 282. In an exemplary embodiment, the plug valve element 332 and the sliding sleeve 284 move downward, relative to the tubular support 282, until the fasteners 288*a* and 288*b* contact respective surfaces of the sliding sleeve 284 defined by respective upper ends of the channels 284*ca* and 284*cb*, thereby limiting the range of movement of the sliding sleeve 284 relative to the tubular support 282. As a result of the downward movement of the sliding sleeve 284, the flow ports 284*ba*, 284*bb*, 284*bc* and 284*bd* of the sliding sleeve 284 are no longer aligned with the flow ports 282*ea*, 282*eb*, 282*ec* and 282*ed*, respectively, of the tubular support 282, and the annular region 294 is no longer fluidicly coupled to the portion of the passage 282*a* below the sliding sleeve 284 since the exterior surface of the sliding sleeve 284 covers, or blocks, the flow ports 282*fa*, 282*fb*, 282*fc* and 282*fd*. As a result of the seating of the plug valve element 332 in the plug seat 284*f*, the absence of any alignment between the flow ports 284*ba*, 284*bb*, 284*bc* and 284*bd* and the flow ports 282*ea*, 282*eb*, 282*ec* and 282*ed*, respectively, and/or the blocking of the ports 282*fa*, 282*fb*, 282*fc* and 282*fd*, the passages 314*a*, 312*a*, 320*b*, 324*a* and 284*a* are fluidicly isolated from the portion of the passage 282*a* below the sliding sleeve 284 and from the valve 290. In an exemplary embodiment, if the plug valve element 332 is abraded and/or damaged by, for example, any debris in, for example, the apparatus 300 and/or the wellbore 36, thereby compromising the sealing engagement between the plug valve element 332 and the plug seat 284*f* to at least some degree, the fluidic isolation between the passages 314*a*, 312*a*, 320*b*, 324*a* and 284*a* and the valve 290 and the portion of the passage 282*a* below the sliding sleeve 284 is still maintained by the absence of any alignment between the flow ports 284*ba*, 284*bb*, 284*bc* and 284*bd* and the flow ports 282*ea*, 282*eb*, 282*ec* and 282*ed*, respectively, and/or the blocking of the ports 282*fa*, 282*fb*, 282*fc* and 282*fd*, thereby maintaining the pressurization of the passages 314*a*, 312*a*, 320*b*, 324*a* and 284*a*. In an exemplary embodiment, the sealing engagement between the exterior surface of the sliding sleeve 284 and the interior surface of the tubular support 282 is maintained because the sealing elements 284*ea*, 284*eb*, 284*ec*, 284*ed*, 284*ee* and 284*ef* are a part of the flow control device 280, and generally are not exposed to debris and/or any other potential causes of abrasion and/or damage in, for example, the wellbore 36 and/or the remainder of the apparatus 300.

Continued injection of the fluidic materials 330 into the apparatus, following the general prevention of further axial movement of the sliding sleeve 284 relative to the tubular support 282, continues to pressurize the passages 314*a*, 320*b* and 324*a*, thereby causing the rupture discs 322*a* and 322*b* to be ruptured, thereby opening the passages 320*c* and 320*d* of the tubular support 320. As a result, the fluidic materials 330 are then conveyed through the passages 320*c* and 320*d*, and the passages 316*b* and 316*c*, thereby pressurizing a region within the apparatus 300 below the tubular expansion cone 318. As a result, the tubular support 312, the tubular support 314, the tubular support 316, the tubular expansion cone 318 and the tubular support 320 are displaced upwardly in a direction 334, relative to the tubular support 324, the expandable tubular member 326, the ring 327, the shoe 328 and the flow control device 280, thereby radially expanding and plastically deforming the expandable tubular member 326.

In an exemplary embodiment, with continuing reference to FIGS. 12, 12*a*, 12*b*, 12*c*, 12*d*, 13, 13*a*, 13*b*, 13*c* and 13*d*, during operation of the apparatus 300, before radially expanding and plastically deforming the expandable tubular member 326, and before the pins 286*a*, 286*b*, 286*c* and 286*d* are sheared, that is, when the flow control device 280 is in the configuration as illustrated in FIGS. 12, 12*a*, 12*b*, 12*c* and 12*d*, the fluidic materials 330 may include a hardenable fluidic sealing material so that the hardenable fluidic sealing material is circulated through at least the internal passages 314*a*, 312*a*, 320*b*, 324*a* and 284*a*, the flow ports 284*ba*, 284*bb*, 284*bc* and 284*bd*, the flow ports 282*ea*, 282*eb*, 282*ec* and 282*ed* aligned with the flow ports 284*ba*, 284*bb*, 284*bc* and 284*bd*, respectively, the annular region 294, the flow ports 282*fa*, 282*fb*, 282*fc* and 282*fd*, the portion of the internal passage 282*a* below the sliding sleeve 284, and the internal passages 328*b*, 328*c*, 328*d*, 328*e*, 328*f*, and 328*g* and out of the apparatus 300, thereby injecting the hardenable fluidic sealing material into the annulus between the exterior surface of the expandable tubular member 326 and the interior surface of the wellbore 36. As a result, an annular body of a hardenable fluidic sealing material such as, for example, cement, is formed within the annulus between the exterior surface of the expandable tubular member 326 and the interior surface of the wellbore 36. Before, during, or after the curing of the annular body of the hardenable fluidic sealing material, the apparatus 300 may then be operated as described above with reference to FIGS. 13, 13*a*, 13*b*, 13*c* and 13*d* to radially expand and plastically deform the expandable tubular member 326.

Referring to FIGS. 14, 14*a*, 14*b*, 14*c*, and 14*d*, an exemplary embodiment of an apparatus 400 for radially expanding and plastically deforming a tubular member includes a tubular support 412 that defines a internal passage 412*a* and includes a threaded connection 412*b* at one end and a threaded connection 412*c* at another end. In an exemplary embodiment, during operation of the apparatus 400, a threaded end of a tubular support member 414 that defines a passage 414*a* may be coupled to the threaded connection 412*b* of the tubular support member 412.

An end of a tubular support 416 that defines an internal passage 416*a* and radial passages, 416*b* and 416*c*, and includes an external annular recess 416*d*, an external sleeve 416*e*, and an internal flange 416*f* is coupled to the other end of the tubular support 412. A tubular expansion cone 418 that includes a tapered external expansion surface 418*a* is received within and is coupled to the external annular recess 416*d* of the tubular support 416 and an end of the tubular expansion cone 418 abuts an end face of the external sleeve 416*e* of the tubular support 416.

A threaded connection 420*a* of an end of a tubular support 420 that defines an internal passage 420*b* having an enlarged-inside-diameter portion 420*ba*, defines radial passages, 420*c* and 420*d*, and includes an external flange 420*e*, and internal splines 420*f* at another end is coupled to the threaded connection 412*c* of the other end of the tubular support 412. In an exemplary embodiment, the external flange 420*e* of the tubular support 420 abuts the internal flange 416*f* of the tubular support 416. Rupture discs, 422*a* and 422*b*, are received and mounted within the radial passages, 420*c* and 420*d*, respectively, of the tubular support 420.

An end of a tubular support 424 defining an internal passage 424*a* and including an external flange 424*b*, an external threaded connection 424*c* at another end, and external splines 424*d* for mating with and engaging the internal splines 420*f* of the tubular support 420, extends within the enlarged-inside-diameter portion 420*ba* of the passage 420*b* of the tubular support 420, and sealingly engages an interior surface of the tubular support 420.

A flow control device 426 is coupled to the tubular support 424. More particularly, an internal threaded connection 428*a* at one end of a tubular support 428 of the flow control device 426 defining an internal passage 428*b*, a plurality of circumferentially-spaced flow ports 428*ca* and 428*cb* at one axial location therealong, and a plurality of circumferentially-spaced flow ports 428*da*, 428*db* and 428*dc* at another axial location therealong, and including an external threaded connection 428*e* at another end thereof, and an internal shoulder 428*f*, is coupled to the external threaded connection 424*c* of the tubular support 424 so that the other end of the tubular support 424 extends within the internal passage 428*b* of the tubular support 428.

The flow control device 426 further includes a sliding sleeve 430 defining a longitudinally-extending internal passage 430*a* and a plurality of circumferentially-spaced flow ports 430*ba* and 430*bb*, and including generally circumferentially-spaced bores 430*ca* and 430*cb*, axially-spaced sealing elements 430*da*, 430*db* and 430*dc*, and a plug seat 430*e*. The sliding sleeve 430 is received within the internal passage 428*b* of the tubular support 428, sealingly engaging the interior surface of the tubular support 428. In an exemplary embodiment, each of the sealing elements 430*da*, 430*db* and 430*dc* is an o-ring that extends within an annular channel formed in the exterior surface of the sliding sleeve 430. The sliding sleeve 430 is adapted to move relative to, and slide against the interior surface of, the tubular support 428 under conditions to be described.

Circumferentially-spaced pins 432*a* and 432*b* extend through the tubular support 428 and into the bores 430*ca* and 430*cb*, respectively, thereby locking the position of the sliding sleeve 430 relative to the tubular support 428 and preventing rotation of the sliding sleeve 430 relative to the tubular support 428.

A one-way poppet valve 434 is coupled to the tubular support 428 and includes a movable valve element 434*a* for controllably sealing an opening of the internal passage 428*b* of the tubular support 428. In an exemplary embodiment, the one-way poppet valve 434 only permits fluidic materials to flow through the internal passage 428*b* of the tubular support 428 in one direction. In an exemplary embodiment, the one-way poppet valve 434 only permits fluidic materials to flow through the internal passage 428*b* of the tubular support 428 in the downward direction as viewed in FIG. 14D.

As noted above, the internal threaded connection 428*a* at one end of a tubular support 428 is coupled to the external threaded connection 424*c* of the tubular support 424 so that the other end of the tubular support 424 extends within the internal passage 428*b* of the tubular support 428. In an exemplary embodiment, the other end of the tubular support 424 is proximate an end of the sliding sleeve 430 of the flow control device 426. In an exemplary embodiment, the other end of the tubular support 424 abuts the end of the sliding sleeve 430 of the flow control device 426.

An expandable tubular member 436 that defines an internal passage 436*a* for receiving the tubular supports 412, 414, 416, and 420 mates with and is supported by the external expansion surface 418*a* of the tubular expansion cone 418 that includes an upper portion 436*b* having a smaller inside diameter and a lower portion 436*c* having a larger inside diameter and an internal threaded connection 436*d*.

A ring 438 through which the other end of the tubular support 424 extends abuts, and is disposed between, the external flange 424*b* of the tubular support 424 and the end of the tubular support 428 of the flow control device 426 proximate the internal threaded connection 428*a*. The ring 428 sealingly engages an exterior surface of the tubular support 424 and an interior surface of the expandable tubular member 436.

The external threaded connection 428*e* of the tubular support 428 of the flow control device 426 is coupled to an internal threaded connection 440*a* of a shoe 440 that defines internal passages, 440*b*, 440*c*, 440*d*, 440*e*, 440*f*, and 440*g*, and includes another threaded connection 440*h* that is coupled to the internal threaded connection 436*d* of the lower portion 436*c* of the expandable tubular member 436. As a result, the flow control device 426 is coupled to and extends between the tubular support 424 and the shoe 440. In an exemplary embodiment, the one-way poppet valve 434 of the flow control device 426 only permits fluidic materials to be exhausted from the apparatus 400.

An annular region 442 is radially defined between the exterior surface of the tubular support 428 of the flow control device 426 and the interior surface of the expandable tubular member 436, and is axially defined between the shoe 440 and the ring 438.

Figure 14:
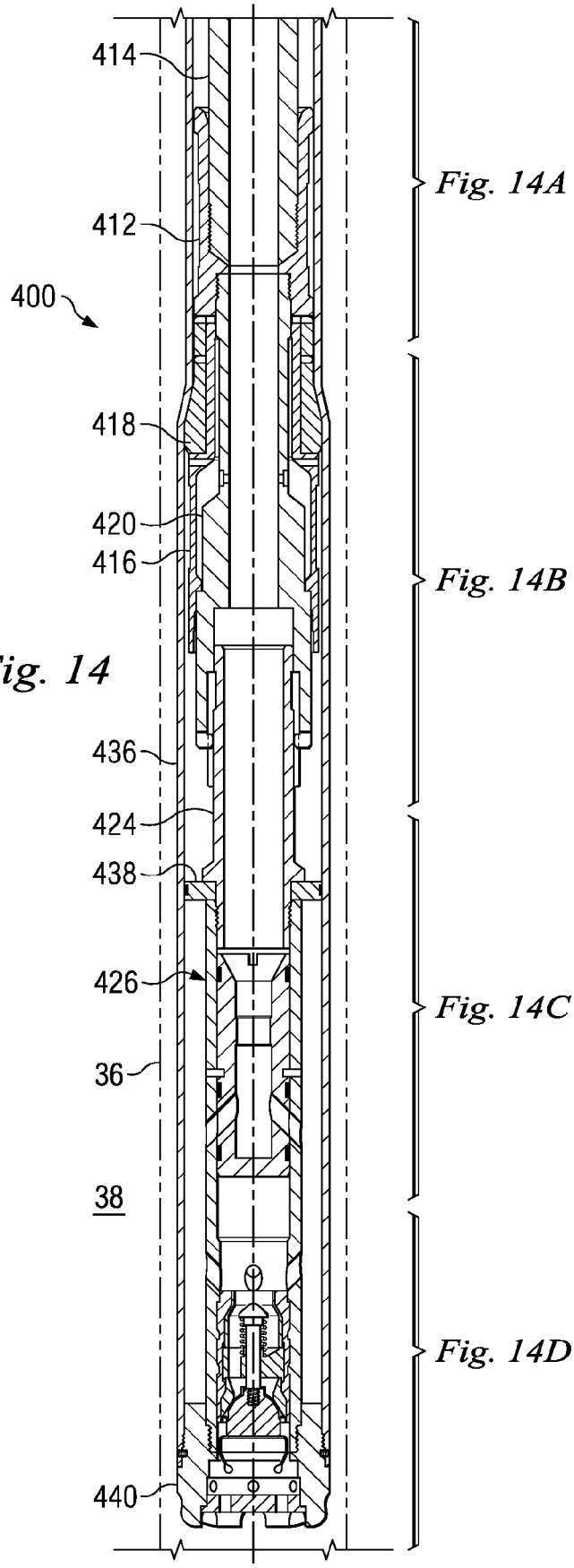
FIGS. 14, 14*a*, 14*b*, 14*c* and 14*d* are fragmentary cross-sectional illustrations of an exemplary embodiment of an apparatus for radially expanding and plastically deforming a tubular member during the placement of the apparatus within a wellbore, the apparatus including an exemplary embodiment of a sliding sleeve.
Figure 14A:
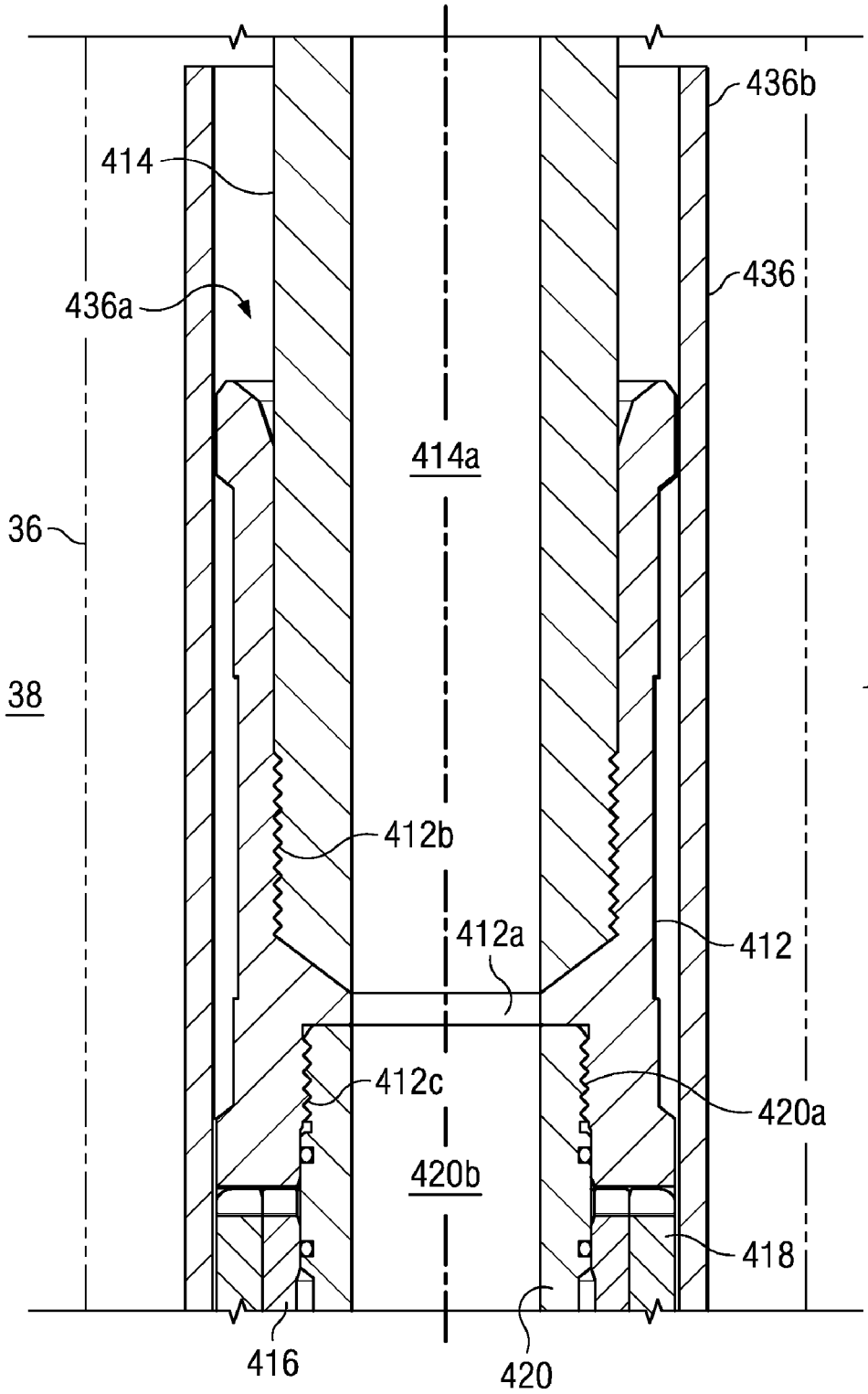
Figure 14B:
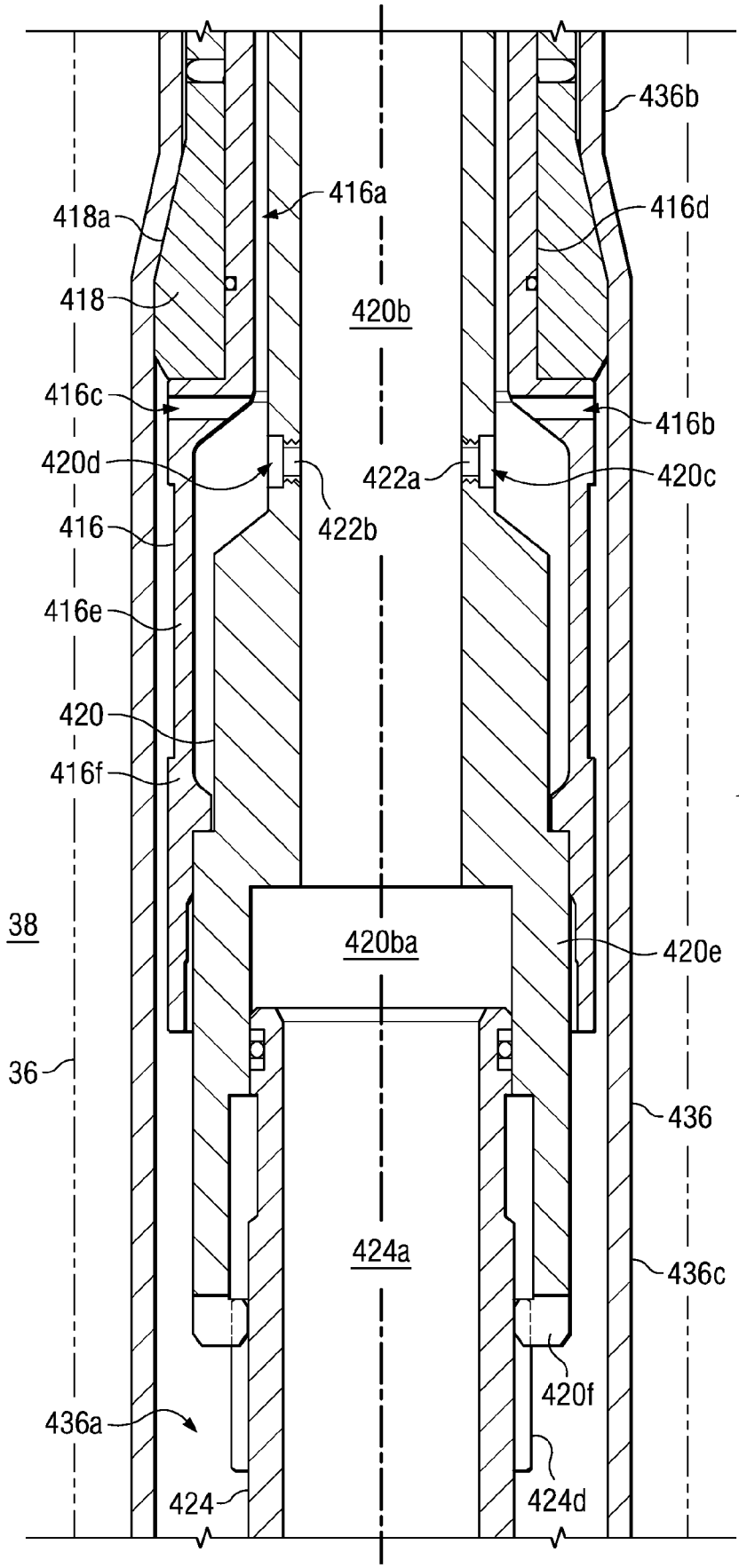
Figure 14C:
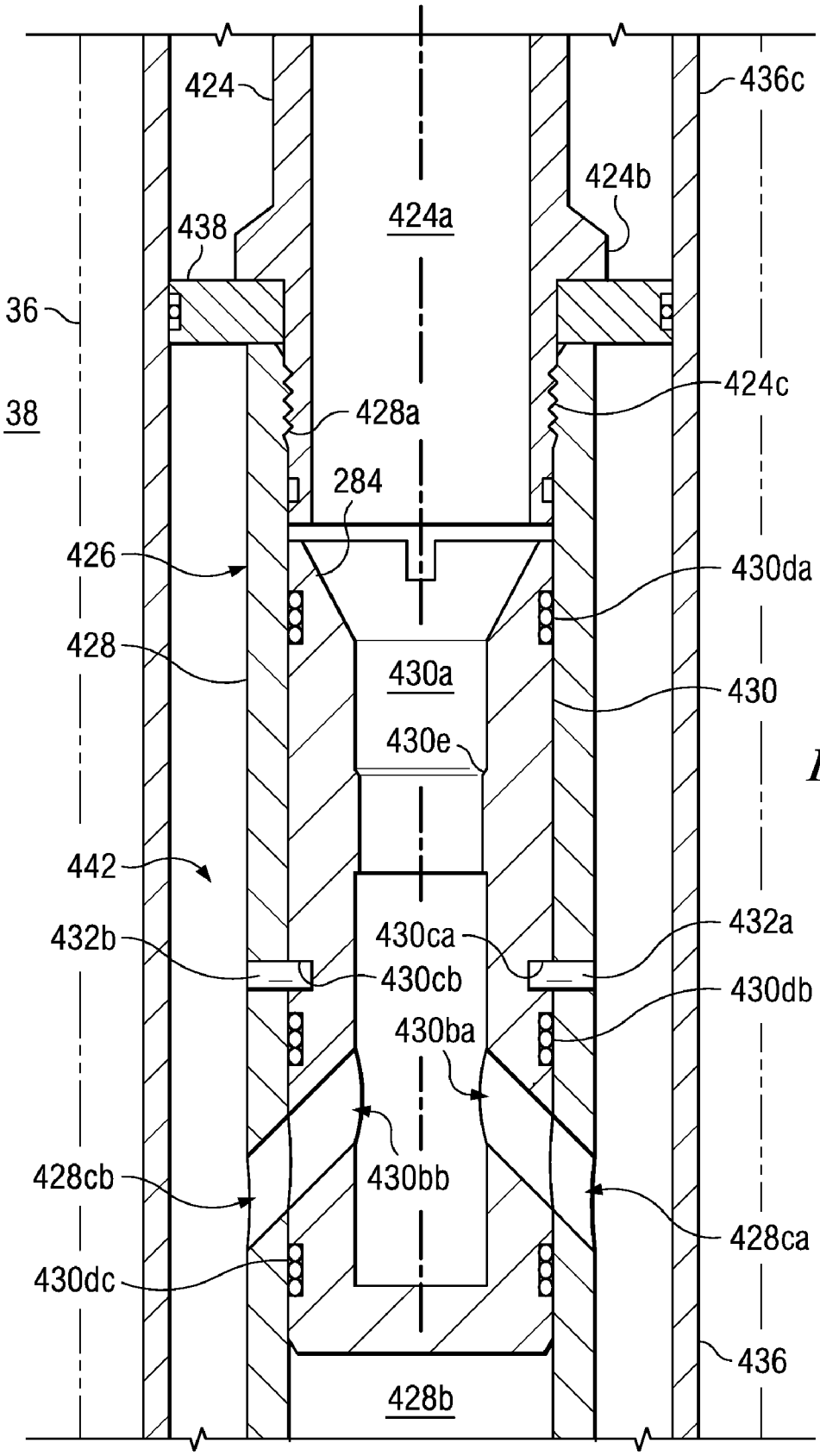
Figure 14D:
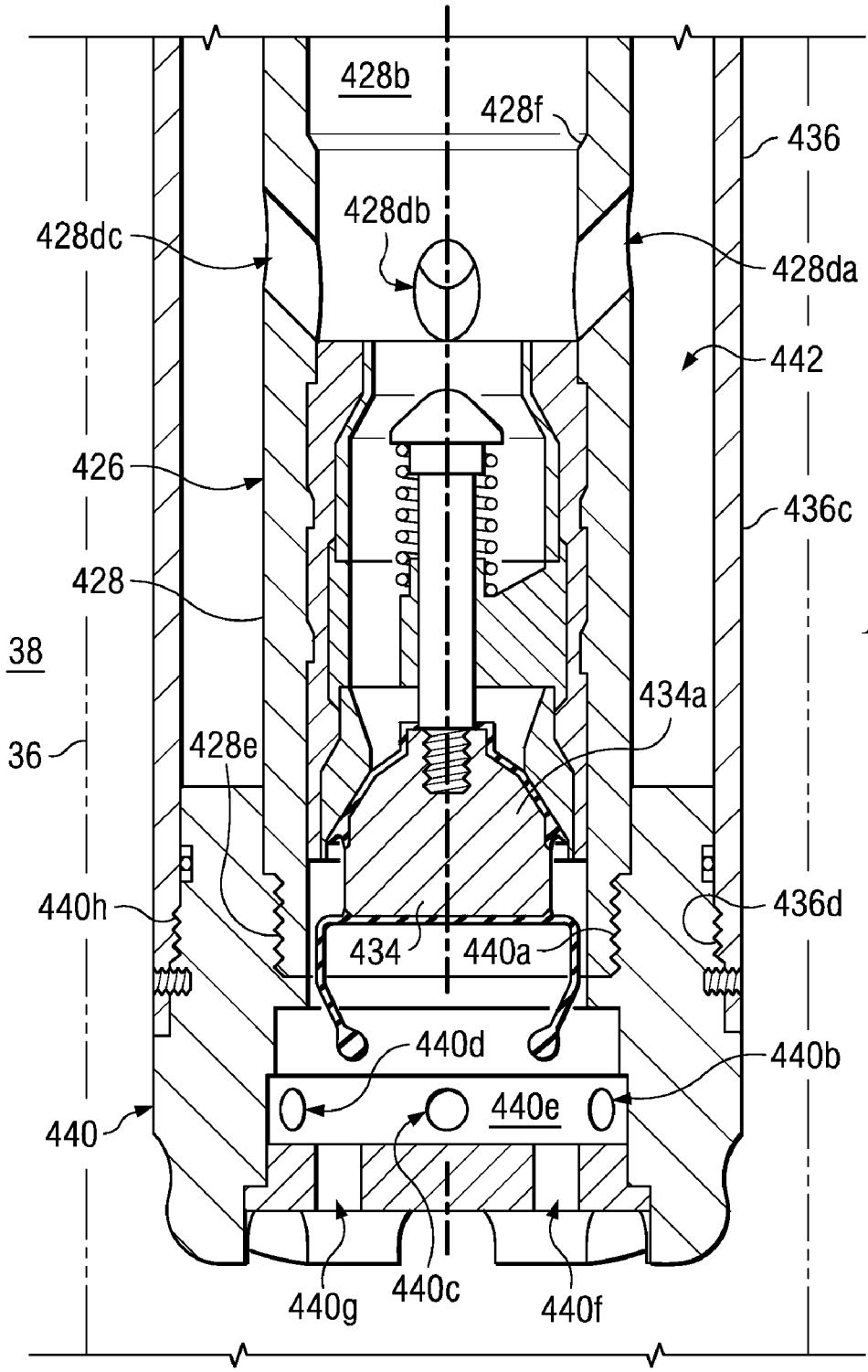
Figure 15:
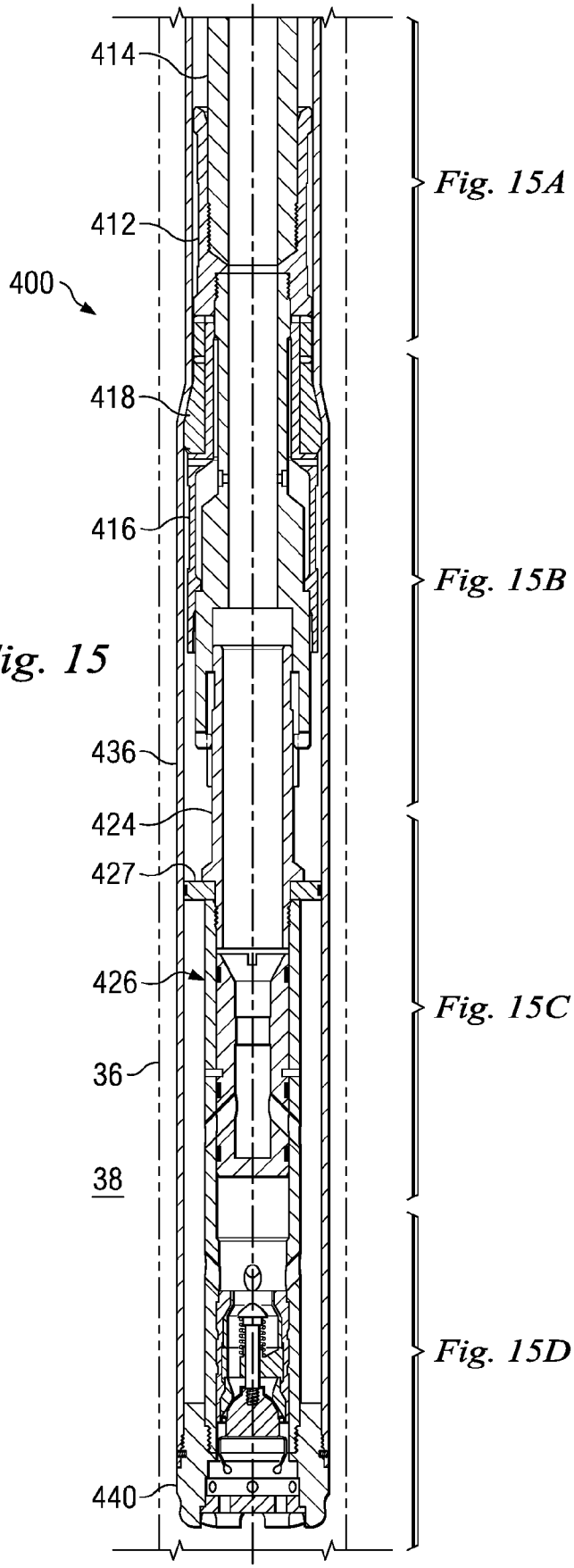
FIGS. 15, 15*a*, 15*b*, 15*c* and 15*d* are fragmentary cross-sectional illustrations of the apparatus of FIGS. 14, 14*a*, 14*b*, 14*c* and 14*d* during the injection of a fluidic material into an annulus between the exterior of the apparatus and the wellbore.
Figure 15A:
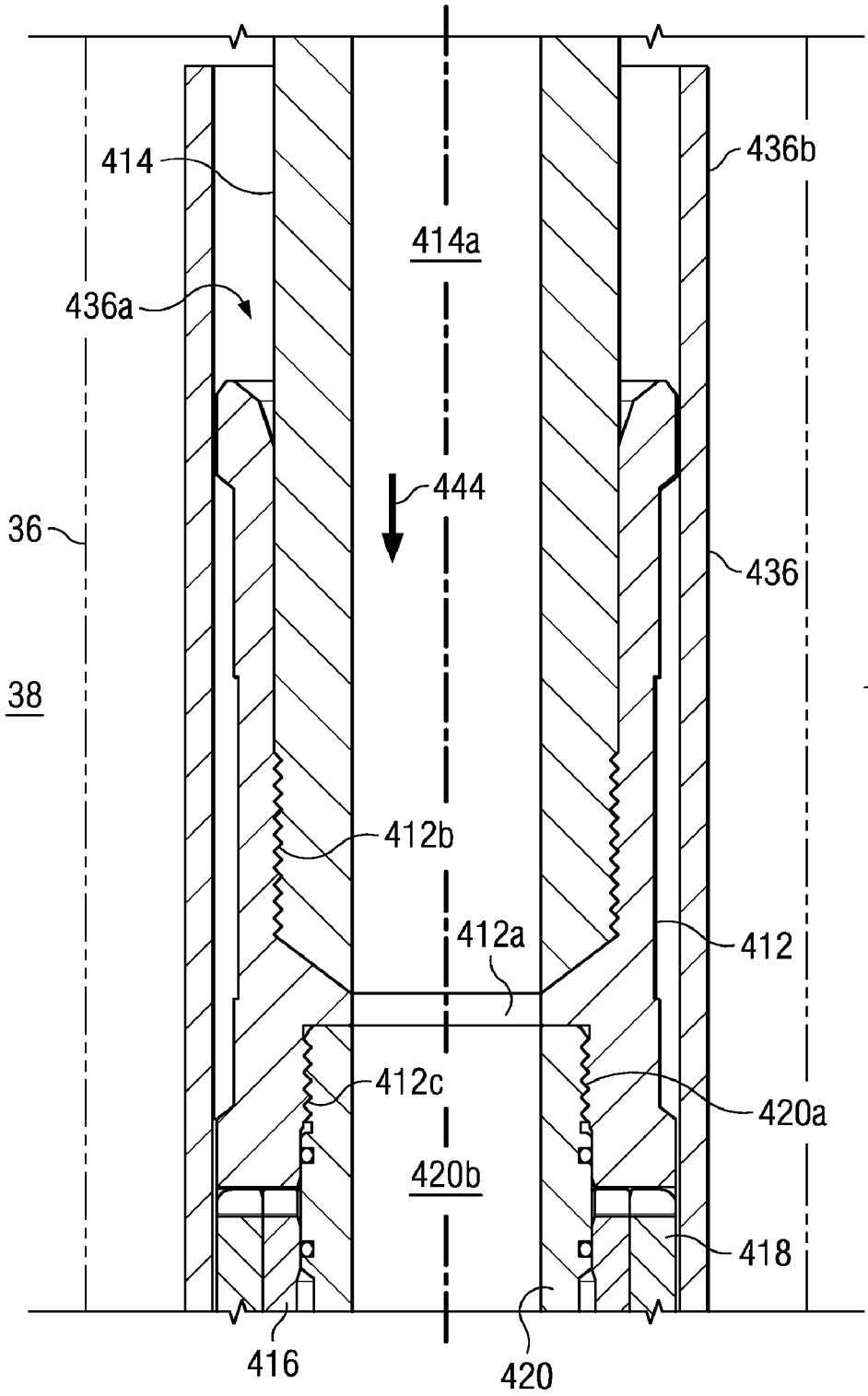
Figure 15B:
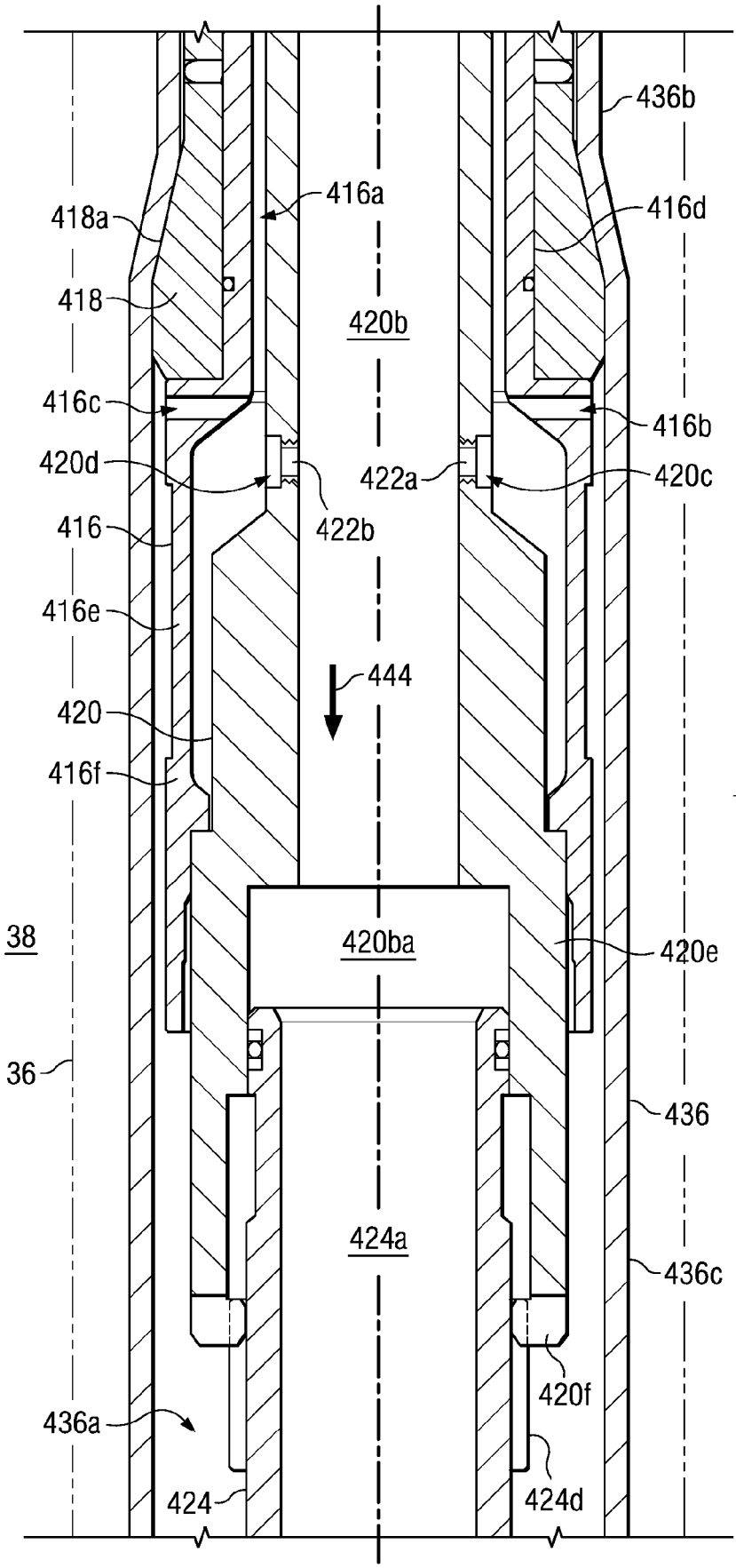
Figure 15C:
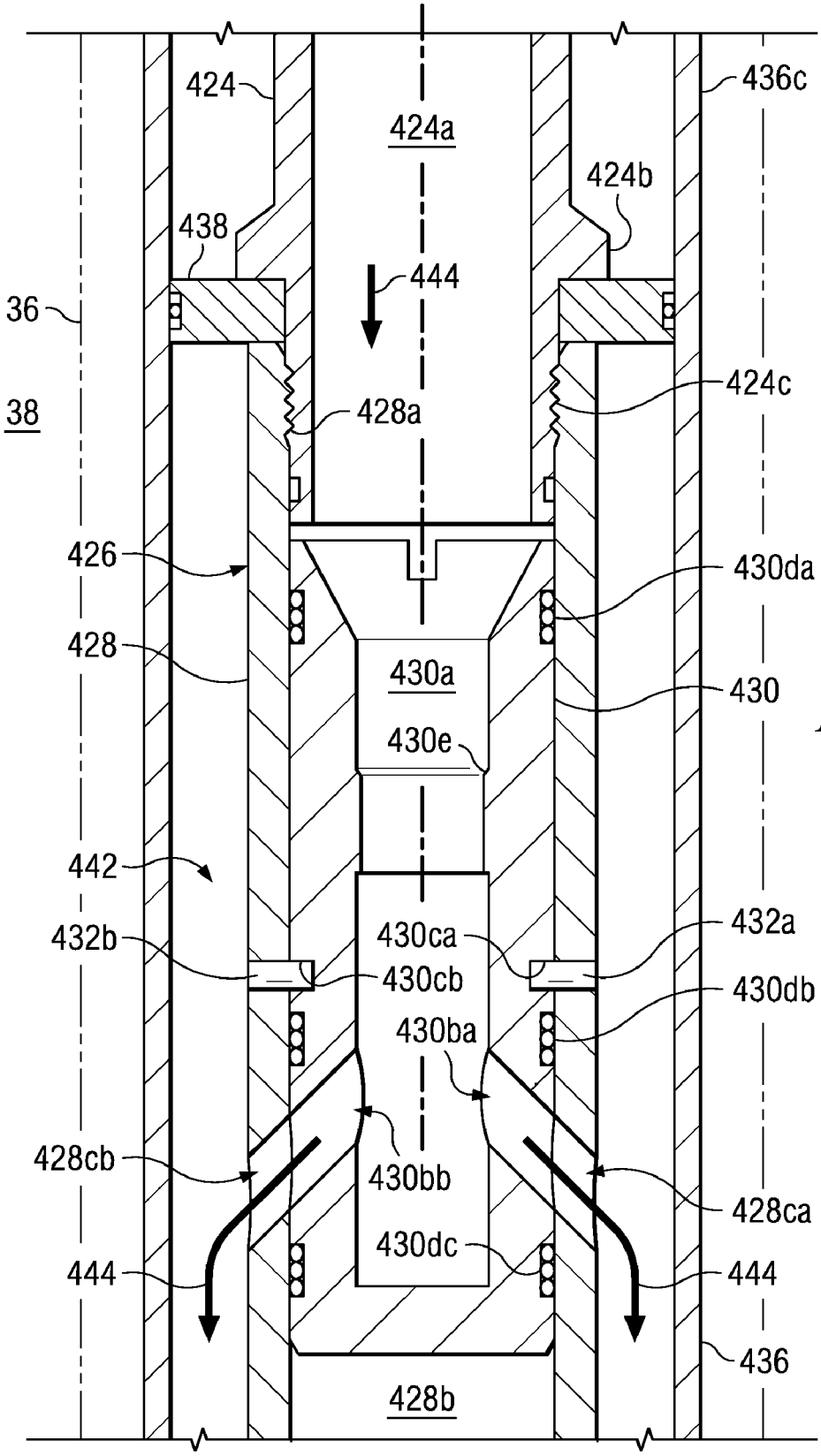
Figure 15D:
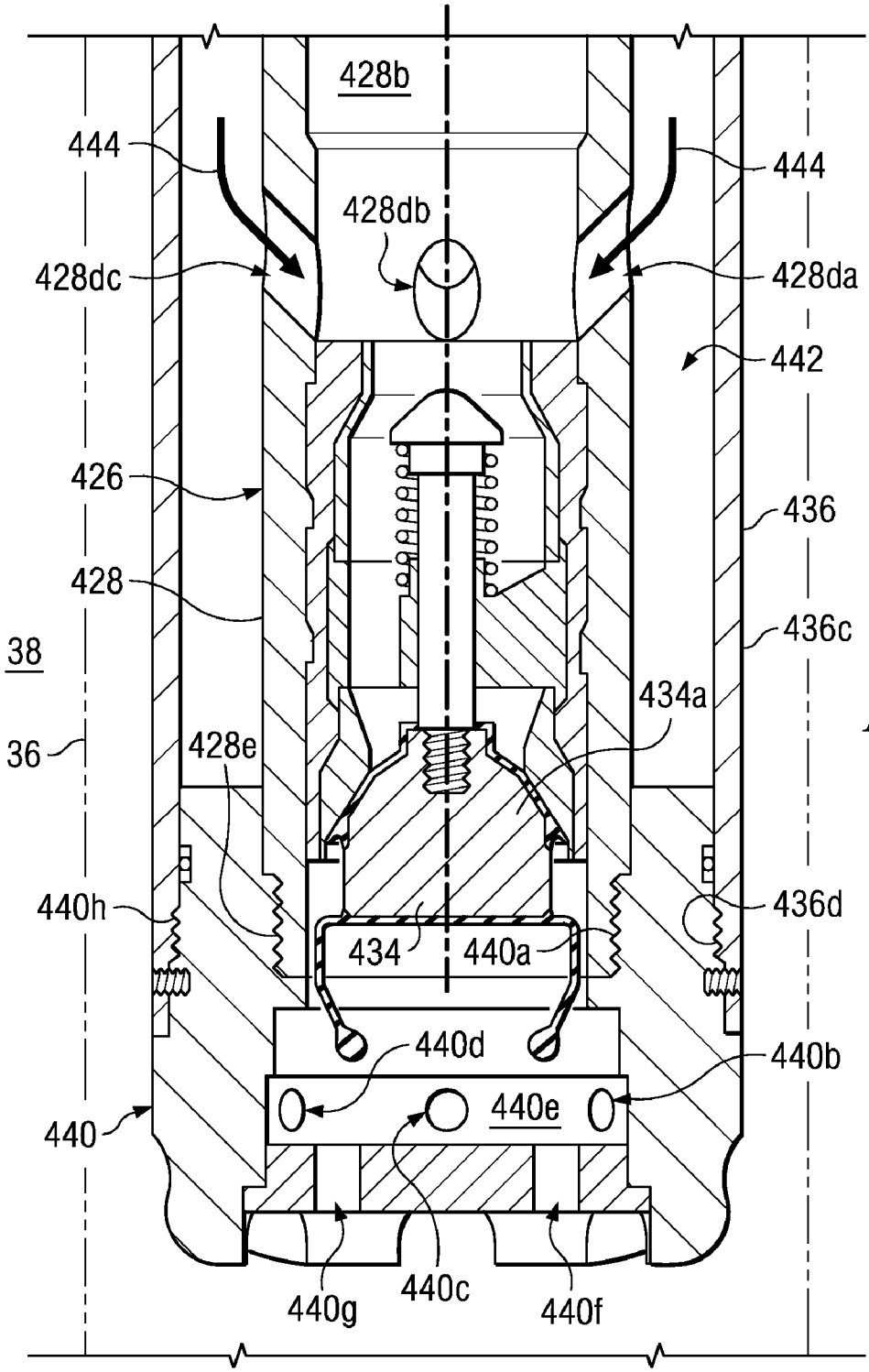
Figure 16:
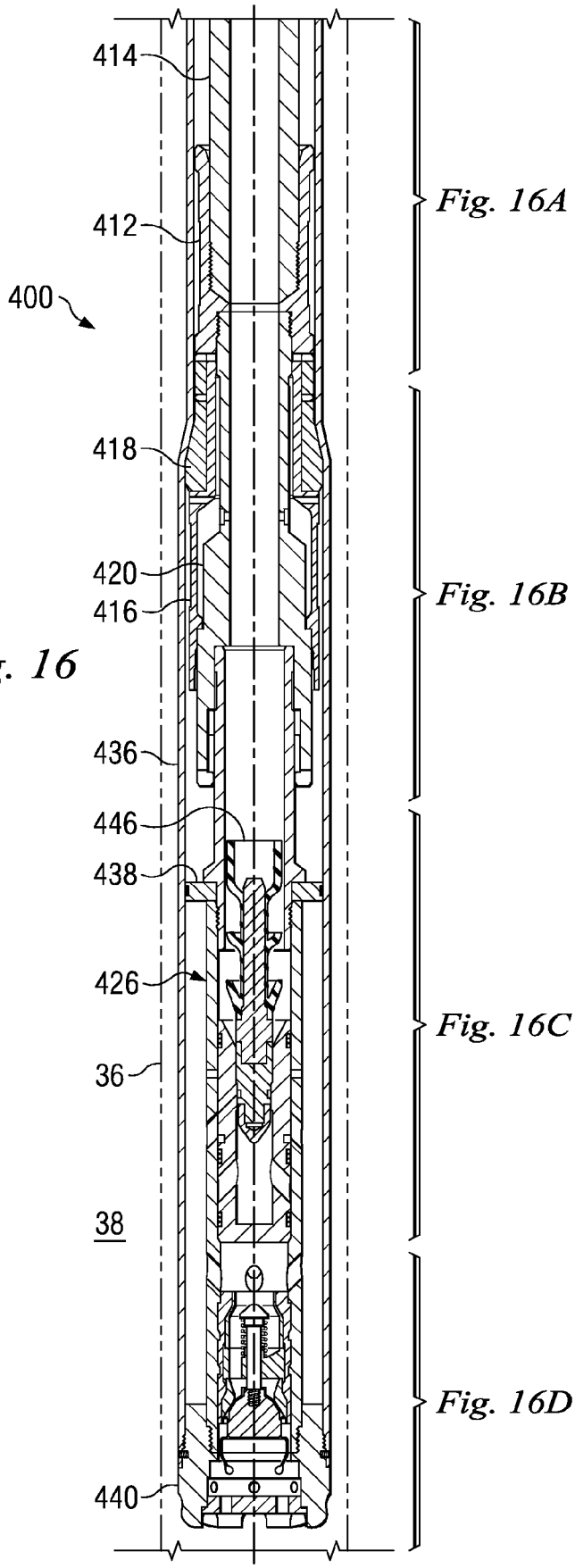
FIGS. 16, 16*a*, 16*b*, 16*c* and 16*d* are fragmentary cross-sectional illustrations of the apparatus of FIGS. 14, 14*a*, 14*b*, 14*c* and 14*d* during the radial expansion and plastic deformation of the tubular member.
Figure 16A:
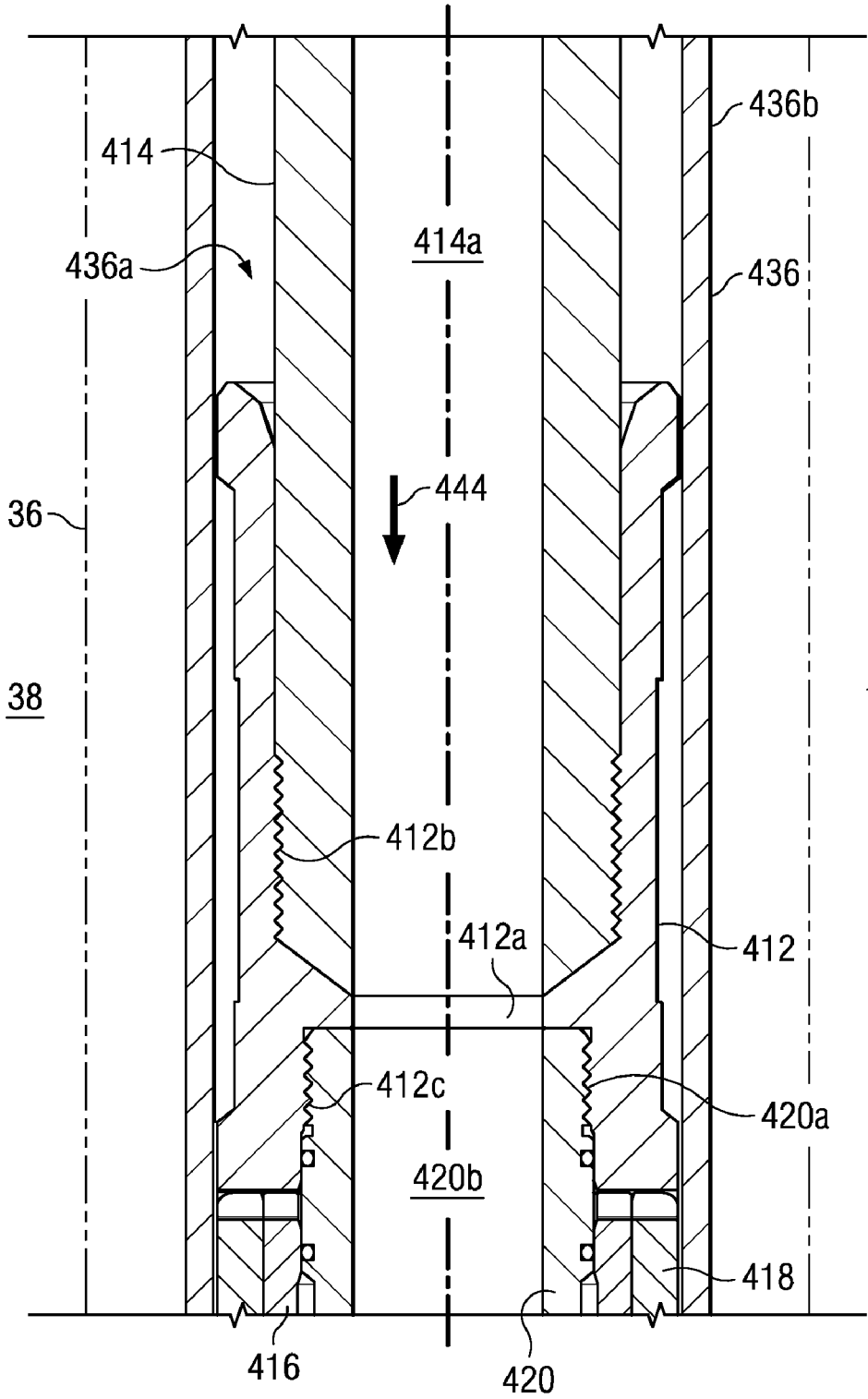
Figure 16B:
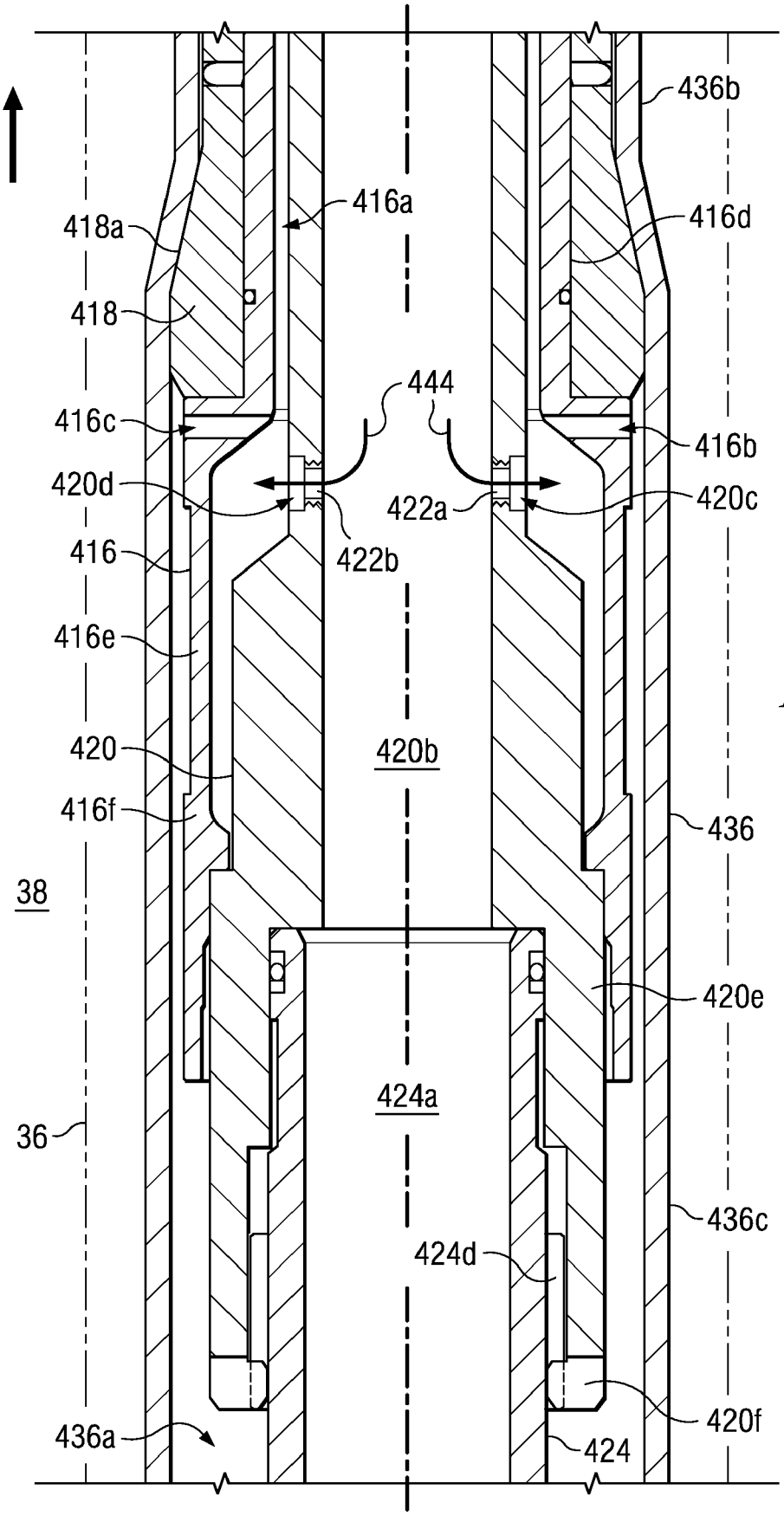
Figure 16C:
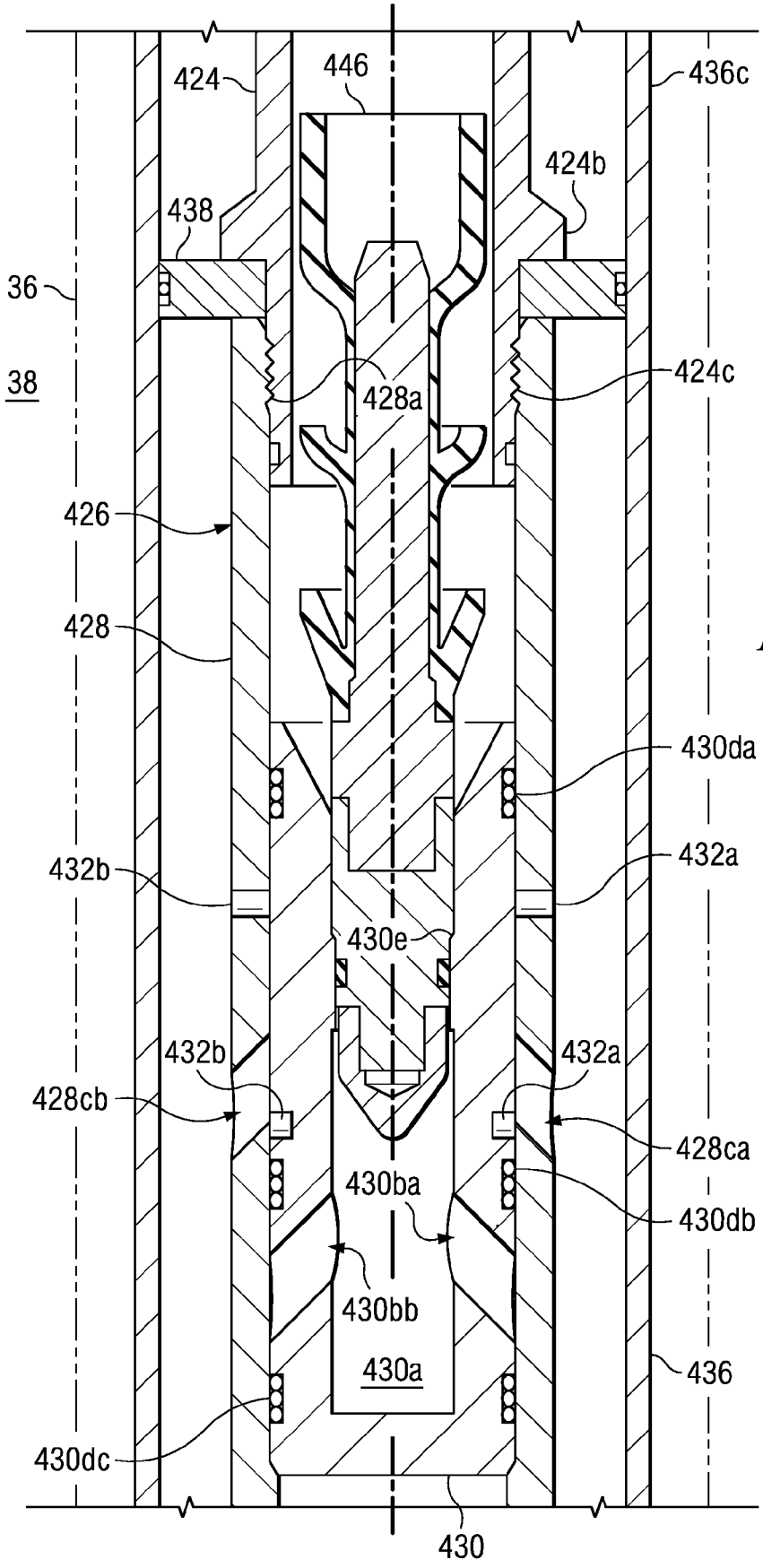
Figure 16D:
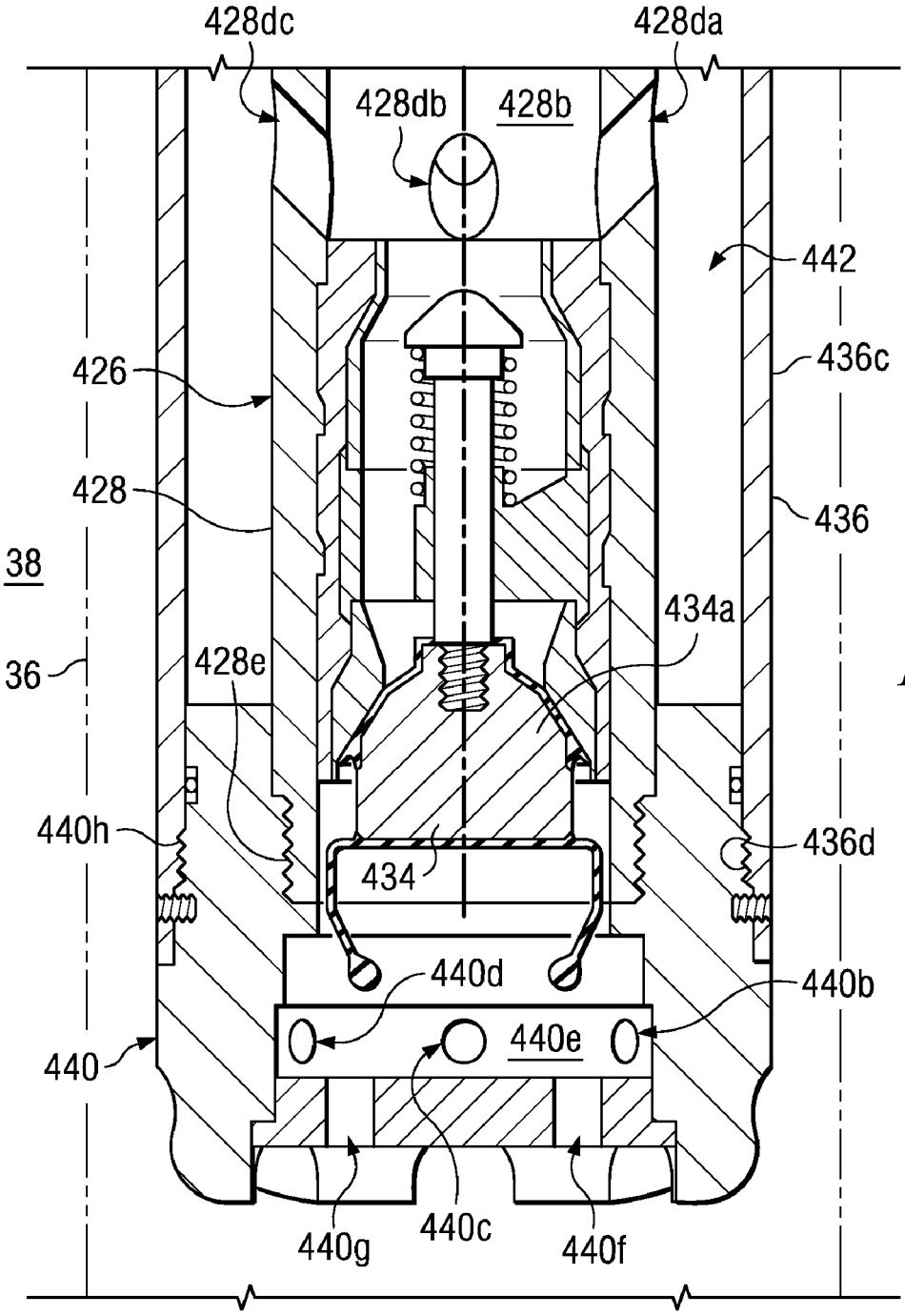

During operation, in an exemplary embodiment, as illustrated in FIGS. 14, 14*a*, 14*b*, 14*c* and 14*d*, the apparatus 400 is positioned within a preexisting structure such as, for example, the wellbore 36 that traverses the subterranean formation 38. The pins 432*a* and 432*b* of the flow control device 426 lock the position of the sliding sleeve 430, relative to the tubular support 428, as described above. As a result, the flow ports 430*ba* and 430*bb* of the sliding sleeve 430 are aligned with the flow ports 428*ca* and 428*cb*, respectively, of the tubular support 428 so that the passage 430*a* of the sliding sleeve 430 is fluidicly coupled to the annular region 442, which, as illustrated in FIG. 14*d*, is fluidicly coupled to the portion of the internal passage 428*b* of the tubular support 428 below the sliding sleeve 430 via the flow ports 428*da*, 428*db* and 428*dc*.

In an exemplary embodiment, as illustrated in FIGS. 15, 15*a*, 15*b*, 15*c* and 15*d*, during or after the positioning of the apparatus 400 within the wellbore 36, fluidic materials 444 may be circulated through and out of the apparatus 400 into the wellbore 36 through at least the internal passages 414*a*, 412*a*, 420*b*, 424*a* and 430*a*, the flow ports 430*ba* and 430*bb*, the flow ports 428*ca* and 428*cb* aligned with the flow ports 430*ba* and 430*bb*, respectively, the annular region 442, the flow ports 428*da*, 428*db* and 428*dc*, the portion of the internal passage 428*b* below the sliding sleeve 430, and the internal passages 440*b*, 440*c*, 440*d*, 440*e*, 440*f*, and 440*g*. In addition, in an exemplary embodiment, the fluidic materials 444 also flow through the portion of the internal passage 428*b* above the sliding sleeve 430. As a result of the circulation of the fluidic materials 444 through and out of the apparatus 400, the fluidic materials 444 are injected into the annulus between the exterior surface of the expandable tubular member 436 and the interior surface of the wellbore 36.

In an exemplary embodiment, as illustrated in FIGS. 16, 16*a*, 16*b*, 16*c*, and 16*d*, during the injection of the fluidic materials 444 into the annulus between the exterior surface of the expandable tubular member 436 and the interior surface of the wellbore 36, a plug valve element 446 may then be injected into the apparatus 400 through the passages 414*a*, 412*a*, 420*b*, 424*a* and 430*a* until the plug valve element 446 is seated in the plug seat 430*e* of the sliding sleeve 430. As a result, the flow of the fluidic materials 444 through the internal passage 430*a* and the flow ports 430*ba* and 430*bb* of the sliding sleeve 430 of the flow control device 426 is blocked. Continued injection of the fluidic materials 444 into the apparatus 400, following the seating of the plug valve element 446 in the plug seat 430*e* of the sliding sleeve 430, pressurizes the passages 414*a*, 420*b* and 424*a*, thereby causing locking pins 432*a* and 432*b* to shear and the plug valve element 446 and the sliding sleeve 430 to move downward, relative to the tubular support 428 of the flow control device 426. The plug valve element 446 and the sliding sleeve 430 move downward, relative to the tubular support 428, until an end of the sliding sleeve 430 contacts the internal shoulder 428*f* of the tubular support 428, thereby limiting the range of movement of the sliding sleeve 430 relative to the tubular support 428. As a result of the downward movement of the sliding sleeve 430, the flow ports 430*ba* and 430*bb* of the sliding sleeve 430 are no longer aligned with the flow ports 428*ca* and 428*cb*, respectively, of the tubular support 428, and the annular region 442 is no longer fluidicly coupled to the portion of the passage 428*b* below the sliding sleeve 430 since the exterior surface of the sliding sleeve 430 covers, or blocks, the flow ports 428*ca* and 428*cb*. As a result of the seating of the plug valve element 446 in the plug seat 430*e*, the absence of any alignment between the flow ports 430*ba* and 430*bb* and the flow ports 428*ca* and 428*cb*, respectively, and/or the blocking of the ports 428*ca* and 428*cb*, the passages 414*a*, 412*a*, 420*b*, 424*a* and 430*a* are fluidicly isolated from the portion of the passage 428*b* below the sliding sleeve 430 and from the valve 434. In an exemplary embodiment, if the plug valve element 446 is abraded and/or damaged by, for example, any debris in, for example, the apparatus 400 and/or the wellbore 36, thereby compromising the sealing engagement between the plug valve element 446 and the plug seat 430*e* to at least some degree, the fluidic isolation between the passages 414*a*, 412*a*, 420*b*, 424*a* and 430*a* and the valve 434 and the portion of the passage 428*b* below the sliding sleeve 430 is still maintained by the absence of any alignment between the flow ports 430*ba* and 430*bb* and the flow ports 428*ca* and 428*cb*, respectively, and/or the blocking of the ports 428*ca* and 428*cb*, thereby maintaining the pressurization of the passages 414*a*, 412*a*, 420*b*, 424*a* and 430*a*. In an exemplary embodiment, the sealing engagement between the exterior surface of the sliding sleeve 430 and the interior surface of the tubular support 428 is maintained because the sealing elements 430*da*, 430*db* and 430*dc* are a part of the flow control device 426, and generally are not exposed to debris and/or any other potential causes of abrasion and/or damage in, for example, the wellbore 36 and/or the remainder of the apparatus 400.

Continued injection of the fluidic materials 444 into the apparatus 400, following the general prevention of further axial movement of the sliding sleeve 430 relative to the tubular support 428 continues to pressurize the passages 414*a*, 420*b* and 424*a*, thereby causing the rupture discs 422*a* and 422*b* to be ruptured, thereby opening the passages 420*c* and 420*d* of the tubular support 420. As a result, the fluidic materials 444 are then conveyed through the passages 420*c* and 420*d*, and the passages 416*b* and 416*c*, thereby pressurizing a region within the apparatus 400 below the tubular expansion cone 418. As a result, the tubular support 412, the tubular support 414, the tubular support 416, the tubular expansion cone 418 and the tubular support 420 are displaced upwardly in a direction 448, relative to the tubular support 424, the expandable tubular member 436, the ring 438, the shoe 440 and the flow control device 426, thereby radially expanding and plastically deforming the expandable tubular member 436.

In an exemplary embodiment, with continuing reference to FIGS. 15, 15*a*, 15*b*, 15*c*, 15*d*, 16, 16*a*, 16*b*, 16*c* and 16*d*, during operation of the apparatus 400, before radially expanding and plastically deforming the expandable tubular member 436, and before the pins 432*a* and 432*b* are sheared, that is, when the flow control device 426 is in the configuration as illustrated in FIGS. 15, 15*a*, 15*b*, 15*c* and 15*d*, the fluidic materials 444 may include a hardenable fluidic sealing material so that the hardenable fluidic sealing material is circulated through at least the internal passages 414*a*, 412*a*, 420*b*, 424*a* and 430*a*, the flow ports 430*ba* and 430*bb*, the flow ports 428*ca* and 428*cb* aligned with the flow ports 430*ba* and 430*bb*, respectively, the annular region 442, the flow ports 428*da*, 428*db* and 428*dc*, the portion of the internal passage 428*b* below the sliding sleeve 430, and the internal passages 440*b*, 440*c*, 440*d*, 440*e*, 440*f*, and 440*g*, and out of the apparatus 400, thereby injecting the hardenable fluidic sealing material into the annulus between the exterior surface of the expandable tubular member 436 and the interior surface of the wellbore 36. As a result, an annular body of a hardenable fluidic sealing material such as, for example, cement, is formed within the annulus between the exterior surface of the expandable tubular member 436 and the interior surface of the wellbore 36. Before, during, or after the curing of the annular body of the hardenable fluidic sealing material, the apparatus 400 may then be operated as described above with reference to FIGS. 16, 16*a*, 16*b*, 16*c* and 16*d* to radially expand and plastically deform the expandable tubular member 436.

In several exemplary embodiments, instead of, or in addition to the above-described methods, apparatuses and/or systems for radially expanding and plastically deforming an expandable tubular member, it is understood that the expandable tubular members 26, 126, 226, 326 and/or 436 may be radially expanded and plastically deformed using one or more other methods, apparatuses and/or systems, and/or any combination thereof. In several exemplary embodiments, instead of, or in addition to the above-described methods, apparatuses and/or systems for radially expanding and plastically deforming an expandable tubular member, the flow control devices 280 and/or 426 may be used with one or more other methods, apparatuses and/or systems for radially expanding and plastically deforming an expandable tubular member, and/or any combination thereof, and/or may be used with one or more other flow control methods, apparatuses and/or systems, and/or any combination thereof, in one or more other flow control applications.

An apparatus has been described that includes a flow control device comprising a tubular support defining a first internal passage and comprising one or more first flow ports; a sliding sleeve at least partially received within the first internal passage and sealingly engaging the tubular support, the sliding sleeve defining a second internal passage into which fluidic materials are adapted to be injected, the sliding sleeve comprising one or more second flow ports; a first position in which the first flow ports are aligned with respective ones of the second flow ports; and a second position in which the first flow ports are not aligned with the respective ones of the second flow ports. In an exemplary embodiment, the flow control device further comprises one or more pins extending into the sliding sleeve; wherein, when the sliding sleeve is in the first position, the one or more pins extend from the tubular support and into the sliding sleeve to maintain the sliding sleeve in the first position; and wherein, when the sliding sleeve is in the second position, the one or more pins are sheared to permit the sliding sleeve to move between the first and second positions. In an exemplary embodiment, the flow control device further comprises a valve coupled to the tubular support, the valve comprising a movable valve element for controllably sealing an opening of the first internal passage of the tubular support. In an exemplary embodiment, the apparatus comprises a plug valve element adapted to be seated in the second internal passage of the sliding sleeve of the flow control device. In an exemplary embodiment, the flow control device further comprises a plurality of axially-spaced sealing elements coupled to the sliding sleeve and sealingly engaging the tubular support; and wherein the second flow ports are axially positioned between two of the sealing elements. In an exemplary embodiment, the tubular support further comprises one or more third flow ports axially spaced from the one or more first flow ports. In an exemplary embodiment, the fluid control device further comprises an outer sleeve coupled to the tubular support so that an annular region is defined between the tubular support and the outer sleeve; wherein, when the sliding sleeve is in the first position, the annular region is fluidicly coupled to the second internal passage of the sliding sleeve via the first flow ports and the second flow ports aligned therewith, respectively; and wherein, when the sliding sleeve is in the second position, the annular region is fluidicly isolated from the second internal passage of the sliding sleeve. In an exemplary embodiment, the tubular support further comprises one or more third flow ports axially spaced from the one or more first flow ports; wherein, when the sliding sleeve is in the first position, a portion of the first internal passage of the tubular support is defined by the sliding sleeve; wherein, when the sliding sleeve is in the first position, the annular region is fluidicly coupled to the portion of the first internal passage via the one or more third flow ports; and wherein, when the sliding sleeve is in the second position, the annular region is fluidicly isolated from the portion of the first internal passage. In an exemplary embodiment, the sliding sleeve comprises one or more longitudinally-extending channels; and wherein the fluid control device further comprises one or more protrusions extending from the tubular support and into respective ones of the channels. In an exemplary embodiment, the apparatus comprises a support member coupled to the fluid control device and defining one or more radial passages; an expansion device coupled to the support member and comprising an external expansion surface; one or more rupture discs coupled to and positioned within corresponding radial passages of the support member; an expandable tubular member coupled to the expansion surface of the expansion device, the expandable tubular member comprising a first portion and a second portion, wherein the inside diameter of the first portion is less than the inside diameter of the second portion; and a shoe defining one or more internal passages coupled to the second portion of the expandable tubular member and to the fluid control device.

A method has been described that includes injecting fluidic materials into a sliding sleeve at least partially received within a tubular support, the tubular support defining an internal passage, a portion of which is at least partially defined by the sliding sleeve; conveying the fluidic materials out of the sliding sleeve and the tubular support; and conveying the fluidic materials into the portion of the internal passage of the tubular support at least partially defined by the sliding sleeve after conveying the fluidic materials out of the sliding sleeve and the tubular support. In an exemplary embodiment, the sliding sleeve comprises one or more first flow ports and the tubular support comprises one or more second flow ports; and wherein conveying the fluidic materials out of the sliding sleeve and the tubular support comprises aligning the one or more first flow ports of the sliding sleeve with respective ones of the one or more second flow ports of the tubular support; and conveying the fluidic materials through the one or more first flow ports and the one or more second flow ports aligned therewith, respectively. In an exemplary embodiment, the method further comprises blocking the flow of fluidic materials through the one or more first flow ports and the one or more second flow ports aligned therewith, respectively. In an exemplary embodiment, the method comprises blocking the flow of fluidic materials through the one or more first flow ports and the one or more second flow ports aligned therewith, respectively, comprises injecting a plug valve element into the sliding sleeve; and causing the plug valve element and the sliding sleeve to move axially in a direction, relative to the tubular support. In an exemplary embodiment, the method further comprises guiding the axial movement of the sliding sleeve, relative to the tubular support, during causing the plug valve element and the sliding sleeve to move axially in the direction, relative to the tubular support. In an exemplary embodiment, the method further comprises preventing any further axial movement of the sliding sleeve in the direction after causing the plug valve element and the sliding sleeve to move axially in the direction, relative to the tubular support. In an exemplary embodiment, the method further comprises locking the sliding sleeve to the tubular support; and unlocking the sliding sleeve from the tubular support. In an exemplary embodiment, locking the sliding sleeve to the tubular support comprises extending one or more pins from the tubular support and into the sliding sleeve; and wherein unlocking the sliding sleeve from the tubular support comprises shearing the one or more pins extending from the tubular support and into the sliding sleeve in response to causing the plug valve element and the sliding sleeve to move axially in the direction, relative to the tubular support. In an exemplary embodiment, the method further comprises fluidicly isolating the internal passage of the sliding sleeve from the portion of the internal passage of the tubular support at least partially defined by the sliding sleeve. In an exemplary embodiment, the method further comprises generally preventing relative rotation between the sliding sleeve and the tubular support. In an exemplary embodiment, an outer sleeve is coupled to the tubular support and an annular region is defined between the tubular support and the outer sleeve; wherein conveying the fluidic materials out of the sliding sleeve and the tubular support comprises conveying the fluidic materials out of the sliding sleeve and the tubular support and into the annular region defined between the tubular support and the outer sleeve; and wherein conveying the fluidic materials into the portion of the internal passage of the tubular support at least partially defined by the sliding sleeve after conveying the fluidic materials out of the sliding sleeve and the tubular support comprises fluidicly coupling the annular region defined between the tubular support and the outer sleeve to the portion of the internal passage of the tubular support at least partially defined by the sliding sleeve. In an exemplary embodiment, the method further comprises coupling an expandable tubular member to the tubular support; positioning the expandable tubular member within a preexisting structure; radially expanding and plastically deforming the expandable tubular member within the preexisting structure. In an exemplary embodiment, the method further comprises injecting fluidic materials into an annulus defined between the expandable tubular member and the preexisting structure. In an exemplary embodiment, the sliding sleeve comprises one or more first flow ports and the tubular support comprises one or more second flow ports; and wherein conveying the fluidic materials out of the sliding sleeve and the tubular support comprises aligning the one or more first flow ports of the sliding sleeve with respective ones of the one or more second flow ports of the tubular support; and conveying the fluidic materials through the one or more first flow ports and the one or more second flow ports aligned therewith, respectively; wherein the method further comprises blocking the flow of fluidic materials through the one or more first flow ports and the one or more second flow ports aligned therewith, respectively; and wherein radially expanding and plastically deforming the expandable tubular member within the preexisting structure comprises coupling one or more other tubular supports to the expandable tubular member and the tubular support within which the sliding sleeve is at least partially received; injecting fluidic material into the one or more other tubular supports after blocking the flow of fluidic materials through the one or more first flow ports and the one or more second flow ports aligned therewith, respectively; sensing the operating pressure of the fluidic material injected into the one or more other tubular supports; and if the sensed operating pressure of the fluidic material injected into the one or more other tubular supports exceeds a predetermined value, then radially expanding and plastically deforming the expandable tubular member within the preexisting structure.

An apparatus has been described that includes a tubular support defining a first internal passage and comprising one or more first flow ports; a sliding sleeve at least partially received within the first internal passage and sealingly engaging the tubular support, the sliding sleeve defining a second internal passage into which fluidic materials are adapted to be injected, the sliding sleeve comprising one or more second flow ports; one or more longitudinally-extending channels; a first position in which the first flow ports are aligned with respective ones of the second flow ports; and a second position in which the first flow ports are not aligned with the respective ones of the second flow ports; one or more protrusions extending from the tubular support and into respective ones of the channels of the sliding sleeve; a valve coupled to the tubular support, the valve comprising a movable valve element for controllably sealing an opening of the first internal passage of the tubular support; one or more pins extending into the sliding sleeve; an outer sleeve coupled to the tubular support so that an annular region is defined between the tubular support and the outer sleeve; a plurality of axially-spaced sealing elements coupled to the sliding sleeve and sealingly engaging the tubular support, wherein the second flow ports are axially positioned between two of the sealing elements; wherein, when the sliding sleeve is in the first position, the annular region is fluidicly coupled to the second internal passage of the sliding sleeve via the first flow ports and the second flow ports aligned therewith, respectively; wherein, when the sliding sleeve is in the second position, the annular region is fluidicly isolated from the second internal passage of the sliding sleeve; wherein, when the sliding sleeve is in the first position, the one or more pins extend from the tubular support and into the sliding sleeve to maintain the sliding sleeve in the first position; wherein, when the sliding sleeve is in the second position, the one or more pins are sheared to permit the sliding sleeve to move between the first and second positions; wherein the tubular support further comprises one or more third flow ports axially spaced from the one or more first flow ports; wherein, when the sliding sleeve is in the first position, a portion of the first internal passage of the tubular support is defined by the sliding sleeve; wherein, when the sliding sleeve is in the first position, the annular region is fluidicly coupled to the portion of the first internal passage via the one or more third flow ports; and wherein, when the sliding sleeve is in the second position, the annular region is fluidicly isolated from the portion of the first internal passage.

A method has been described that includes injecting fluidic materials into a sliding sleeve at least partially received within a tubular support, the tubular support defining an internal passage, a portion of which is at least partially defined by the sliding sleeve, the sliding sleeve comprising one or more first flow ports and the tubular support comprising one or more second flow ports; conveying the fluidic materials out of the sliding sleeve and the tubular support, comprising aligning the one or more first flow ports of the sliding sleeve with respective ones of the one or more second flow ports of the tubular support; and conveying the fluidic materials through the one or more first flow ports and the one or more second flow ports aligned therewith, respectively; conveying the fluidic materials into the portion of the internal passage of the tubular support at least partially defined by the sliding sleeve after conveying the fluidic materials out of the sliding sleeve and the tubular support; blocking the flow of fluidic materials through the one or more first flow ports and the one or more second flow ports aligned therewith, respectively, comprising injecting a plug valve element into the sliding sleeve; and causing the plug valve element and the sliding sleeve to move axially in a direction, relative to the tubular support; guiding the axial movement of the sliding sleeve, relative to the tubular support, during causing the plug valve element and the sliding sleeve to move axially in the direction, relative to the tubular support; preventing any further axial movement of the sliding sleeve in the direction after causing the plug valve element and the sliding sleeve to move axially in the direction, relative to the tubular support; locking the sliding sleeve to the tubular support, comprising extending one or more pins from the tubular support and into the sliding sleeve; unlocking the sliding sleeve from the tubular support, comprising shearing the one or more pins extending from the tubular support and into the sliding sleeve in response to causing the plug valve element and the sliding sleeve to move axially in the direction, relative to the tubular support; generally preventing relative rotation between the sliding sleeve and the tubular support; wherein an outer sleeve is coupled to the tubular support and an annular region is defined between the tubular support and the outer sleeve; wherein conveying the fluidic materials out of the sliding sleeve and the tubular support further comprises conveying the fluidic materials out of the sliding sleeve and the tubular support and into the annular region defined between the tubular support and the outer sleeve; and wherein conveying the fluidic materials into the portion of the internal passage of the tubular support at least partially defined by the sliding sleeve after conveying the fluidic materials out of the sliding sleeve and the tubular support comprises fluidicly coupling the annular region defined between the tubular support and the outer sleeve to the portion of the internal passage of the tubular support at least partially defined by the sliding sleeve.

A system has been described that includes means for injecting fluidic materials into a sliding sleeve at least partially received within a tubular support, the tubular support defining an internal passage, a portion of which is at least partially defined by the sliding sleeve; means for conveying the fluidic materials out of the sliding sleeve and the tubular support; and means for conveying the fluidic materials into the portion of the internal passage of the tubular support at least partially defined by the sliding sleeve after conveying the fluidic materials out of the sliding sleeve and the tubular support. In an exemplary embodiment, the sliding sleeve comprises one or more first flow ports and the tubular support comprises one or more second flow ports; and wherein means for conveying the fluidic materials out of the sliding sleeve and the tubular support comprises means for aligning the one or more first flow ports of the sliding sleeve with respective ones of the one or more second flow ports of the tubular support; and means for conveying the fluidic materials through the one or more first flow ports and the one or more second flow ports aligned therewith, respectively. In an exemplary embodiment, the system further comprises means for blocking the flow of fluidic materials through the one or more first flow ports and the one or more second flow ports aligned therewith, respectively. In an exemplary embodiment, means for blocking the flow of fluidic materials through the one or more first flow ports and the one or more second flow ports aligned therewith, respectively, comprises means for injecting a plug valve element into the sliding sleeve; and means for causing the plug valve element and the sliding sleeve to move axially in a direction, relative to the tubular support. In an exemplary embodiment, the system further comprises means for guiding the axial movement of the sliding sleeve, relative to the tubular support, during causing the plug valve element and the sliding sleeve to move axially in the direction, relative to the tubular support. In an exemplary embodiment, the system further comprises means for preventing any further axial movement of the sliding sleeve in the direction after causing the plug valve element and the sliding sleeve to move axially in the direction, relative to the tubular support. In an exemplary embodiment, the system further comprises means for locking the sliding sleeve to the tubular support; and means for unlocking the sliding sleeve from the tubular support. In an exemplary embodiment, means for locking the sliding sleeve to the tubular support comprises means for extending one or more pins from the tubular support and into the sliding sleeve; and wherein means for unlocking the sliding sleeve from the tubular support comprises means for shearing the one or more pins extending from the tubular support and into the sliding sleeve in response to causing the plug valve element and the sliding sleeve to move axially in the direction, relative to the tubular support. In an exemplary embodiment, the system further comprises means for fluidicly isolating the internal passage of the sliding sleeve from the portion of the internal passage of the tubular support at least partially defined by the sliding sleeve. In an exemplary embodiment, the system further comprises means for generally preventing relative rotation between the sliding sleeve and the tubular support. In an exemplary embodiment, an outer sleeve is coupled to the tubular support and an annular region is defined between the tubular support and the outer sleeve; wherein means for conveying the fluidic materials out of the sliding sleeve and the tubular support comprises means for conveying the fluidic materials out of the sliding sleeve and the tubular support and into the annular region defined between the tubular support and the outer sleeve; and wherein means for conveying the fluidic materials into the portion of the internal passage of the tubular support at least partially defined by the sliding sleeve after conveying the fluidic materials out of the sliding sleeve and the tubular support comprises means for fluidicly coupling the annular region defined between the tubular support and the outer sleeve to the portion of the internal passage of the tubular support at least partially defined by the sliding sleeve. In an exemplary embodiment, the system further comprises means for coupling an expandable tubular member to the tubular support; means for positioning the expandable tubular member within a preexisting structure; means for radially expanding and plastically deforming the expandable tubular member within the preexisting structure. In an exemplary embodiment, the system further comprises means for injecting fluidic materials into an annulus defined between the expandable tubular member and the preexisting structure. In an exemplary embodiment, the sliding sleeve comprises one or more first flow ports and the tubular support comprises one or more second flow ports; and wherein means for conveying the fluidic materials out of the sliding sleeve and the tubular support comprises means for aligning the one or more first flow ports of the sliding sleeve with respective ones of the one or more second flow ports of the tubular support; and means for conveying the fluidic materials through the one or more first flow ports and the one or more second flow ports aligned therewith, respectively; wherein the system further comprises means for blocking the flow of fluidic materials through the one or more first flow ports and the one or more second flow ports aligned therewith, respectively; and wherein means for radially expanding and plastically deforming the expandable tubular member within the preexisting structure comprises means for coupling one or more other tubular supports to the expandable tubular member and the tubular support within which the sliding sleeve is at least partially received; means for injecting fluidic material into the one or more other tubular supports after blocking the flow of fluidic materials through the one or more first flow ports and the one or more second flow ports aligned therewith, respectively; means for sensing the operating pressure of the fluidic material injected into the one or more other tubular supports; and means for if the sensed operating pressure of the fluidic material injected into the one or more other tubular supports exceeds a predetermined value, then radially expanding and plastically deforming the expandable tubular member within the preexisting structure.

An apparatus has been described that includes a flow control device comprising a tubular support defining a first internal passage and comprising one or more first flow ports; a sliding sleeve at least partially received within the first internal passage and sealingly engaging the tubular support, the sliding sleeve defining a second internal passage into which fluidic materials are adapted to be injected, the sliding sleeve comprising one or more second flow ports; a first position in which the first flow ports are aligned with respective ones of the second flow ports to thereby permit the fluidic materials to flow out of the second internal passage; and a second position in which the first flow ports are not aligned with the respective ones of the second flow ports to thereby prevent the fluidic materials from flowing out of the second internal passage; a plurality of axially-spaced sealing elements coupled to the sliding sleeve and sealingly engaging the tubular support, wherein the second flow ports are axially positioned between two of the sealing elements; one or more pins extending into the sliding sleeve; and a valve coupled to the tubular support, the valve comprising a movable valve element for controllably sealing an opening of the first internal passage of the tubular support; a plug valve element adapted to be seated in the second internal passage of the sliding sleeve of the flow control device; a support member coupled to the fluid control device and defining one or more radial passages; an expansion device coupled to the support member and comprising an external expansion surface; one or more rupture discs coupled to and positioned within corresponding radial passages of the support member; an expandable tubular member coupled to the expansion surface of the expansion device, the expandable tubular member comprising a first portion and a second portion, wherein the inside diameter of the first portion is less than the inside diameter of the second portion; and a shoe defining one or more internal passages coupled to the second portion of the expandable tubular member and to the fluid control device; wherein the tubular support of the fluid control device further comprises one or more third flow ports axially spaced from the one or more first flow ports; wherein, when the sliding sleeve is in the first position, the one or more pins extend from the tubular support and into the sliding sleeve to maintain the sliding sleeve in the first position; and wherein, when the sliding sleeve is in the second position, the one or more pins are sheared to permit the sliding sleeve to move between the first and second positions.

A system has been described that includes means for injecting fluidic materials into a sliding sleeve at least partially received within a tubular support, the tubular support defining an internal passage, a portion of which is at least partially defined by the sliding sleeve, the sliding sleeve comprising one or more first flow ports and the tubular support comprising one or more second flow ports; means for conveying the fluidic materials out of the sliding sleeve and the tubular support, comprising means for aligning the one or more first flow ports of the sliding sleeve with respective ones of the one or more second flow ports of the tubular support; and means for conveying the fluidic materials through the one or more first flow ports and the one or more second flow ports aligned therewith, respectively; means for conveying the fluidic materials into the portion of the internal passage of the tubular support at least partially defined by the sliding sleeve after conveying the fluidic materials out of the sliding sleeve and the tubular support; means for blocking the flow of fluidic materials through the one or more first flow ports and the one or more second flow ports aligned therewith, respectively, comprising means for injecting a plug valve element into the sliding sleeve; and means for causing the plug valve element and the sliding sleeve to move axially in a direction, relative to the tubular support; means for guiding the axial movement of the sliding sleeve, relative to the tubular support, during causing the plug valve element and the sliding sleeve to move axially in the direction, relative to the tubular support; means for preventing any further axial movement of the sliding sleeve in the direction after causing the plug valve element and the sliding sleeve to move axially in the direction, relative to the tubular support; means for locking the sliding sleeve to the tubular support, comprising means for extending one or more pins from the tubular support and into the sliding sleeve; means for unlocking the sliding sleeve from the tubular support, comprising means for shearing the one or more pins extending from the tubular support and into the sliding sleeve in response to causing the plug valve element and the sliding sleeve to move axially in the direction, relative to the tubular support; means for generally preventing relative rotation between the sliding sleeve and the tubular support; wherein an outer sleeve is coupled to the tubular support and an annular region is defined between the tubular support and the outer sleeve; wherein means for conveying the fluidic materials out of the sliding sleeve and the tubular support further comprises means for conveying the fluidic materials out of the sliding sleeve and the tubular support and into the annular region defined between the tubular support and the outer sleeve; and wherein means for conveying the fluidic materials into the portion of the internal passage of the tubular support at least partially defined by the sliding sleeve after conveying the fluidic materials out of the sliding sleeve and the tubular support comprises means for fluidicly coupling the annular region defined between the tubular support and the outer sleeve to the portion of the internal passage of the tubular support at least partially defined by the sliding sleeve.

It is understood that variations may be made in the foregoing without departing from the scope of the disclosure. In several exemplary embodiments, the teachings of the present illustrative embodiments may be used to provide, form and/or repair a wellbore casing, a pipeline, a structural support and/or any combination thereof. In several exemplary embodiments, the wellbore 36 may be an open wellbore, a cased wellbore and/or any combination thereof.

Any spatial references such as, for example, "upper," "lower," "above," "below," "between," "vertical," "horizontal," "angular," "upward," "downward," "side-to-side," "left-to-right," "right-to-left," "top-to-bottom," "bottom-to-top," "top," "bottom," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A system comprising:

a tubular support having a first internal passage and a flow passage;

a sliding sleeve disposed in the first internal passage, the sliding sleeve having a second internal passage and being moveable by fluid pressure between a first position, wherein the second internal passage is in fluid communication with a first annulus surrounding the tubular support, and a second position, wherein the second internal passage is fluidicly isolated from the first annulus;

a rupture disc seated in the flow passage, the rupture disc fluidicly isolating the first internal passage from a second annulus surrounding the tubular support and adapted to rupture, whereby the first internal passage and the second annulus are fluidicly coupled; and an expansion cone disposed in the second annulus and moveable under pressure from fluid in the second annulus.

2. The system of claim 1, further comprising:

one or more shear pins extending into the sliding sleeve, the shear pins configured to maintain the sliding sleeve in the first position and shearable to enable movement of the sliding sleeve from the first position toward the second position.

3. The system of claim 1, further comprising:

a plug valve element adapted to be seated in the second internal passage of the sliding sleeve.

4. The system of claim 1, wherein the tubular support further comprises one or more first flow ports and the sliding sleeve comprises one or more second flow orts and wherein the first and second flow ports are aligned when the sliding sleeve is in the first position, whereby the second internal passage and the first annulus are fluidicly coupled, and are misaligned when the sliding sleeve is in the second position.

5. The system of claim 4, wherein the sliding sleeve divides the first internal passage into an upper portion defined by the second internal passage and a lower portion below the sliding sleeve and the tubular support further comprises one or more third flow ports axially spaced from the first flow ports, the third flow ports fluidicly coupling the first annulus with the lower portion of the first internal passage.

6. The system of claim 5, further comprising a valve disposed in an opening of the tubular support and actuatable by fluid pressure in the lower portion of the tubular support between an open configuration, wherein fluid passes through the opening, and a closed configuration, wherein fluid is prevented from passing through the opening.

7. The system of claim 1, wherein the first annulus is fluidicly isolated from the second annulus.

8. The system of claim 7, wherein the first annulus is defined by the tubular support and an outer sleeve coupled thereto.

9. A method comprising:

disposing a tubular support having a first internal passage within an expandable tubular;

positioning an expansion cone in an annulus between the expandable tubular and the tubular support;

disposing a sliding sleeve in the first internal passage, the sliding sleeve dividing the first internal passage into an upper portion above the sliding sleeve and a lower portion below the sliding sleeve and having a second internal passage fluidicly coupled to the upper portion;

fluidicly isolating the annulus from the upper portion;

fluidicly coupling the lower portion and the second internal passage;

injecting fluidic materials from the upper portion through the second internal passage into the lower portion;

opening a valve disposed in an opening of the tubular support proximate the lower portion, whereby the fluid material passes through the opening from the tubular support;

moving the sliding sleeve by fluid pressure acting thereon, thereby fluidicly isolating the lower portion from the second internal passage and fluidicly coupling the upper portion with the annulus;

diverting fluidic materials from the upper into the annulus; and moving the expansion cone relative to the tubular support by fluid pressure applied thereto, thereby radially expanding the expandable tubular.

10. The method of claim 9, wherein said fluidicly coupling of the lower portion and the second internal passage comprises:

aligning one or more first flow ports in the tubular support and one or more second flow ports in the sliding sleeve; and extending one or more shear pins from the tubular support through the sliding sleeve, whereby the position of the sliding sleeve relative to the tubular support is maintained and the first and second flow ports are aligned.

11. The method of claim 10, wherein said fluidicly isolating the lower portion from the second internal passage comprises:

injecting fluidic materials from the upper portion of the first internal passage to the second internal passage;

delivering a plug element into the second internal passage with the injected fluidic materials;

increasing a pressure of the injected fluidic materials acting on the plug element and the sliding sleeve;

shearing the shear pins in response to the increasing fluid pressure;

moving the sliding sleeve relative to the tubular support; and misaligning the first and second flow ports.

12. The method of claim 11, further comprising:

guiding the sliding sleeve as the sliding sleeve moves relative to the tubular support.

13. The method of claim 11, further comprising:

preventing rotation of the sliding sleeve as the sliding sleeve moves relative to the tubular support.

14. The method of claim 9, wherein said fluidicly isolating the annulus from the upper portion comprises:

disposing a rupture disc in a flow passage extending through the tubular support between the upper portion and the annulus.

15. The method of claim 14, wherein said fluidicly coupling the annulus and the upper portion comprises:

increasing fluid pressure in the upper portion; and rupturing the rupture disc, whereby fluid communication between the annulus and the upper portion is established.

16. A system comprising:

a tubular support having a first internal passage;

a sliding sleeve disposed in the first internal passage and dividing the first internal passage into an upper portion above the sliding sleeve and a lower portion below the sliding sleeve, the sliding sleeve having a second internal passage fluidicly coupled to the upper portion and being moveable under fluid pressure between a first position, wherein the second internal passage is fluidicly coupled to the lower portion, and a second position, wherein the second internal passage is fluidicly isolated from the lower portion;

one or more shear pins extending from the tubular support into the sliding sleeve, the shear pins configured to maintain the sliding sleeve in the first position and being shearable to enable movement of the sliding sleeve from the first position toward the second position; and an expansion cone disposed in an annulus external to the tubular support, the expansion cone moveable by fluid pressure acting thereon relative to the tubular support when the annulus is fluidicly coupled to the upper portion of the first internal passage.

17. The system of claim 16, wherein the sliding sleeve is adapted to receive a plug element therein.

18. The system of claim 16, wherein the tubular support further comprises one or more first flow ports and the sliding sleeve comprises one or more second flow ports; and wherein the first and second flow ports are aligned when the sliding sleeve is in the first position, whereby the second internal passage and the lower portion are fluidicly coupled, and are misaligned when the sliding sleeve is in the second position.

19. The system of claim 16, further comprising a valve disposed in an opening of the tubular support and actuatable by fluid pressure in the lower portion of the tubular support between an open configuration, wherein fluid passes through the opening, and a closed configuration, wherein fluid is prevented from passing through the opening.

20. The system of claim 16, further comprising one or more protrusions extending radially from the tubular support into one or more channels formed in the outer surface of the sliding sleeve, the protrusions limiting movement of the sliding sleeve relative to the tubular support.

21. The system of claim 16, wherein the tubular support comprises a flow passage extending between the annulus and the upper portion of the first internal passage and a rupture disc seated in the flow passage, the rupture disc fluidicly isolating the first internal passage from the annulus and adapted to rupture, whereby the first internal passage and the annulus are fluidicly coupled.

* * * * *